United States Patent [19]

Eckert et al.

[11] Patent Number: 4,535,407

[45] Date of Patent: Aug. 13, 1985

[54] POSTAGE METER WITH KEYBOARD KEYS FOR CHANGING POSTAGE UNUSED AMOUNT

[75] Inventors: Alton B. Eckert, Norwalk; John H. Soderberg, Stratford; Edward C. Duwel, Trumbull, all of Conn.

[73] Assignee: Pitney Bowes Inc., Stamford, Conn.

[21] Appl. No.: 447,870

[22] Filed: Dec. 8, 1982

[51] Int. Cl.[3] ..... G06F 15/20

[52] U.S. Cl. ..... 364/464; 364/466

[58] Field of Search ..... 364/464, 466

[56] References Cited

U.S. PATENT DOCUMENTS

| | | | |
|---|---|---|---|
| 4,280,180 | 7/1981 | Eckert et al. | 364/464 |
| 4,291,375 | 9/1981 | Wolf | 364/464 X |
| 4,301,507 | 11/1981 | Soderberg et al. | 364/464 |
| 4,326,254 | 4/1982 | Uchimura et al. | 364/464 X |

*Primary Examiner*—Edward J. Wise

*Attorney, Agent, or Firm*—Donald P. Walker; William D. Soltow, Jr.; Albert W. Scribner

[57] ABSTRACT

In a postage meter having structure for printing postage, for displaying numerical values and for entering data, and which includes a computer electrically connected to the printing, displaying and data entering structure, and wherein the computer is programmed for processing data for controlling the operation of the respective printing and displaying and data entering structures, and wherein the data entering structure includes a keyboard having a first plurality of depressable keys, and wherein the computer includes memory for storing a first amount corresponding to all postage then available for printing; there is provided apparatus and a method for changing the first amount to a new first amount. The method includes the steps of sequentially depressing a second plurality of keys of the keyboard, for entering a second amount into said computer, sequentially depressing a third plurality of keys of the keyboard, for entering a combination into the computer, and automatically processing the second amount and combination for adding the second amount to the first amount. Preferably, the step for entering the second amount includes the step of displaying a numerical value corresponding to said second amount, and the step for entering said combination includes the step of displaying a numerical value corresponding to said combination.

21 Claims, 11 Drawing Figures

90
OPTO
SERIAL I/O CHANNEL
92
SYSTEM CLOCK
72
POWER ON RESET
88
LOW VOLTAGE SENSE
NVM READY
CPU WAIT
TP
CPU
10a
ADDRESS BUS
94
DATA BUS
108
CONTROL BUS
96
DEVICE SELECT
98
16a
RAM I/O TIMER
TP
SELECT LINES
99
NVM V5 SW
V4
V5
82
76
V5 SWITCH
AC LINE
HOT SW MDV
50
58
FUSE
56
TRANSFORMER
70
REG.
74
REG.
54
OPTO TRIAC
60
COLD SWITCH
62
SWITCHER
66
V2 FILTER
AC DRIVE MOTOR
36a
48
V2 DISPLAY
V2 LOGIC
52
RFI FILTER
59
PREREGULATOR
V5

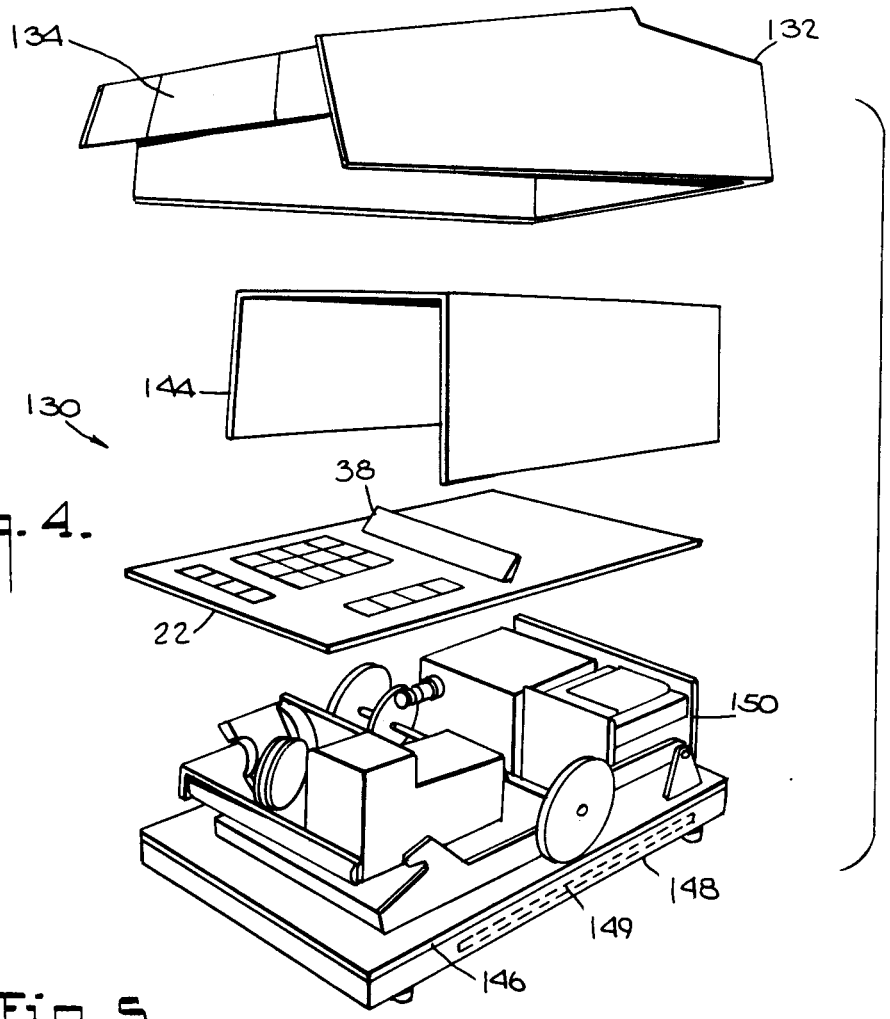
Fig. 4.
Fig. 5.
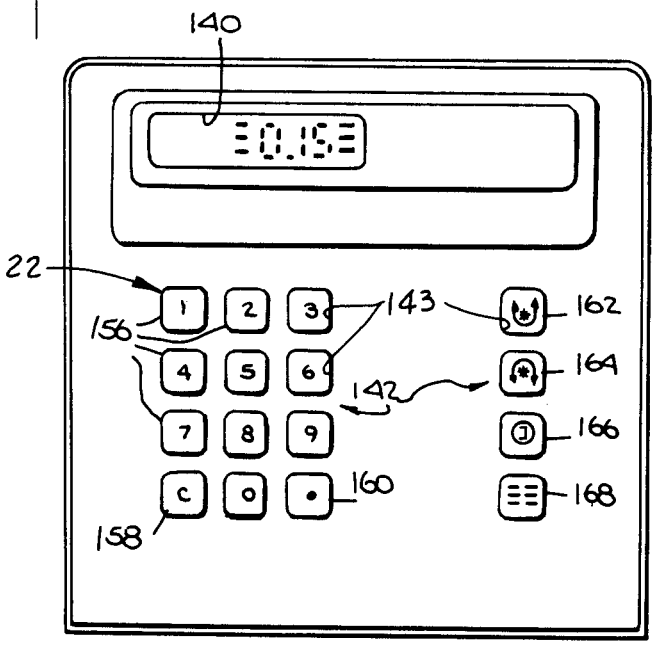

POSTAGE METER WITH KEYBOARD KEYS FOR CHANGING POSTAGE UNUSED AMOUNT

BACKGROUND OF INVENTION

This application is related to U.S. application Ser. No. 447,815 of D. P. Baun et al., for "Stand-Alone Electronic Mailing Machine", and to U.S. application Ser. No. 447,913 of A. B. Eckert, Jr. et. al., for "Initializing The Print Wheels In An Electronic Postage Meter"; both of which applications were filed concurrently herewith, are assigned to the assignee of the present invention and are hereby specifically incorporated hereinby reference. In addition, this application is related to five additional concurrently filed co-pending patent applications, each of which is assigned to the assignee of the present invention, i.e., U.S. Patent Application Nos.: 447,861, for POSTAGE METER WITH KEYBOARD KEYS FOR CAUSING METER OPERATIONS TO BE PERFORMED; 447,901, for POSTAGE METER WITH KEYBOARD KEYS FOR COMMANDING AND REQUESTING PERFORMANCE OF METER OPERATIONS; 447,905, for POSTAGE METER WITH KEYBOARD KEYS USED FOR CHANGING OPERATING CONSTANTS; 447,914, for POSTAGE METER WITH DATE CHECK REMINDER MEANS; and 447,919, for POSTAGE METER WITH KEYBOARD KEYS FOR CAUSING DISPLAY OF DATA PERTAINING TO METER OPERATIONS.

Currently available electronic postal meters of, for example, the type disclosed in U.S. Pat. No. 4,301,507 for an Electronic Postage Meter Having Plural Computing Systems, issued Nov. 17, 1981 to J. H. Soderberg et al., and assigned to the assignee of the present invention, are generally provided with a keyboard for entering numerical postal values that are to be printed, a display for visually indicating the entered postage and other values, a printing mechanism and a micro-computer including accounting means and means for controlling the various functions of the postal meter.

In the aforesaid U.S. Pat. No. 4,301,507 the various components of the postal meter are compartmented according to their functions to form three units, referred to as the control, accounting and printing units. Each of the units incorporates a dedicated microprocessor having a separately controlled clock and programs. And, two-way communications are conducted via serial channels between the units, and via serial channels between the postage meter and any external apparatus connected to the meter, in the form of serially transmitted single byte "header" only messages, consisting of ten bits including a start bit followed by an 8 bit byte which is in turn followed by a stop bit, or in the form of a multi-byte message consisting of a header and one or more additional bytes of information. All transmitted messages are followed by a no error pulse if the echoplex message was received error free. In practice, each of the units is capable of processing data independently and asynchronously of the other. Further, to allow for compatibility between the postal meter and any external apparatus, all operational data transmitted to, from and between each of the three units and all stored operator information is accessible via the postal meter interface, as a result of which the external apparatus (if any) may be adapted to have complete control of the postal meter as well as access to all current operational information in the postal meter. In addition, the flow of messages to, from and between the three internal units is in a predetermined, hierarchical direction. For example, any command message from the control unit is communicated to the accounting unit, where it is processed either for local action in the accounting unit and/or for a command message in the printing unit. On the other hand, any message from the printing unit is communicated to the accounting unit, where it is either used for internal information or merged with additional data and communicated to the control unit. And, any message from the accounting unit is initially directed to the printing unit or to the control unit.

Some commercially available postal meters which utilize the aforesaid communication system have been provided with a mechanically operable field service switch which is operable to indicate to the meter that a service mode of operation of the meter is in effect in which various messages are given an alternate interpretation, for example, commanding or requesting the postal meter to display selected values stored in the postal meter. In this connection reference is made to U.S. Pat. No. 4,280,180 for an Electronic Postage Meter Having Field Resettable Control Values, issued to A. B. Eckert et al. and assigned to the assignee of the present invention. In U.S. Pat. No. 4,280,180, a second, key controlled, three-position, mechanical switch, is also provided, to permit an authorized user to initiate a series of routines allowing the user to recharge the postal meter with a predetermined amount of additional postage.

To that end, the positions of the three position switch are identified as the "operate", "enter amount" and "enter combination" positions. By positioning the three-position switch in either the "enter combination" or "enter amount" positions the operator may enter the combination or amount respectively into the meter via the keyboard. In each instance the entry results in providing an indication on the display, of the entered amount or combination, as the case may be. Leaving each position generates a message causing the displayed value to be entered into the accounting unit and blanking the display for the next entry. Return of the three-position switch to the operate position in either instance causes the accounting unit to complete the recharging routine and return the meter to normal usage with the amount added to the postage unused register. In practise, the combination for this feature is obtained by calling a Data Center having information relevant to remotely enabling the resetting of the postal meter/mailing machine for which the value is being modified, such as the Data Center of Pitney Bowes Inc. To obtain the combination the operator identifies the meter by serial number, and provides the Data Center with the code which is generated and displayed to the operator upon initially moving the key from the operate position, and also provides the value of the postage which the operator is desirous of adding to the postage unused register. Whereupon the Data Center provides the operator with a unique combination for use with the enter combination key, which combination is a random or pseudorandom number which changes with each resetting of the postage used register for security reasons.

Aside from the aforesaid usage, the three position switch is disclosed in U.S. Pat. No. 4,280,180 as being operable in combination with the service switch for changing certain other values stored in the meter, including a settable limit value, consisting of a predetermined maximum postage value which will not be printed if equaled or exceeded, a low postage warning value, consisting of a predetermined value which causes the postal meter to provide a visual indicator informing the user that the postal meter should be recharged, and a dollar unlock value, consisting of a predetermined postal value which will not be printed at any one time unless something is additionally done by the operator after the select postage key is initially actuated.

An object of the present invention is to provide a simply constructed, non-compartmentalized postal meter/mailing machine which includes a modified version of the aforesaid prior art communication system;

Another object is to provide a simply constructed non-compartmentalized, stand-alone, mailing machine which includes an electronically controlled postal meter incorporating a modified version of the aforesaid prior art communication system, and which includes improved means for servicing the mailing machine;

Another object is to provide an electrically controlled postal meter/mailing machine, having a keyboard, with means for entering and modifying various values in the same, including the serial number of the meter/machine via the keyboard; and A further object is to provide an electronically controlled postal meter/mailing machine including a communication system having a single micro-computer which is programmed so as to retain the hierarchical communication and serial message transmission features of the aforesaid prior art communication system for implementing the control, accounting and printing functions of the postal meter/mailing machine, and which includes improved means for informing the user that the date should be checked, invoking various routines for displaying information stored in the postal meter and changing selected values stored in the postal meter.

SUMMARY OF THE INVENTION

In a postage meter having means for printing postage, means for displaying numerical values, means for entering data, computer means electrically connected to each of the aforesaid means and programmed for processing data for controlling the operation thereof, wherein said computer means includes means for storing a first amount corresponding to all postage then available for printing, there is provided an improvement for changing the said first amount to a new first amount. The improvement comprises: the data entering means including a keyboard, said keyboard including a plurality of depressable numeric keys and at least two depressable special purpose keys; the computer means programmed for causing the displaying means to display a first numerical value in response to the depression of selected numeric keys, said first numerical value corresponding to a second amount desired to be added to said first amount; the computer means programmed for causing said display means to display a second numerical value in response to the depression of selected numeric keys, said second numerical value corresponding to a predetermined combination; the computer means programmed for entering said second amount in response to the depression of one of said special purpose keys and for entering said combination in response to the depression of another of said special purpose keys; and the computer means programmed for automatically processing said second amount and said combination in response to entry of the later one of said second amount and said combination for adding said second amount to said first amount, whereby said first amount is changed to said new first amount.

BRIEF DESCRIPTION OF THE DRAWINGS

As shown in the drawings wherein like reference numerals designate like or corresponding parts throughout the several views;

FIG. 2, is a detailed block diagram of the electronic circuits of the electronic postage meter;

FIG. 4 is an exploded view of the mailing machine of FIG. 3;

FIG. 5 is a plan view of the keyboard and display of the postal meter/mailing machine of FIG. 3;

FIG. 6, is a flow chart of the date check logic routine according to the invention;

FIG. 8, is a flow chart of the amount and combination, end of entry, logic routine according to the invention.

DESCRIPTION OF THE PREFERRED EMBODIMENTS

Figure 1:
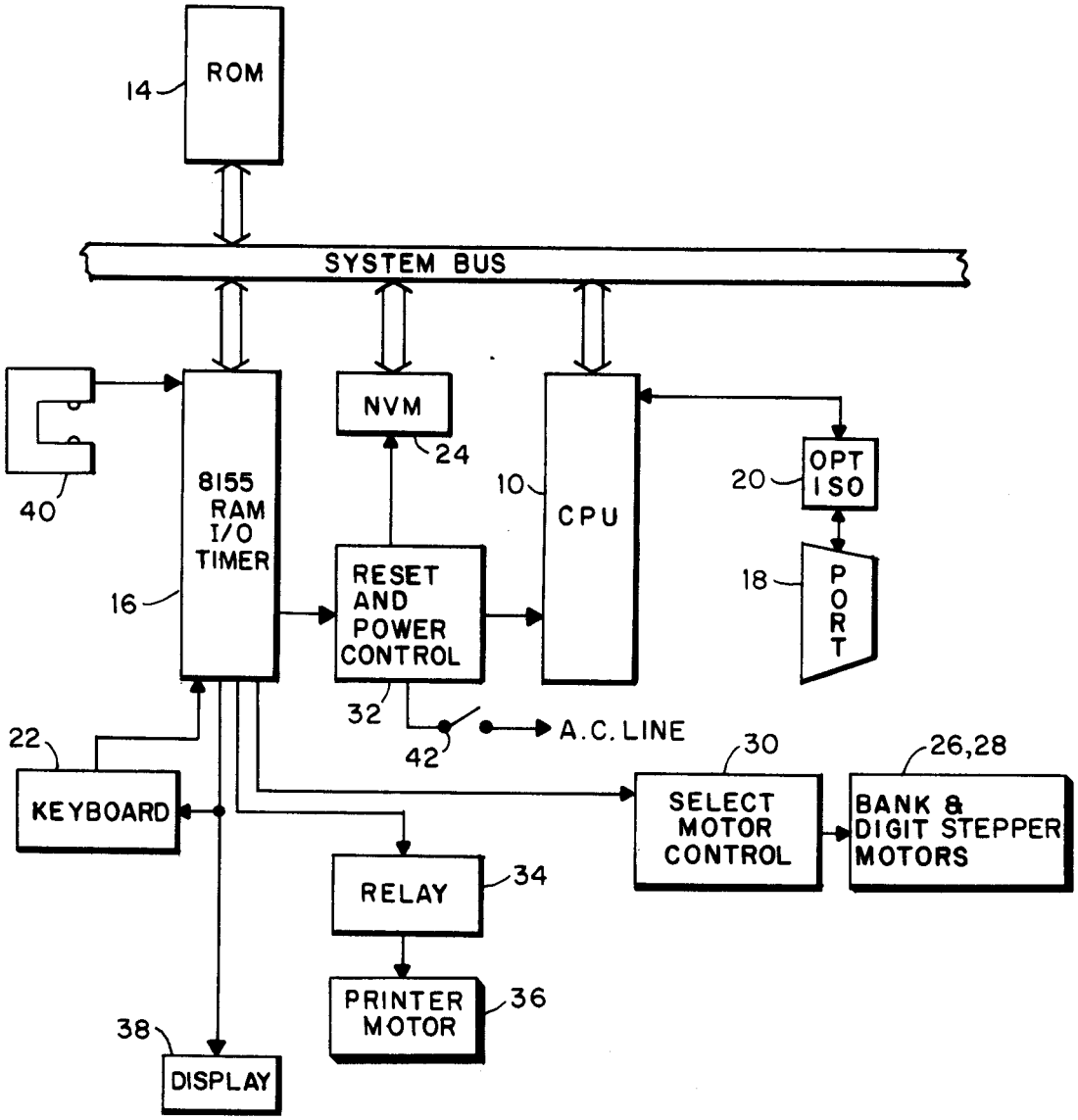
FIG. 1 is a block diagram of the electronic circuits of an electronic postage meter.

The electronic postal meter 130 (FIG. 3) includes an 8-bit microprocessor 10 (FIG. 1) (CPU), such as an Intel Model 8085A microprocessor which is connected to various electronically operable components through a system bus 12, including a ROM 14. The ROM 14, which is provided for storing the programs for controlling the postal meter, includes permanently programmed as well as reprogrammable devices. An integrated circuit 16, such as an Intel Model 8155, is connected to the system bus 12 and includes a RAM, input and output (I/O) lines and a timer. The RAM portion of the integrated circuit 16 has memory allocated for transient storage of the data for the ascending register and descending register. An external data communication port 18 which is connected to the microprocessor 10 through an optical isolator 20, allows for the connection to the postal meter of devices such as an electronic scale, external computer various types of servicing equipment and the like. Also electrically connected to the microprocessor 10 through the system bus 12 is the keyboard 22 of the postal meter and a non-volatile memory (NVM) 24. The bank and digit stepper motors 26, 28 of the postal meter are in electrical connection with the microprocessor 10 via a motor driver 30 and the integrated circuit 16. A reset and power control 32 is electrically connected between the integrated circuit 16, the NVM 24 and the microprocessor 10. A relay 34 connects the AC printer motor 36 to the integrated circuit 16. A display 38 is also electrically connected to the integrated circuit 16. Preferably the display 38 includes a plurality of, and preferably ten or less, seven segment (with decimal) digit display sections. And, for the purpose of this disclosure each decimal shall be considered to be a segment. And, a trip photosensor 40, which is connected to the microprocessor 10 through the integrated circuit 16, is provided for indicating the presence of an envelope to be imprinted, as described more fully in the aforementioned patent application entitled "Stand-Alone Electronic Mailing Machine".

The electronic postage meter is controlled by the microprocessor 10 operating under control of the programs stored in the ROM 14. The microprocessor 10 accepts information entered via the keyboard 22 or via the external communication port 18 from external message generators. Critical accounting data and other important information is stored in the non-volatile memory 24. The non-volatile memory 24, which may be an MNOS semiconductor type memory, a battery augmented CMOS memory, core memory, or other suitable non-volatile memory component, stores critical postal meter data during periods when power is not applied to the postal meter. This data includes, in addition to the serial number of the mailing machine or postal meter, information as to the value in the descending register (the amount of postage available for printing), the value in the ascending register (the total amount of postage printed by the meter), and the value in the piece count register (the total number of cycles the meter has performed), as well as other types of data, such as trip status, initialization and service information, which are desired to be retained in the memory even though no power is applied to the postal meter.

When an on/off power switch 42 is turned on (closed) a power supply internal to the mailing machine energizes the microprocessor 10 and the balance of the electronic components. Whereupon information stored in the non-volatile memory 24 is copied into the RAM by the microprocessor 10. Accordingly, after power up the RAM contains an image or copy of the information which was stored only in the non-volatile memory 24 prior to energization. During operation of the postal meter, certain portions of the data in the RAM are ordinarily modified. For example, whenever postage is printed, the value stored in descending register will be reduced by the value of the printed postage, the value in the ascending register will be increased by the value of the printed postage and the value stored in the piece counter register will be incremented. When the power switch 42 is turned off (opened), the updated data reflecting such changed values in the RAM is transferred via the microprocessor 10 back into a suitably prepared area of the non-volatile memory 24. A like transfer of information between the non-volatile memory 24 and the RAM takes place during power failure.

Figure 2A:
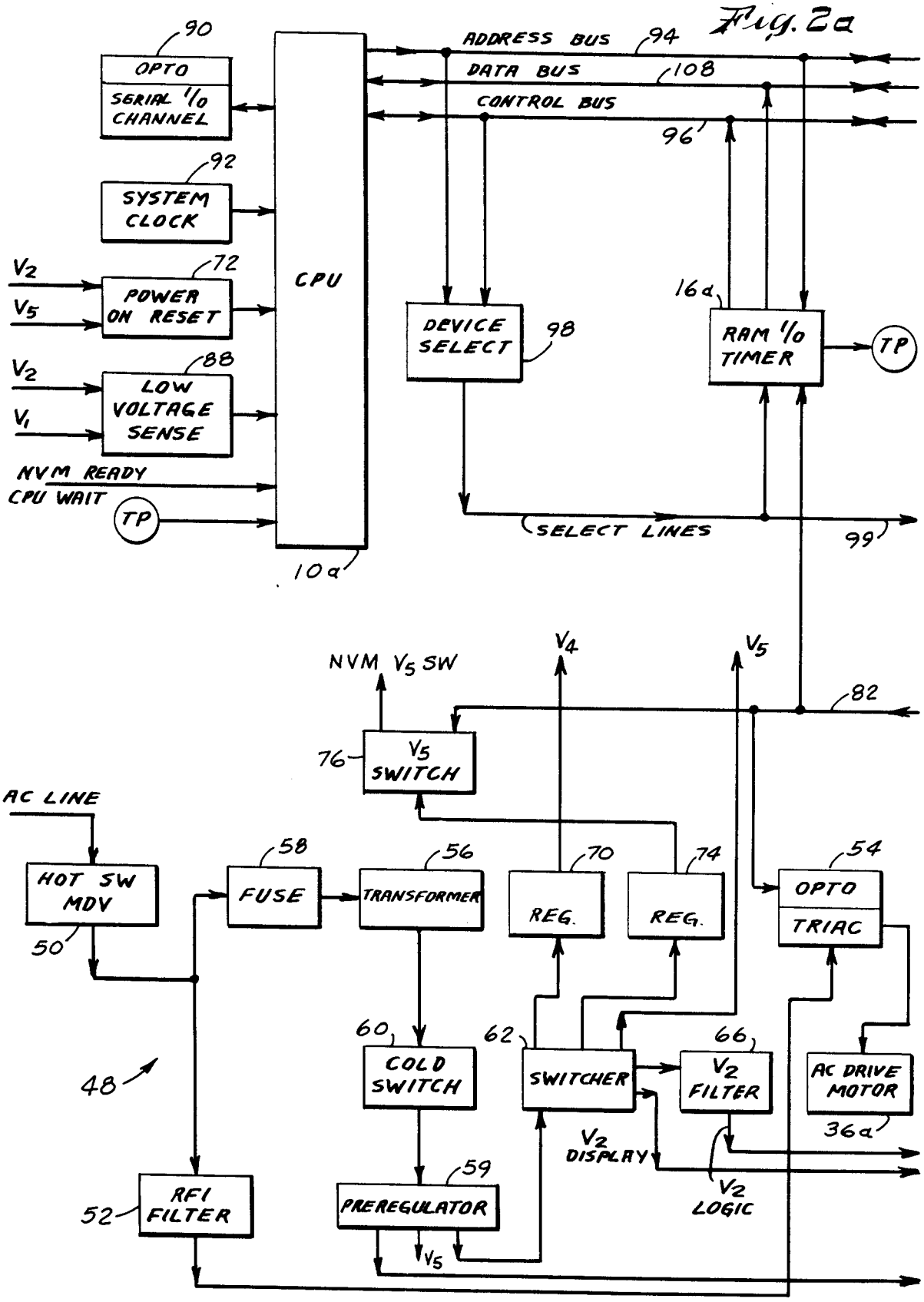
FIG. 2, consisting of the views shown in FIGS. 2*a* and 2*b* which each show eight lead lines for interconnecting the views to each other to form
Figure 2B:
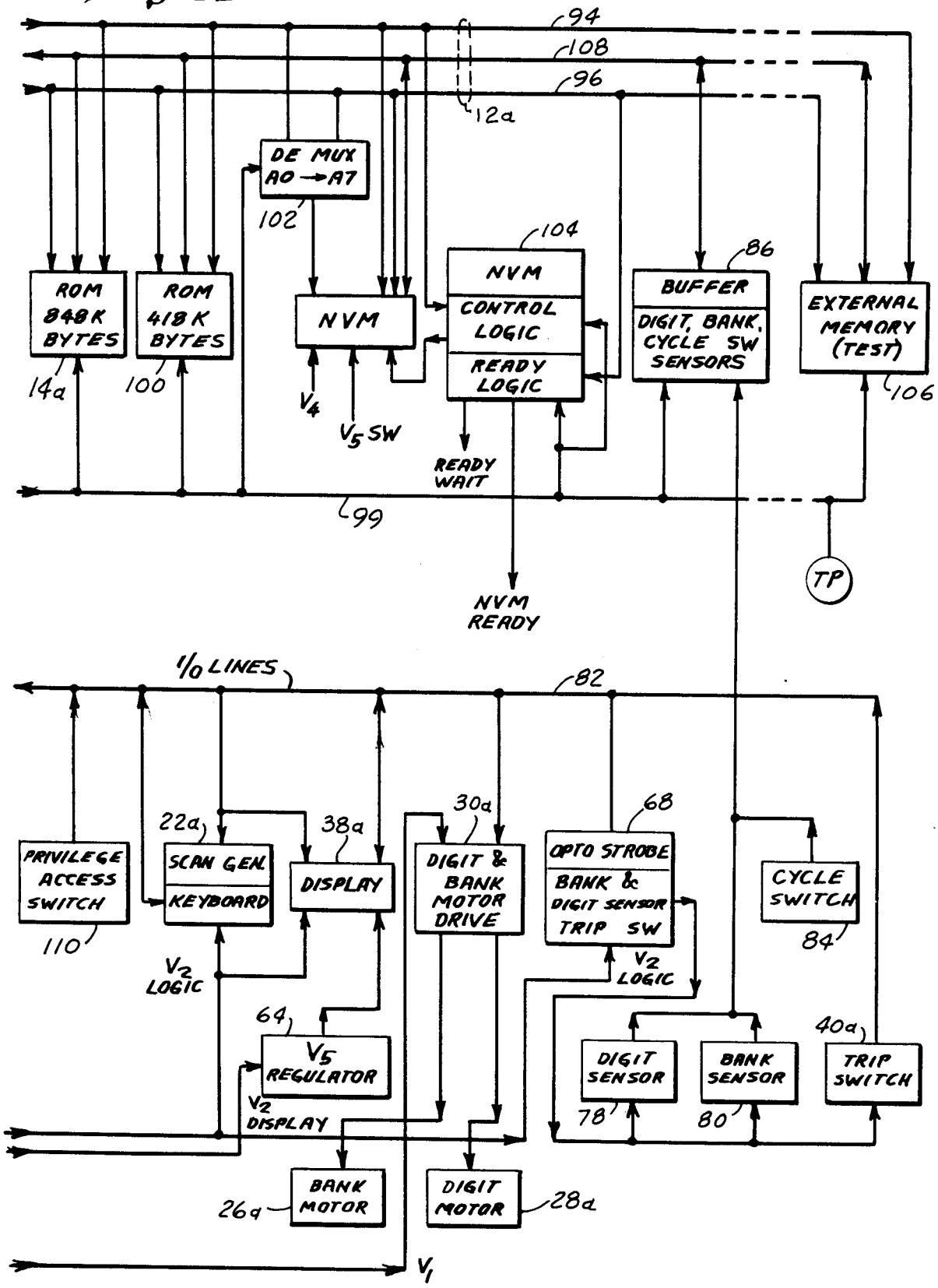

Referring to FIG. 2, a more detailed block diagram of the arrangement of the electrical components of the postage meter is illustrated generally as 48. Power is supplied to the postage meter from the AC line voltage, typically 115 volts. This line voltage is applied to the meter through a hot switch 50 which cuts off power to the postage meter to protect the electrical components thereof if the temperature rises above a preset limit, nominally 70° C. The hot switch 50 is connected to the AC drive motor 36A through an RF filter 52 and an opto-triac 54 which provides isolation between the line voltage and the control logic for the meter. The hot switch 50 is also suitably connected to a transformer 56 protected by a fuse 58. The output of the transformer 56 is coupled to a pre-regulator 59 through a cold switch 60. The cold switch 60 cuts off power to the pre-regulator 59 if the temperature drops below a preset limit, nominally 0° C. The pre-regulator 59 provides an output voltage of a predetermined range to a switcher 62 which generates the output voltage +5 V; and the voltages for generating −12 V and −30 V.

The +5 V is applied to a +3 volt regulator 64 and then to the display 38A. The +5 V from the switch 62 is also applied to a +5 V filter 66 which provides a +5 V for logic circuits. Specifically, the +5 V is applied to the keyboard 22A, the display board 38A, and bank, digit and trip sensor logic 68 and to the integrated circuits. The −12 V is applied to a −12 V regulator 70 and then to the non-volatile memory 24A.

The −30 V output from the switcher 62 is also applied to a −30 V regulator 74 and then to a −30 V switch 76 which switches its output voltage on and off in response to the requirements of writing in NVM as dictated by a program. The output of the −30 V switch is applied to the non-volatile memory 24A. The −30 V supply is connected to the power on reset 72 of the microprocessor 10A.

+5 V from the switcher 62 is also supplied to one input of the power on reset 72; the other input receives −30 V from the regulator 74 as previously described. A low voltage sensor 88 also receives one input of +5 V from the switcher 62 and its other input from the pre-regulator 59 the output of the voltage sensor 88 is applied to the microprocessor 10A. The low voltage sensor 88 detects power failure and communicates this to the microprocessor 10A which in turn addresses the RAM through system bus 12A to transfer all security data present in the RAM to the non-volatile memory 24A.

Another output from the pre-regulator 59 in the from of +24 V is applied to the digit and bank motor drive 30A for the bank motor 26A and digit motor 28A, which respectively select the particular printing wheel (bank) which is to be activated and the particular digit of the selected printing wheel which is to be set.

An output strobe from the integrated circuit 16A is buffered through buffer driver 68 and applied to a digit sensor (encoder) 78, bank sensor (encoder) 80, and trip sensor 40A. The opto strobe applies power to the digit sensor 78, bank sensor 80 and trip sensor 40A when needed. The output from the trip sensor 40A is applied to the input/output lines 82 which are coupled to the integrated circuit 16A. The outputs from the digit sensor 78 and bank sensor 80 and cycle switch 84 are applied to a storage buffer 86.

During power up, the key switch 42 (FIG. 1) is closed, and the AC line voltage energizes the electrical components previously described and an Initialization process will occur. Such initialization may include a hard and/or soft initialization process as disclosed in the aforementioned U.S. Pat. No. 4,301,507. Preferably the initialization process for the mechanical components of the meter/machine is as disclosed in the aforementioned patent application entitled "Initializing The Print Wheels In An Electronic Postage Meter".

In operation, the microprocessor 10A under control of the ROM 14A and possibly the auxiliary ROM 100 communicates over the address bus 94 and control bus 96 with the device select 98. The output of the device select 98 communicates with the particular component to be addressed over select lines 99, including the RAM, the ROM 14A, an auxiliary ROM 100, a demultiplexer 102, NVM logic 104 and the buffer 86. The RAM of integrated circuit 16A provides the working memory for the postage meter and the microprocessor 10A. The ROM 14A stores the program; the auxiliary ROM 100 may be used to provide additional program storage space. The non-volatile memory 24A provides storage of all security information for the meter and retains such information during power down or power failure. The demultiplexer 102 latches the lower eight (8) bits of address information that defines a particular location which is used immediately thereafter. The NVM logic 104 controls the mode of operation of the NVM 24A and also provides ready, wait and NVM ready signals to the microprocessor 10A to indicate the presence of the slow speed device (NVM) as active on the bus 12A.

As previously mentioned, the digital sensor 78 (optical encoder) and bank sensor 80 (optical encoder) and cycle switch 84 whose current state is read, i.e., "Home" or "In Cycle", apply input signals to the buffer 86 which sends output signals over data bus 108 to the microprocessor 10A for storage in the proper RAM location.

The RAM is also electrically coupled to the I/O lines to transmit receive data from the trip sensor 40A, the display 38A, keyboard 22A, and, if present, a privileged access switch 110 which is kept under seal. The switch 110 is provided for use in applications which require manual resetting of meter postage by authorized personnel of, for example, the Postal Service.

Figure 3:
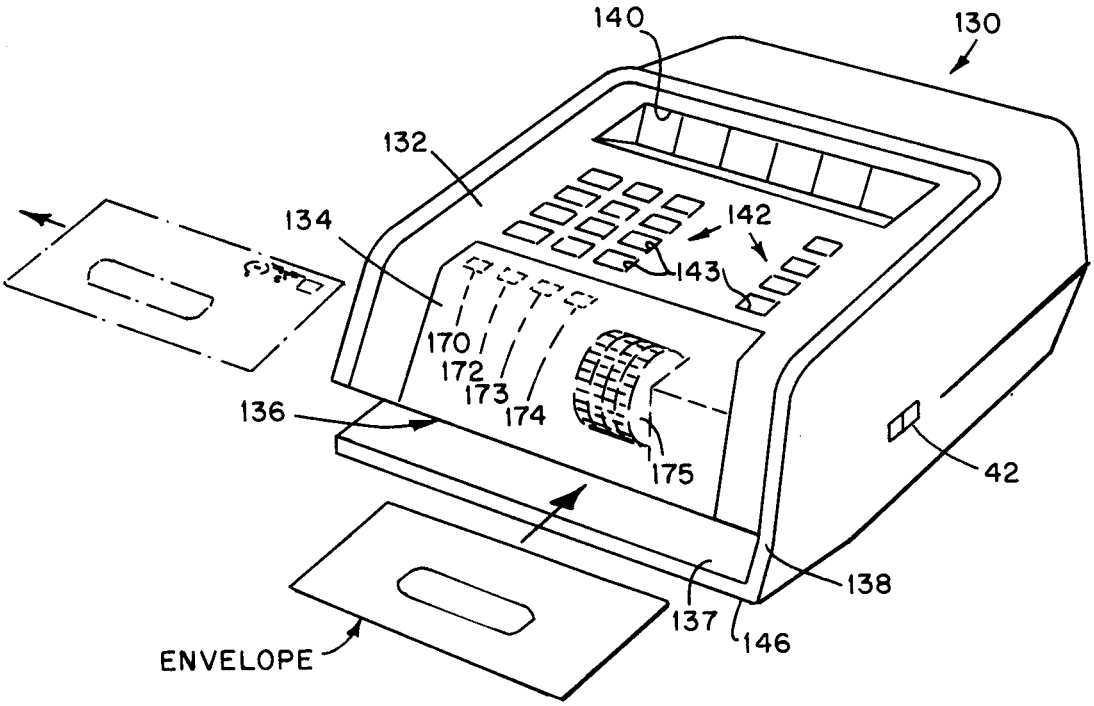
FIG. 3 is a front perspective view of a mailing machine, including a postal meter, which incorporates the features of the present invention.

As shown in FIG. 3, a mailing machine 130 adapted to house the aforesaid electronic postal meter includes a cover 132 having a hinged lid 134, and a slot 136 therein with a closed end 138 at the right hand side thereof. A portion of the slot 136 forms a deck 137 on which an envelope is placed when inserted into the slot 136 for printing postage thereon. At the top of the cover 132 is an opening 140, and a control panel 142 having a plurality of openings 143 formed therein. The cover 132 (FIG. 4) has nested therein an electromagnetic insulating shield 144. The cover 132 and shield 144 are attached to a base 146; the cover 132 and base 146 together forming a housing. Depending from the base 146 is a pan 148 that contains a logic board 149. A power supply board 150 is mounted on the base 146. The display 38 and the keyboard 22 are conventionally supported within the housing, with the display 38 aligned with the opening 140 in the cover 132. The keyboard 22 (FIG. 5), which serves as an information inputting and information retrieval device, has a plurality of keys which extend through the openings 143 of the control panel 142 for access by the operator. Such keys include the numeric setting keys 156 numbered 0–9, a clear key 158, a decimal key 160, a postage used key 162, a postage unused key 164, a piece count key 166 and a select postage key 168. In addition, towards the front of the mailing machine 130 (FIG. 3), located under the lid 134, are a plurality of special purpose keys of the keyboard 22. Such keys including an access code key 170, an enter amount key 172, an enter combination key 173 and a date key 174. Also located under the lid 134 are a plurality of thumbwheels 175 which are mechanically connected to the date printing mechanism for adjustment thereof as described more fully in the aforementioned application entitled "Stand-Alone Electronic Mailing Machine". Preferably the keys of the keyboard 22 are membrane switches.

In general, the electronic communication system of the postal meter is in many respects the same as the system disclosed in the aforesaid U.S. Pat. No. 4,301,507. In this connection it is noted that the software architecture of the communication system disclosed in U.S. Pat. No. 4,301,507 services three separately compartmented units of electronic structure, referred to as the control unit, accounting unit and printing unit. Each of such units includes a dedicated central processing unit connected by way of conventional data lines, control lines and address lines to, in the case of the control unit, a multipurpose conventional RAM/ROM/I/O timer circuit incorporating timing control elements and input/output interface hardware, in the case of the accounting unit, a conventional EAROM and a plurality of PROMs incorporating timing control elements and input/output interface hardware, and, in the case of the printing unit, conventional buffers, timing control elements and input/output interface hardware. And, communications between the three units are conducted via serial channels connected between the respective microprocessors of the control, accounting and printing units.

In the postal meter/mailing machine disclosed herein the functionally comparable units of electronic structure, although not compartmented from each other are treated and function as separate and independent structures. And, although a single microprocessor 10 is used, the ROM 14 is organized for storing three substantially independently functioning sets of routines, one for each of the control, accounting and printing functions. Further, although the serial channel communication lines between the compartmented units of the prior art have been eliminated, the RAM of the integrated circuit 16 includes dedicated control, accounting and printing registers for communication between the three functional modules, and includes dedicated buffers for communications with external devices. Accordingly, information is communicated in message form between the three functional modules and between the mailing machine 130 and any external device connected to the external ports 18. Aside from the foregoing, since the three crystal controlled clocks used in the compartmented units of the prior art communication system have been replaced in the present communication system with a single crystal controlled clock, the three functional modules of the present communications system are no longer internally asynchronously operable. Rather the control, accounting and printing routines are independently selected under the control of a single idle loop program stored in the ROM 14. On the other hand, as in the prior art communication system processing precedence is given to messages and requests received from external devices, over those that are internally generated for processing. Thus, as in the prior art, the external device may, as a general rule, take control of the operation of the postal meter/mailing machine. In addition, as a general rule, once the processing of a message has been commenced, such processing will proceed to completion. For example, when printing cycle has been commenced, by tripping the postal meter/mailing machine, nothing is permitted to interrupt the completion of the postage printing cycle and processing the postage value associated therewith under the control of the selected accounting routines.

In addition to the above referred to circuits of the control structure, the control structure includes the circuits of the integrated circuit 16. The control routines utilize two buffers in the RAM, one in which messages corresponding to the digits of the display are built and stored, and the other in which a bit for bit copy or image of displayed digits is stored. As information is entered into the keyboard 22 by depressing one or more keys, a copy of such information in numerical message format is built in the display buffer and transferred in bit format to the image buffer for driving the display. When the postal meter responds to any message from the keyboard 22, the response is communicated to the external device from the transmit buffer. And, with the exception of status responses any message stored in the transmit buffer is copied from the transmit buffer into the display buffer. On the other hand, when the postal meter responds to messages from the external device the responses are only communicated to the external device. Such messages are not displayed, with the exception of postal value messages which are copied into the display buffer as well as being communicated to the external device. Thus the display is mainly used for displaying responses to entries from the keyboard 22. And the keyboard 22 is utilized for inputting information to the microprocessor 10, which interprets each switch closure and in response thereto drives the display 38.

As is hereinafter more fully discussed, for reminding the user to adjust the date by manipulating the thumbwheels 175, the control structure is responsive to the application of power via the power supply board 150 to the mailing machine 130, for selectively energizing the LED display to visually display a predetermined code, which is preferably a single segment in the middle, or minus sign position, in the extreme left digit position of the LED display, and to concurrently intermittently flash the entire display until the lid 134 is opened and the date key 174 depressed.

Further, the control structure is selectively responsive to utilization of the appropriate numerical keys 156 in combination with the access code key 170 for generating command and request messages for which separate keys have not been provided, for example a command to enter or exit the service mode.

In addition, in the service mode of operation the control structure is selectively responsive to utilization of the remote resetting keys, including the enter amount key 172 and enter combination key 173, for generating data entry messages which invoke various accounting routines for modifying values stored in the RAM to conform to customer requests, for example, for modifying the settable limit value, low postage warning value and dollar unlock value. In addition, in the service mode of operation provision is made for modifying the serial number of the postal meter if it is stored in the postal meter in modifiable form.

Further, in the non-service mode of operation the control structure is selectively responsive to utilization of the access code key 170, enter amount key 172 and enter combination key 174 for generating data entry messages which invoke various accounting routines for, in the case of the access code key 170, displaying an access code which is used by the operator for calling into a Data Center to obtain a combination code, and in the case of the enter amount and enter combination keys, 172 and 174, for modifying (normally increasing) the postage unused value stored in the RAM to permit the postal meter to print additional postage.

In addition to the above referred to circuits thereof, the accounting structure includes the non-volatile memory 24 for storing critical data, including the serial number, current values in the ascending and descending and piece count registers. The accounting structures also includes volatile memories, including a plurality of registers in the RAM which function as working ascending, descending and piece count registers for storing total amounts that are appropriately adjusted whenever postage is printed or the remote resetting function keys are utilized. The working volatile memories store such critical operational data for current use and transfer the same to the non-volatile memory 24 at such time as a reduction in power is sensed or the main power switch 42 is moved to its off position.

In addition to the above referred to circuits thereof, the printing structure includes the circuits of the optical sensors, 78 and 80, which are respectively associated with the digit and bank selector stepper motors 28 and 26, respectively, for sensing the relative positioning of the print wheels of the postal meter. And the printing structure also includes the circuits of the photosensor 40 associated with the trip lever for sensing the movement of the lever in response to appropriate insertion of an envelope into the mailing machine slot 136 as discussed more fully in the aforesaid patent application entitled "Stand-Alone Electronic Mailing Machine".

Assuming initialization of the postal meter has been completed for example as disclosed in U.S. Pat. No. 4,301,507 and in U.S. application Ser. No. 447,913 of A. B. Eckert et al., for "Initializing The Print Wheels In An Electronic Postage Meter", the microprocessor 10 executes a scan routine under the control of the idle loop program. The scan routine continuously searches the keyboard 12 for key closures resulting from depression of keys. When each key is depressed, thereby closing the associated switch, the microprocessor 10 executes a control routine which causes a subroutine stored in the control structure to drive the LED display in response to such key depressions. Upon turning the power switch to its "on" position 600 (FIG. 6), the postal meter/mailing machine flags the date key as not checked 602. Thereafter, in the course of the initialization process, a zero postal value is displayed and flagged as a postage setting being on display 604. Whereupon, according to the invention, the date check logic routine of FIG. 6 is invoked.

Figure 6A:
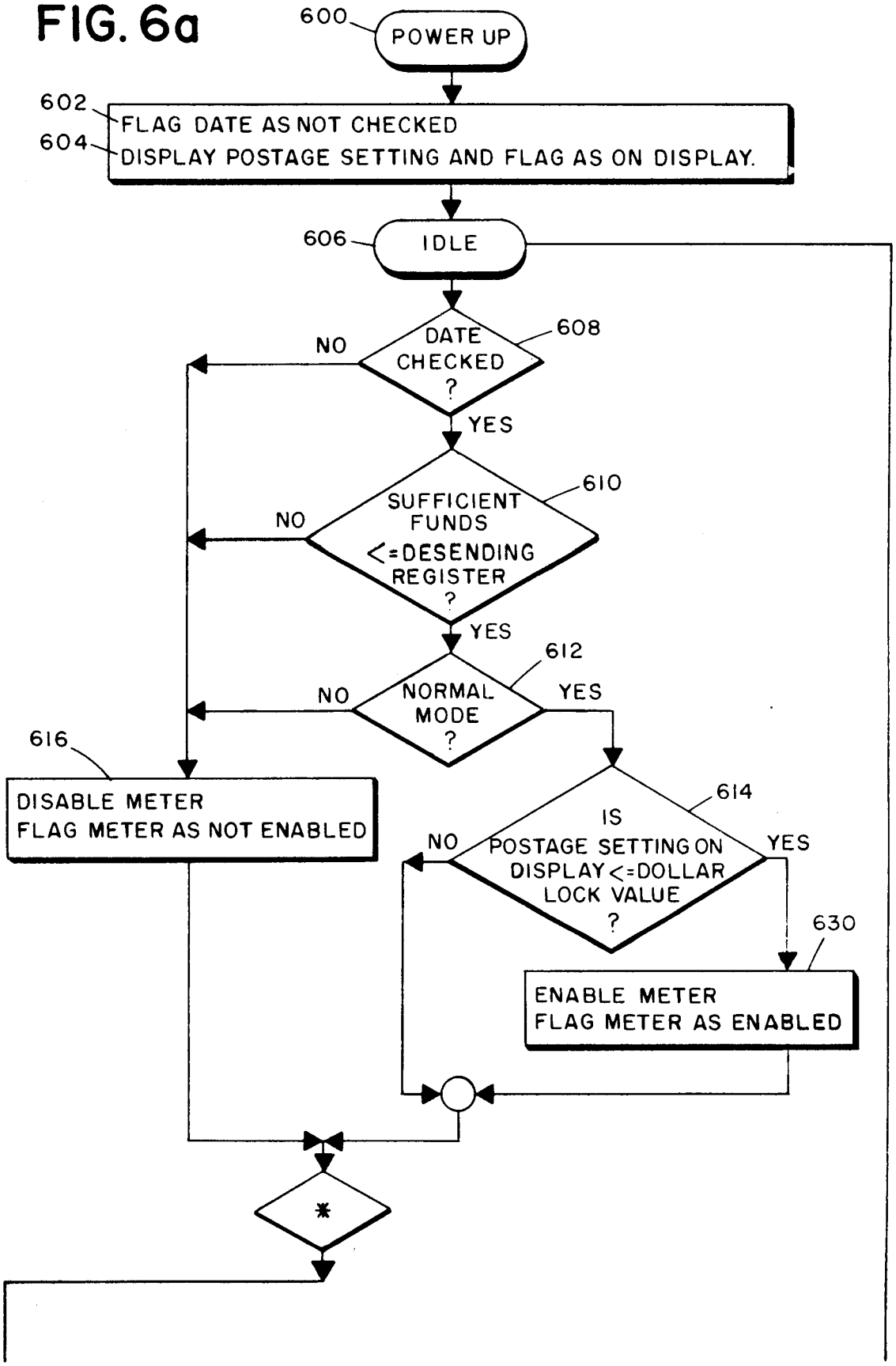
FIG. 6, consisting of the views shown in FIGS. 6*a* and 6*b* which each show two lead lines for interconnecting the views to each other to form
Figure 6B:
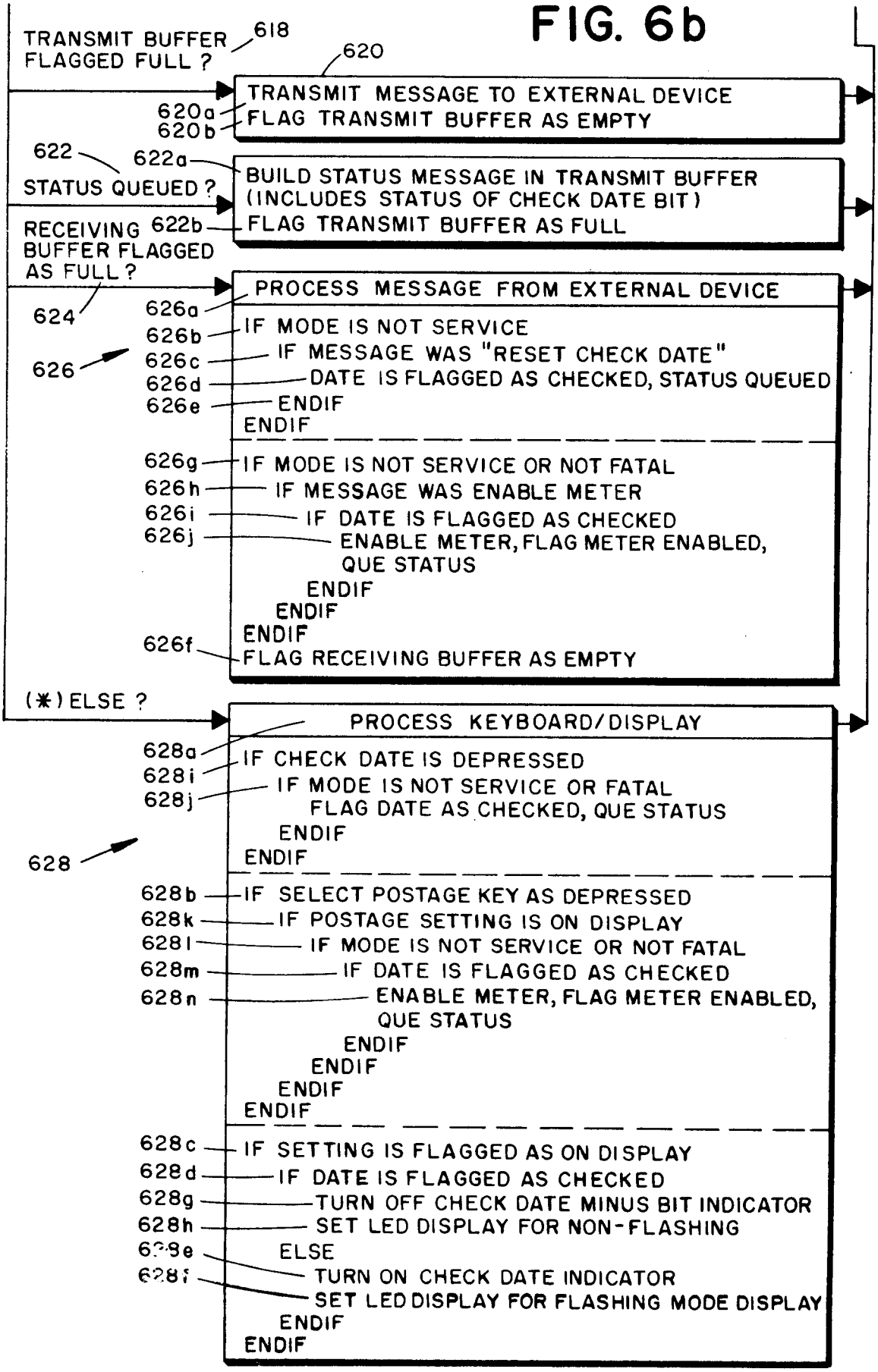

As shown in FIG. 6, wherein the 600 series of numbers is utilized to identify steps of the process shown therein, the microprocessor executes the program starting from idle 606, commencing with a determination as to whether or not the date has been checked 608. If it is not, the postal meter is disabled 616 and flagged as such, as a result of which the postal meter cannot print postage. If it were, determinations would also be made as to whether or not sufficient funds are available in the meter to print the displayed value 610, whether or not the postal meter is in the normal mode of operation 612, and whether or not the dollar unlock value stored in the meter is greater than the postage value which is displayed 614. Thus, if any one of these first three questions, 608, 610, 612, is answered in the negative, the postal meter is disabled 616 and flagged as such. On the other hand, if all of the first three questions, 608, 610 and 612, are answered in the affirmative, a determination is made as to whether or not the dollar unlock value is equalled or exceeded by the postage setting on display 614. If the dollar unlock value has not been equalled or exceeded the postage meter is enabled 630 and flagged as such, otherwise it is not; and, thereafter, in both instances, the transmit buffer 618, receiving buffer 624 and keyboard/display buffer/flags 628 are scanned for processing. For the purpose of this discussion, until otherwise stated, it will be assumed that the postage setting on display remains at the zero value displayed in the course of the initialization process, as a result of which the postage setting is less than the dollar unlock value 614. In addition it will be assumed that there are sufficient funds 610 and that the mode is normal 612.

As shown in FIG. 6, the remainder of the organization of the check date logic routine calls for processing precedence to be given in turn to transmitting messages to the external device which are stored in the transmit buffer 618, then to processing messages generated by the external device and stored in the receiving buffer 624 and then to processing messages generated by the keyboard 628. Before discussing the same in greater detail, there follows a general discussion of such processing steps.

The transmit buffer is initially scanned to determine whether it is full or empty 618. If it is full, then, as shown in the first block 620, the message stored in the transmit buffer is transmitted to the external device 620*a*, the transmit buffer is flagged as empty 620*b* and processing returns to idle 606. Thereafter the microprocessor scans the various flags to determine whether status information has been queued 622, that is, has been flagged to indicate that it is information which is to be transmitted to the external device. If status has been queued, a message corresponding to the status of the postage meter is built in the transmit buffer 622*a*, for example a message including a bit which indicates the status of the date as not being checked, and the transmit buffer is flagged as full 622*b*. Whereupon processing returns to idle 606. On the next scan, since the transmit buffer is now flagged as full 618, the message stored in the transmit buffer is transmitted to the external device 620*a* and the transmit buffer is again flagged as empty 620*b* and processing returns to idle 606. The aforesaid processing continues until all of the queue flags have resulted in a message being transmitted to the external device, one for each such queue flags. At this juncture, the transmit buffer having been flagged as empty, is available for filling with subsequent data to be transmitted, and processing returns to idle 606.

If on the next scan the receiving buffer is flagged as full 624, the check date message stored therein is processed provided the postal meter is not in the service mode of operation 626*b*, 626*g*. Date check processing does not occur in the service mode because the postal meter is not equipped to process and account for printed postage when it is in the service mode. Also, in the case of a meter enable message being processed 626*h*, processing is ended if the meter is in the fatal mode of operation. This occurs when, for example, the meter has experienced a malfunction requiring the attention of a qualified serviceman. If the receiving buffer is flagged as empty 624, processing occurs in the fourth block 628, wherein keyboard generated messages 628*a*, pertaining to the postage setting being on display 628*c*, are processed.

Referring now to the date check query 608, and assuming that the date is not checked, the meter is disabled 616 and flagged as such. Thereafter assuming the transmit buffer 618 and receive buffer 624 are both flagged as empty, processing occurs in the fourth block 628. If none of the keys 628*a* or 628*b* have been depressed, since the postage setting (zero value) is still flagged as on display 628*c* (from 604) and the date is still flagged as checked 628*d* (from 602), the check date indicator, preferably a minus sign in the extreme left digit position of the LED display, is turned on 628*e* and the entire LED display is set to a flashing mode of operation 628*f*. Thus the keyboard operator is visually reminded to check the setting of the thumbwheels 175 (FIG. 3). In addition, status is queued, 628*f*, 622 (FIG. 6) and processed as hereinbefore discussed in the case of an external device being utilized to operate the postal meter.

Assuming the postal meter is being operated from the keyboard, the operator would at this juncture check the setting of the date and change the same, if necessary, by manipulating the thumbwheels 175 (FIG. 3). Thereafter, the operator would depress the date key 174. Upon doing so, the date will not as yet have been checked 608 (FIG. 6). Accordingly, the meter would remain disabled 616 and flagged as such. On the other hand, since the transmit buffer is flagged as empty 618, the receiving buffer flagged as empty 624 and the check date key has been depressed 628*a*, the date is then flagged as checked 628*i*. In addition, since the postage setting is still on display 628*c* and the date flagged as checked 628*d*, the minus bit indicator is turned off 628*g*, the LED display set to its non-flashing mode 628*h*, and processing returned to idle 606. At this juncture since the date has now been flagged as checked 608 (from 628*j*), and the answer to the questions 610, 612 and 614 are all yes, the meter is enabled and flagged as such.

Assuming the postal meter is being operated from an external device, the external device would normally be operated to generate and transmit to the postal meter a "reset check date" message, i.e., a header only message which simulates the depression of the date key of the postal meter. Assuming this has occurred, the transmit buffer is flagged as full 624, and the message processed. Since the postal meter is not in the service mode 626*b* and the message was "reset check date" 626*c*, the date is flagged as checked 626*d*, the receiving buffer is flagged as empty 626*f* and processing returned to idle 606. Since the date has now been flagged as checked 608 (from 626*d*), and the questions 610, 612 and 614 are all answered affirmatively, the meter is enabled and flagged as such. Thereafter, all queued status is processed as hereinbefore discussed and transmitted to the external device. Then, since the date is flagged as checked (from 626*d*) and the setting is still flagged as on display 628*c*, the check date minus bit indicator is turned off 628*g*, the LED display set for the non-flashing mode 628*h*, and processing returned to idle 606.

As shown in FIG. 6, the external device can enable the meter 626*j* by transmitting an enable meter message to the postal meter. Assuming this occurs and the postage setting on display 614 is greater than the dollar unlock value, the receiving buffer will be flagged as full 624 and the message therein processed in block 626. Whereupon if the mode is not service or not fatal 626*g* and the date is flagged as checked 626*i*, the enabled meter message will be processed, preferably, on an unconditional basis. However it is within the scope of the invention to conditionally enable the meter 626*j*. This may be deemed to be a desirable occurrence due to it being generally impermissible to unconditionally enable the meter 626*j* when the postage value on display exceeds the dollar unlock value 614. For example, it may be desirable that the processing step 626*j* include a conventional subroutine to permit enablement of the postal meter by the external device when the enable meter message 626*h* simulates more than one discrete depression of the select postage key.

Similarly, the postal meter may be enabled from the keyboard by depressing the select postage key 628*b*. Again, assuming the postage is on display 628*k*, the mode not service or not fatal 628*l* and the date flagged as checked 628*m*, the meter will be, preferably, unconditionally enabled. However, as hereinbefore discussed it may be desirable to conditionally enable the postage meter, for example if the postage setting on display exceeds the dollar lock value. Thus the remarks hereinbefore made with regard to processing at step 626*j* apply with equal force to the processing at step 628*n*, except that meter enablement would occur, for example, when the select postage key 628*b* is actually depressed a second time.

Aside from the foregoing, if the date has been checked 608 but there are insufficient funds in the postal meter to print the displayed postage 610, the meter will be disabled 616 and flagged as such. Reading down the flow chart (FIG. 6) it will be noted that nothing in chart can cure this problem, as a result of which processing is ended and returns to idle 606. Ordinarily the operator would at this juncture recharge the meter.

If the date has been checked 608 and there are sufficient funds 610 but the meter is not in the normal mode 612, then, the meter will be disabled and flagged as such, processing ended and returned to idle 606 since there is nothing in the flow chart (FIG. 6) for curing this problem. Ordinarily, if the meter is in the service mode, the operator would have to take it out of the service mode before proceeding with check date processing. On the other hand, if the meter were not in the service mode but was in the fatal mode, the user would ordinarily call a serviceman to cure the problem.

Assuming that the problems which could occur with respect to insufficient funds 610 or not being in the normal mode 612, are cured, it will then be assumed that the date is checked 608, but the setting on display is less than the dollar lock value 614, as a result of which nothing is done. However, this state of affairs can be dealt with as hereinbefore discussed by the check date logic routine. Since the date was checked 608 at the outset, the operator can operate the select postage key 628*b* to depress the same a second time for overriding the dollar unlock feature of the postal meter. And, upon doing so, since the setting is on display 628*k*, the mode of operation is normal 628, and the date was flagged as checked 628*m*, the meter is enabled 628*n* to print postage. After which, processing is ended and returns to idle 606.

Accordingly, when the postal meter/machine is powered-up, the date is flagged as not checked, as a result of which the check date program is invoked and executed by the microprocessor to determine whether or not a postage setting is on display and, if it is and the date is not checked, the microprocessor disables the meter to prevent postage from being printed. In addition, the display is then driven to display at least one segment in a predetermined digit position of the display. In the preferred embodiment, a minus sign is displayed in the extreme left digit position. In addition, the entire LED display commences flashing, intermittently, to inform the user that the date has not been checked. Further, the postal meter/machine is programmed to respond to depression of the date key to turn off the minus sign bit in the extreme left hand digit position of the LED display and set the LED display to a non-flashing mode. In addition, the postal meter/machine is programmed to respond to messages from an external device for simulating depression of the date key and for enabling the meter/machine without operator intervention. Further, the postal meter is programmed to permit utilization of the select postage key for generating an enable meter message after the date has been checked although the postage setting on display exceeds the dollar unlock value; and provision is made to permit an external device to simulate such operation of the postage meter.

Referring now to FIG. 5, in any mode of meter operation other than the service mode, depression of the postage used key 162 effects the display at the display panel 140 of the total value in the ascending register of all postage that has been printed, depression of the postage unused key 164 effects the display of the total value in the descending register of the postage then available for printing, and depression of the piece count key 166 effects the display of the total count of all printing operations of the mailing machine 130. In each instance the depression of the selected key results in the current value associated with the key being displayed for a predetermined time interval after the key is released, for example several seconds, after which time interval the display will return to the then current postage setting.

According to the invention, the numerical keys 156 (FIG. 5) in combination with the access code key 170 (FIG. 3) may be used for displaying the aforesaid information and other information which is not ordinarily the kind of information that a customer needs or is able to interpret. And, when the meter is in the service mode of operation, the postage used, postage unused and piece count keys, 162, 164 and 166 (FIG. 5) may each be used to effectuate the display of some of such other information. The latter case is hereinafter initially discussed since it exemplifies both usages of the keyboard.

In order to effectuate utilization of the keyboard 22 (FIG. 4) to initiate command or request functions for which separate keys have not been provided, a predetermined numerical code, having at least two and preferably four characters without a decimal, is entered in the keyboard 22 by depressing the appropriate numerical keys 156 (FIG. 5), followed by depression of the access code key 170 (FIG. 3). Upon depression of the access code key 70 a control routine is invoked which causes the generation of a request or command header corresponding to the two low order digits in the display. For example, although a service mode key has not been provided, entering the numerals 6946 in the keyboard followed by depression of the access code key 170 will cause the generation of a "46" command header. Whereupon the microprocessor will invoke a conventional subroutine causing the meter to enter the service mode of operation. When this occurs, a predetermined code, preferably consisting of a segment inserted in the low segment position of each blank digit position will be displayed to inform the user that the postal meter and thus the machine is in the service mode of operation. Thereafter, depression of the postage used key 162 will result in the display of the "dollar unlock" value, consisting of a predetermined value which if equaled or exceeded, in the course of use of the postal meter, will not be printed unless the operator depresses the select postage key a second time after the value is originally displayed. On the other hand, in the service mode of operation, the depression of the postage unused key 164 will result in the display of the "low postage warning" value, consisting of a predetermined postage value which results in the display of a warning signal informing the operator that the postal meter/mailing machine should be recharged. And, depression of the piece count key 166 will result in a diagnostic status display identifying the last fatal condition that occured, even though that condition was subsequently cleared.

Figure 7:
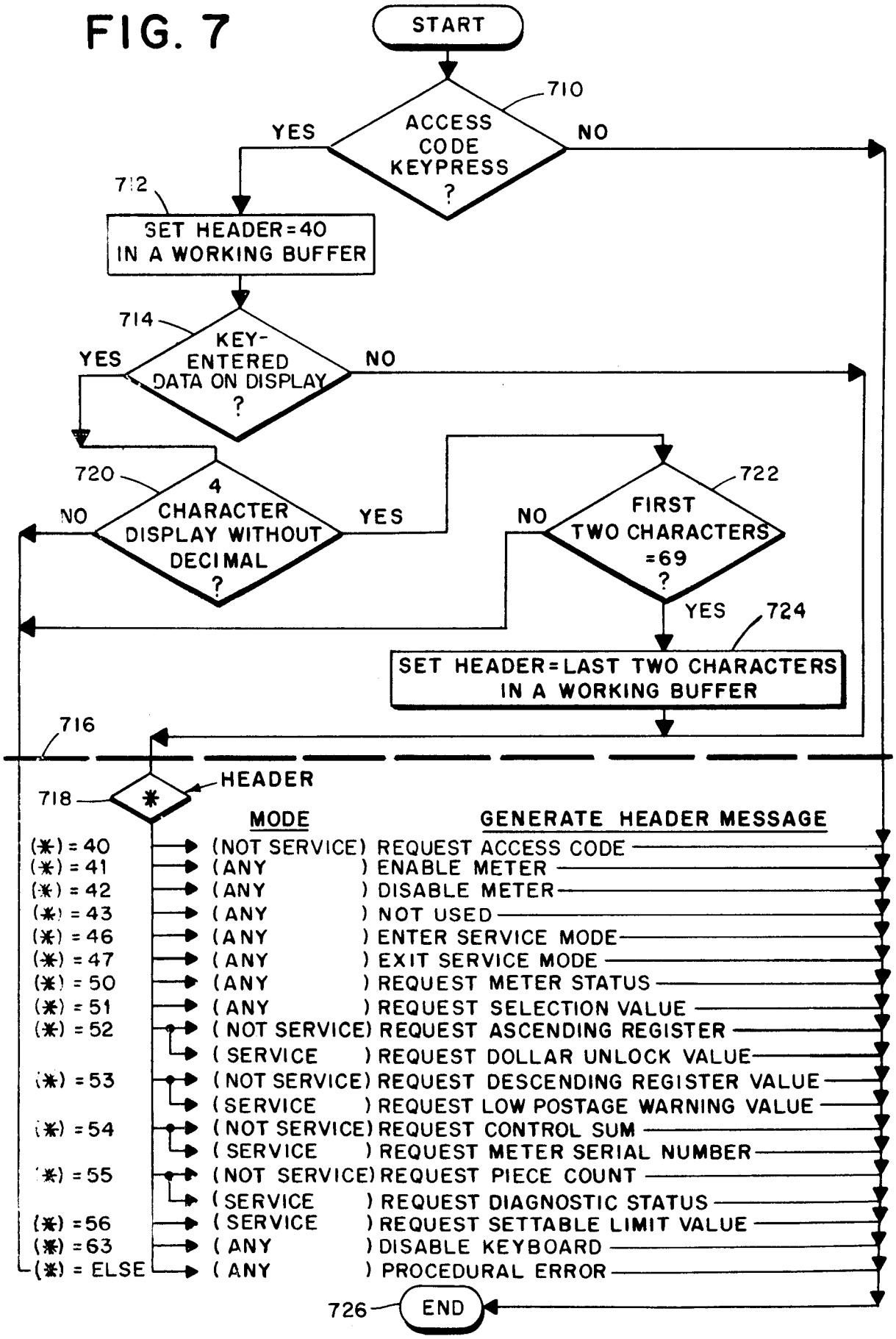
FIG. 7 is a flow chart of the header message logic routine according to the invention.

For the general case of usage of the numerical keys in combination with the access key 170 (FIG. 3) for displaying all of the above referred to information and still further information, reference is made to FIG. 7, wherein the 700 series of numbers are utilized to identify the steps of processing. As shown in FIG. 7, until the access code key is depressed 710, the microprocessor under the direction of the idle loop program continues its idle routine. When the access key is depressed 710, a single byte header message corresponding to the numerical value of "40" is built and stored in an available working buffer 712. If there is no key entered data in the display 714 at this juncture, the microprocessor invokes the header message execution routine 716 shown below the dashed line in FIG. 7 to execute the header message 718. Since the header message corresponds to the numeral 40, a "request access code" message is generated, which message results in the microprocessor invoking a conventional subroutine for building an access code in the display buffer. And, as hereinbefore discussed, the display buffer is copied into the image buffer in bit format for driving the LED display, as a result of which the access code is displayed to the operator, i.e., the code ordinarily used by the operator, for example for calling into Pitney Bowes Data Center, when charging the postal meter with additional postage. On the other hand, after the aforesaid numeral 40 header is generated 712 and set in the available buffer, if there is key entered data is in the display 714 the header will not be executed. Rather, the display buffer will be scanned, and, if the data in the display buffer is not a four character display without a decimal 720, then the microprocessor invokes a conventional sub-routine which generates a "procedural error" message, i.e., a meter status message having a procedural error bit, which message is transferred to the display image buffer to drive the LED display to display the notation "ERR". Similarly, if the display is a four character display without a decimal, but the first two characters 722 are not the numerals "69", the microprocessor invokes the aforesaid sub-routine to generate the procedural error message and display the same error notation. On the other hand, if the first two characters 722, of the four character display without a decimal, are the numerals "69", then, a single byte header message 724 utilizing the last two characters is generated and stored in an available working buffer, whereupon the microprocessor invokes the header message execution routine 716 below the dashed line in FIG. 37 and execute the same to generate a message corresponding to the last two digits.

Upon execution of the header message routine 716 (FIG. 7), if the aforesaid last two digit header message is "40", a "request access code" message is generated, resulting in the display hereinbefore discussed. If the two digit header message is "41" an "enable meter" message is generated, if it is "42" a "meter disable" message is generated, if it is "46" an "enter service mode" message is generated, if it is "47" an "exit service mode" message is generated, if it is "50" a "request status" message is generated, and if it is "51" a "request selection value" message is generated. If it is "52" and the meter is not in the service of operation a "request ascending register" message is generated. On the other hand, if it is "52" and the meter is in the service mode of operation the request ascending register message is interpreted as a "request dollar lock value" message. If the two digit code is "53", "54" or "55" and the meter is not in the service mode of operation, then the "request descending register", "request control sum" or "request piece count" messages will be respectively generated; whereas if it is "53", "54" or "55" and the meter is in the service mode of operation then these same messages will be respectively interpreted as the "request low postage warning value", "request meter serial number" or "request diagnostic status" messages. Further, if it is "56" and the meter is in the service mode of operation the "request settable limit value" message will be generated, if it is "63" the "disable keyboard" message will be generated, and, if the last two digits are any two digits other than one of the foregoing last two digits, then the "procedural error" message will be generated. In each instance, upon generating or otherwise providing the particular message, processing is ended 726, and thereafter the microprocessor invokes a conventional sub-routine which is executed by the microprocessor to cause the performance of the particular operation of the meter which corresponds to the message and to provide a display corresponding to the message. For example, when the message "request access code" and "procedural error" were respectively generated as hereinbefore discussed, an access code and the notation "ERR" were respectively displayed.

To effectuate utilization of the keyboard 22 to initiate data entry functions for which separate keys have not been provided, and to obviate the necessity of entering and end of entry command from the keyboard without providing a separate key therefor, the postal meter/mailing machine is also programmed to permit an operator, usually a factory trained serviceman, to modify or initially store various predetermined values in the mailing machine which effect its operational characteristics. These values include the settable limit value, low postage warning value and dollar unlock value, which are usually modified to comply with customer needs or preferences. According to the invention, for modifying such values the machine is initially put into the service mode of operation as hereinbefore discussed. Having done so it would be noted that since the access code key is not involved with modifying values stored in the meter, the flow chart of FIG. 7 is not hereinafter referred to in the following discussion.

Before modifying the aforesaid values, after putting the postal meter in the service mode of operation, the operator may optionally check the values that are to be modified, by depressing the appropriate key 162, 164 or 166 (FIG. 5) to determine whether or not modification is necessary. Thereafter the operator ordinarily enters the new value to be stored into the keyboard 22, by depressing the appropriate numerical keys 156, which results in the display of the corresponding value, and then depressing the enter amount key 172 (FIG. 3), which results in the storage of the displayed amount and blanking the display. Either before or after entry of the new value, the operator may enter a predetermined combination, having at least one digit, into the keyboard by utilizing the numerical keys 156 (FIG. 5), which results in the display of the corresponding value, and then depressing the enter combination key 173 (FIG. 3), which results in the storage of the combination corresponding to the keyboard entry and blanking of the display. As a result of having entered both the amount and combination, the microprocessor automatically invokes the end of entry program shown in FIG. 8 for processing the entered amount and combination, as if an end of entry command had been received, thereby causing the value stored in the register identified by the combination to be changed to the new value.

Figure 8A:
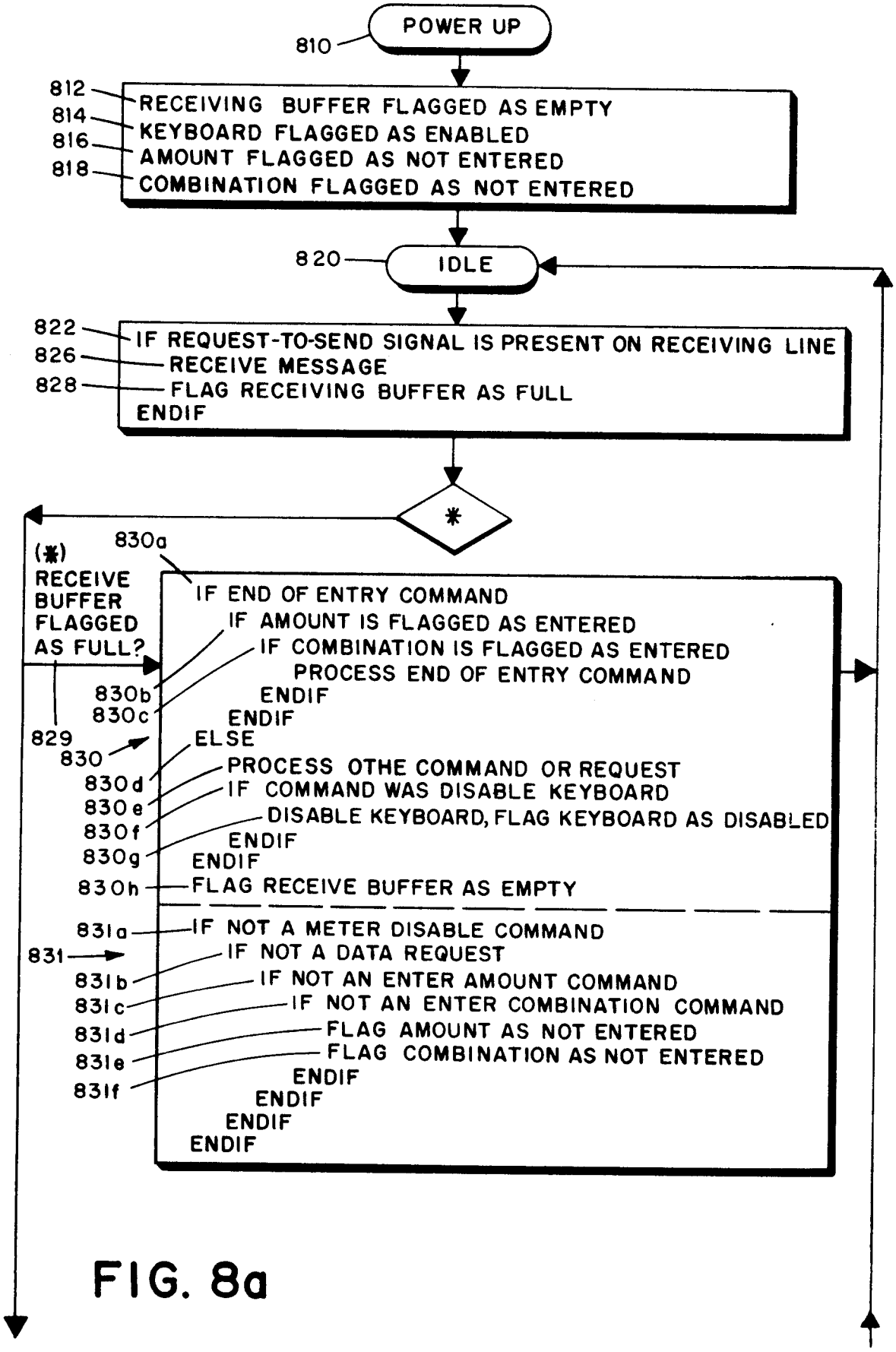
FIG. 8, consisting of the views shown in FIGS. 8*a* and 8*b* which each show two lead lines for interconnecting the views to each other to form
Figure 8B:
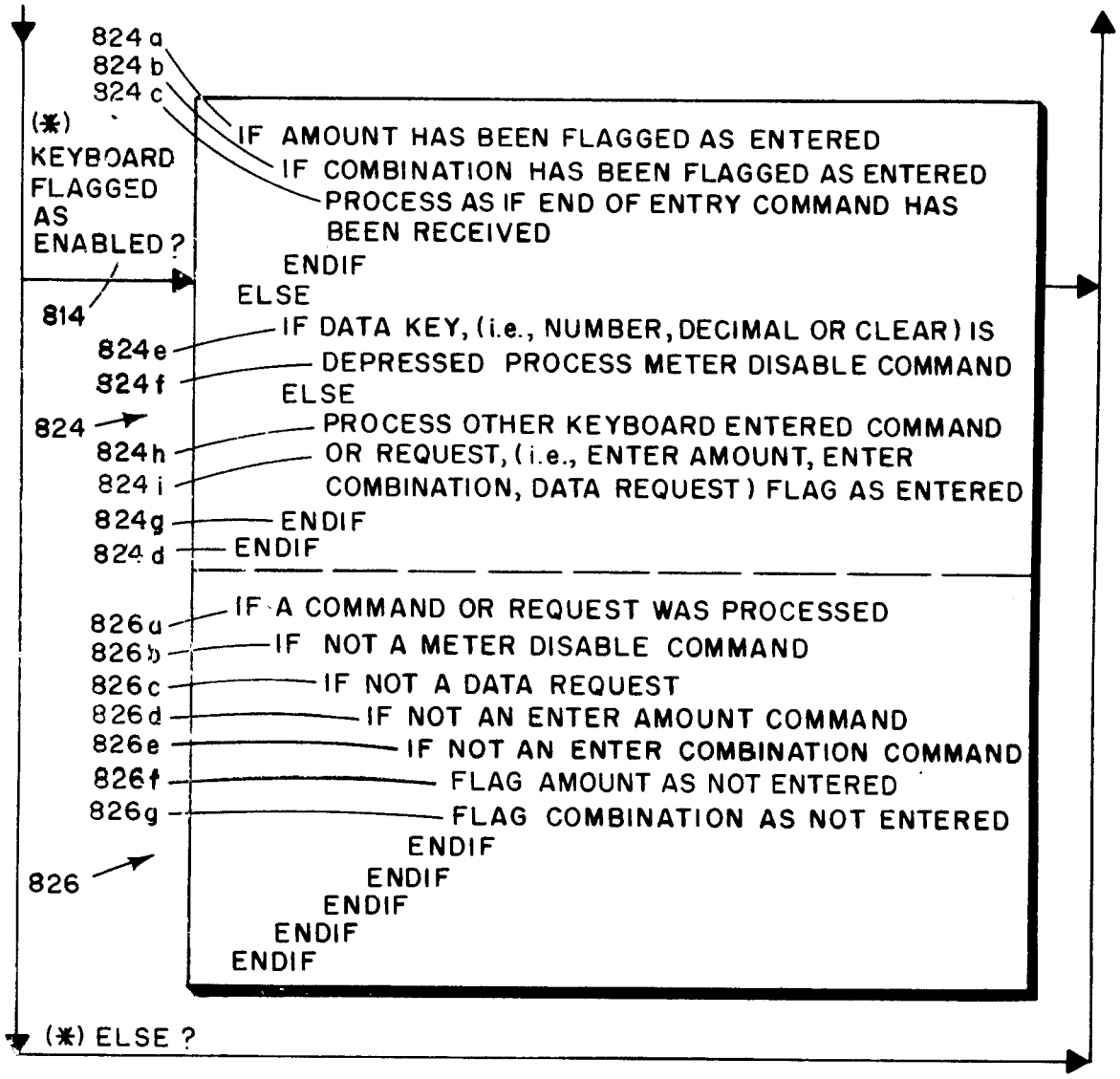

The end of entry program (FIG. 8) is executed by the microprocessor under the control of the appropriate accounting routine. As shown in FIG. 8, after power 810 is applied to the postal meter the receiving buffer is flagged as empty 812, the keyboard is flagged as enabled 814. In addition, the amount and combination working registers of the RAM are flagged as not entered, 816 and 818, in the course of initialization of the postal meter/machine. Under the control of the idle loop program, the microprocessor then searches for executable instruction in the various working buffers of the RAM.

As shown in FIG. 8, wherein the 800 series of numbers are used for identifying the processing steps, processing precedence from idle 820 is given to messages received from external devices, over those that are integrally generated. For the purpose of this discussion, it will be assumed until otherwise stated that a request-to-send signal 822 has not been received from any external device since the initialization process was completed, and that the receiving buffer remains flagged as empty 812, the keyboard remains flagged as enabled 814, the amount remains flagged as not entered 816 and the combination remains flagged as not entered 818. Accordingly, messages are processed in accordance with the steps of the process set forth in the lower block 824 (FIG. 8). If the amount has been flagged as entered 824*a*, due to a new value having been entered in the keyboard and the enter amount key having been depressed, and if the combination code has also been flagged as entered 824*b*, due to the appropriate code having been entered in the keyboard and the enter combination key having been depressed, then, the amount and combination code are processed 824*c* as if an end of entry command has been received. On the other hand, if the amount has been flagged as entered 824*a* but the combination has not been so flagged, then, processing is ended 824*d*. If however the amount has not been flagged as entered 824*a* and if a numerical data key is depressed 824*e*, then, the keyed data 824*f* generates a meter disable command. In this connection it should be noted that disabling the meter prevents the same from printing postage, and that the keyboard remains enabled. Referring again to FIG. 8, if the amount has not been flagged as entered 824*a* and a numerical data key is not depressed 824*e*, processing is ended 824*g* unless some other key is depressed 824*h*, in which event the other command or request is processed 824*i*.

After the aforesaid processing is completed, all such processing is additionally subjected to the abort analysis subroutine 826 shown below the dashed line in the lower block 826. As shown in this subroutine 826, if a command or request has been processed above the dashed line 826*a*, and if it was not a meter disable command 826*b*, and it was not a keyboard entered data request 826*c* i.e., a message generated as a result of depression of any one of the postage used, postage unused or piece count keys, and it was not an enter amount command 826*d*, and it was not an enter combination command 826*e*, then, the amount 826*f* and combination 826*g* are both flagged as not entered. If however the command or request was processed above the dashed line 826*a* and it was a meter disable command 826*b* processing is ended; or, if it was not a meter disable 826*b* but was a keyed data request 826, then processing is ended; or, if it was neither a meter disable command 826*b* now a numerically keyed data request 826*c*, but was an enter amount command 826*d*, then, processing is ended; or if it was not a meter disable command 826*b* nor data request 826*c* nor enter amount command 826*d*, but was an enter combination command 826*d*, then, processing is ended. And, in each instance in which processing is ended, the amount and combination, 826*b*, 826*g* are not flagged as not entered, or, otherwise stated, if one or the other of the amount or combination had been flagged as entered due to prior processing above the dashed line it will remain flagged as entered.

The aforesaid abort analysis subroutine 826 (FIG. 8) is provided to be sure that once the operator commences the process of modifying one of the values stored in the postal meter, and certain other information other than the appropriate information for completing the value modification process is entered into the keyboard before completing the value modification process, then the operator is forced to recommence the value modification process. For example, if after the operator enters an amount, the operator then enters a postage value via the keyboard 824*e*, the meter will be disabled due to a meter disable command being generated and processed 824*f* each time a key is depressed. Such entries will not clear the amount and combination entry flags since a meter disable command was processed 826*b*. However, when the operator depresses the select postage key, the message generated is a select postage command 826*b* not a data request 826*c*, not an enter amount command 826*d* and not an enter combination command 826*e*; as a result of which the amount and combination code will both be flagged as not entered. Thus the previously entered amount will have to be reentered by the operator. On the other hand, it is permissable to interrupt processing the new value/combination code entry sequence for the purpose of displaying values by depressing data request keys. Thus the postage used key may be depressed for displaying the "dollar unlock" value, the postage unused key may be depressed for displaying the "low postage warning" value, and the piece count key may be depressed for displaying the "diagnostic status"; these values, rather than those associated with the name of the key, being displayed since the new value/combination code is entered when the postal meter is in the service mode of operation. Under these circumstances, the amount and combination will not be flagged as not entered, since the depression of such keys results in generating a data request message and processing a data request message 826*a* results in ending the abort analysis subroutine. Accordingly, a previously entered amount or combination will not be flagged as not entered. Thus, although the postal meter is programmed for forcing the operator to complete the value modification process after having commenced the same, or, otherwise stated, is programmed for preventing the value modification process from being aborted after its commencement, information which is relevant to value modification processing may be displayed after the process has been commenced with respect to any of the values that are ordinarily modified.

At any time in the course of the foregoing procedures the operator of an external device may take control of the meter to transmit a command or message by sending a request-to-send signal. However, the message associated with the signal will not be processed until internal processing then in progress is completed.

As shown in FIG. 8, after idle 810, if there is not a request to send signal 822 on the receiving line nothing is done. If however a request to send signal 822 is on the receiving line, then the message is received 826 and the receive buffer is flagged as full 828. Having flagged the receive buffer as full 828, 829 the message will be processed in the upper block 830 whether or not the keyboard is enabled, due to processing receiving buffer messages taking precedence over processing keyboard entered messages.

As shown in the upper block 830, if the message following the request to send signal is an end of entry command **830*a* and the amount and combination are both flagged as entered 830*b* and 830*c*, then, the amount and combination are processed. However, it should be noted that if the keyboard entry routine hereinbefore discussed was interrupted by a request-to-send signal 822 after entry of the amount and combination via the keyboard, the amount and combination would not be effected, since processing would have already automatically occurred as if an end of entry command had been received, inasmuch as the end of entry message associated with the request-to-send signal 822 will not be processed until the processing then in progress is completed. Accordingly, the incoming end of entry command 830*a* would find both the amount and combination flagged as not entered 830*b* and 830*c***, as a result of which processing of the end of entry command in the upper block diagram would be ended. This would also cover if the external device operator were to consecutively enter the amount and then enter the combination, in any order, unless the operator of the external device initially disables the keyboard. Assuming the external device is equipped to disable the keyboard, the operator of the external device has the option of allowing automatic processing, as previously discussed, as if an end of entry command had been sent, or, preventing such processing until an end of entry command is transmitted.

Referring back to the upper block 830 (FIG. 8) assuming the message following the request-to-send signal 822 is not an end of entry command, but is something else **830*d*, that request or command is processed 830*e*. And if the message is a disable keyboard command 830*f*, the keyboard is flagged as not enabled 830*g*. In any event, after processing the request or command received from the external device, processing is ended and the receiving buffer is flagged as empty 830*h***.

As discussed in connection with processing the keyboard entries, commands and messages from the external device are also subjected to an abort analysis subroutine 831, in this instance as shown in the upper block 830. As shown below the dashed line 831, if a command or request was not a meter disable command **830*a*, not a numerical data request 830*b*, not an enter amount command 830*c* and not an enter combination command 830*d*, then, both the amount 830*a* and combination 830*f* are flagged as not entered. On the other hand, if the request or command was a meter disable command 830*a*, or, if it was not, but was a data request 830*b*; or, if it was neither a meter disable command 830*c* nor a data request 830*d* but was an enter amount command 830*e*; or if it was not a meter disable command 830*a* nor data request 830*b* nor enter amount command 830*c*, but was an enter combination command 830*d*; then, in each instance, processing below the dashed line is ended and returns to idle 820**.

The main difference between the processing steps involved in modifying the values in the registers via the external device rather than via keyboard entries, is that an end of entry command **830*a* must be sent from the external device to commence processing the amount and combination code if the operator of the external device initially transmitted a disable keyboard command; whereas, as shown in the lower block 824**, an end of entry command need not be initiated by the operator to commence processing the amount and combination code data, rather it is automatically processed when the last of the two (amount or combination) are entered. Thus the external operator has a choice of methodology which is unavailable to the keyboard operator.

Assuming the operator of the external device sends a disable keyboard command, it must be sent prior to entering either the amount or combination. For example, assuming the amount has been entered **830*b* but the combination has not been entered 830*c* and a disable keyboard command 831*a* has not as yet been sent by the operator of the external device, if at this time a request to send signal 822 is sent, followed by a disable keyboard command 826, since this is not an end of entry command 830 it would be processed by the upper block 830 as any other command or request 830*d* and, in addition, the keyboard would be flagged as not enabled 830*g*. However, since all processing above the dashed line of the upper block 830 is analyzed below the dashed line, and since the keyboard disable command is not a meter disable command 831*a*, and not a data request 830*b*, and not an enter amount command 830*c* and not an enter combination command 830*d*; the amount 830*e* and combination 830*e*** will both be flagged as not entered. As a result, the previously entered amount would be cleared.

Assuming the external device operator chooses to disable the keyboard before entering the amount and combination, since he wants to avoid automatic processing, then, after such processing, unless the external operator transmits an enable keyboard command, the keyboard will remain disabled. If this state of affairs is not intended, the keyboard operator can cure the problem by turning the power switch "off" and then "on" again, as a result of which the keyboard will be flagged as enabled 814 in the course of the initialization process.

The aforesaid discussion concerning the end of entry processing is based on the assumption that the postal meter is in the service mode of operation. When the postal meter is in the non-service mode of operation, the amount and combination keys 172 and 714 are utilized in the same fashion to effectuate modifying the amount stored in the postage unused register of the RAM. And, processing any message generated by depression of the amount and combination keys 172 and 174 is in all respects the same as is hereinbefore discussed. In addition, the same may be said for processing messages generated by the external device. And all other remarks hereinbefore made with regard to utilization of other keys of the keyboard, and processing messages from the external device other than those pertaining to entry of the amount and combination, apply with equal force to utilization of the meter in the non-service mode. However, it is critical to the security of the postal meter that the combination code used for modifying the value stored in the postage unused register not be made available to anyone other than authorized users of the postal meter. Therefore the code is obtained from the Data Center by following the steps of depressing the access code key 170, which results in the display of a code other than the combination code, and then calling this code into the appropriate Data Center, as hereinbefore discussed, along with the serial number of the postal meter/machine and the amount which is to be added to the postage unused register, to obtain from the Data Center the then current combination code which must be used for entry in order to effectuate modification of the value stored in the postage unused register.

Since it is critical to the security of the postal meter to be sure that the serial number cannot be modified except by authorized personnel, any modification of the serial number is ordinarily undertaken in the course manufacture of the machine and, in any event, before the machine is placed in service. For preventing the serial number from being modified by unauthorized personnel, the above discussed modification procedure can only be used for modifying the serial number if it is stored in modifiable form. For example, assuming the postal meter/mailing machine does not have a serial number or has a serial number which is to be modified; the foregoing procedure may be followed, utilizing as the new value, a serial number having at least one digit prefixed by a "zero" digit, for either initial entry or any modification of an unlocked serial number. However, at such time as it is desirable to fix the serial number of the postal meter/mailing machine, the operator repeats the aforesaid modification procedure another time, utilizing the next previously entered serial number prefixed by a "one" digit rather than a "zero" digit, whereupon the microprocessor invokes a conventional subroutine which locks the next previously entered combination in place in the serial number register.

It is known and understood that the terms postage meter and postal meter, as used herein, refer to the general definition of a device for the imprinting of a defined unit value for governmental or private carrier parcel, evelope or package delivery, or other like application for unit value printing. Thus, although the term postal meter is utilized, it is both known and employed in the trade as a general term for devices utilized in conjunction with services other than those exclusively employed by governmental postal services. For example, private parcel or freight services purchase and employ postal meters as a means to provide unit value pricing for individual parcels, including acounting and printing functions.

A more detailed description of the programs hereinbefore discussed is disclosed in the appended program listing describing in detail all of the various routines incorporated in, and used in the operation of, the postal meter/mailing machine.

While the inventions disclosed herein have been described with reference to a simple embodiment thereof, it will be apparent to those skilled in that art that variations and modifications may be made therein without departing from the spirit and scope of the same. Accordingly, it is intended in the following claims to cover each such variation and modification as falls within the true spirit and scope of the claimed inventions.

```
    <<< ASSEMBLY COMMAND STRING >>>

/LIST=_DRA1:[OPT1.DEBUG]PATENT.LIS
/OBJECT=_DRA1:[OPT1.DEBUG]PATENT.OBJ
+       LINES 60
+       LIST    A,E,G,O,S,X
+       NLIST   M
_DRA1:[OPT1.DEBUG]SYMBOL.SRC
;   I N T E R R U P T   V E C T O R   T A B L E
_DRA1:[OPT1.DEBUG]VECTBL.SRC
;   I N T E R R U P T   P R O C E S S I N G
+       ORG     40H
_DRA1:[OPT1.NEWINT]CLKDEC
_DRA1:[OPT1.NEWINT]DBOUNC
_DRA1:[OPT1.NEWINT]DISPLY
_DRA1:[OPT1.NEWINT]INT75
_DRA1:[OPT1.NEWINT]KDIO
_DRA1:[OPT1.NEWINT]MVDDAT
_DRA1:[OPT1.NEWINT]RDROW
_DRA1:[OPT1.NEWINT]STPTMR
_DRA1:[OPT1.NEWINT]STRTMR
_DRA1:[OPT1.NEWINT]TIMINT
;       P O W E R   U P   &   D O W N
;_DRA1:[OPT1.DEBUG]PWRUP
_DRA1:[OPT1.NEWCTL]PWRABN
_DRA1:[OPT1.NEWCTL]PWRDN
_DRA1:[OPT1.NEWCTL]PWRNOR
_DRA1:[OPT1.NEWCTL]PWRUNG
_DRA1:[OPT1.NEWCTL]PWRUOK
;       K E Y B O A R D   &   D I S P L A Y
_DRA1:[OPT1.NEWKEY]CDBUF
_DRA1:[OPT1.NEWKEY]FILDIM
_DRA1:[OPT1.NEWKEY]KEYBRD
_DRA1:[OPT1.NEWKEY]MODDSP
_DRA1:[OPT1.NEWKEY]PAUTHK
_DRA1:[OPT1.NEWKEY]PCLRK
_DRA1:[OPT1.NEWKEY]PDCMK
_DRA1:[OPT1.NEWKEY]PERDSP
_DRA1:[OPT1.NEWKEY]PNUMK
_DRA1:[OPT1.NEWKEY]PROKEY
_DRA1:[OPT1.NEWKEY]PSETK
_DRA1:[OPT1.NEWKEY]SEGCOD
_DRA1:[OPT1.NEWKEY]VALDSP
;       C O N T R O L   &   P R O C E S S I N G
;+      ORG     400H
_DRA1:[OPT1.NEWCTL]CMDDSB
_DRA1:[OPT1.NEWCTL]CMDENB
_DRA1:[OPT1.NEWCTL]CONFIG
_DRA1:[OPT1.NEWCTL]CONSUM
_DRA1:[OPT1.NEWCTL]CTLSUM
_DRA1:[OPT1.NEWCTL]DBLHDR
_DRA1:[OPT1.NEWCTL]DECADD
_DRA1:[OPT1.NEWCTL]DECCOM
_DRA1:[OPT1.NEWCTL]DECERR
_DRA1:[OPT1.NEWCTL]DECSUB
_DRA1:[OPT1.NEWCTL]DOACCT
_DRA1:[OPT1.NEWCTL]DOSTAT
_DRA1:[OPT1.NEWCTL]DOTRIP
_DRA1:[OPT1.NEWCTL]ENDENT
_DRA1:[OPT1.NEWCTL]ENTAMT
_DRA1:[OPT1.NEWCTL]ENTSER
_DRA1:[OPT1.NEWCTL]EXTSER
_DRA1:[OPT1.NEWCTL]EXTIRP
_DRA1:[OPT1.NEWCTL]FATERR
_DRA1:[OPT1.NEWCTL]FINTRP
_DRA1:[OPT1.NEWCTL]HDRONY
_DRA1:[OPT1.NEWCTL]HDRPLS
_DRA1:[OPT1.NEWCTL]IDLE
_DRA1:[OPT1.NEWCTL]MANRST
_DRA1:[OPT1.NEWCTL]MESAGE
_DRA1:[OPT1.NEWCTL]MSERNO
_DRA1:[OPT1.NEWCTL]MSG2MU
_DRA1:[OPT1.NEWCTL]MTRSTS
_DRA1:[OPT1.NEWCTL]NPAUSE
_DRA1:[OPT1.NEWCTL]POSUPD
```

```
_DRA1:[OPT1.NEWCTL]PROERR
_DRA1:[OPT1.NEWCTL]RDCYC
_DRA1:[OPT1.NEWIO]RECEVE
_DRA1:[OPT1.NEWCTL]REDSTS
_DRA1:[OPT1.NEWCTL]SELVAL
_DRA1:[OPT1.NEWCTL]SEREOE
_DRA1:[OPT1.NEWCTL]SETPOS
_DRA1:[OPT1.NEWCTL]SRVCNV
_DRA1:[OPT1.NEWCTL]SRVREQ
_DRA1:[OPT1.NEWCTL]VALREQ
_DRA1:[OPT1.NEWCTL]XEQHDR
_DRA1:[OPT1.NEWIO]XMIT
;       U T I L I T I E S
_DRA1:[OPT1.NEWUTL]CLRBLK
_DRA1:[OPT1.NEWUTL]CMPARE
_DRA1:[OPT1.NEWUTL]CRC
_DRA1:[OPT1.NEWUTL]CRCNIB
_DRA1:[OPT1.NEWUTL]DBLANK
_DRA1:[OPT1.NEWUTL]DFLUSH
_DRA1:[OPT1.NEWUTL]DSBKBD
_DRA1:[OPT1.NEWUTL]ENAKBD
_DRA1:[OPT1.NEWUTL]FILNIB
_DRA1:[OPT1.NEWUTL]GETNIB
_DRA1:[OPT1.NEWUTL]LSTATE
_DRA1:[OPT1.NEWUTL]MOVBIT
_DRA1:[OPT1.NEWUTL]MVLNIB
_DRA1:[OPT1.NEWUTL]MVRNIB
_DRA1:[OPT1.NEWUTL]PUTNIB
_DRA1:[OPT1.NEWUTL]RSCAN
_DRA1:[OPT1.NEWUTL]TDBITM
_DRA1:[OPT1.NEWUTL]VCALL
_DRA1:[OPT1.NEWUTL]VCALLS
;       N O N   V O L A T I L E   M E M O R Y
_DRA1:[OPT1.NEWNVM]NVM30F
_DRA1:[OPT1.NEWNVM]NVM30T
_DRA1:[OPT1.NEWNVM]NVMBYT
_DRA1:[OPT1.NEWNVM]NVMCHG
_DRA1:[OPT1.NEWNVM]NVMDED
_DRA1:[OPT1.NEWNVM]NVMDXB
_DRA1:[OPT1.NEWNVM]NVMER
_DRA1:[OPT1.NEWNVM]NVMFND
_DRA1:[OPT1.NEWNVM]NVMLOD
_DRA1:[OPT1.NEWNVM]NVMMAP
_DRA1:[OPT1.NEWNVM]NVMNBK
_DRA1:[OPT1.NEWNVM]NVMNXT
_DRA1:[OPT1.NEWNVM]NVMOPN
_DRA1:[OPT1.NEWNVM]NVMPRP
_DRA1:[OPT1.NEWNVM]NVMRD
_DRA1:[OPT1.NEWNVM]NVMSTO
_DRA1:[OPT1.NEWNVM]NVMWN
_DRA1:[OPT1.NEWNVM]NVMWR
;       V R M R S
_DRA1:[OPT1.VRMRS]ACCODE
_DRA1:[OPT1.VRMRS]BINOCT
_DRA1:[OPT1.VRMRS]VRCDR
_DRA1:[OPT1.VRMRS]VRCLR
_DRA1:[OPT1.VRMRS]VRCREC
_DRA1:[OPT1.VRMRS]VRMRS
_DRA1:[OPT1.VRMRS]VRSET
_DRA1:[OPT1.DEBUG]PATENT
;       M O T O R   S U B S Y S T E M
;_DRA1:[OPT1.DEBUG]STUB
_DRA1:[EASWARAN.CONTROL]DMOVE
_DRA1:[EASWARAN.CONTROL]ENCMOV
_DRA1:[EASWARAN.CONTROL]ENDMOV
_DRA1:[EASWARAN.CONTROL]MDSEEK
_DRA1:[EASWARAN.CONTROL]MOPEN
_DRA1:[EASWARAN.CONTROL]MOTMOV
_DRA1:[EASWARAN.CONTROL]POHOME
_DRA1:[EASWARAN.CONTROL]RENC
_DRA1:[EASWARAN.CONTROL]SETCLS
```

<<< end of assembly command string >>>

```
8080/8085 ASSEMBLER V2.0   27-OCT-1982 15:42:42.44

  1          LINES 60
  3          NLIST  M
  5      ;  ***********************************
  6      ;  ***   RAM LABEL DEFINATIONS   ***
  7      ;  ***********************************
 21  0000                +FIXSED  EQU   PTR
 26  0008                +VARSED  EQU   PTR
 31  0010                +CTLCRC  EQU   PTR
 36  0012                +RSTCNT  EQU   PTR
 41  0013                +ERRST   EQU   PTR
 46  0014                +ERRCOD  EQU   PTR
 51  0016                +ERRCNT  EQU   PTR
 56  0018                +UNLOCK  EQU   PTR
 61  001C                +LOWWRN  EQU   PTR
 66  001E                +SETLIM  EQU   PTR
 71  0020                +SERFLG  EQU   PTR
 76  0021                +SERNUM  EQU   PTR
 81  0028                +PCEREG  EQU   PTR
 86  002F                +DSCREG  EQU   PTR
 91  0036                +DSCCRC  EQU   PTR
 96  0038                +ASCREG  EQU   PTR
101  0040                +ASCCRC  EQU   PTR
106  0042                +POSREG  EQU   PTR
111  0046                +MTRCHR  EQU   PTR
116  0048                +MRSTS1  EQU   PTR
121  004A                +MRSTS2  EQU   PTR
126  004C                +NORFLG  EQU   PTR
131  004E                +KDCTRL  EQU   PTR
136  0050                +BLKTMR  EQU   PTR
141  0052                +DSPTMR  EQU   PTR
146  0054                +KEYBKT  EQU   PTR
151  0056                +CTLBKT  EQU   PTR
156  0058                +CHRBKT  EQU   PTR
161  005A                +CURBKT  EQU   PTR
166  005C                +DBCTR   EQU   PTR
171  005E                +SKPVAL  EQU   PTR
176  0060                +SKPCNT  EQU   PTR
181  0062                +TIMVEC  EQU   PTR
186  0066                +NVMCTL  EQU   PTR
191  0068                +OLDSWT  EQU   PTR
196  006A                +DIEDCM  EQU   PTR
201  006C                +DEFDCM  EQU   PTR
206  006E                +PORTBI  EQU   PTR
214  0070                +SPARE   EQU   PTR
219  0080                +DBUF    EQU   PTR
224  008C                +SPARE1  EQU   PTR
229  0090                +RECBUF  EQU   PTR
234  00A0                +XMTBUF  EQU   PTR
239  00B0                +SPARE2  EQU   PTR
244  00C0                +WORK1   EQU   PTR
249  00D0                +WORK2   EQU   PTR
254  00E0                +AMTBUF  EQU   PTR
259  00F0                +CMBBUF  EQU   PTR
265  0000                +DIMAGE  EQU   PTR
269            NLIST M
```

SYMBOL TABLES

```
272          ;                    FLAG ASSIGNMENTS

274          ; RAM                BIT
275          ; LABEL     BIT      LABEL     DESCRIPTION

277          ; Serflg    0        Dead      Unrecoverable Fatal Error
278          ;            1
279          ;             2      Weknvm    Retention qualities of NVM poor
280          ;              3     Smolck    Sernum can no longer be changed
281          ;
282          ; Mrsts1     0        Unksel    Unknown selection value
283          ;            1        Datdor    Check date warning
284          ;             2       Insfnd    Insufficient funds
285          ;              3      Lowpos    Low postage warning
286          ;               4     Sermod    In service mode
287          ;                5    Enabld    Meter enabled
288          ;                 6   Incyc     Trip mechanism in cycle
289          ;                  7  Quereq    Trip request being processed
290          ;
291          ; Mrsts2     0        Fatmod    Detected fatal error condition
292          ;            1
293          ;             2
294          ;              3
295          ;               4     Trpsw     Trip switch status
296          ;                5
297          ;                 6
298          ;                  7  Prvmod    Privileged mode set
299          ;
300          ; Norflg     0        Quests    Status is to be transmitted
301          ;            1        Quepos    Current selection is to be transmitted
302          ;             2       Cmbin     Combination entered
303          ;              3      Amtin     Amount entered
304          ;               4     Trpreq    Trip waiting to be processed
305          ;                5    Comdsb    External communications disabled
306          ;                 6   Unvsel    Selected postage not verified
307          ;                  7  Latdsb    Commanded disable (latched)
308          ;
309          ; Kdctrl     0        Stgdsp    Setting is on display
310          ;            1        Flsdsp    Flashing display
311          ;             2       Timed     Display is timed
312          ;              3
313          ;               4
314          ;                5    Flsdcm    Flashing decimal
315          ;                 6
316          ;                  7  Kbddsb    Keyboard disabled

318          ; ****************************************
319          ; ***   HARDWARE ADDRESS POINTERS   ***
320          ; ****************************************

322 7400     X        EQU   7400H  BASE ADDRESS OF RAM
323 7480     Y   EQU   7480H  BASE ADDRESS OF RAM UPPER HALF
324 7000     CTLREG   EQU   7000H  8155 CONTROL REGISTER
325 6800     DATA1    EQU   6800H  SWITCH DATA ADDRESS
326 02BE     KILCOD   EQU    2BEH  ADDRESS OF KILCODES IN NVM
327 4800     NVMWRT   EQU   4800H  WRITE ADDRESS FOR NON VOLATILE MEMORY
328 4400     NVMRED   EQU   4400H  READ ADDRESS FOR NON VOLATILE MEMORY
329 4000     NVMERS   EQU   4000H  ERASE ADDRESS FOR NON VOLATILE MEMORY
330 6800     PORT2A   EQU   DATA1
331 7001     PORTA    EQU   7001H  8155 PORT A ADDRESS
332 7002     PORTB    EQU   7002H  8155 PORT B ADDRESS
333 7003     PORTC    EQU   7003H  8155 PORT C ADDRESS
334 00FE     RETAIN   EQU    0FEH  ADDRESS OF NVM RETENTION LOCATION
335 8000     TEST     EQU   8000H  ADDRESS OF EXTERNAL TEST SOFTWARE
336 7004     TIMER    EQU   7004H  8155 TIMER DATA ADDRESS
```

```
338                 ; ********************************
339                 ; ***   P A R A M E T E R S   ***
340                 ; ********************************

342 0002            DBVAL   EQU   2      DEBOUNCE COUNT
343 0007            DSPVAL  EQU   7.     COUNT FOR 5.5 SEC TIMED DISPLAY
344 0002            KDSKIP  EQU   2      TIMER INT SKIP COUNT
345 4C96            KEYINT  EQU   (18.*179.).OR.4000H   VALUE FOR 1.8 MILLI SEC INT RATE
346 7FA1            MAXINT  EQU   (91.*179.).OR.4000H  MAX TIMER INTERVAL , 9.1 MILLI SEC
347 0080            MULKEY  EQU   80H    VALUE ASSIGNED TO MULTI KEY DEPRESSION
348 0002            NDISP   EQU   2      NO. OF DISPLAY PACKS
349 0008            DSPCHR  EQU   (NDISP*4) MAX NO. OF CHAR DISPLAYABLE
350                 ;   NON-VOLATILE MEMORY PARAMETERS
351 0000            SRVSTR   EQU   FIXSED  NIBB OFFSET FOR START OF SERVICE BLOCK IN RAM
352 0028            NORSTR   EQU   PCEREG  NIBB OFFSET FOR START OF NORMAL BLOCK IN RAM
353 0028            SRVSIZ   EQU   NORSTR-SRVSTR
354 0022            NORSIZ   EQU   MRSTS2-NORSTR


356                 ;  ***********************************************
357                 ; ***   VALUE SIZE IN NIBBLES ( DIGITS )   ***
358                 ; ***********************************************

360 0008            ASCSIZ   EQU   8     ASCENDING REGISTER
361 0007            DSCSIZ   EQU   7     DESCENDING REGISTER
362 0004            NBANKS   EQU   4     BANKS FOR POSTAGE PRINTING
363 0007            PCESIZ   EQU   7     PIECE REGISTER


365                 ; ****************************************
366                 ; ***   V A L U E   F O R M A T S   ***
367                 ; ****************************************

369                 ; FORMAT OF DATA  2 DIGITS
370                 ;    LEFT DIGIT = NO. OF DIGITS
371                 ;    RIGHT DIGIT = NO. OF DECIMAL PLACES EXCEPT
372                 ;                = F HEX  NOT DECIMAL NO ( COUNT )
373                 ;                = 0 USE NO. OF DECIMALS INDICATED BY DIEDCM

375 008F            ACCFMT  EQU   8FH    ACCESS CODE
376 0080            ASCFMT  EQU   80H    ASCENDING REG
377 0080            CSMFMT  EQU   80H    CONTROL SUM
378 005F            DIAFMT  EQU   5FH    DIAGNOSTIC STATUS
379 0070            DSCFMT  EQU   70H    DESCENDING REG
380 0040            LOKFMT  EQU   40H    UNLOCK
381 007F            MSNFMT  EQU   7FH    METER SERIAL NO
382 007F            PCEFMT  EQU   7FH    PEICE COUNT
383 0040            POSFMT  EQU  NBANKS*10H SELECTION


385                 ; ****************************************
386                 ; ***   MISSING ENTRY POINT TRAPS   ***
387                 ; ****************************************


390                 ; ********************************
391                 ; ***   FATAL ERROR CODES   ***
392                 ; ********************************

394 0002            SFTWRE   EQU   02H   DETECTED INCONSISTANT SET OF ARGUMENTS ON CALL
395 0008            TRPTIM   EQU   08H   TRIP FAILED TO COMPLETE WITHIN ALLOWED TIME
396 0009            RSTTRY   EQU   09H   EXCEEDED ALLOWED NO OF UNSUCESSFUL RESET ATTEMPTS
397 0011            BADSW    EQU   11H   DETECTED ILLOGICAL SWITCH CONDITION
398 0012            BUFOVR   EQU   12H   INFORMATION WAS OVER WRITTEN IN TRANSMIT BUF
```

```
0017        BARF     EQU   17H   UNEXPECTED INTERRUPT
0018        NINCYC   EQU   18H   CYCLE SWITCH FAILED TO INDICATE NOT HOME


            ; ***********************
            ; ***   KILL CODES   ***
            ; ***********************

            ; CODES 0 - 9 WILL RESULT IN THE METER BEING
            ;             PERMINITELY INOPERATIVE
            ; CODES A - E WILL RESULT IN CPU BEING HALTED
            ; CODE F  IS NORMAL OPERATION
0000        BADCRC   EQU    0H   DETECTED BAD CRC
0001        NVMBAD   EQU    1H   ERRASE OR WRITE TO NVM UNSUCESSFUL
0002        NVMRET   EQU    2H   READ BEFORE ERASE FAILED,  IE UNACCEPTABLE RETENTIO
0003        FATRST   EQU    3H   DESCENDING REG CLEARED WHILE FATAL MODE
0004        BADCYC   EQU    4H   UNACCEPTABLE RESPONSE FROM CYCLE SWITCH
            ;        EQU    5H   SPARE
            ;        EQU    6H   SPARE
            ;        EQU    7H   SPARE
            ;        EQU    8H   SPARE
            ;        EQU    9H   SPARE
            ;   WILL RESULT IN CPU HALTING ON POWER UP
000A        BADRAM   EQU   0AH   DETECTED BAD RAM ON POWERUP
            ;        EQU   0BH   SPARE
            ;        EQU   0CH   SPARE
            ;        EQU   0DH   SPARE
            ;        EQU   0EH   SPARE


            ; ****************************
            ; ***   MESSAGE HEADERS   ***
            ; ****************************

            ; COMMANDS
0041        HENABL  EQU   41H    ENABLE METER
0042        HDISAB  EQU   42H    DISABLE METER
0043        HENDEN  EQU   43H    END OF ENTRY
0046        HSETSV  EQU   46H    SET SERVICE MODE
0047        HCLRSV  EQU   47H    CLEAR SERVICE MODE
004E        HEXTRP  EQU   4EH    EXTERNAL TRIP
0062        HENAKB  EQU   62H    ENABLE KEYBOARD
0063        HDISKB  EQU   63H    DISABLE KEYBOARD

00C0        HSETMN  EQU   0C0H   ENTER METER SERIAL NUMBER
00C1        HSETPO  EQU   0C1H   SET POSTAGE
00C4        HSETDA  EQU   0C4H   CLEAR CHECK DATE
00C5        HENTAM  EQU   0C5H   ENTER AMOUNT
00C6        HENTCO  EQU   0C6H   ENTER COMBINATION
            ; SERVICE
            ; NAME            COMBO    AMT FMT MAX
            ; UNLOCK VALUE       0        42
            ; LOW POSTAGE WARN   1        2F
            ; SETTABLE LIMIT     2        2F

            ;REQUESTS - NORMAL MODE
0040        HREQAC  EQU   40H    ACCESSCODE REQUEST
0050        HREQST  EQU   50H    STATUS REQUEST
0051        HREQPO  EQU   51H    CURRENT SELECTION VALUE
0052        HREQAR  EQU   52H    ASCENDING REGISTER VALUE
0053        HREQDR  EQU   53H    DESCENDING REGISTER VALUE
0054        HREQCS  EQU   54H    CONTROL SUM VALUE
0055        HREQPC  EQU   55H    PEICE COUNT VALUE
005B        HREQCF  EQU   5BH    CONFIGURATION REQUEST
005C        HREQSN  EQU   5CH    SERIAL NUMBER VALUE

            ;REQUESTS - SERVICE MODE
```

```
465                 ;               50H     STATUS REQUEST
466                 ;               51H     CURRENT SELECTION VALUE
467 0052            HREQDL  EQU     52H     LOCK VALUE
468 0053            HREQLP  EQU     53H     LOW POSTAGE WARNING
469 0054            HREQMN  EQU     54H     METER SERIAL NO.
470 0055            HREQDS  EQU     55H     DIAGNOSTIC STATUS
471 0056            HREQSL  EQU     56H     SETTABLE LIMIT
472                 ;               5CH     SERIAL NUMBER VALUE
473 0000            EJEC
474                 ;VALUE HEADERS
475 0080            HSTAT   EQU     80H     METER STATUS
476 0081            HPSET   EQU     81H     POSTAGE VALUE
477 0082            HAREG   EQU     82H     ASCENDING REGISTER
478 0083            HDREG   EQU     83H     DESCENDING REGISTER
479 0084            HCSUM   EQU     84H     CONTROL SUM
480 0085            HPCNT   EQU     85H     PIECE COUNT
481 008A            HDLOCK  EQU     8AH     UNLOCK VALUE
482 008B            HLOPOS  EQU     8BH     LOW POSTAGE WARNING
483 008C            HMTRNO  EQU     8CH     METER SERIAL NUMBER
484 008D            HDIAGS  EQU     8DH     DIAGNOSTIC STATUS
485 008E            HHSLIM  EQU     8EH     SETTABLE LIMIT
486 0090            HACODE  EQU     90H     ACCESS CODE
487 00AB            HCONFG  EQU     0ABH    METER CONFIGURATION
```

VECTOR INTERRUPTS

```
490                 ;   INTERRUPT JUMP TABLE TO VECTOR INTERRUPTS TO CORRECT ENTRY POINT
491                  ORG   0
492 0000 C3 C5 01    JMP   PWRUP      RST 0  POWER ON RESET
493                  ORG   8H         RST1
494 0008 C3 A1 0B    JMP   PROERR
495                  ORG   10H        RST2
496 0010 C3 A1 0B    JMP   PROERR
497                  ORG   18H        RST3
498 0018 C3 A1 0B    JMP   PROERR
499                  ORG   20H        RST4
500 0020 C3 A1 0B    JMP   PROERR
501                  ORG   24H        TRAP  ( WATCH DOG TIMER )
502 0024 C3 7E 08    JMP   FATINT
503                  ORG   28H        RST5
504 0028 C3 A1 0B    JMP   PROERR
505                  ORG   2CH        5.5  ( POWER FAIL )
506 002C C3 7E 08    JMP   FATINT
507                  ORG   30H        RST6
508 0030 C3 A1 0B    JMP   PROERR
509                  ORG   34H        6.5
510 0034 C3 B6 01    JMP   PWRDN
511                  ORG   38H        RST7
512 0038 C3 A1 0B    JMP   PROERR
513                  ORG   3CH        7.5  ( TIMER )
514 003C C3 9D 00    JMP   INT75
515                     ORG     40H
```

CLKDEC

```
518                 ;CLKDEC/CLKDGT(KDCTRL,BLKMSK,PORTA )
519                 ;               (BITSTR,BYTE  ,BITSTR)
520                 ;               ( I    , I    , I/O  )
521                 ;               ( PSW  , B    , @HL  )
522                 ;               ( C    , NC   , C    )
523                 ;
524                 ;REGISTER A DESTROYED
525                 ;PSW DESTROYED
526                 ;
527                 ;CLOCK DECIMAL/DIGIT BITS FROM PORTA INTO DISPLAYS.
528                 ;MODIFIES BITS TO CAUSE BLINKING.
529                 ;
530                 CLKDEC;                 ****ENTRY FROM DSPLY ONLY
531 0040 EA 46 00    JPE  CLKD01           IF(KDCTRL.FLSDCM .OR. KDCTRL.FLSDSP)
```

```
532                 ;                       .EQ. TRUE
533                 ;                       MODIFY BITS WITH BLINK CONTROL MASK
534                 ;                     ENDIF
535                 ;                     PULSE CLOCK BITS
536                 ;                     RETURN
537                 CLKDGT;               ****ENTRY FROM DSPLY ONLY
538 0043 C2 49 00     JNZ  CLKD02         IF KDCTRL.FLSDSP .EQ. TRUE
539                 CLKD01;                 MODIFY BITS WITH BLINK CONTROL MASK
540 0046 7E           MOV  A,M              PORTA = PORTA .OR. BLKMSK
541 0047 B0           ORA  B
542 0048 77           MOV  M,A
543                 CLKD02;               ENDIF
544 0049 35           DCR  M              PULSE CLOCK BIT
545 004A 34           INR  M
546 004B C9           RET                 RETURN
```

DBOUNC

```
549                 ;DBOUNC()(KEYBKT,CTLBKT,CHRBKT)(DBCTR)
550                 ;        (BYTE  ,BYTE  ,BYTE  )(UBYTE)
551                 ;        ( I    , O    , O    )( I/O )
552                 ;        ( RAM  , RAM  , RAM  )( RAM )
553                 ;        ( NC   , C    , C    )( C   )
554                 ;
555                 ;REGISTERS DESTROYED
556                 ;PSW DESTROYED
557                 ;
558                 ;DEFINES DEBOUNCED KEYCODES CTLBKT AND CHRBKT FOR USE OF
559                 ;MAINLINE KEYBOARD ROUTINE.  CHRBKT DIFFERS FROM CTLBKT
560                 ;IN THAT THE MAINLINE ROUTINE MAY SET CHRBKT = 0.
561                 ;
562                 DBOUNC;               ****ENTRY FROM KDIO ONLY
563 004C 3A 2A 74    LDA  KEYBKT/2+X     A = KEYBKT
564                 ;                     DECREMENT DBOUNCE COUNTER
565 004F 21 2E 74     LXI  H,DBCTR/2+X    HL = ADDRESS, DBCTR
566 0052 35           DCR  M              DBCTR = DBCTR - 1
567                 ;                     CHECK WHETHER COUNTER WAS STOPPED AT 1
568 0053 C2 5D 00     JNZ  DBOUN1         IF DBCTR .EQ. 0
569                 ;                       KEEP COUNTER AT 1
570 0056 34           INR  M                DBCTR = 1
571                 ;                       KEYBOARD IS DEBOUNCED
572                 ;                       DEFINE NEW KEYCODE OUTPUT BUCKETS
573 0057 32 2C 74     STA  CHRBKT/2+X       CHRBKT = KEYBKT
574 005A 32 2B 74     STA  CTLBKT/2+X       CTLBKT = KEYBKT
575                 DBOUN1;               ENDIF
576                 ;                     CHECK WHETHER KEY IS  PRESSED
577 005D B7           ORA  A              IF KEYBKT .NE. HEX00
578 005E C8           RZ
579                 ;                       SET DEBOUNCE PERIOD
580 005F 36 02        MVI  M,DBVAL          DBCTR = DBVAL
581                 ;                     ENDIF
582 0061 C9           RET                 RETURN
```

DISPLY

```
585                 ;DISPLY()(KDCTRL,BLKTMR,PORTA )
586                 ;        (BITSTR,BYTE  ,BITSTR)
587                 ;        ( I    , I    , I/O  )
588                 ;        ( RAM  , RAM  , 7001 )
589                 ;        ( NC   , NC   , C    )
590                 ;
591                 ;REGISTERS DESTROYED
592                 ;PSW DESTROYED
593                 ;
594                 ;DISPLAY ROUTINE
595                 ;
596                 DISPLY;               ****ENTRY FROM KDIO ONLY
597                 ;                     FETCH DISPLAY CONTROL BYTE
598 0062 2A 27 74     LHLD KDCTRL/2+X
599                 ;                     L = KDCTRL
```

```
600                 ;                          H = BLKTMR
601 0065 5D           MOV  E,L                 E = KDCTRL
602                 ;                          DEFINE DISPLAY BLINK CONTROL MASK
603 0066 06 01        MVI  B,01H               B = BLKMSK = HEX01, FOR DISPLAY ON
604 0068 24           INR  H                   IF (BLKTMR+1) .GE. 0
605 0069 FA 72 00     JM   DISP02
606 006C 2C           INR  L                     IF KDCTRL.STGDSP .EQ. TRUE
607 006D F2 72 00     JP   DISP01
608 0070 06 0F        MVI  B,0FH                   B = BLKMSK = HEX0F, FOR DISPLAY OFF
609                 DISP01;                      ENDIF
610                 DISP02;                    ENDIF
611                 ;                          OUTPUT START BITS FOR DISPLAY LOAD
612 0072 21 01 70     LXI  H,PORTA             HL = ADDRESS, PORTA
613 0075 7E           MOV  A,M                 PORTA = PORTA.AND.HEXF1, 3 START BITS
614 0076 E6 F1        ANI  0F1H
615 0078 77           MOV  M,A
616 0079 35           DCR  M                   PULSE CLOCK BIT
617 007A 34           INR  M
618                 ;                          SET TO LOAD 4 DIGITS INTO EACH DISPLAY
619 007B 0E 04        MVI  C,4                 C = CHRCNT = 4
620                 DISP03;                    DO UNTIL CHRCNT .EQ. 0
621                 ;                            DEFINE BIT SELECTION MASK
622 007D 16 80        MVI  D,80H                 D = BITMSK = HEX80
623                 DISP04;                      DO UNTIL BITMSK .EQ. HEX01
624                 ;                              MOVE DIGIT BITS FROM DIMAGE TO
625                 ;                              PORTA
626 007F CD DE 00     CALL MVDDAT                  MVDDAT(CHRCNT,BITMSK,KDCTRL,PORTA,
627                 ;                                    ( C    , D    , E    , @HL ,
628                 ;                                    ( I    , I    , I    , I/O ,
629                 ;
630                 ;                                    KDCTRL)
631                 ;                                     PSW  )
632                 ;                                     0    )
633                 ;                              CLOCK OUT DIGIT BITS
634 0082 CD 43 00     CALL CLKDGT                  CLKDGT(KDCTRL,BLKMSK,PORTA )
635                 ;                                    ( PSW  , B    , @HL  )
636                 ;                                    ( I    , I    , I/O  )
637                 ;                              SHIFT BIT SELECTION MASK TO RIGHT
638 0085 7A           MOV  A,D                     D = BITMSK = BITMSK/2
639 0086 0F           RRC
640 0087 57           MOV  D,A
641 0088 1F           RAR                          TEST BITMSK
642 0089 D2 7F 00     JNC  DISP04
643                 ;                            ENDDO
644                 ;                            MOVE DECIMAL BITS FROM DIMAGE TO
645                 ;                            PORTA
646 008C CD DE 00     CALL MVDDAT                MVDDAT(CHRCNT,BITMSK,KDCTRL,PORTA,
647                 ;                                  ( C    , D    , E    , @HL ,
648                 ;                                  ( I    , I    , I    , I/O ,
649                 ;
650                 ;                                  KDCTRL)
651                 ;                                   PSW  )
652                 ;                                   0    )
653                 ;                            CLOCK OUT DECIMAL BITS
654 008F CD 40 00     CALL CLKDEC                CLKDEC(KDCTRL,BLKMSK,PORTA)
655                 ;                                  ( PSW  , B    , @HL )
656                 ;                                  ( I    , I    , I/O )
657 0092 0D           DCR  C                     C = CHRCNT = CHRCNT-1
658 0093 C2 7D 00     JNZ DISP03
659                 ;                          ENDDO
660 0096 35           DCR  M                   3 CLOCK CYCLES TO FINISH LOAD
661 0097 34           INR  M
662 0098 35           DCR  M
663 0099 34           INR  M
664 009A 35           DCR  M
665 009B 34           INR  M
666 009C C9           RET                      RETURN
```

INT75

```
669                 ;INT75
670                 ;
671                 ;SERVICE INTERRUPT 7.5
672                 ;
673                 INT75;                  ****INTERRUPT ENTRY 7.5
674 009D E5           PUSH H                SAVE HL
675 009E 21 7C 01     LXI  H,TIMINT         HL = ADRESS = ADDRESS, TIMINT
676 00A1 CD 25 10     CALL VCALLS           VCALLS(ADRESS)
677                 ;                             ( HL    )
678                 ;                             ( I     )
679 00A4 E1           POP  H                RESTORE HL
680 00A5 FB           EI                    ENABLE INTERRUPTS
681 00A6 C9           RET                   RETURN
```

KDIO

```
684                 ;KDIO()(KDCTRL,PORTBI,PORTB ,BLKTMR,DSPTMR,KEYBKT)
685                 ;      (BITSTR,BITSTR,BITSTR,BYTE  ,UBYTE ,BITSTR)
686                 ;      ( I    , I    , I/O  , I/O  , I/O  , O    )
687                 ;      ( RAM  , RAM  , 7002 , RAM  , RAM  , RAM  )
688                 ;      ( NC   , NC   , C    , C    , C    , C    )
689                 ;
690                 ;REGISTERS DESTROYED
691                 ;PSW DESTROYED
692                 ;
693                 ;KEYBOARD/DISPLAY I/O ROUTINE MAKES REAL TIME ASPECTS OF
694                 ;KEYBOARD/DISPLAY PROCESSING INVISIBLE TO APPLICATION
695                 ;LEVEL ROUTINES.
696                 ;
697                 KDIO;                   ****ENTRY FROM TIMINT ONLY
698                 ;                       INCREMENT CONTINUOUS RUN BLINK TIMER
699 00A7 21 28 74    LXI  H,BLKTMR/2+X     HL = ADDRESS, BLKTMR
700 00AA 34           INR  M                BLKTMR = BLKTMR+1
701 00AB 5E           MOV  E,M              E = BLKTMR
702 00AC C2 B7 00     JNZ  KDIO02           IF BLKTMR .EQ. 0
703                 ;                         DECREMENT TIMED DISPLAY TIMER. 1=STOP
704 00AF 21 29 74     LXI  H,DSPTMR/2+X       HL = ADDRESS, DSPTMR
705 00B2 35           DCR  M                  DSPTMR = DSPTMR-1
706 00B3 C2 B7 00     JNZ  KDIO01             IF DSPTMR .EQ. 0
707 00B6 34           INR  M                    DSPTMR = 1
708                 KDIO01;                   ENDIF
709                 KDIO02;                 ENDIF
710                 ;                       TOGGLE MOTOR FOR HALF POWER HOLD
711 00B7 3A 37 74     LDA  PORTBI/2+X       A = PORTBI
712 00BA 21 02 70     LXI  H,PORTB          HL = ADDRESS, PORTB
713 00BD AE           XRA  M                PORTB = PORTB .XOR. PORTBI
714 00BE 77           MOV  M,A
715                 ;                       DEFINE PROGRAM CONTROL COUNTER
716 00BF 7B           MOV  A,E              E = IOCTR = BLKTMR .AND. HEX07
717 00C0 E6 07        ANI  07H
718 00C2 5F           MOV  E,A
719                 ;                       CASE (IOCTR)
720 00C3 FE 05        CPI  5
721 00C5 D2 D0 00     JNC  KDIO03
722                 ;                         **0,1,2,3,4: READ KEYROWS
723 00C8 3A 27 74     LDA  KDCTRL/2+X           IF KDCTRL.KBDDSB .EQ. FALSE
724 00CB 1F           RAR
725                 ;                             KEYBOARD IS NOT DISABLED
726 00CC D2 0A 01     JNC  RDROW                    RDROW(IOCTR)
727                 ;                                   ( E    )
728                 ;                                   ( I    )
729                 ;                           ENDIF
730 00CF C9           RET
731                 KDIO03;
732 00D0 C0           RNZ                     **5: START KEYBOARD/DISPLAY OUTPUT
733 00D1 CD 4C 00     CALL DBOUNC               DEBOUNCE KEYBOARD
734                 ;                           INITIALIZE FOR NEXT KEYBOARD SCAN
735 00D4 AF           XRA  A                    KEYBKT = 0
```

```
736 00D5 32 2A 74   STA  KEYBKT/2+X
737 00D8 CD F6 0E   CALL DFLUSH          FLUSH NOISE FROM DISPLAY SHIFT REG
738 00DB C3 62 00   JMP  DISPLY          OUTPUT TO DISPLAY
739                ;                    **ELSE:
740                ;                      COMPLETE PROCESSING INITIATED
741                ;                      IN CASE **5:. THIS INTERRUPT LEVEL
742                ;                      ROUTINE IS ITSELF INTERRUPTED.
743                ;                   ENDCASE
744                ;                   RETURN

MVDDAT

747                ;MVDDAT(CHRCNT,BITMSK,KDCTRL,PORTA ,KDCTRL)(DIMAGE)
748                ;      (BYTE  ,BYTE  ,BITSTR,BITSTR,BITSTR)(BYTSTR)
749                ;      ( I    , I    , I    , I/O  , O    )( I    )
750                ;      ( C    , D    , E    , @HL  , PSW  )( RAM  )
751                ;      ( NC   , NC   , NC   , C    , C    )( NC   )
752                ;
753                ;REGISTER A DESTROYED
754                ;PSW DESTROYED
755                ;
756                ;FETCH SELECTED BITS FROM DIMAGE, INVERT THEM,
757                ;AND MOVE THEM TO PORTA.
758                ;COPY KDCTRL INTO PSW FOR LATER USE
759                ;
760                MVDDAT;              ****ENTRY FROM DSPLY ONLY
761 00DE C5          PUSH B             SAVE REGISTERS
762 00DF E5          PUSH H
763                ;                    SET DATA AND CLOCK BITS
764 00E0 7E          MOV  A,M           PORTA = PORTA .OR. HEXOF
765 00E1 F6 0F       ORI  0FH
766 00E3 77          MOV  M,A
767                ;                    DEFINE INVERTED OUTPUT BIT FOR PORTA
768 00E4 06 FD       MVI  B,0FDH        B = OUTBIT = HEXFD
769                ;                    CALCULATE INDEX
770 00E6 3E 04       MVI  A,4           A = INDEX = 4-CHRCNT
771 00E8 91          SUB  C
772                ;                    SET TO MOVE 1 BIT INTO EACH DISPLAY
773 00E9 0E 02       MVI  C,NDISP       C = BITCTR = NDISP
774                ;                    HL = ADDRESS,
775                ;                    DIMAGE[INDEX+(NDISP-BITCTR)*4]
776 00EB 21 80 74    LXI  H,DIMAGE/2+Y
777 00EE 85          ADD  L
778 00EF 6F          MOV  L,A
779                MVDD01;              DO UNTIL BITCTR .EQ. 0
780 00F0 7E          MOV  A,M             IF(DIMAGE[INDEX+(NDISP-BITCTR)*4]
781                ;                        .AND. BITMSK) .NE. 0
782 00F1 A2          ANA  D
783 00F2 CA FA 00    JZ   MVDD02
784                ;                        PUT OUTBIT INTO PORTA
785 00F5 E3          XTHL                     HL = ADDRESS, PORTA
786 00F6 7E          MOV  A,M                 PORTA = PORTA .AND. OUTBIT
787 00F7 A0          ANA  B
788 00F8 77          MOV  M,A
789 00F9 E3          XTHL                     HL = ADDRESS,
790                ;                          DIMAGE[INDEX+(NDISP-BITCTR)*4]
791                MVDD02;                ENDIF
792                ;                      SHIFT OUTBIT TO LEFT
793 00FA 78          MOV  A,B             B = OUTBIT = OUTBIT*2+1
794 00FB 07          RLC
795 00FC 47          MOV  B,A
796 00FD 0D          DCR  C               C = BITCTR = BITCTR-1
797                ;                      HL = ADDRESS,
798                ;                      DIMAGE[INDEX+(NDISP-BITCTR)*4]
799 00FE 23          INX  H
800 00FF 23          INX  H
801 0100 23          INX  H
802 0101 23          INX  H
803 0102 C2 F0 00    JNZ  MVDD01          TEST BITCTR
```

```
804                 ;                       ENDDO
805 0105 E1           POP  H                RESTORE REGISTERS
806 0106 C1           POP  B
807                 ;                       SET PSW FOR CALL TO CLKDEC/CLKDAT
808 0107 D5           PUSH D                PSW = KDCTRL
809 0108 F1           POP  PSW
810 0109 C9           RET                   RETURN
```

RDROW

```
813                 ;RDROW(IOCTR )(PORTA ,PORTC ,KEYBKT)
814                 ;     ( MOD8 )(BITSTR,BITSTR,NIBSTR)
815                 ;     ( I    )( I/O  , I    , I/O  )
816                 ;     ( E    )( 7001 , 7002 , RAM  )
817                 ;     ( C    )( C    , NC   , C    )
818                 ;
819                 ;REGISTERS DESTROYED
820                 ;STATUS DESTROYED
821                 ;
822                 ;READS THE KEYROWS DESIGNATED BY IOCTR.  CONSOLIDATES
823                 ;DATA AS THE SCAN OF 5 KEYROWS PROGRESSES.  OUTPUTS
824                 ;CODES TO KEYBKT INDICATING WHICH KEY, OR WHETHER NO
825                 ;SINGLE KEY IS DOWN.
826                 ;
827                 RDROW;                  ****ENTRY FROM KDIO ONLY
828                 ;                       FORM STROBE MASK
829 010A 7B           MOV  A,E              B = STRMSK = (2*IOCTR) .XOR. HEXFF
830 010B 07           RLC
831 010C 2F           CMA
832 010D 47           MOV  B,A
833                 ;                       FORM ROW CODE
834 010E 2F           CMA                   C = ROWCOD = IOCTR*HEX10
835 010F 07           RLC
836 0110 07           RLC
837 0111 07           RLC
838 0112 4F           MOV  C,A
839                 ;                       STROBE KEYROW
840 0113 21 01 70     LXI  H,PORTA          HL = ADDRESS, PORTA
841 0116 7E           MOV  A,M              PORTA =
842                 ;                       PORTA .OR. HEX0F .AND. STRMSK
843 0117 F6 0F        ORI  0FH
844 0119 A0           ANA  B
845 011A 77           MOV  M,A
846                 ;                       READ POSITIVE LOGIC IMAGE OF KEYROW
847 011B 3A 03 70     LDA  PORTC            A = COLCOD = PORTC .AND. HEX0F
848 011E E6 0F        ANI  0FH
849 0120 C8           RZ                    IF COLCOD .NE. 0
850                 ;                         A KEY IN CURRENT ROW IS DOWN
851 0121 21 2A 74     LXI  H,KEYBKT/2+X       HL = ADDRESS, KEYBKT
852 0124 34           INR  M                  PSW:Z = NOPREV = KEYBKT .EQ. 0
853 0125 35           DCR  M
854                 ;                         ASSUME MULTIPLE KEYS DOWN
855 0126 36 80        MVI  M,MULKEY           KEYBKT = MULKEY
856 0128 C0           RNZ                     IF NOPREV .EQ. TRUE
857                 ;                           NO KEY SEEN IN PREVIOUS ROW
858 0129 FE 09        CPI  9                      IF COLCOD .LT. 9
859 012B D0           RNC
860                 ;                               COL CODE VALUES 1 THRU 8 REMAIN
861 012C B7           ORA  A                          PSW:P = PARITY, COLCOD
862 012D E8           RPE                             IF PARITY .EQ. ODD
863                 ;                                   COL CODES 1,2,4,7,8 REMAIN
864 012E FE 07        CPI  7                              IF COLCOD .NE. 7
865 0130 C8           RZ
866                 ;                                       A SINGLE KEY IN ROW IS DOWN
867 0131 B1           ORA  C                                  KEYBKT = ROWCOD .OR. COLCOD
868 0132 77           MOV  M,A
869                 ;                                   ENDIF
```

```
870                 ;                          ENDIF
871                 ;                        ENDIF
872                 ;                      ENDIF
873                 ;                    ENDIF
874 0133 C9           RET                RETURN

STPTMR

877                 ;STPTMR(WASOFF)(PORTBI,PORTB ,SKPCNT,CTLREG)
878                 ;      (BIT   )(BITSTR,BITSTR,UBYTE ,TIMCTL)
879                 ;      ( 0    )( I    , 0    , 0    , 0    )
880                 ;      (PSW:Z )(RAM   ,7002  ,RAM   ,7000  )
881                 ;      ( C    )( NC   , C    , C    , C    )
882                 ;
883                 ;PSW:CY = NO CHANGE
884                 ;PSW:S, Z, P CHANGED; CORRESPOND TO SKPCNT AT ENTRY
885                 ;
886                 ;STOP INTERRUPT TIMER
887                 ;
888                 STPTMR;              ****ENTRY POINT
889 0134 E5           PUSH H             SAVE HL
890                 ;                    INDICATE TIMER STATUS AT ENTRY
891 0135 2A 30 74     LHLD SKPCNT/2+X    L = SKPCNT
892 0138 2C           INR  L             PSW:Z = WASOFF = SKPCNT .EQ. 0
893 0139 2D           DCR  L
894 013A E1           POP  H             RESTORE HL
895 013B F5           PUSH PSW           SAVE A, PSW:CY, WASOFF
896                 ;                    CHECK FOR RUNNING TIMER
897 013C CA 51 01     JZ   STPTM1        IF WASOFF .EQ. FALSE
898 013F 3E 43        MVI  A,43H           STOP TIMER
899 0141 32 00 70     STA  CTLREG
900                 ;                      DISABLE TIMER INTERRUPT
901 0144 3E 0D        MVI  A,0DH           A = HEX0D
902 0146 30           SIM
903                 ;                      INDICATE THAT TIMER IS STOPPED
904 0147 AF           XRA  A               SKPCNT = 0
905 0148 32 30 74     STA  SKPCNT/2+X
906                 ;                      HOLD DIGIT MOTOR IN POSITION
907 014B 3A 37 74     LDA  PORTBI/2+X      PORTB = PORTBI
908 014E 32 02 70     STA  PORTB
909                 STPTM1;              ENDIF
910 0151 F1           POP  PSW           RESTORE A, PSW:CY
911                 ;                    PSW:Z = WASOFF
912 0152 C9           RET                RETURN
915                 ;STRTMR(ISADR,SKIPCT,PERIOD,WASOFF)(TIMER ,SKPCNT,SKPVAL,
916                 ;      (ADDR ,UBYTE ,TMODCT,BIT   )(TMODCT,UBYTE ,UBYTE ,
917                 ;      ( I   , I    , I    , 0    )( 0    , 0    , 0    ,
918                 ;      ( HL  , A    , DE   , PSW:Z)(7004  , RAM  , RAM  ,
919                 ;      ( NC  , NC   , NC   , C    )( C    , C    , C    ,
920                 ;
921                 ;      TIMVEC,CTLREG,PORTB ,PORTBI)
922                 ;      ADDR  ,TIMCTL,BYTE  ,BYTE  )
923                 ;       0    , 0    , I    , 0    )
924                 ;      RAM   ,7000  ,7002  , RAM  )
925                 ;       C    , C    , NC   , C    )
926                 ;
927                 ;PSW:CY = NO CHANGE
928                 ;PSW:S, Z, P CHANGED; CORRESPOND TO SKPCNT AT ENTRY
929                 ;
930                 ;STARTS TIMER INTERRUPTS AFTER DEFINING INFORMATION NEEDED
931                 ;BY TIMINT.  ISADR IS ADDRESS OF INTERRUPT SERVICE RTN
932                 ;WHICH WILL BE ENTERED EVERY SKIPCT(TH) OCCURRENCE OF
933                 ;INTERRUPT.
934                 ;PERIOD WILL CONTAIN THE PARAMETER VALUE KEYINT.
935                 ;
936                 STRTMR;              ****ENTRY POINT
937 0153 E5           PUSH H             SAVE HL
938                 ;                    INDICATE TIMER STATUS AT ENTRY
939 0154 2A 30 74     LHLD SKPCNT/2+X    L = SKPCNT
```

```
940 0157 2C          INR  L            PSW:Z = WASOFF = SKPCNT .EQ. 0
941 0158 2D          DCR  L
942 0159 E1          POP  H            RESTORE HL
943 015A F5          PUSH PSW          SAVE A, PSW:CY, WASOFF
944                ;                   CHECK FOR STOPPED TIMER
945 015B C2 7A 01    JNZ  STRTM1       IF WASOFF .EQ. TRUE
946                ;                     SET TIMER MODE AND COUNT
947 015E EB          XCHG                HL = PERIOD
948                ;                     DE = ISADR
949 015F 22 04 70    SHLD TIMER          TIMER = PERIOD
950 0162 EB          XCHG                HL = ISADR
951                ;                     DE = PERIOD
952                ;                     INITIALIZE SKIP COUNTER
953 0163 32 30 74    STA  SKPCNT/2+X     SKPCNT = SKIPCT
954                ;                     SET REINITIALIZATION VALUE
955 0166 32 2F 74    STA  SKPVAL/2+X     SKPVAL = SKIPCT
956                ;                     SET INTERRUPT SERVICE ROUTINE ADDR
957 0169 22 31 74    SHLD TIMVEC/2+X     TIMVEC = ISADR
958 016C 3E 19       MVI  A,19H          RESET AND ENABLE TIMER INTERRUPT
959 016E 30          SIM
960 016F 3E C3       MVI  A,0C3H         START TIMER
961 0171 32 00 70    STA  CTLREG
962                ;                     UPDATE IMAGE OF PORTB
963 0174 3A 02 70    LDA  PORTB          PORTBI = PORTB
964 0177 32 37 74    STA  PORTBI/2+X
965               STRTM1;              ENDIF
966 017A F1          POP  PSW          RESTORE A, PSW:CY
967                ;                   PSW:Z = WASOFF
968 017B C9          RET               RETURN
```

TIMINT

```
971                ;TIMINT()(SKPCNT,SKPVAL,TIMVEC)
972                ;        (UBYTE ,UBYTE ,ADDR  )
973                ;        ( I/O  , I    , I    )
974                ;        ( RAM  , RAM  , RAM  )
975                ;        ( C    , NC   , NC   )
976                ;
977                ;PSW:S, Z, P, CY CHANGED
978                ;
979                ;DETERMINE WHETHER IT IS TIME TO TRANSFER CONTROL
980                ;TO CURRENTLY ACTIVE INTERRUPT SERVICE ROUTINE.
981                ;
982               TIMINT;              ****ENTRY FROM INT75 ONLY
983 017C CD C7 0B    CALL RECEVE       TRY TO RECEIVE MESSAGE
984                ;                   DECREMENT SKIP COUNTER
985 017F 21 30 74    LXI  H,SKPCNT/2+X HL = ADDRESS, SKPCNT
986 0182 35          DCR  M            SKPCNT = SKPCNT-1
987                ;                   CHECK FOR COMPLETED COUNTDOWN
988 0183 C0          RNZ               IF SKPCNT .EQ. 0
989                ;                     REINITIALIZE SKIP COUNTER
990 0184 3A 2F 74    LDA  SKPVAL/2+X     A = SKPVAL
991 0187 77          MOV  M,A            SKPCNT = SKPVAL
992 0188 FB          EI                  ENABLE INTERRUPT
993                ;                     PERFORM CURRENT INTRPT SERVICE RTN
994 0189 2A 31 74    LHLD TIMVEC/2+X     HL = ADRESS = TIMVEC
995 018C E9          PCHL
996                ;                   ENDIF
997                ;                   RETURN
```

PWRABN

```
1000               ;PWRABN
1001               ;
1002               ;A,PSW DESTROYED
1003               ;REGISTERS DESTROYED
1004               ;
1005               ;ABNORMAL POWER-UP OF METER WHICH POWERED DOWN DURING
1006               ;SETTING OR TRIP CYCLE
1007               ;
```

```
1008                PWRABN;                 ****ENTRY POINT
1009 018D 3A 24 74    LDA  MRSTS1/2+X       IF MRSTS1.QUEREG .EQ. TRUE
1010 0190 1F          RAR
1011 0191 D2 AA 01    JNC  PWRAB2
1012                ;                         POWERED DOWN DURING TRIP
1013 0194 1F          RAR                     IF MRSTS1.INCYC .EQ. FALSE
1014 0195 DA A7 01    JC   PWRAB1
1015                ;                           ACCOUNTING NOT COMPLETED
1016 0198 CD 71 18    CALL SEKTRP               PREPARE TO TRIP
1017 019B F3          DI                        DISABLE INTERRUPTS
1018 019C CD 44 07    CALL DOACCT               DO ACCOUNTING
1019                ;                           INDICATE ACCOUNTING COMPLETE
1020 019F 21 24 74    LXI  H,MRSTS1/2+X         HL = ADDRESS, MRSTS1
1021 01A2 7E          MOV  A,M                  MRSTS1.INCYC = TRUE
1022 01A3 F6 02       ORI  2
1023 01A5 77          MOV  M,A
1024 01A6 FB          EI                        ENABLE INTERRUPTS
1025                PWRAB1;                   ENDIF
1026 01A7 C3 A0 08    JMP  FINTRP               COMPLETE TRIP CYCLE
1027                PWRAB2;                 ENDIF
1028                ;                       TRIP CYCLE COMPLETE
1029                ;                       PREPARE TO ZERO SET METER
1030 01AA CD 4E 0F    CALL LSTATE             LSTATE(FATMOD,NORMOD,SERMOD,PRVMOD)
1031                ;                             (PSW:S ,PSW:Z ,PSW:P ,PSW:CY)
1032                ;                             ( 0    , 0    , 0    , 0    )
1033 01AD F8          RM                      IF FATMOD .NE. TRUE
1034                ;                         METER IS HOME AND NOT DEAD
1035                ;                         DRIVE METER TO ZERO SETTING
1036 01AE CD 25 16    CALL SEKPOS             SEKPOS(ERROR)
1037                ;                                ( A   )
1038                ;                                ( 0   )
1039 01B1 B7          ORA  A                  IF ERROR .NE. 0
1040                ;                           DECLARE FATAL ERROR
1041 01B2 C2 80 08    JNZ  FATERR               FATERR(ERROR,ERRFLG)
1042                ;                                 ( A   ,PSW:Z )
1043                ;                                 ( I   , 0    )
1044                ;                         ENDIF
1045                ;                       ENDIF
1046 01B5 C9          RET                     RETURN
```

PWRDN/PWRUP

```
1049                ;PWRDN/PWRUP
1050                ;
1051                ;A,PSW DESTROYED
1052                ;REGISTERS DESTROYED
1053                ;
1054                ;ENFORCE ORDERLY POWER-UP AND POWER-DOWN
1055                ;
1056                PWRDN;                  ****ENTRY POINT
1057 01B6 F3          DI                    DISABLE INTERRUPTS
1058                ;                       TURN OFF DEVICES ON PORTA AND PORTB
1059 01B7 AF          XRA  A                PORTB = HEX00
1060 01B8 32 02 70    STA  PORTB
1061 01BB 3D          DCR  A                PORTA = HEXFF
1062 01BC 32 01 70    STA  PORTA
1063 01BF CD DE 0E    CALL DBLANK           CLEAR DISPLAY
1064                ;                       WRITE AND CLOSE ANY OPEN BLOCK
1065 01C2 CD 9E 12    CALL NVMWR            NVMWR(ERRFLG)
1066                ;                             (PSW:Z )
1067                ;                             ( 0    )
1068                PWRUP;                  ****ENTRY POINT
1069                PWRU01;                 DO UNTIL INT6.5 .EQ. 0
1070 01C5 20          RIM
1071 01C6 07          RLC
1072 01C7 07          RLC
1073 01C8 07          RLC                     PSW:CY = INT6.5
1074                ;                         A.0  = INT5.5
1075 01C9 DA C5 01    JC   PWRU01
1076                ;                       ENDDO
1077                ;                       POWER IS NOW FULLY ON
```

```
1078 01CC B7          ORA  A              PSW:S = INT5.5
1079                ;                     IF INT5.5 .EQ. TRUE
1080 01CD FA 00 80    JM   TEST             GO TO SPECIAL SERVICE ROUTINE
1081                ;                     ENDIF
1082                ; >>OMITTED<<         PULSE DEAD STICK TIMER
1083                ;                     INITIALIZE STACK POINTER
1084 01D0 31 00 75    LXI  SP,7500H       SP = HEX7500
1085                ;                     INITIALIZE 8155 TIMER AND PORTS
1086 01D3 3E 43       MVI  A,043H         CTLREG = HEX43
1087 01D5 32 00 70    STA  CTLREG
1088                ;                     TIMER SET FOR REPETITIVE SQUARE WAVE
1089                ;                     PORTA = PORTB = 0; OUTPUT MODE SET
1090                ;                     PORTC; INPUT MODE SET
1091 01D8 3E FF       MVI  A,0FFH         PORTA = HEXFF
1092 01DA 32 01 70    STA  PORTA
1093                ;                     TEST AND CLEAR ALL OF RAM
1094                ;                     FILL 256 BYTES OF RAM WITH HEXAA
1095 01DD 06 AA       MVI  B,0AAH         B = HEXAA
1096 01DF 21 00 74    LXI  H,X            HL = ADDRESS, X(I=0)
1097                PWRU02;               DO UNTIL (ADDR,X(I)) .EQ. (ADDR,X(0))
1098 01E2 70          MOV  M,B              X(I) = HEXAA
1099 01E3 2C          INR  L                HL = ADDRESS, X(I=I+1)
1100 01E4 C2 E2 01    JNZ  PWRU02
1101                ;                     ENDDO
1102                ;                     XOR 256 BYTES OF RAM WITH HEX55
1103 01E7 06 55       MVI  B,55H          B = HEX55
1104                PWRU03;               DO UNTIL (ADDR,X(I)) .EQ. (ADDR,X(0))
1105 01E9 7E          MOV  A,M              X(I) = X(I) .XOR. HEX55
1106 01EA A8          XRA  B
1107 01EB 77          MOV  M,A
1108 01EC 2C          INR  L                HL = ADDRESS, X(I=I+1)
1109 01ED C2 E9 01    JNZ  PWRU03
1110                ;                     ENDDO
1111 01F0 3E 0A       MVI  A,BADRAM       A = BADRAM
1112                ;                     INCREMENT AND TEST 256 BYTES OF RAM
1113                PWRU04;               DO UNTIL (ADDR,X(I)) .EQ. (ADDR,X(0))
1114 01F2 34          INR  M                X(I) = X(I)+1
1115 01F3 CA FC 01    JZ   PWRU05           IF X(I) .NE. 0
1116                ;                       DECLARE DEAD METER. BAD RAM
1117 01F6 CD 85 10    CALL NVMDED             NVMDED(BADRAM,ERRFLG)
1118                ;                                ( A    ,PSW:Z )
1119                ;                                ( I    , 0    )
1120 01F9 C3 00 02    JMP  PWRU06             BREAK
1121                PWRU05;                 ENDIF
1122 01FC 2C          INR  L                HL = ADDRESS, X(I=I+1)
1123 01FD C2 F2 01    JNZ  PWRU04
1124                PWRU06;               ENDDO
1125                ;                     READ SPECIAL NVM LOCATION
1126 0200 3A BE 46    LDA  NVMRED+KILCOD A = NVMRED[KILCOD]
1127 0203 3C          INR  A              IF (A .GE. 10).AND.(A .LT. 15) = TRUE
1128 0204 E6 0F       ANI  0FH
1129 0206 FE 0B       CPI  11
1130 0208 DA 0C 02    JC   PWRU07
1131                ;                       METER IS OUT OF SERVICE
1132 020B 76          HLT                     HALT
1133                PWRU07;               ENDIF
1134 020C CD 6D 15    CALL INITSM         INITIALIZE STEPPER MOTORS
1135                ;                     FILL NVM DATA AREA WITH HEXFF
1136 020F 01 00 48    LXI  B,((MTRCHR+1)-(FIXSED+0)+1)X100H+(FIXSED+0)
1137                ;                     B = NIBCNT; NVM DATA AREA
1138                ;                     C = OFFSET, FIXSED[0]
1139 0212 3E FF       MVI  A,0FFH         A = HEXFF
1140 0214 CD 24 0F    CALL FILNIB         FILNIB(FIXSED[0],HEXFF,NIBCNT)
1141                ;                           ( @C      , A   , B    )
1142                ;                           ( 0       , I   , I    )
1143                ;                     CLEAR DISPLAY IMAGE
1144 0217 AF          XRA  A              A = HEX00
1145 0218 CD 22 03    CALL FILDIM         FILDIM(HEX00)
1146                ;                           ( A   )
1147                ;                           ( I   )
```

```
1148                ;                          ENABLE INTERRUPT 6.5
1149 021B 3E 0D       MVI  A,0DH               INTMSK = HEX0D
1150 021D 30          SIM
1151 021E CD 6B 11    CALL NVMLOD              LOAD AND CHECK NON VOLATILE MEMORY
1152                ;                          CHECK METER STATUS
1153 0221 CD 4E 0F    CALL LSTATE              LSTATE(FATMOD,NORMOD,SERMOD,PRVMOD)
1154                ;                                (PSW:S ,PSW:Z ,PSW:P ,PSW:CY)
1155                ;                                ( 0    , 0    , 0    , 0    )
1156 0224 FA 45 02    JM   PWRU09              IF FATMOD .EQ. FALSE
1157                ;                            NVM LOADED OK
1158                ;                            DEFINE DECIMAL POSITIONS ON DIE
1159 0227 3A 23 74    LDA  MTRCHR/2+X            A = MTRCHR
1160 022A E6 03       ANI  3                     DIEDCM = MTRCHR .AND. HEX03
1161 022C 32 35 74    STA  DIEDCM/2+X
1162                ;                            DEFINE DEFAULT DECIMAL POSITION
```

PWRDN/PWRUP

```
1163 022F E6 02       ANI  2                     DEFDCM = DIEDCM .AND. HEX02
1164 0231 32 36 74    STA  DEFDCM/2+X
1165                ;                            CHECK NVM STATUS
1166 0234 21 45 02    LXI  H,PWRU08              SET TO RETURN TO ENDIF
1167 0237 E5          PUSH H
1168 0238 3A BE 46    LDA  NVMRED+KILCOD         A = CODE = NVMRED[KILCOD]
1169 023B E6 0F       ANI  0FH
1170 023D FE 0F       CPI  0FH                   IF NVMRED[KILCOD] .EQ. HEX0F
1171 023F CA 9B 02    JZ   PWRUOK                  CONTINUE NORMAL INITIALIZATION
1172                ;                            ELSE
1173                ;                              CONTINUE FATAL INITIALIZATION
1174 0242 C2 83 02    JNZ  PWRUNG                  PWRUNG(CODE)
1175                ;                                     ( A  )
1176                ;                                     ( I  )
1177                PWRU08;                      ENDIF
1178                PWRU09;                    ENDIF
1179                ;                          RECHECK METER STATUS
1180 0245 CD 4E 0F    CALL LSTATE              LSTATE(FATMOD,NORMOD,SERMOD,PRVMOD)
1181                ;                                (PSW:S ,PSW:Z ,PSW:P ,PSW:CY)
1182                ;                                ( 0    , 0    , 0    , 0    )
1183 0248 F2 50 02    JP   PWRU10              IF FATMOD .EQ. TRUE
1184                ;                            TURN ON SENSOR LEDS FOR SERVICE CHECK
1185 024B 3E DF       MVI  A,0DFH                PORTA = HEXDF
1186 024D 32 01 70    STA  PORTA
1187                PWRU10;                    ENDIF
1188                ;                          INITIALIZE DEBOUNCE COUNTER
1189 0250 3E 01       MVI  A,1                 DBCTR = 1
1190 0252 32 2E 74    STA DBCTR/2+X
1191 0255 C3 7E 09    JMP  IDLE                ENTER IDLE STATE
```

PWRNOR

```
1194                ;PWRNOR
1195                ;
1196                ;A,PSW DESTROYED
1197                ;REGISTERS DESTROYED
1198                ;
1199                ;CONTINUE POWER-UP FOR NORMAL SITUATION THAT POWER-DOWN
1200                ;OCCURRED WHEN METER WAS HOME
1201                ;
1202                PWRNOR;                    ****ENTRY POINT
1203                ;                          SET METER TO ALL NINES
1204 0258 21 24 74    LXI  H,MRSTS1/2+X        HL = ADDRESS, MRSTS1
1205 025B 7E          MOV  A,M                 MRSTS1.UNKSEL = TRUE
1206 025C F6 80       ORI  80H
1207 025E 77          MOV  M,A
1208 025F 01 CC 04    LXI  B,NBANKS*100H+(WORK1+16-NBANKS)
1209                ;                          B = NIBCNT = NBANKS
1210                ;                          C = OFFSET, WORK1[I=16-NBANKS]
1211 0262 3E 09       MVI  A,9                 A = HEX09
1212 0264 CD 24 0F    CALL FILNIB              FILNIB(WORK1[I],HEX09,NIBCNT)
1213                ;                                ( @C     , A    , B    )
1214                ;                                ( 0      , I    , I    )
```

```
1215 0267 CD 25 1A   CALL MVPOST        MVPOST(ERROR)
1216                ;                        ( A    )
1217                ;                        ( 0    )
1218 026A B7         ORA  A             IF ERROR .NE. 0
1219                ;                     SETTING ERROR IS FATAL
1220 026B C2 80 08   JNZ  FATERR           FATERR(ERROR,ERRFLG)
1221                ;                          ( A    ,PSW:Z )
1222                ;                          ( I    , 0     )
1223                ;                  ELSE
1224                ;                     UPDATE BUFFER TO AGREE WITH SETTING
1225 026E 01 42 04   LXI  B,NBANKS*100H+POSREG
1226                ;                     B = NIBCNT = NBANKS
1227                ;                     C = OFFSET, POSREG
1228 0271 3E 09      MVI  A,9             A = HEX09
1229 0273 CD 24 0F   CALL FILNIB          FILNIB(POSREG,HEX09,NIBCNT)
1230                ;                          ( @C    , A    , B     )
1231                ;                          ( 0     , I    , I     )
1232                ;                     SET METER TO ALL ZEROES
1233 0276 3E C0      MVI  A.WORK1         A = OFFSET, WORK1
1234 0278 CD 85 0E   CALL CLRBLK          CLRBLK(WORK1)
1235                ;                          ( @A   )
1236                ;                          ( 0    )
1237 027B CD 25 1A   CALL MVPOST          MVPOST(ERROR)
1238                ;                          ( A    )
1239                ;                          ( 0    )
1240 027E B7         ORA  A               IF ERROR .NE. 0
1241                ;                       SETTING ERROR IS FATAL
1242 027F C2 80 08   JNZ  FATERR            FATERR(ERROR,ERRFLG)
1243                ;                            ( A    ,PSW:Z )
1244                ;                            ( I    , 0     )
1245                ;                     ENDIF
1246                ;                  ENDIF
1247 0282 C9         RET                RETURN
```

PWRUNG

```
1250                ;PWRUNG(CODE   )
1251                ;      (NIBBLE)
1252                ;      ( I     )
1253                ;      ( A     )
1254                ;      ( C     )
1255                ;
1256                ;A,PSW DESTROYED
1257                ;REGISTERS CHANGED
1258                ;
1259                ;HANDLE POWER-UP OF METER PREVIOUSLY DECLARED DEAD
1260                ;
1261                PWRUNG;            ****ENTRY POINT
1262 0283 F5         PUSH PSW          SAVE A,PSW
1263                ;                  DECLARE FATAL ERROR
1264                ;                  FLAG METER DEAD
1265 0284 47         MOV  B,A          B = CODE
1266 0285 CD 99 10   CALL NVMDE1       NVMDE1(CODE,ERRFLG)
1267                ;                       ( B   ,PSW:Z )
1268                ;                       ( I   , 0    )
1269 0288 F1         POP  PSW          RESTORE A,PSW
1270 0289 FE 03      CPI  FATRST       IF CODE .EQ. FATRST
1271 028B C0         RNZ
1272                ;                     FAILED WHILE CLEARING DESC REGISTER
1273                ;                     CLEAR DESCENDING REGISTER
1274 028C 01 2F 07   LXI  B,DSCSIZ*100H+DSCREG
1275                ;                     B = NIBCNT = DSCSIZ
1276                ;                     C = OFFSET, DSCREG
1277 028F AF         XRA  A               A = HEX00
1278 0290 CD 24 0F   CALL FILNIB          FILNIB(DSCREG,HEX00,NIBCNT)
1279                ;                          ( @C    , A    , B     )
1280                ;                          ( 0     , I    , I     )
1281                ;                     UPDATE CRC
1282 0293 CD B1 0E   CALL CRC             CRC(DSCREG,NIBCNT,CRCVAL)
1283                ;                        ( @C    , B    , D     )
```

```
1284                ;                                ( I    , I    , 0    )
1285 0296 7A          MOV  A,D                     DSCCRC = CRCVAL
1286 0297 32 1B 74    STA  DSCCRC/2+X
1287                ;                            ENDIF
1288 029A C9          RET                          RETURN
```

PWRUOK

```
1291                ;PWRUOK
1292                ;
1293                ;A,PSW DESTROYED
1294                ;REGISTERS DESTROYED
1295                ;
1296                ;CONTINUATION OF SUCCESSFUL POWER-UP SEQUENCE
1297                ;
1298                PWRUOK;                      ****ENTRY POINT
1299                ;                            OPEN NORMAL NVM BLOCK
1300 029B CD C4 11    CALL NVMOPN                NVMOPN(ERRFLG)
1301                ;                                  (PSW:Z )
1302                ;                                  ( 0    )
1303 029E C8          RZ                         IF ERRFLG .EQ. FALSE
1304                ;                              NVM BLOCK IS NOW OPEN
1305 029F 21 AD 02    LXI  H,PWRU01                SET TO RETURN TO ENDIF
1306 02A2 E5          PUSH H
1307 02A3 3A 24 74    LDA  MRSTS1/2+X              IF MRSTS1.UNKSEL .EQ. TRUE
1308 02A6 B7          ORA  A
1309                ;                                POWERED DOWN DURING SETTING OR TRIP
1310 02A7 FA 8D 01    JM   PWRABN                      PERFORM ABNORMAL POWER-UP
1311                ;                              ELSE
1312 02AA F2 58 02    JP   PWRNOR                      PERFORM NORMAL POWER-UP
1313                PWRU01;                        ENDIF
1314                ;                              CHECK METER STATUS
1315 02AD CD 4E 0F    CALL LSTATE                  LSTATE(FATMOD,NORMOD,SERMOD,PRVMOD)
1316                ;                                    (PSW:S ,PSW:Z ,PSW:P ,PSW:CY)
1317                ;                                    ( 0    , 0    , 0    , 0    )
1318 02B0 FA C1 02    JM   PWRU02                  IF FATMOD .EQ. FALSE
1319                ;                                POWER-UP COMPLETED
1320                ;                                CONTINUE WITH INITIALIZATION
1321                ;                                CLEAR POSTAGE REGISTER
1322 02B3 01 42 04    LXI  B,NBANKS*100H+POSREG
1323                ;                                B = NIBCNT = NBANKS
1324                ;                                C = OFFSET, POSREG
1325 02B6 AF          XRA  A                         A = HEX00
1326 02B7 CD 24 0F    CALL FILNIB                    FILNIB(POSREG,HEX00,NIBCNT)
1327                ;                                     ( @C   , A    , B    )
1328                ;                                     ( 0    , I    , I    )
1329                ;                                REGISTER NOW MATCHES SETTING
1330 02BA 21 24 74    LXI  H,MRSTS1/2+X              HL = ADDRESS, MRSTS1
1331 02BD 7E          MOV  A,M                       MRSTS1.UNKSEL = FALSE
1332 02BE E6 7F       ANI  7FH
1333 02C0 77          MOV  M,A
1334                PWRU02;                        ENDIF
1335                ;                              CHECK MEMORY RETENTION OF NVM
1336 02C1 3A FE 44    LDA  NVMRED+RETAIN           A = NVMRED[RETAIN]
1337 02C4 E6 0F       ANI  0FH
1338 02C6 FE 0A       CPI  0AH                     IF NVMRED[RETAIN] .NE. HEX0A
1339 02C8 CA DE 02    JZ   PWRU04
1340                ;                                MEMORY IS FAILING
1341 02CB 21 10 74    LXI  H,SERFLG/2+X              HL = ADDRESS, SERFLG
1342 02CE 7E          MOV  A,M                       IF SERFLG.WEKNVM .EQ. FALSE
1343 02CF E6 20       ANI  20H
1344 02D1 C2 DE 02    JNZ  PWRU03
1345                ;                                  SERFLG.WEKNVM NOT SET IN NVM
1346 02D4 7E          MOV  A,M                         SERFLG.WEKNVM = TRUE
1347 02D5 F6 20       ORI  20H
1348 02D7 77          MOV  M,A
1349                ;                                  WRITE NORMAL BLOCK
1350                ;                                  LEAVE NO BLOCKS OPEN
1351 02D8 CD 9E 12    CALL NVMWR                       NVMWR(ERRFLG)
1352                ;                                       (PSW:Z )
```

```
1353                ;                                  ( 0    )
1354                ;                              WRITE NEW SERVICE BLOCK
1355                ;                              OPEN ERASED NORMAL BLOCK
1356 02DB CD 19 12    CALL NVMSTO                  NVMSTO(ERRFLG)
1357                ;                                   (PSW:Z )
1358                ;                                   ( 0    )
1359                PWRU03;                      ENDIF
1360                PWRU04;                    ENDIF
1361 02DE CD 47 10    CALL NVM30T              TURN ON -30V FOR NVM
1362                ;                          START ERASING RETENTION LOCATION
1363 02E1 32 FE 40    STA  NVMERS+RETAIN       NVMERS[RETAIN] = A
1364                ;                          PAUSE FOR 10 MSEC
1365 02E4 01 64 00    LXI  B,100               BC = LOOPCT = 100
1366                PWRU05;                    DO UNTIL LOOPCT .EQ. 0
1367 02E7 CD 19 0B    CALL NPAUSE                NPAUSE(LOOPCT,ZROFLG)
1368                ;                                  ( BC   ,PSW:Z )
1369                ;                                  ( I/O  , 0    )
1370 02EA C2 E7 02    JNZ  PWRU05
1371                ;                          ENDDO
1372                ;                          TERMINATE ERASURE
1373 02ED 3A FE 44    LDA  NVMRED+RETAIN       A[1] = NVMRED[RETAIN] = GARBAGE
1374                ;                          CHECK ERASURE
1375 02F0 3A FE 44    LDA  NVMRED+RETAIN       A[1] = NVMRED[RETAIN]
1376 02F3 F6 F0       ORI  0F0H                A[0] = HEXF
1377 02F5 3C          INR  A                   PSW:Z=ERASED=NVMRED[RETAIN].EQ.HEXF
1378 02F6 3E 01       MVI  A,NVMBAD            A = NVMBAD
1379                ;                          IF ERASED .EQ. FALSE
1380                ;                            DECLARE DEAD METER. BAD NVM.
1381 02F8 C2 85 10    JNZ  NVMDED                NVMDED(NVMBAD,ERRFLG)
1382                ;                                  ( A    ,PSW:Z )
1383                ;                                  ( I    , 0    )
1384                ;                          ENDIF
1385                ;                          WRITE HEX0A INTO RETENTION LOCATION
1386 02FB 21 FE 00    LXI  H,RETAIN            HL = BASE = ADDRESS, RETAIN
1387 02FE 3E 0A       MVI  A,0AH               A = HEX0A
1388 0300 CD 61 12    CALL NVMWN               NVMWN(HEX0A,BASE,ERRFLG)
1389                ;                                ( A[1], HL ,PSW:Z )
1390                ;                                ( I   , I  , 0    )
1391 0303 C3 31 10    JMP  NVM30F              TURN OFF -30 V TO NVM
1392                ;                        ENDIF
1393                ;                        RETURN
```

CDBUF

```
1396                ;CDBUF/CDBUFC/CDBUFD()(DBUF   )
1397                ;                     (NIBSTR)
1398                ;                     ( I/O  )
1399                ;                     ( RAM  )
1400                ;                     ( C    )
1401                ;
1402                ;PSW:S, Z, P, CY = NO CHANGE
1403                ;
1404                ;-----------------------------------------------------------
1405                ;                    DISABLE METER AND CLEAR DBUF ONLY ON
1406                ;                    CONDITION THAT DISPLAYED VALUE WAS
1407                ;                    NOT ENTERED FROM KEYBOARD
1408                ;
1409                CDBUFC;              ****ENTRY POINT
1410 0306 F5          PUSH PSW           SAVE A, PSW
1411                ;                    CHECK FOR KEY ENTERED DISPLAY
1412 0307 3A 40 74    LDA  DBUF/2+X      A = DBUF[0..1]
1413 030A B7          ORA  A             IF DBUF[0..1] .EQ. HEX00
1414 030B CA 20 03    JZ   CDBUF1
1415                ; >>JUMP AHEAD<<
1416                ;                      DISPLAY WAS KEY ENTERED
1417                ;                      RESTORE A, PSW
1418                ;                      RETURN
1419                ;                    ENDIF
1420 030E F1          POP  PSW           RESTORE A, PSW
1421                ;-----------------------------------------------------------
```

```
1422                ;                       DISABLE METER AND CLEAR DISPLAY BUFFER
1423                ;
1424                CDBUFD;                 ****ENTRY POINT
1425 030F F5          PUSH PSW              SAVE A, PSW
1426                ;                       DISABLE METER
1427 0310 3E 42       MVI  A,HDISAB         A = HDISAB
1428 0312 CD C7 0D    CALL XEQHDR           XEQHDR(HDISAB,ERROR)
1429                ;                             ( A    ,PSW:Z)
1430                ;                             ( I    , 0   )
1431 0315 F1          POP  PSW              RESTORE A, PSW
1432                ;-----------------------------------------------------------
1433                ;                       CLEAR DISPLAY BUFFER
1434                ;
1435                CDBUF;                  ****ENTRY POINT
1436 0316 F5          PUSH PSW              SAVE A, PSW
1437                ;                       SET DBUF HEADER TO KEY ENTRY
1438 0317 AF          XRA  A                A = HEX00
1439 0318 32 40 74    STA  DBUF/2+X         OUTPUT DBUF[0..1] = HEX00
1440                ;                       SET DBUF FORMAT FOR NUL MESSAGE
1441 031B 3E 0F       MVI  A,0FH            DBUF[2..3] = HEX0F
1442 031D 32 41 74    STA  DBUF/2+X+1
1443                CDBUF1;                 >>TARGET OF JUMP AHEAD<<
1444 0320 F1          POP  PSW              RESTORE A, PSW
1445 0321 C9          RET                   RETURN
```

FILDIM

```
1448                ;FILDIM(VALUE )(DIMAGE)
1449                ;      (UBYTE )(BITSTR)
1450                ;      ( I    )( O    )
1451                ;      ( A    )( RAM  )
1452                ;      ( NC   )( C    )
1453                ;
1454                ;PSW DESTROYED
1455                ;REGISTERS DESTROYED
1456                ;
1457                ;FILL DISPLAY IMAGE BUFFER WITH VALUE
1458                ;
1459                FILDIM;                 ****ENTRY POINT
1460                ;                       SET TO FILL (NDISP*4) BYTES
1461 0322 06 07       MVI  B,NDISP*4-1      B = BYTNO = NDISP*4-1
1462 0324 21 87 74    LXI  H,DIMAGE/2+Y+NDISP*4-1
1463                ;                       HL = ADDRESS, DIMAGE[BYTNO]
1464                FILDI1;                 DO UNTIL BYTNO .LT. 0
1465 0327 77          MOV  M,A                DIMAGE[BYTNO] = VALUE
1466 0328 05          DCR  B                  BYTNO = BYTNO-1
1467 0329 2B          DCX  H                  HL = ADDRESS, DIMAGE[BYTNO]
1468 032A F2 27 03    JP   FILDI1             TEST BYTNO
1469                ;                       ENDDO
1470 032D C9          RET                     RETURN
```

KEYBRD

```
1473                ;KEYBRD()(NORFLG,CTLBKT,CHRBKT,KDCTRL,DSPTMR,CURBKT)
1474                ;        (BITSTR,BYTE  ,BYTE  ,BITSTR,UBYTE ,BYTE  )
1475                ;        ( I    , I    , I/O  , I    , I    , O    )
1476                ;        ( RAM  , RAM  , RAM  , RAM  , RAM  , RAM  )
1477                ;        ( NC   , NC   , C    , NC   , NC   , C    )
1478                ;
1479                ;PSW AND REGISTERS DESTROYED
1480                ;
1481                ;SAMPLES INTERRUPT LEVEL KEYCODE BUCKETS.  DEFINES A
1482                ;STABLE KEYCODE BUCKET FOR APPLICATION USE.  INITIATES
1483                ;PROCESSING OF KEYPRESS.  UPDATES DISPLAY TO CONFORM TO
1484                ;METER STATUS.  INITIATES END OF ENTRY PROCESSING.
1485                ;
1486                KEYBRD;                 ****ENTRY POINT
1487 032E 3A 27 74    LDA  KDCTRL/2+X       IF (KDCTRL.KBDDSB .EQ. FALSE) .AND.
1488 0331 1F          RAR                     ((NORFLG.CMBIN .AND. NORFLG.AMTIN).EQ.
1489 0332 DA 4A 03    JC   KEYB01             TRUE)
```

```
0335 3A 26 74   LDA  NORFLG/2+X
0338 E6 30      ANI  30H
033A FE 30      CPI  30H
033C C2 4A 03   JNZ  KEYB01
033F CD DE 0E   CALL DBLANK          BLANK DISPLAY
                ;                    EXECUTE END OF ENTRY
0342 3E 43      MVI  A,HENDEN        A = HENDEN
0344 CD C7 0D   CALL XEQHDR          XEQHDR(HENDEN,ERROR)
                ;                          ( A    ,PSW:Z)
                ;                          ( I    , 0   )
0347 C3 8C 03   JMP  KEYB09
                KEYB01:            ELSE
                ;                    READ INTERRUPT BUCKETS TOGETHER
034A 2A 2B 74   LHLD CTLBKT/2+X
034D EB         XCHG                 E = CTLBKT
                ;                    D = CHRBKT
034E 1C         INR  E               IF CTLBKT .EQ. HEX00
034F 1D         DCR  E
0350 C2 78 03   JNZ  KEYB06
                ;                      NO KEY IS DOWN
0353 21 27 74   LXI  H,KDCTRL/2+X      HL = ADDRESS, KDCTRL
0356 7E         MOV  A,M               A = KDCTRL
0357 E6 20      ANI  20H               IF KDCTRL.TIMED .EQ. TRUE
0359 CA 75 03   JZ   KEYB05
                ;                        CURRENT DISPLAY IS TIMED
035C 3A 29 74   LDA  DSPTMR/2+X          A = DSPTMR
035F 3D         DCR  A                   IF DSPTMR .EQ. 1
0360 C2 75 03   JNZ  KEYB04
                ;                          DISPLAY TIME IS UP
                ;                          REVERT TO POSTAGE DISPLAY
                ;                          CHECK FOR FATAL ERROR
0363 CD 4E 0F   CALL LSTATE                LSTATE(FATAL,NORM,SERV,PRIV)
                ;                                (PSW:S, :Z , :P , :C )
                ;                                ( 0   , 0  , 0  , 0  )
0366 F2 70 03   JP   KEYB02                IF FATAL .EQ. TRUE
                ;                            SET FOR FATAL SETTING DISPLY
0369 7E         MOV  A,M                     KDCTRL.STGDSP = TRUE
036A F6 80      ORI  80H
036C 77         MOV  M,A
036D C3 75 03   JMP  KEYB03
```

KEYBRD

```
                KEYB02;                    ELSE
                ;                            MAKE NORMAL SETTING DISPLAY
0370 3E 51      MVI  A,HREQPO                A = HREQPO
0372 CD C7 0D   CALL XEQHDR                  XEQHDR(HREQPO,ERROR)
                ;                                  ( A    ,PSW:Z)
                ;                                  ( I    , 0   )
                KEYB03;                    ENDIF
                KEYB04;                  ENDIF
                KEYB05;                ENDIF
0375 C3 8C 03   JMP  KEYB08
                KEYB06;              ELSE
                ;                      KEYS ARE DOWN
                ;                      RESTART DISPLAY TIMER
0378 3E 07      MVI  A,DSPVAL            DSPTMR = DSPVAL
037A 32 29 74   STA  DSPTMR/2+X
037D 7A         MOV  A,D               A = CHRBKT
037E B7         ORA  A                 IF CHRBKT .NE. HEX00
037F CA 8C 03   JZ   KEYB07
                ;                        A SINGLE UNPROCESSED KEY IS DOWN
                ;                        DEFINE A STABLE KEYBUCKET
0382 32 2D 74   STA  CURBKT/2+X          CURBKT = CHRBKT
                ;                        PREVENT REPROCESSING KEYPRESS
0385 AF         XRA  A                   CHRBKT = NOKEY
0386 32 2C 74   STA  CHRBKT/2+X
0389 CD CE 04   CALL PROKEY              PROCESS KEYPRESS
                KEYB07;                ENDIF
                KEYB08;              ENDIF
```

```
1557                KEYB09;                ENDIF
1558 038C 3A 26 74   LDA  NORFLG/2+X       IF NORFLG.QUEPOS .EQ. TRUE
1559 038F E6 40      ANI  40H
1560 0391 C0         RNZ                     RETURN
1561                ;                      ELSE
1562 0392 CD A0 03   CALL MODDSP             MODIFY DISPLAY TO MATCH METER STATUS
1563                ;                        START KEYBOARD/DISPLAY INTERRUPTS
1564 0395 21 A7 00   LXI  H,KDIO             HL = ADDRESS = ADDRESS, KDIO
1565 0398 3E 02      MVI  A,KDSKIP           A = KDSKIP
1566 039A 11 96 4C   LXI  D,KEYINT           DE = KEYINT
1567 039D C3 53 01   JMP  STRTMR             STRTMR(ADDRESS,KDSKIP,KEYINT,WASOFF)
1568                ;                              ( HL   , A    , DE   ,PSW:Z )
1569                ;                              ( I    , I    , I    , O    )
1570                ;                        RETURN
1571                ;                      ENDIF
```

MODDSP

```
1574                ;MODDSP()(DIMAGE, MRSTS1, KDCTRL)
1575                ;        (BYTSTR, BITSTR, BITSTR)
1576                ;        ( O   ,  I   ,  O   )
1577                ;        ( RAM ,  RAM ,  RAM )
1578                ;        ( C   ,  NC  ,  C   )
1579                ;
1580                ;ALL REGISTERS CHANGED
1581                ;PSW: S, Z, P, CY CHANGED
1582                ;
1583                ;UPDATE DISPLAY CONTROL FLAGS AND DISPLAY IMAGE
1584                ;TO REFLECT CURRENT METER STATUS
1585                ;
1586                MODDSP;                ****ENTRY POINT
1587                ;                       CHECK DISPLAY TYPE
1588 03A0 21 27 74   LXI  H,KDCTRL/2+X      HL = ADDRESS, KDCTRL
1589 03A3 7E         MOV  A,M               A = KDCTRL
1590 03A4 E6 BB      ANI  0BBH              A.FLSDSP = FALSE
1591                ;                       A.FLSDCM = FALSE
1592                ;                       PSW:S = KDCTRL.STGDSP
1593 03A6 FA AD 03   JM   MODD01             IF KDCTRL.STGDSP .EQ. FALSE
1594                ;                         SETTING NOT ON DISPLAY
1595                ;                         PREVENT FLASHING DISPLAY
1596 03A9 77         MOV  M,A                  KDCTRL.FLSDSP = FALSE
1597                ;                         KDCTRL.FLSDCM = FALSE
1598 03AA C3 FF 03   JMP  MODD07
1599                MODD01;                 ELSE
1600                ;                         SETTING IS ON DISPLAY
1601                ;                         DECIDE WHETHER TO FLASH DISPLAY
1602 03AD 3A 24 74   LDA  MRSTS1/2+X          B = MRSTS1
1603 03B0 47         MOV  B,A
1604                ;                         D.DATDOR = D.0 = MRSTS1.DATDOR
1605                ;                         E.FLSDSP = E.1 = MRSTS1.DATDOR .OR.
1606                ;                                          MRSTS1.INSFND
1607                ;                         E.FLSDCM = E.5 = MRSTS1.LOWPOS
1608 03B1 E6 70      ANI  70H
1609 03B3 57         MOV  D,A
1610 03B4 0F         RRC
1611 03B5 0F         RRC
1612 03B6 B2         ORA  D
1613 03B7 57         MOV  D,A
1614 03B8 07         RLC
1615 03B9 B2         ORA  D
1616 03BA 57         MOV  D,A
1617 03BB E6 44      ANI  44H
1618 03BD 5F         MOV  E,A
1619                ;                         KDCTRL.FLSDSP = E.FLSDSP
1620                ;                         KDCTRL.FLSDCM = E.FLSDCM
1621 03BE 21 27 74   LXI  H,KDCTRL/2+X
1622 03C1 7E         MOV  A,M
1623 03C2 E6 BB      ANI  0BBH
1624 03C4 B3         ORA  E
1625 03C5 77         MOV  M,A
```

```
1626                ;                          DETERMINE METER STATUS
1627 03C6 CD 4E 0F   CALL LSTATE               LSTATE(FATMOD,NORMOD,SERMOD,PRVMOD)
1628                ;                                (PSW:S ,PSW:Z ,PSW:P ,PSW:CY)
1629                ;                                ( 0    , 0    , 0    , 0    )
1630 03C9 FA F5 03   JM   MODD04               IF FATMOD .EQ. FALSE
1631                ;                            METER NOT FATAL
1632                ;                            TURN DATER DOOR LAMP ON OR OFF
1633 03CC 21 80 74   LXI  H,DIMAGE/2+Y          HL = ADDRESS, DIMAGE
1634 03CF 7E         MOV  A,M                   A = DIMAGE
1635 03D0 E6 FD      ANI  0FDH                  A.DATLMP = FALSE
1636 03D2 14         INR  D                     PSW:S = D.DATDOR
1637 03D3 F2 D8 03   JP   MODD02                IF D.DATDOR .EQ. TRUE
1638 03D6 F6 02      ORI  2                       A.DATLMP = TRUE
1639                MODD02;                     ENDIF
1640 03D8 77         MOV  M,A                   DIMAGE = A
1641                ;                           SELECT WING TYPE
1642 03D9 16 02      MVI  D,02H                 D = WING, DISABLED
1643 03DB 3E 04      MVI  A,04H                 A = MRSTS1.ENABLD
1644 03DD A0         ANA  B
1645 03DE CA E3 03   JZ   MODD03                IF MRSTS1.ENABLD .EQ. TRUE
1646 03E1 16 92      MVI  D,92H                   D = WING, ENABLED
1647                MODD03;                     ENDIF
1648                ;                            INSERT RIGHT HAND WING
1649 03E3 21 87 74   LXI  H,DIMAGE/2+Y+(NDISP*4-1)
1650                ;                           HL = ADDRESS, DIMAGE[(NDISP*4-1)]
1651 03E6 72         MOV  M,D                   DIMAGE[(NDISP*4-1)] = WING
1652                ;                            INSERT LEFT HAND WING
1653 03E7 06 82      MVI  B,DBUF+2              B = OFFSET, DBUF[2]
1654 03E9 CD 35 0F   CALL GETNIB                GETNIB(NCHAR,ZERO ,DBUF[2])
1655                ;                                ( A    ,PSW:Z, @B     )
1656                ;                                ( 0    , 0    , I     )
1657 03EC 2F         CMA                        BC = -NCHAR-1
1658 03ED 4F         MOV  C,A
1659 03EE 06 FF      MVI  B,0FFH
1660 03F0 09         DAD  B                     HL = ADDRESS,
1661                ;                           DIMAGE[(NDISP*4-2)-NCHAR]
1662 03F1 72         MOV  M,D                   DIMAGE[(NDISP*4-2)-NCHAR] = WING
1663 03F2 C3 FF 03   JMP  MODD06
1664                MODD04;                    ELSE
1665                ;                            METER IS FATAL
1666                ;                            SET TO DISPLAY ALL DECIMALS
1667 03F5 3E 01      MVI  A,01H                 A = DECBIT = HEX01
1668 03F7 E2 FC 03   JPO  MODD05                IF SERMOD .EQ. TRUE
1669                ;                              SET TO DISPLAY DECIMALS+DASHES
1670 03FA 3E 11      MVI  A,11H                   A = DECBIT = HEX11
1671                MODD05:                     ENDIF
1672 03FC CD 22 03   CALL FILDIM                FILDIM(DECBIT)
1673                ;                                ( A    )
1674                ;                                ( I    )
1675                MODD06;                    ENDIF
1676                MODD07;                   ENDIF
1677                ;                         BUILD SERVICE/NORMAL MODE EDIT MASK
1678 03FF AF         XRA  A                   A = MASK, BLANK
1679 0400 CD 4E 0F   CALL LSTATE              LSTATE(FATMOD,NORMOD,SERMOD,PRVMOD)
1680                ;                                (PSW:S ,PSW:Z ,PSW:P ,PSW:CY)
1681                ;                                ( 0    , 0    , 0    , 0    )
1682 0403 E2 08 04   JPO  MODD08              IF SERMOD .EQ. TRUE
1683 0406 3E 10      MVI  A,10H                 A = MASK, UNDERSCORE
1684                MODD08;                   ENDIF
1685 0408 4F         MOV  C,A                 C = MASK
1686                ;                         EDIT MASK INTO DISPLAY
1687 0409 06 07      MVI  B,(NDISP*4-1)       B = DISPNO = (NDISP*4-1)
1688 040B 21 87 74   LXI  H,DIMAGE/2+Y+(NDISP*4-1)
1689                ;                         HL = ADDRESS, DIMAGE[DISPNO]
1690                MODD09;                   FOR DISPNO = (NDISP*4-1) DOWNTO 0
1691 040E 7E         MOV  A,M                   IF(DIMAGE[DISPNO] .AND. HEXEE).EQ.0
1692 040F E6 EE      ANI  0EEH
1693 0411 C2 19 04   JNZ  MODD10
1694                ;                            COPY MASK INTO DISPLAY
```

```
1695 0414 7E          MOV  A,M              A = IMAGE = DIMAGE[DISPNO]
1696 0415 E6 EF       ANI  0EFH             IMAGE = IMAGE, WITHOUT UNDERSCORE
1697 0417 B1          ORA  C                IMAGE = IMAGE, WITH EDIT MASK
1698 0418 77          MOV  M,A              DIMAGE[DISPNO] = IMAGE
1699                MODD10;               ENDIF
1700 0419 05          DCR  B               B = DISPNO = DISPNO-1
1701 041A 2B          DCX  H               HL = ADDRESS, DIMAGE[DISPNO]
1702 041B F2 0E 04    JP   MODD09          TEST DISPNO
1703                ;                     ENDFOR
1704 041E C9          RET                  RETURN
```

PAUTHK

```
1707                ;PAUTHK()(DBUF  ,NORFLG)
1708                ;        (NIBSTR,BITSTR)
1709                ;        ( I    , I    )
1710                ;        ( RAM  , RAM  )
1711                ;
1712                ;PSW DESTROYED
1713                ;REGISTERS DESTROYED
1714                ;
1715                ;PROCESS AUTHORIZATION KEY
1716                ;
1717                PAUTHK;               ****ENTRY POINT
1718                ;                     TEST DISPLAY HEADER
1719 041F 21 40 74    LXI  H,DBUF/2+X     HL = ADDRESS, DBUF[0..1]
1720 0422 7E          MOV  A,M            A = DHEAD = DBUF[0..1]
1721 0423 B7          ORA  A              PSW:Z = KEYDAT = DHEAD .EQ. 0
1722                ;                     DEFINE REQUEST HEADER
1723 0424 3E 40       MVI  A,HREQAC       A = RHEAD = HREQAC
1724                ;                     IF KEYDAT .EQ. FALSE
1725                ;                       NO KEYENTERED DATA IN DISPLAY
1726                ;                       REQUEST AUTHORIZATION CODE
1727 0426 C2 C7 0D    JNZ  XEQHDR           XEQHDR(RHEAD,ERRFLG)
1728                ;                             ( A   ,PSW:Z )
1729                ;                             ( I   , 0    )
1730                ;                     ELSE
1731 0429 23          INX  H              HL = ADDRESS, DBUF[2..3]
1732 042A 7E          MOV  A,M            A = FORMAT = DBUF[2..3]
1733 042B FE 4F       CPI  4FH            IF FORMAT .NE. HEX4F
1734                ;                       DISPLAY NOT 4 CHAR WITHOUT DECIMAL
1735                ;                       DECLARE PROCEDURAL ERROR
1736 042D C2 A1 0B    JNZ  PROERR           PROERR(ERRFLG)
1737                ;                             (PSW:Z )
1738                ;                             ( 0    )
1739                ;                     ELSE
1740 0430 23          INX  H              HL = ADDRESS, DBUF[4..5]
1741 0431 7E          MOV  A,M            A = CODE = DBUF[4..5]
1742 0432 FE 69       CPI  69H            IF CODE .NE. HEX69
1743                ;                       FIRST 2 CHARACTERS IN DISPLAY NOT 69
1744                ;                       DECLARE PROCEDURAL ERROR
1745 0434 C2 A1 0B    JNZ  PROERR           PROERR(ERRFLG)
1746                ;                             (PSW:Z )
1747                ;                             ( 0    )
1748                ;                     ELSE
1749                ;                       ISSUE LAST 2 CHARACTERS OF DISPLAY
1750                ;                       AS REQUEST HEADER
1751 0437 23          INX  H                HL = ADDRESS, DBUF[6..7]
1752 0438 7E          MOV  A,M              A = RHEAD = DBUF[6..7]
1753 0439 CD C7 0D    CALL XEQHDR           XEQHDR(RHEAD,ERRFLG)
1754                ;                             ( A   ,PSW:Z )
1755                ;                             ( I   , 0    )
1756                ;                       TEST THE REQUEST HEADER
1757 043C FE 46       CPI  HSETSV           IF RHEAD .EQ. HSETSV
1758 043E C0          RNZ
1759                ;                         SERVICE MODE ENTERED VIA KEYBOARD
1760                ;                         DISABLE COMMUNICATIONS
1761 043F 21 26 74    LXI  H,NORFLG/2+X       HL = ADDRESS, NORFLG
1762 0442 7E          MOV  A,M                NORFLG.COMDSB = TRUE
1763 0443 F6 04       ORI  04H
```

```
1764 0445 77          MOV  M,A
1765                ;                        ENDIF
1766                ;                      ENDIF
1767 0446 C9          RET                  RETURN

PCLRK

1770                ;PCLRK
1771                ;
1772                ;PSW:S, Z, P, CY = NO CHANGE
1773                ;
1774                ;PROCESS CLEAR KEY
1775                ;
1776                PCLRK;               ****ENTRY POINT
1777 0447 CD 06 03    CALL CDBUFC        IF DISPLAY WAS NOT KEY ENTERED
1778                ;                      DISABLE METER
1779                ;                      CLEAR DISPLAY BUFFER
1780                ;                    ENDIF
1781 044A CD 16 03    CALL CDBUF         CLEAR DISPLAY BUFFER
1782 044D C3 5A 05    JMP  VALDSP        DISPLAY VALUE IN DBUF
1783                ;                    RETURN

PDCMK

1786                ;PDCMK()(DBUF  )
1787                ;       (NIBSTR)
1788                ;       ( I/O  )
1789                ;       ( RAM  )
1790                ;       ( C    )
1791                ;
1792                ;PSW AND REGISTERS DESTROYED
1793                ;
1794                ;PROCESS DECIMAL KEY
1795                ;
1796                PDCMK;               ****ENTRY POINT
1797                ;                    CHECK FOR NON KEYENTRY DISPLAY
1798                ;                    IF DBUF[0..1] .NE. HEX00
1799 0450 CD 06 03    CALL CDBUFC          PUT NUL MESSAGE IN DBUF
1800                ;                      DISABLE METER
1801                ;                    ENDIF
1802                ;                    CHECK THAT DECIMAL NOT ALREADY ENTERED
1803 0453 01 83 83    LXI B,(DBUF+3)*100H+DBUF+3
1804                ;                    B = OFFSET, DBUF[3]
1805                ;                    C = OFFSET, DBUF[3]
1806 0456 CD 35 0F    CALL GETNIB        GETNIB(DECPOS,ZERO ,DBUF[3])
1807                ;                          ( A    ,PSW:Z, @B    )
1808                ;                          ( 0    , 0   , I     )
1809 0459 D6 0F       SUI  0FH           IF DECPOS .EQ. HEX0F
1810 045B C2 61 04    JNZ  PDCMK1
1811                ;                      A = DECPOS = 0, RIGHTMOST POSITION
1812                ;                      OUTPUT DECPOS
1813 045E CD EE 0F    CALL PUTNIB          PUTNIB(DBUF[3],DECPOS)
1814                ;                           ( @C    , A    )
1815                ;                           ( 0     , I    )
1816                PDCMK1;              ENDIF
1817 0461 C3 5A 05    JMP  VALDSP        MAKE NEW DISPLAY
1818                ;                    RETURN

PERDSP

1821                ;PERDSP()(KDCTRL,DIMAGE,DSPTMR)
1822                ;        (BITSTR,BYTSTR,UBYTE )
1823                ;        ( 0    , 0    , 0    )
1824                ;        ( RAM  , RAM  , RAM  )
1825                ;        ( C    , C    , C    )
1826                ;
1827                ;PSW:S, Z, P, CY = NO CHANGE
1828                ;
1829                ;MAKE PROCEDURAL ERROR DISPLAY
1830                ;
```

```
1831                PERDSP;              ****ENTRY POINT
1832 0464 F5          PUSH PSW           SAVE A, PSW
1833                ;                    CLEAR SETTING-ON-DISPLAY FLAG
1834 0465 3A 27 74    LDA  KDCTRL/2+X    A = KDCTRL
1835 0468 E6 7F       ANI  7FH           KDCTRL.STGDSP = FALSE
1836                ;                    SET DISPLAY-IS-TIMED FLAG
1837 046A F6 20       ORI  20H           KDCTRL.TIMED = TRUE
1838 046C 32 27 74    STA  KDCTRL/2+X
1839 046F CD 16 03    CALL CDBUF         CLEAR DISPLAY BUFFER
1840                ;                    CLEAR DISPLAY IMAGE BUFFER
1841 0472 AF          XRA  A             A = BLANK
1842 0473 CD 22 03    CALL FILDIM        FILDIM(BLANK)
1843                ;                          ( A   )
1844                ;                          (.I   )
1845                ;                    INSERT 'ERR' IN DISPLAY IMAGE
1846 0476 3E 9E       MVI  A,9EH         DIMAGE[0] = 'E'
1847 0478 32 80 74    STA  DIMAGE/2+Y
1848 047B 3E 0A       MVI  A,0AH         DIMAGE[1] = 'r'
1849 047D 32 81 74    STA  DIMAGE/2+Y+1
1850 0480 32 82 74    STA  DIMAGE/2+Y+2  DIMAGE[2] = 'r'
1851                ;                    START DISPLAY TIMER
1852 0483 3E 07       MVI  A,DSPVAL      DSPTMR = DSPVAL
1853 0485 32 29 74    STA  DSPTMR/2+X
1854 0488 F1          POP  PSW           RESTORE A, PSW
1855 0489 C9          RET                RETURN
```

PNUMK

```
1858                ;PNUMK(CURKEY)(DBUF  ,WORK1 )
1859                ;     (BYTE  )(NIBSTR,NIBSTR)
1860                ;     ( I    )( I/O  , O    )
1861                ;     ( A    )( RAM  , RAM  )
1862                ;     ( C    )( C    , C    )
1863                ;
1864                ;PSW AND REGISTERS DESTROYED
1865                ;
1866                ;PROCESS NUMERIC KEY
1867                ;
1868                PNUMK;               ****ENTRY POINT
1869 048A 57          MOV  D,A           D = CURKEY
1870 048B CD 06 03    CALL CDBUFC        IF DBUF[0..1] .NE. HEX00
1871                ;                      NOT IN KEYENTRY MODE
1872                ;                      DISABLE METER
1873                ;                      ENTER KEYENTRY MODE
1874                ;                      DBUF[0..1] = HEADER = HEX00
1875                ;                      DECLARE DBUF CLEAR
1876                ;                      DBUF[2..3] = FORMAT = HEX0F
1877                ;                    ENDIF
1878                ;                    CHECK DATA LENGTH IN DISPLAY
1879 048E 21 41 74    LXI  H,(DBUF+2)/2+X
1880                ;                    HL = ADDRESS, DBUF[2..3]
1881 0491 7E          MOV  A,M           E = NCHAR*16 = DBUF[2]*16
1882 0492 E6 F0       ANI  0F0H
1883 0494 5F          MOV  E,A
1884 0495 FE 80       CPI  DSPCHR*16     IF NCHAR .LT. DSPCHR
1885 0497 D0          RNC
1886                ;                      THERE IS ROOM IN DISPLAY FOR CHAR
1887                ;                      CALCULATE NEXT DECIMAL POSITION
1888 0498 7E          MOV  A,M           A = DECPOS = (DBUF[3]+1) .AND. HEX0F
1889 0499 3C          INR  A
1890 049A E6 0F       ANI  0FH
1891 049C FE 08       CPI  DSPCHR        IF DECPOS .LT. DSPCHR
1892 049E D0          RNC
1893                ;                        THERE IS ROOM TO SHIFT DECIMAL
1894 049F B7          ORA  A               IF DECPOS .EQ. 0
1895 04A0 C2 A5 04    JNZ  PNUMK1
1896                ;                          DECIMAL HASN'T BEEN ENTERED
1897                ;                          INDICATE NO DECIMAL
1898 04A3 3E 0F       MVI  A,0FH               A = DECPOS = HEX0F
1899                PNUMK1;                ENDIF
```

```
1900                ;                          UPDATE FORMAT BYTE
1901 04A5 B3          ORA  E                   DBUF[2..3] = (NCHAR+1)X16+DECPOS
1902 04A6 C6 10       ADI  10H
1903 04A8 77          MOV  M,A
1904 04A9 06 82       MVI  B,DBUF+2            B = OFFSET, DBUF[2]
1905 04AB CD 35 0F    CALL GETNIB              GETNIB(NCHAR,ZROFLG,DBUF[2])
1906                ;                                ( A   ,PSW:Z , @B    )
1907                ;                                ( O   , O    , I     )
1908 04AE 5F          MOV  E,A                 E = NCHAR
1909                ;                          COPY DBUF INTO WORK AREA
1910 04AF 01 C0 84    LXI  B,(DBUF+4)X100H+(WORK1+0)
1911                ;                          B = OFFSET, DBUF[I=4]
1912                ;                          C = OFFSET, WORK1[J=0]
1913 04B2 CD B3 0F    CALL MVLNIB              MVLNIB(WORK1[J],DBUF[I],NCHAR,
1914                ;                                ( @C     , @B    , A   ,
1915                ;                                ( O      , I     , I   ,
1916                ;
1917                ;                                NONBCD,ZROFLG)
1918                ;                                PSW:S ,PSW:Z )
1919                ;                                 O    , O    )
1920                ;                          ZERO PAD DISPLAY BUFFER
1921 04B5 23          INX  H                   HL = ADDRESS, DBUF[4..5]
1922 04B6 36 00       MVI  M,0                 DBUF[4..5] = 0
1923                ;                          INSERT NEW CHAR IN WORK AREA
1924 04B8 81          ADD  C                   C=OFFSET, WORK1[J=NCHAR.AND.HEXFE]
1925 04B9 E6 FE       ANI  0FEH
1926 04BB 4F          MOV  C,A
1927 04BC 7A          MOV  A,D                 A = CURKEY
1928 04BD CD EE 0F    CALL PUTNIB              PUTNIB(WORK1[J],CURKEY)
1929                ;                                ( @C     , A    )
1930                ;                                ( O      , I    )
1931                ;                          MOVE WORK AREA TO DISPLAY BUFFER
1932 04C0 41          MOV  B,C                 B = OFFSET, WORK1[I=J]
1933 04C1 3E 83       MVI  A,DBUF+3            C=OFFSET,DBUF[J=(3+NCHAR).OR.HEX01]
1934 04C3 83          ADD  E
1935 04C4 F6 01       ORI  1
1936 04C6 4F          MOV  C,A
1937 04C7 7B          MOV  A,E                 A = NCHAR
1938 04C8 CD C2 0F    CALL MVRNIB              MVRNIB(DBUF[J],WORK1[I],NCHAR,
1939                ;                                ( @C    , @B     , A   ,
1940                ;                                ( O     , I      , I   ,
1941                ;
1942                ;                                NONBCD,ZROFLG)
1943                ;                                PSW:S ,PSW:Z )
1944                ;                                 O    , O    )
1945 04CB C3 5A 05    JMP  VALDSP              UPDATE DISPLAY IMAGE
1946                ;                        ENDIF
1947                ;                      ENDIF
1948                ;                      RETURN
```

PROKEY

```
1951                ;PROKEY()(CURBKT)
1952                ;        ( BYTE )
1953                ;        ( I    )
1954                ;        ( RAM  )
1955                ;        ( NC   )
1956                ;
1957                ;PSW AND REGISTERS DESTROYED
1958                ;
1959                ;INITIATE PROCESSING OF A KEYPRESS
1960                ;
1961                PROKEY;              ****ENTRY POINT
1962 04CE CD DE 0E    CALL DBLANK        STOP TIMER, BLANK DISPLAY
1963                ;                    BUILD INDEX FOR TABLE LOOKUP
1964                ;                    CURBKT = ORRR CCCC WHERE:
1965                ;                    RRR = 0, 1, 2, 3, OR 4 = ROW CODE
1966                ;                    CCCC= 1, 2, 4, OR 8 = COLUMN CODE
1967 04D1 3A 2D 74    LDA CURBKT/2+X     A = CURBKT
1968 04D4 57          MOV  D,A           D = CURBKT
1969 04D5 E6 70       ANI  70H           E = INDEX = (CURBKT .AND. HEX70)/4
```

```
1970 04D7 0F          RRC
1971 04D8 0F          RRC
1972 04D9 5F          MOV  E,A
1973 04DA 7A          MOV  A,D          A = CURBKT
1974                PROKE1;             DO WHILE COLUMN CODE BIT NOT IN CARRY
1975 04DB 1F          RAR
1976 04DC DA E3 04    JC   PROKE2
1977 04DF 1C          INR  E              E = INDEX = INDEX + 1
1978 04E0 C3 DB 04    JMP  PROKE1
1979                PROKE2:             ENDDO
1980                ;                   DEFINE CURRENT KEYCODE OR HEADER
1981 04E3 16 00       MVI  D,0          DE = INDEX
1982 04E5 21 02 05    LXI  H,PROKE3     HL = ADDRESS, PROKE3
1983 04E8 19          DAD  D            HL = ADDRESS, PROKE3[INDEX]
1984 04E9 7E          MOV  A,M          A = CURKEY = PROKE3[INDEX]
1985                ;                   PROCESS CURRENT KEYCODE
1986 04EA FE 0A       CPI  10           IF CURKEY .LT. 10
1987                ;                     PROCESS NUMERIC KEY
1988 04EC DA 8A 04    JC   PNUMK            PNUMK(CURKEY)
1989                ;                           ( A    )
1990                ;                           ( I    )
1991                ;                     RETURN
1992                ;                   ELSE IF CURKEY .EQ. 10
1993 04EF CA 47 04    JZ   PCLRK            PROCESS CLEAR KEY
1994                ;                     RETURN
1995 04F2 FE 0C       CPI  12           ELSE IF CURKEY .EQ. 11
1996 04F4 DA 50 04    JC   PDCMK            PROCESS DECIMAL KEY
1997                ;                     RETURN
1998                ;                   ELSE IF CURKEY .EQ. 12
1999 04F7 CA 16 05    JZ   PSETK            PROCESS SET KEY
2000                ;                     RETURN
2001 04FA FE 0D       CPI  13           ELSE IF CURKEY .EQ. 13
2002 04FC CA 1F 04    JZ   PAUTHK           PROCESS AUTHORIZATION KEY
2003                ;                     RETURN
2004                ;                   ELSE
2005                ;                     A = HEADER = PROKE3[INDEX]
2006                ;                     EXECUTE HEADER
2007 04FF C3 C7 0D    JMP  XEQHDR           XEQHDR(HEADER,ERROR)
2008                ;                           ( A    ,PSW:Z)
2009                ;                           ( I    , O    )
2010                ;                     RETURN
2011                ;                   ENDIF
2012                PROKE3;   CURKEY    INDEX   DESCRIPTION
2013                ;           OR
2014                ;         HEADER
2015                ;
2016 0502 C4          DB      HSETDA      0     SET DATE
2017 0503 C6          DB      HENTCO      1     ENTER COMBINATION
2018 0504 C5          DB      HENTAM      2     ENTER AMOUNT
2019 0505 0D          DB      13          3     AUTHORIZATION KEY
2020 0506 0C          DB      12          4     SET KEY
2021 0507 0B          DB      11          5     DECIMAL KEY
2022 0508 00          DB       0          6     0 KEY
2023 0509 0A          DB      10          7     CLEAR KEY
2024 050A 55          DB      HREQPC      8     REQUEST PIECE COUNT
2025 050B 09          DB       9          9     9 KEY
2026 050C 08          DB       8         10     8 KEY
2027 050D 07          DB       7         11     7 KEY
2028 050E 53          DB      HREQDR     12     REQUEST DESCENDING REGISTER
2029 050F 06          DB       6         13     6 KEY
2030 0510 05          DB       5         14     5 KEY
2031 0511 04          DB       4         15     4 KEY
2032 0512 52          DB      HREQAR     16     REQUEST ASCENDING REGISTER
2033 0513 03          DB       3         17     3 KEY
2034 0514 02          DB       2         18     2 KEY
2035 0515 01          DB       1         19     1 KEY
```

PSETK

```
2038                ;PSETK()(DBUF  ,NORFLG)
```

```
2039                ;       (NIBSTR,BITSTR)
2040                ;       ( I    , O    )
2041                ;       ( RAM  , RAM  )
2042                ;       ( C    , C    )
2043                ;
2044                ;PSW AND REGISTERS DESTROYED
2045                ;
2046                ;PROCESS SET KEY
2047                ;
2048                PSETK;                  ****ENTRY POINT
2049                ;                       PROCESS SET KEY ACCORDING TO DISPLAY
2050 0516 3A 40 74    LDA  DBUF/2+X         A = DBUF[0..1]
2051 0519 B7          ORA  A                IF DBUF[0..1] .EQ. HEX00
2052 051A C2 2F 05    JNZ  PSETK1
2053                ;                         DISPLAY IS IN KEYENTRY MODE
2054 051D 21 36 05    LXI  H,PSETK2           SET TO QUE POSTAGE VIA RETURN
2055 0520 E5          PUSH H
2056 0521 3A 41 74    LDA  (DBUF+2)/2+X       A = DBUF[2..3]
2057 0524 FE 0F       CPI  0FH                IF DBUF[2..3] .EQ. HEX0F
2058 0526 C8          RZ                        DISPLAY IS CLEAR
2059                ; >>RETURN AHEAD<<          QUE POSTAGE REQUEST
2060                ;                           NORFLG.QUEPOS = TRUE
2061                ;                         ELSE
2062                ;                           DISPLAY CONTAINS KEYENTERED VALUE
2063                ;                           SET POSTAGE
2064 0527 3E C1       MVI  A,HSETPO             A = HSETPO
2065 0529 CD C7 0D    CALL XEQHDR               XEQHDR(HSETPO,ERRFLG)
2066                ;                                 ( A    ,PSW:Z )
2067                ;                                 ( I    , O    )
2068 052C C0          RNZ                       IF ERRFLG .EQ. FALSE
2069                ; >>RETURN AHEAD<<            QUE POSTAGE REQUEST
2070                ;                             NORFLG.QUEPOS = TRUE
2071                ;                           ENDIF
2072                ;                         ENDIF
2073 052D E1          POP  H                  CLEAN UP STACK
2074 052E C9          RET
2075                PSETK1;                 ELSE
2076                ;                         DISPLAY NOT IN KEYENTRY MODE
2077 052F FE 81       CPI  HPSET              PSW:Z = SETTING=DBUF[0..1].EQ.HPSET
2078 0531 3E 41       MVI  A,HENABL           A = HENABL
2079                ;                         IF SETTING .EQ. TRUE
2080                ;                           SETTING IS ON DISPLAY
2081                ;                           ENABLE METER
2082 0533 CA C7 0D    JZ   XEQHDR               XEQHDR(HENABL,ERRFLG)
2083                ;                                 ( A    ,PSW:Z )
2084                ;                                 ( I    , O    )
2085                ;                         ELSE
2086                ;                           SETTING IS NOT ON DISPLAY
2087                PSETK2:                     >>TARGET OF RETURN AHEAD<<
2088                ;                           QUE POSTAGE REQUEST
2089 0536 21 26 74    LXI  H,NORFLG/2+X         HL = ADDRESS, NORFLG
2090 0539 7E          MOV  A,M                  A = NORFLG
2091 053A F6 40       ORI  40H                  NORFLG.QUEPOS = TRUE
2092 053C 77          MOV  M,A
2093                ;                         ENDIF
2094                ;                       ENDIF
2095 053D C9          RET                   RETURN
```

SEGCOD

```
2098                ;SEGCOD(CODE)
2099                ;       (BYTE)
2100                ;       (I/O )
2101                ;       ( A  )
2102                ;       ( C  )
2103                ;
2104                ;PSW:S, Z, P, CY DESTROYED
2105                ;
2106                ;CONVERT 4 BIT HEX VALUE INTO 7 SEGMENT DISPLAY CODE
2107                ;
```

```
2108                SEGCOD;                 ****ENTRY POINT
2109 053E E5          PUSH H                SAVE HL
2110                ;                       FETCH 7 SEGMENT DISPLAY CODE
2111 053F C6 4A       ADI  >SEGC01          HL = ADDRESS, SEGC01[CODE]
2112 0541 6F          MOV  L,A
2113 0542 3E 00       MVI  A,0
2114 0544 CE 05       ACI  <SEGC01
2115 0546 67          MOV  H,A
2116 0547 7E          MOV  A,M              A = CODE = SEGC01[CODE]
2117 0548 E1          POP  H                RESTORE HL
2118 0549 C9          RET                   RETURN
2119                ;
2120                SEGC01; 7 SEG CODE;  HEX VALUE:  GRAPHIC
2121                ;
2122 054A FC          DB      0FCH          0        0
2123 054B 60          DB      060H          1        1
2124 054C DA          DB      0DAH          2        2
2125 054D F2          DB      0F2H          3        3
2126 054E 66          DB      066H          4        4
2127 054F B6          DB      0B6H          5        5
2128 0550 BE          DB      0BEH          6        6
2129 0551 E0          DB      0E0H          7        7
2130 0552 FE          DB      0FEH          8        8
2131 0553 F6          DB      0F6H          9        9
2132 0554 9E          DB      09EH          A        E
2133 0555 0A          DB      00AH          B        r
2134 0556 3A          DB      03AH          C        o
2135 0557 92          DB      092H          D        WING, ENABLED
2136 0558 02          DB      002H          E        WING, DISABLED
2137 0559 00          DB      000H          F        BLANK
```

VALDSP

```
2140                ;VALDSP()(DIMAGE,KDCTRL,DBUF  ,DSPTMR)
2141                ;        (BYTSTR,BITSTR,NIBSTR,UBYTE )
2142                ;        ( O    , O    , I    , O    )
2143                ;        ( RAM  , RAM  , RAM  , RAM  )
2144                ;        ( C    , C    , NC   , C    )
2145                ;
2146                ;PSW:S, Z, P, CY = NO CHANGE
2147                ;
2148                ;TRANSLATE CONTENTS OF DISPLAY BUFFER INTO 7 SEGMENT
2149                ;CHARACTER CODES WHICH ARE PLACED IN THE DISPLAY IMAGE
2150                ;BUFFER
2151                ;
2152                VALDSP;                 ****ENTRY POINT
2153 055A E5          PUSH H                SAVE HL
2154 055B D5          PUSH D                SAVE DE
2155 055C C5          PUSH B                SAVE BC
2156 055D F5          PUSH PSW              SAVE A, PSW
2157                ;                       CLEAR DISPLAY IMAGE BUFFER
2158 055E AF          XRA A                 A = BLANK
2159 055F CD 22 03    CALL FILDIM           FILDIM(BLANK)
2160                ;                             ( A    )
2161                ;                             ( I    )
2162                ;                       DEFINE DEFAULT DISPLAY MODE
2163 0562 3A 27 74    LDA  KDCTRL/2+X       A = KDCTRL
2164 0565 E6 7F       ANI  7FH              KDCTRL.STGDSP = FALSE
2165 0567 F6 20       ORI  20H              KDCTRL.TIMED = TRUE
2166 0569 57          MOV  D,A              D = KDCTRL
2167                ;                       FETCH VALUES FROM DBUF'S FORMAT BYTE
2168 056A 06 82       MVI  B,DBUF+2         B = OFFSET, DBUF[2]
2169 056C CD 35 0F    CALL GETNIB           GETNIB(NCHAR,ZERO ,DBUF[2])
2170                ;                             ( A    ,PSW:Z, @B     )
2171                ;                             ( O    , O    , I     )
2172 056F 4F          MOV  C,A              C = NCHAR
2173 0570 04          INR  B                B = OFFSET, DBUF[3]
2174 0571 CD 35 0F    CALL GETNIB           GETNIB(DECPOS,ZERO ,DBUF[3])
2175                ;                             ( A     ,PSW:Z, @B     )
2176                ;                             ( O     , O    , I     )
```

```
2177 0574 5F          MOV  E,A            E = DECPOS
2178                ;                     POINT AT L/O OF DISPLAY IMAGE BUFFER
2179 0575 21 87 74    LXI  H,DIMAGE/2+Y+(NDISP*4-1)
2180                ;                     HL = ADDRESS, DIMAGE[NDISP*4-1]
2181                ;                     CHECK FOR KEYENTRY IN DISPLAY BUFFER
2182 0578 3A 40 74    LDA  DBUF/2+X       A = DBUF[0..1]
2183 057B B7          ORA  A              IF DBUF[0..1] .EQ. HEX00
2184 057C C2 8D 05    JNZ  VALDS2
2185                ;                       CHECK FOR NULL MESSAGE IN DBUF
2186 057F 3A 41 74    LDA  (DBUF+2)/2+X     A = DBUF[2..3]
2187 0582 FE 0F       CPI  0FH              IF DBUF[2..3] .EQ. HEX0F
2188 0584 C2 89 05    JNZ  VALDS1
2189                ;                         PUT SMALL O IN DISPLAY
2190 0587 36 3A       MVI  M,3AH              OUTPUT DIMAGE[NDISP*4-1] = 'o'
2191                VALDS1;                 ENDIF
2192 0589 7A          MOV  A,D              A = KDCTRL
2193                ;                       MAKE UNTIMED DISPLAY
2194 058A C3 97 05    JMP  VALDS3
2195                ; >>JUMP AHEAD<<
2196                VALDS2;               ENDIF
2197                ;                     CHECK WHETHER SETTING IS ON DISPLAY
2198 058D FE 81       CPI  HPSET          COMPARE DBUF[0..1] WITH HPSET
2199 058F 7A          MOV  A,D            A = KDCTRL
2200 0590 C2 99 05    JNZ  VALDS4         IF DBUF[0..1] .EQ. HPSET
2201                ;                       SHIFT DESTINATION TO LEFT
2202 0593 1C          INR  E                E = DECPOS = DECPOS + 1
2203 0594 2B          DCX  H                HL = ADDRESS, DIMAGE[DST=NDISP*4-2]
2204                ;                       SET SETTING-ON-DISPLAY FLAG
2205 0595 F6 80       ORI  80H              KDCTRL.SIGDSP = TRUE
2206                VALDS3;                 >>TARGET OF JUMP AHEAD<<
2207                ;                       CLEAR DISPLAY-IS-TIMED FLAG
2208 0597 E6 DF       ANI  0DFH             KDCTRL.TIMED = FALSE
2209                VALDS4;               ENDIF
2210 0599 32 27 74    STA  KDCTRL/2+X     OUTPUT KDCTRL
2211                ;                     POINT AT L/O DATA IN DBUF
2212 059C 79          MOV  A,C            A = N = NCHAR
2213 059D B7          ORA  A              A = N/2;  CY = N .MOD. 2
2214 059E 1F          RAR
2215 059F CE 00       ACI  0              B = OFFSET, DBUF[SRC=(N/2+N.MOD.2)*2+3]
2216 05A1 17          RAL
2217 05A2 C6 83       ADI  DBUF+3
2218 05A4 47          MOV  B,A
2219                VALDS5;               DO WHILE NCHAR .GT. 0
2220 05A5 0D          DCR  C
2221 05A6 FA B5 05    JM   VALDS6
2222                ;                       FETCH BCD CHARACTER FROM DBUF
2223 05A9 CD 35 0F    CALL GETNIB           GETNIB(CODE,ZERO ,DBUF[SRC])
2224                ;                             ( A  ,PSW:Z, @B      )
2225                ;                             ( O  , O   , I       )
2226                ;                       TRANSLATE TO 7 BIT DISPLAY CODE
2227 05AC CD 3E 05    CALL SEGCOD           SEGCOD(CODE)
2228                ;                             ( A  )
2229                ;                             ( I/O)
2230                ;                       PUT CODE INTO DISPLAY IMAGE BUFFER
2231 05AF 77          MOV  M,A              DIMAGE[DST] = CODE
2232                ;                       MOVE INDICES LEFT
2233 05B0 05          DCR  B                B = OFFSET, DBUF[SRC=SRC-1]
2234 05B1 2B          DCX  H                HL = ADDRESS, DIMAGE[DST=DST-1]
2235 05B2 C3 A5 05    JMP  VALDS5
2236                VALDS6;               ENDDO
2237                ;                     CHECK WHETHER DECIMAL IS DISPLAYABLE
2238 05B5 7B          MOV  A,E            A = DECPOS
2239 05B6 FE 08       CPI  DSPCHR         IF DECPOS .LT. DSPCHR
2240 05B8 D2 C3 05    JNC  VALDS7
2241                ;                       CALC DECIMAL'S ADDRESS IN DIAMGE
2242 05BB 2F          CMA                   A = -DECPOS-1
2243 05BC C6 88       ADI  (DIMAGE/2+Y-X)+(NDISP*4)
2244 05BE 6F          MOV  L,A
2245                ;                       HL = ADDRESS,
2246                ;                       DIMAGE[N=(NDISP*4-1)-DECPOS]
```

```
2247                ;                          INSERT DECIMAL INTO DISPLAY
2248 05BF 7E          MOV  A,M                 DIMAGE[N] = DIMAGE[N] .OR. HEX01
2249 05C0 F6 01       ORI  01H
2250 05C2 77          MOV  M,A
2251                VALDS7;                  ENDIF
2252                ;                        START DISPLAY TIMER
2253 05C3 3E 07       MVI  A,DSPVAL            DSPTMR = DSPVAL
2254 05C5 32 29 74    STA  DSPTMR/2+X
2255 05C8 F1          POP  PSW                 RESTORE A, PSW
2256 05C9 C1          POP  B                   RESTORE BC
2257 05CA D1          POP  D                   RESTORE DE
2258 05CB E1          POP  H                   RESTORE HL
2259 05CC C9          RET                      RETURN
```

CMDDSB

```
2262                ;CMDDSB/DISABL()(MRSTS1,NORFLG)
2263                ;                (BITSTR,BITSTR)
2264                ;                ( I/O  , O    )
2265                ;                ( RAM  , RAM  )
2266                ;                ( C    , C    )
2267                ;
2268                ;PSW = NO CHANGE
2269                ;
2270                ;DISABLE METER
2271                ;
2272                CMDDSB;                  ****ENTRY POINT FOR EXTERNAL DISABLES
2273 05CD F5          PUSH PSW               SAVE A, PSW
2274                ;                        SET TO SET NORFLG.LATDSB = TRUE
2275 05CE 3E 01       MVI  A,1               A = LATMSK = HEX01
2276 05D0 C3 D5 05    JMP  DISAB1
2277                ; >>JUMP AHEAD<<
2278                DISABL;                  ****ENTRY POINT FOR INTERNAL DISABLES
2279 05D3 F5          PUSH PSW               SAVE A,PSW
2280                ;                        SET TO PRESERVE NORFLG.LATSDB
2281 05D4 AF          XRA  A                 A = LATMSK = HEX00
2282                DISAB1;                  >>TARGET OF JUMP AHEAD<<
2283 05D5 D5          PUSH D                 SAVE DE
2284 05D6 E5          PUSH H                 SAVE HL
2285 05D7 21 26 74    LXI  H,NORFLG/2+X      HL = ADDRESS, NORFLG
2286                ;                        UPDATE NORFLG.LATDSB
2287 05DA B6          ORA  M                 NORFLG = NORFLG .OR. LATMSK
2288 05DB 77          MOV  M,A
2289 05DC 11 24 74    LXI  D,MRSTS1/2+X      DE = ADDRESS, MRSTS1
2290 05DF 1A          LDAX D                 IF MRSTS1.ENABLD .EQ. TRUE
2291 05E0 E6 04       ANI  4
2292 05E2 CA EF 05    JZ   DISAB2
2293 05E5 1A          LDAX D                   MRSTS1.ENABLD = FALSE
2294 05E6 E6 FB       ANI  0FBH
2295 05E8 12          STAX D
2296 05E9 7E          MOV  A,M                 NORFLG.TRPREQ = FALSE
2297 05EA E6 F7       ANI  0F7H
2298 05EC F6 80       ORI  80H                 NORFLG QUESTS = TRUE
2299 05EE 77          MOV  M,A
2300                DISAB2;                  ENDIF
2301 05EF E1          POP  H                   RESTORE HL
2302 05F0 D1          POP  D                   RESTORE DE
2303 05F1 F1          POP  PSW                 RESTORE A, PSW
2304 05F2 C9          RET                      RETURN
```

CMDENB

```
2307                ;CMDENB/ENABLE()(MRSTS1,NORFLG,NVMCTL)
2308                ;                (BITSTR,BITSTR,BITSTR)
2309                ;                ( I/O  , I/O  , I    )
2310                ;                ( RAM  , RAM  , RAM  )
2311                ;                ( C    , C    , NC   )
2312                ;
2313                ;PSW = NO CHANGE
2314                ;
```

```
2315                ;ENABLE METER
2316                ;
2317                CMDENB;                 ****ENTRY POINT FOR EXTERNAL ENABLES
2318 05F3 F5          PUSH PSW              SAVE A, PSW
2319                ;                       SET TO SET NORFLG.LATDSB = FALSE
2320 05F4 3E FE       MVI  A,0FEH           A = LATMSK = HEXFE
2321 05F6 C3 FC 05    JMP  ENABL1
2322                ; >>JUMP AHEAD<<
2323                ENABLE;                 ****ENTRY POINT FOR INTERNAL ENABLES
2324 05F9 F5          PUSH PSW              SAVE A, PSW
2325                ;                       SET TO PRESERVE NORFLG.LATDSB
2326 05FA 3E FF       MVI  A,0FFH           A = LATMSK = HEXFF
2327                ENABL1:                 >>TARGET OF JUMP AHEAD<<
2328 05FC C5          PUSH B                SAVE BC
2329 05FD D5          PUSH D                SAVE DE
2330 05FE E5          PUSH H                SAVE HL
2331 05FF 21 26 74    LXI  H,NORFLG/2+X     HL = ADDRESS, NORFLG
2332                ;                       UPDATE NORFLG.LATDSB
2333 0602 A6          ANA  M                NORFLG = NORFLG .AND. LATMSK
2334 0603 77          MOV  M,A
2335 0604 3A 33 74    LDA  NVMCTL/2+X       IF NVMCTL[0] .NE. HEXF
2336 0607 B7          ORA  A
2337 0608 FA 27 06    JM   ENABL4
2338                ;                         A BLOCK IS OPEN
2339 060B CD 4E 0F    CALL LSTATE             LSTATE(FATMOD,NORMOD,SERMOD,PRVMOD)
2340                ;                               (PSW:S ,PSW:Z ,PSW:P ,PSW:CY)
2341                ;                               ( 0    , 0    , 0    , 0    )
2342 060E C2 27 06    JNZ  ENABL3             IF NORMOD .EQ. TRUE
2343 0611 11 24 74    LXI  D,MRSTS1/2+X         DE = ADDRESS, MRSTS1
2344 0614 1A          LDAX D
2345 0615 E6 EC       ANI  0ECH
2346 0617 47          MOV  B,A                  B = FLAGS = MRSTS1.UNKSEL,
2347                ;                                       MRSTS1.DATDOR,
2348                ;                                       MRSTS1.INSFND,
2349                ;                                       MRSTS1.ENABLD
2350 0618 7E          MOV  A,M
2351 0619 E6 03       ANI  3
2352 061B B0          ORA  B                    A = FLAGS = FLAGS .OR.
2353                ;                                       NORFLG.UNVSEL,
2354                ;                                       NORFLG.LATDSB
2355 061C C2 27 06    JNZ  ENABL2               IF FLAGS .EQ. FALSE
2356 061F 7E          MOV  A,M                    NORFLG.QUESTS = TRUE
2357 0620 F6 80       ORI  80H
2358 0622 77          MOV  M,A
2359 0623 1A          LDAX D                      MRSTS1.ENABLD = TRUE
2360 0624 F6 04       ORI  4
2361 0626 12          STAX D
2362                ENABL2;                     ENDIF
2363                ENABL3;                   ENDIF
2364                ENABL4;                 ENDIF
2365 0627 E1          POP  H                RESTORE HL
2366 0628 D1          POP  D                RESTORE DE
2367 0629 C1          POP  B                RESTORE BC
2368 062A F1          POP  PSW              RESTORE A, PSW
2369 062B C9          RET                   RETURN
```

CONFIG

```
2372                ;CONFIG(ERRFLG)(MTRCHR,XMTBUF)
2373                ;      (BIT   )(BYTE  ,BYTSTR)
2374                ;      ( 0    )( I    , 0    )
2375                ;      (PSW:S )( RAM  , RAM  )
2376                ;      ( C    )( NC   , C    )
2377                ;
2378                ;REGISTERS DESTROYED
2379                ;PSW DESTROYED
2380                ;
2381                ;PUT METER CONFIGURATION MESSAGE IN TRANSMIT BUFFER
2382                ;
2383                CONFIG;                 ****ENTRY POINT
```

```
2384 062C 21 50 74   LXI  H,XMTBUF/2+X  HL = ADDRESS, XMTBUF[0]
2385                ;                   DEFINE MESSAGE LENGTH
2386 062F 36 02      MVI  M,2           XMTBUF[0] = 2
2387                ;                   DEFINE MESSAGE HEADER
2388 0631 23         INX  H             HL = ADDRESS, XMTBUF[1]
2389 0632 36 AB      MVI  M,HCONFG      XMTBUF[1] = HCONFG
2390                ;                   DEFINE ERROR FLAG
2391 0634 2C         INR  L             HL = ADDRESS, XMTBUF[2]
2392                ;                   PSW:Z = ERRFLG = FALSE
2393                ;                   DEFINE METER CHARACTERISTICS
2394 0635 3A 23 74   LDA  MTRCHR/2+X    XMTBUF[2] = MTRCHR
2395 0638 77         MOV  M,A
2396 0639 C9         RET                RETURN
```

CONSUM

```
2399                ;CONSUM(ERRFLG)(CTLCRC)
2400                ;      (BIT   )(BYTE  )
2401                ;      ( 0    )( I    )
2402                ;      (PSW:Z )( RAM  )
2403                ;      ( C    )( NC   )
2404                ;
2405                ;REGISTERS DESTROYED
2406                ;PSW DESTROYED
2407                ;
2408                ;CHECK CONTROL SUM CRC AGAINST EXPECTED CRC
2409                ;
2410                CONSUM;              ****ENTRY POINT
2411                ;                    CALCULATE CONTROL SUM CRC
2412 063A CD 4E 06   CALL CTLSUM         CTLSUM(CSMCRC,ERRFLG)
2413                ;                          ( D    ,PSW:Z )
2414                ;                          ( 0    , 0    )
2415 063D CA 47 06   JZ   CONSU1         IF ERRFLG .EQ. TRUE
2416                ; >>JUMP AHEAD<<       DECLARE DEAD METER. BAD CRC
2417                ;                      A = BADCRC
2418                ;                      NVMDED(BADCRC,ERRFLG)
2419                ;                            ( A    ,PSW:Z )
2420                ;                            ( I    , 0    )
2421                ;                    ELSE
2422 0640 3A 08 74   LDA  CTLCRC/2+X     A = DIF = CTLCRC-CSMCRC
2423 0643 92         SUB  D
2424 0644 CA 4C 06   JZ   CONSU2         IF DIF .NE. 0
2425                CONSU1;                >>TARGET OF JUMP AHEAD<<
2426                ;                      DECLARE DEAD METER. BAD CRC
2427 0647 3E 00      MVI  A,BADCRC         A = BADCRC
2428 0649 C3 85 10   JMP  NVMDED           NVMDED(BADCRC,ERRFLG)
2429                ;                            ( A    ,PSW:Z )
2430                ;                            ( I    , 0    )
2431                CONSU2;              ELSE
2432 064C 3C         INR  A                PSW:Z = ERRFLG = FALSE
2433                ;                    ENDIF
2434 064D C9         RET                  RETURN
```

CTLSUM

```
2437                ;CTLSUM(CSMCRC,ERRFLG)(ASCREG,DSCREG,WORK1 )
2438                ;      (BYTE  ,BIT   )(NIBSTR,NIBSTR,NIBSTR)
2439                ;      ( 0    , 0    )( I    , I    , 0    )
2440                ;      ( D    ,PSW:Z )( RAM  , RAM  , RAM  )
2441                ;      ( C    , C    )( NC   , NC   , C    )
2442                ;
2443                ;REGISTERS DESTROYED
2444                ;PSW DESTROYED
2445                ;
2446                ;CALCULATE CONTROL SUM AND ITS CRC FOR THE CURRENT VALUES
2447                ;OF THE ASCENDING AND DESCENDING REGISTERS
2448                ;
2449                CTLSUM;              ****ENTRY POINT
2450                ;                    COPY ASCENDING REGISTER INTO WORK AREA
2451 064E 01 C9 3F   LXI  B,(ASCREG+ASCSIZ-1)*100H+(WORK1+9)
```

```
2452                ;                          B = OFFSET, ASCREG[I=ASCSIZ-1]
2453                ;                          C = OFFSET, WORK1[J=10-1]
2454 0651 3E 03       MVI  A,ASCSIZ            A = ASCSIZ
2455 0653 CD C2 0F    CALL MVRNIB              MVRNIB(WORK1[J],ASCREG[I],ASCSIZ,
2456                ;                                ( @C     , @B      , A    ,
2457                ;                                ( O      , I       , I    ,
2458                ;
2459                ;                                NONBCD,ZROFLG)
2460                ;                                PSW:S ,PSW:Z )
2461                ;                                O     , O     )
2462 0656 F2 5B 06    JP   CTLSU1              IF NONBCD .EQ. TRUE
2463 0659 AF          XRA  A                     PSW:Z = ERRFLG = TRUE
2464 065A C9          RET
2465                CTLSU1;                    ELSE
2466 065B 3A 17 74    LDA  DSCREG/2+X          IF DSCREG[0..1] .EQ. HEXFF
2467 065E FE FF       CPI  OFFH                  PSW:Z = ERRFLG = TRUE
2468 0660 C8          RZ
2469                ;                          ELSE
2470                ;                            CALCULATE CONTROL SUM IN WORK AREA
2471 0661 06 35       MVI  B,DSCREG+DSCSIZ-1
2472                ;                            B = OFFSET, DSCREG[K=DSCSIZ-1]
2473 0663 11 08 07    LXI  D,DSCSIZ*100H+ASCSIZ
2474                ;                            D = DSCSIZ
2475                ;                            E = ASCSIZ
2476 0666 CD F8 06    CALL DECADD                DECADD(WORK1[J],DSCREG[K],
2477                ;                                  ( O      , I       ,
2478                ;                                  ( @C     , @B      ,
2479                ;
2480                ;                                  ASCSIZ,DSCSIZ,OVRFLO)
2481                ;                                   I    , I    , O    )
2482                ;                                   E    , D    ,PSW:CY)
2483                ;                            CALCULATE CRC FOR CONTROL SUM
2484 0669 01 C2 08    LXI  B,(ASCSIZ)*100H+(WORK1+10-ASCSIZ)
2485                ;                            B = ASCSIZ
2486                ;                            C = OFFSET, WORK1[L=10-ASCSIZ]
2487 066C CD B1 0E    CALL CRC                   CRC(WORK1[L],ASCSIZ,CSMCRC)
2488                ;                               ( I      , I    , O    )
2489                ;                               ( @C     , B    , D    )
2490 066F 04          INR  B                     PSW:Z = ERRFLG = FALSE
2491                ;                          ENDIF
2492 0670 C9          RET                        RETURN
```

DBLHDR

```
2495                ;DBLHDR(HEADER,ERRFLG)(LOWWRN,SERNUM,ERRST ,SETLIM,ASCREG,
2496                ;      (BYTE  ,BIT   )(NIBSTR,NIBSTR,NIBSTR,NIBSTR,NIBSTR,
2497                ;      ( I    , O    )( I    , I    , I    , I    , I    ,
2498                ;      ( A    ,PSW:Z )( RAM  , RAM  , RAM  , RAM  , RAM  ,
2499                ;      ( NC   , C    )( NC   , NC   , NC   , NC   , NC   ,
2500                ;
2501                ;      DSCREG,WORK1 ,PCEREG,MRSTS1)
2502                ;      NIBSTR,NIBSTR,NIBSTR,BITSTR)
2503                ;       I    , I    , I    , O    )
2504                ;       RAM  , RAM  , RAM  , RAM  )
2505                ;       NC   , NC   , NC   , C    )
2506                ;
2507                ;REGISTERS DESTROYED
2508                ;PSW DESTROYED
2509                ;
2510                ;PROCESS DOUBLY DEFINED HEADERS
2511                ;
2512                DBLHDR;                    ****ENTRY POINT
2513 0671 CD 4E 0F    CALL LSTATE              LSTATE(FATMOD,NORMOD,SERMOD,PRVMOD)
2514                ;                                (PSW:S ,PSW:Z ,PSW:P ,PSW:CY)
2515                ;                                ( O    , O    , O    , O    )
2516 0674 21 E2 06    LXI  H,DBLH04            SET TO RETURN TO ENDCASE
2517 0677 E5          PUSH H
2518 0678 E2 A6 06    JPO  DBLH02              IF SERMOD .EQ. TRUE
2519                ;                          --CASE (HEADER)
2520 067B FE 52       CPI  HREQDL                **52: DOLLAR LOCK VALUE REQUEST
```

```
2521 067D 11 E3 06   LXI  D,DBLH05+0
2522 0680 CA 5B 0D   JZ   VALREQ          VALREQ(UNLOCK,LOKFMT,HDLOCK,ERRFLG)
2523               ;                            (@@DE+0,@DE+1 ,@DE+2 ,PSW:Z )
2524               ;                            ( I    , I    , I    , O    )
2525 0683 FE 53      CPI  HREQLP          **53: LOW POSTAGE WARNING VALUE REQ
2526 0685 01 8B 1C   LXI  B,LOWWRN*100H+HLOPOS
2527 0688 CA 34 0D   JZ   SRVREQ          SRVREQ(LOWWRN,HLOPOS,ERRFLG)
2528               ;                            ( @B   , C    ,PSW:Z )
2529               ;                            ( I    , I    , O    )
2530 068B FE 54      CPI  HREQMN          **54: METER SERIAL NUMBER REQUEST
2531               DBLH01;                ****ALTERNATE ENTRY POINT
2532 068D 11 E6 06   LXI  D,DBLH05+3
2533 0690 CA 5B 0D   JZ   VALREQ          VALREQ(SERNUM,MSNFMT,HMTRNO,ERRFLG)
2534               ;                            (@@DE+0,@DE+1 ,@DE+2 ,PSW:Z )
2535               ;                            ( I    , I    , I    , O    )
2536 0693 FE 55      CPI  HREQDS          **55: DIAGNOSTIC REQUEST
2537 0695 11 E9 06   LXI  D,DBLH05+6
2538 0698 CA 5B 0D   JZ   VALREQ          VALREQ(ERRST ,DIAFMT,HDIAGS,ERRFLG)
2539               ;                            (@@DE+0,@DE+1 ,@DE+2 ,PSW:Z )
2540               ;                            ( I    , I    , I    , O    )
2541 069B FE 56      CPI  HREQSL          **56: SETTING LIMIT VALUE REQUEST
2542 069D 01 8E 1E   LXI  B,SETLIM*100H+HHSLIM
2543 06A0 CA 34 0D   JZ   SRVREQ          SRVREQ(SETLIM,HHSLIM,ERRFLG)
2544               ;                            ( @B   , C    ,PSW:Z )
2545               ;                            ( I    , I    , O    )
2546               ;                       **ELSE: PROCESS ERROR
2547 06A3 C3 A1 0B   JMP  PROERR          PROERR(ERRFLG)
2548               ;                            (PSW:Z )
2549               ;                            ( O    )
2550               ;                      --ENDCASE
2551               DBLH02;                ELSE
```

DBLHDR

```
2552               ;                      --CASE (HEADER)
2553 06A6 FE 52      CPI  HREQAR          **52: ASCENDING REGISTER REQUEST
2554 06A8 11 EC 06   LXI D,DBLH05+9
2555 06AB CA 5B 0D   JZ   VALREQ          VALREQ(ASCREG,ASCFMT,HAREG ,ERRFLG)
2556               ;                            (@@DE+0,@DE+1 ,@DE+2 ,PSW:Z )
2557               ;                            ( I    , I    , I    , O    )
2558 06AE FE 53      CPI  HREQDR          **53: DESCENDING REGISTER REQUEST
2559 06B0 11 EF 06   LXI  D,DBLH05+12
2560 06B3 CA 5B 0D   JZ   VALREQ          VALREQ(DSCREG,DSCFMT,HDREG ,ERRFLG)
2561               ;                            (@@DE+0,@DE+1 ,@DE+2 ,PSW:Z )
2562               ;                            ( I    , I    , I    , O    )
2563 06B6 FE 54      CPI  HREQCS          **54: CONTROL SUM REQUEST
2564 06B8 C2 C5 06   JNZ  DBLH03
2565 06BB CD 3A 06   CALL CONSUM          CONSUM(ERRFLG)
2566               ;                            (PSW:Z )
2567               ;                            ( O    )
2568 06BE 11 F2 06   LXI  D,DBLH05+15
2569               ;                       IF ERRFLG .EQ. FALSE
2570               ;                         I = 10-ASCSIZ
2571 06C1 C4 5B 0D   CNZ  VALREQ            VALREQ(WORK1[I],CSMFMT.HCSUM,ERRFLG)
2572               ;                              (@@DE+0  ,@DE+1 ,@DE+2,PSW:Z )
2573               ;                              ( I      , I    , I    , O    )
2574               ;                       ENDIF
2575 06C4 C9         RET
2576               DBLH03;
2577 06C5 FE 55      CPI  HREQPC          **55: PIECE COUNT REQUEST
2578 06C7 11 F5 06   LXI  D,DBLH05+18
2579 06CA CA 5B 0D   JZ   VALREQ          VALREQ(PCEREG,PCEFMT,HPCNT ,ERRFLG)
2580               ;                              (@@DE+0,@DE+1 ,@DE+2 ,PSW:Z )
2581               ;                              ( I    , I    , I    , O    )
2582 06CD FE 5B      CPI  HREQCF          **5B: CONFIGURATION DATA REQUEST
2583 06CF CA 3C 06   JZ   CONFIG          CONFIG(ERRFLG)
2584               ;                              (PSW:Z )
2585               ;                              ( O    )
2586 06D2 FE C4      CPI  HSETDA          **C4: RESET DATER DOOR
2587 06D4 C2 A1 0B   JNZ  PROERR
```

```
2588 06D7 21 24 74   LXI  H,MRSTS1/2+X     HL = ADDRESS, MRSTS1
2589 06DA 7E         MOV  A,M              MRSTS1.DATDOR = FALSE
2590 06DB E6 BF      ANI  0BFH
2591 06DD 77         MOV  M,A
2592 06DE 24         INR  H                PSW:Z = ERRFLG = FALSE
2593 06DF C3 48 0C   JMP  SELVAL           DISPLAY SELECTION VALUE
2594                ;                      **ELSE: PROCESS ERROR
2595                ;                      PROERR(ERRFLG)
2596                ;                            (PSW:Z )
2597                ;                            ( 0    )
2598               DBLH04;               --ENDCASE
2599                ;                    ENDIF
2600 06E2 C9         RET                 RETURN
2601               DBLH05;               ARGUMENTS FOR VALREQ
2602 06E3 18 40 8A   DB   UNLOCK,LOKFMT,HDLOCK          ;+0
2603 06E6 21 7F 8C   DB   SERNUM,MSNFMT,HMTRNO          ;+3
2604 06E9 13 5F 8D   DB   ERRST,DIAFMT,HDIAGS           ;+6
2605 06EC 38 80 82   DB   ASCREG,ASCFMT,HAREG           ;+9
2606 06EF 2F 70 83   DB   DSCREG,DSCFMT,HDREG           ;+12
2607 06F2 C2 80 84   DB   WORK1+10-ASCSIZ,CSMFMT,HCSUM   ;+15
2608 06F5 28 7F 85   DB   PCEREG,PCEFMT,HPCNT           ;+18
```

DECADD

```
2611                ;DECADD(V1[V1DGTS-1],V2[V2DGTS-1],V1DGTS,V2DGTS,OVRFLO)
2612                ;      (NIBSTR      ,NIBSTR      ,BYTE  ,BYTE  , BIT  )
2613                ;      ( I/O        , I          , I    , I    , O    )
2614                ;      ( @C         , @B         , E    , D    ,PSW:CY)
2615                ;      ( C          , NC         , C    , C    , C    )
2616                ;
2617                ;PSW DESTROYED
2618                ;REGISTERS DESTROYED
2619                ;
2620                ;BCD ADDITION OF UNSIGNED BCD VALUE STRINGS
2621                ;V1[0..V1DGTS-1] = V1[0..V1DGTS-1] + V2[0..V2DGTS-1]
2622                ;WHERE V1DGTS .GE. V2DGTS
2623                ;
2624               DECADD;               ****ENTRY POINT
2625                ;                    C  OFFSET, V1[I=V1DGTS-1]
2626                ;                    B  OFFSET, V2[J=V2DGTS-1]
2627 06F8 7B         MOV  A,E            IF V1DGTS .LT. V2DGTS
2628 06F9 BA         CMP  D
2629 06FA DA 20 07   JC   DECERR           DECLARE BAD ARGUMENT
2630                ;                      ENTER FATAL ERROR MODE
2631                ;                    ENDIF
2632 06FD AF         XRA  A              PSW:CY = CARRY = FALSE
2633               DECAD1;               DO WHILE V1DGTS .GE. 0
2634 06FE 1D         DCR  E                E = V1DGTS = V1DGTS-1
2635 06FF F8         RM
2636 0700 CD 0C 07   CALL DECCOM           DECCOM(V1[I],V2[J],V1DGTS,V2DGTS,
2637                ;                            ( @C  , @B  , E    , D    ,
2638                ;                            ( I   , I/O , -    , I/O  ,
2639                ;
2640                ;                            VAL1,VAL2)
2641                ;                             L  , A  )
2642                ;                             O  , O  )
2643                ;                      L[0..1] = VAL1 = HEX90 .OR. V1[I]
2644                ;                      A[0..1] = VAL2 = V2[J]
2645                ;                      B = OFFSET, V2[J=J-1]
2646                ;                      D = V2DGTS = V2DGTS-1
2647 0703 8D         ADC  L              A[1] = VAL1 = VAL1+VAL2+CARRY
2648 0704 27         DAA
2649                ;                      PSW:CY = CARRY
2650 0705 CD EE 0F   CALL PUTNIB           PUTNIB(V1[I],VAL1)
2651                ;                            ( @C  ,A[1])
2652                ;                            ( O   , I  )
2653 0708 0D         DCR  C                C = OFFSET, V1[I=I-1]
2654 0709 C3 FE 06   JMP  DECAD1
2655                ;                    ENDDO
2656                ;                    RETURN
```

DECCOM

```
                    ;DECCOM(V1[I] ,V2[J] ,V1DGTS,V2DGTS,VAL1,VAL2)
                    ;      (NIBBLE,NIBBLE,BYTE  ,BYTE  ,BYTE,BYTE)
                    ;      ( I    , I/O  , -    , I/O  , O  , O  )
                    ;      ( @C   , @B   , E    , D    , L  , A  )
                    ;      ( NC   , C    , NC   , C    , C  , C  )
                    ;
                    ;PSW:CY = NO CHANGE
                    ;PSW:S, Z, P CHANGED
                    ;REGISTERS DESTROYED
                    ;
                    ;COMMON ROUTINE CALLED BY DECADD AND DECSUB
                    ;FETCHES NEXT PAIR OF OPERANDS
                    ;VAL1 = HEX90 .OR. V1[I]
                    ;VAL2 = V2[J]
                    ;J AND V2DGTS WILL BE DECREMENTED
                    ;
                    DECCOM;                 ****ENTRY POINT
070C F5               PUSH PSW              SAVE PSW:CY
070D 60               MOV  H,B              H = OFFSET, V2[J]
070E 41               MOV  B,C              B = OFFSET, V1[I]
070F CD 35 0F         CALL GETNIB           GETNIB(VAL1,ZROFLG,V1[I])
                    ;                             ( A  ,PSW:Z , @B  )
                    ;                             ( O  , O    , I   )
0712 F6 90            ORI  90H              L[0..1] = VAL1 = HEX90 .OR. VAL1
0714 6F               MOV  L,A
0715 44               MOV  B,H              B = OFFSET, V2[J]
0716 F1               POP  PSW              RESTORE PSW:CY
0717 3E 00            MVI  A,0              A[0..1] = VAL2 = 0
0719 15               DCR  D                D = V2DGTS = V2DGTS-1
071A F8               RM                    IF V2DGTS .GE. 0
071B CD 35 0F         CALL GETNIB             GETNIB(VAL2   ,ZROFLG,V2[J])
                    ;                               (A[0..1],PSW:Z , @B  )
                    ;                               ( O     , O    , I   )
071E 05               DCR  B                  B = OFFSET, V2[J=J-1]
                    ;                       ENDIF
071F C9               RET                   RETURN
```

DECERR

```
                    ;DECERR()
                    ;
                    ;PSW DESTROYED
                    ;ALL REGISTERS DESTROYED
                    ;
                    ;ERROR ROUTINE CALLED BY DECADD AND DECSUB
                    ;
                    DECERR;                 ****ENTRY POINT
0720 3E 02            MVI  A,SFTWRE         A = SFTWRE
0722 CD 80 08         CALL FATERR           ENTER FATAL MODE. SOFTWARE ERROR
0725 CD 68 10         CALL NVMCHG           SAVE NONVOLATILE MEMORY
0728 C3 B6 01         JMP  PWRDN            FREEZE UNTIL NEXT POWER UP
```

DECSUB

```
                    ;DECSUB(V1[V1DIGS-1],V2[V2DGTS-1],V1DGTS,V2DGTS)
                    ;      (NIBSTR      ,NIBSTR      ,BYTE  ,BYTE  )
                    ;      ( I/O        , I          , I    , I    )
                    ;      ( @C         , @B         , E    , D    )
                    ;      ( C          , NC         , C    , C    )
                    ;
                    ;PSW DESTROYED
                    ;REGISTERS DESTROYED
                    ;
                    ;BCD SUBTRACTION OF UNSIGNED BCD VALUE STRINGS
                    ;V1[0..V1DGTS-1] = V1[0..V1DGTS-1] - V2[0..V2DGTS-1]
                    ;WHERE V1DGTS .GE. V2DGTS
                    ;
                    DECSUB;                 ****ENTRY POINT
```

```
2725                ;                          C = OFFSET, V1[I=V1DGTS-1]
2726                ;                          B = OFFSET, V2[J=V2DGTS-1]
2727 072B 7B          MOV  A,E                 IF V1DGTS .LT. V2DGTS
2728 072C BA          CMP  D
2729 072D DA 20 07    JC   DECERR                DECLARE BAD ARGUEMENT
2730                ;                            ENTER FATAL ERROR MODE
2731                ;                          ENDIF
2732 0730 AF          XRA  A                   PSW:CY = BORROW = FALSE
2733                DECSU1;                    DO WHILE V1DGTS .GE. 0
2734 0731 1D          DCR  E                     E = V1DGTS = V1DGTS-1
2735 0732 F8          RM
2736 0733 CD 0C 07    CALL DECCOM                DECCOM(V1[I],V2[J],V1DGTS,V2DGTS,
2737                ;                                 ( @C  , @B  , E   , D   ,
2738                ;                                 ( I   , I/O , -   , I/O ,
2739                ;
2740                ;                                 VAL1,VAL2)
2741                ;                                  L  , A  )
2742                ;                                  O  , O  )
2743                ;                            L[0..1] = VAL1 = HEX90 .OR. V1[I]
2744                ;                            A[0..1] = VAL2 = V2[J]
2745                ;                            B = OFFSET, V2[J=J-1]
2746                ;                            D = V2DGTS = V2DGTS-1
2747 0736 CE F6       ACI  -10                   A[1] = VAL1-VAL2-BORROW
2748 0738 2F          CMA
2749 0739 3C          INR  A
2750 073A 85          ADD  L
2751 073B 27          DAA
2752 073C 3F          CMC                        PSW:CY = BORROW
2753 073D CD EE 0F    CALL PUTNIB                PUTNIB(V1[I],VAL1)
2754                ;                                 ( @C  , A  )
2755                ;                                 ( O   , I  )
2756 0740 0D          DCR  C                     C = OFFSET, V1[I=I-1]
2757 0741 C3 31 07    JMP  DECSU1
2758                ;                          ENDDO
2759                ;                          RETURN
```

DOACCT

```
2762                ;DOACCT()(POSREG,ASCCRC,ASCREG,DSCCRC,DSCREG,PCEREG,WORK1 )
2763                ;        (NIBSTR,BYTE  ,NIBSTR,BYTE  ,NIBSTR,NIBSTR,NIBSTR)
2764                ;        ( I    , O    , I/O  , O    , I/O  , I/O  , O    )
2765                ;        ( RAM  , RAM  , RAM  , RAM  , RAM  , RAM  , RAM  )
2766                ;        ( NC   , C    , C    , C    , C    , C    , C    )
2767                ;
2768                ;PSW DESTROYED
2769                ;REGISTERS DESTROYED
2770                ;
2771                ;DO ACCOUNTING FOR METER TRIP
2772                ;
2773                DOACCT;                    ****ENTRY POINT
2774                ;                          ADD POSTAGE TO ASCENDING REGISTER
2775 0744 11 08 04    LXI  D,NBANKS*100H+ASCSIZ
2776                ;                          D = NBANKS
2777                ;                          E = ASCSIZ
2778 0747 01 3F 45    LXI  B,(POSREG+NBANKS-1)*100H+(ASCREG+ASCSIZ-1)
2779                ;                          B = OFFSET, POSREG[I=NBANKS-1]
2780                ;                          C = OFFSET, ASCREG[J=ASCSIZ-1]
2781 074A CD F8 06    CALL DECADD              DECADD(ASCREG[J],POSREG[I],
2782                ;                                 ( @C      , @B      ,
2783                ;                                 ( I/O     , I       ,
2784                ;
2785                ;                                 ASCSIZ,NBANKS)
2786                ;                                  E    , D    )
2787                ;                                  I    , I    )
2788                ;                          COMPUTE CRC FOR ASCENDING REGISTER
2789 074D 01 38 06    LXI  B,ASCSIZ*100H+ASCREG
2790                ;                          B = ASCSIZ
2791                ;                          C = OFFSET, ASCREG
2792 0750 CD B1 0E    CALL CRC                 CRC(ASCREG,ASCSIZ,CRCVAL)
```

```
2793                ;                          ( @C    , B     , D     )
2794                ;                          ( I     , I     , O     )
2795 0753 7A          MOV  A,D             ASCCRC = CRCVAL
2796 0754 32 20 74    STA  ASCCRC/2+X
2797                ;                    SUBTRACT POSTAGE FROM DESCENDING REG
2798 0757 11 07 04    LXI  D,NBANKS*100H+DSCSIZ
2799                ;                    D = NBANKS
2800                ;                    E = DSCSIZ
2801 075A 01 35 45    LXI  B,(POSREG+NBANKS-1)*100H+(DSCREG+DSCSIZ-1)
2802                ;                    B = OFFSET, POSREG[I=NBANKS-1]
2803                ;                    C = OFFSET, DSCREG[J=DSCSIZ-1]
2804 075D CD 2B 07    CALL DECSUB          DECSUB(DESCREG[J],POSREG[I],
2805                ;                          ( @C        , @B       ,
2806                ;                          ( I/O       , I        ,
2807                ;
2808                ;                          DSCSIZ,NBANKS)
2809                ;                           E     , D     )
2810                ;                           I     , I     )
2811                ;                    COMPUTE CRC FOR DESCENDING REGISTER
2812 0760 01 2F 07    LXI  B,DSCSIZ*100H+DSCREG
2813                ;                    B = DSCSIZ
2814                ;                    C = OFFSET,DSCREG
2815 0763 CD B1 0E    CALL CRC             CRC(DSCREG,DSCSIZ,CRCVAL)
2816                ;                       ( @C    , B     , D     )
2817                ;                       ( I     , I     , O     )
2818 0766 7A          MOV  A,D             DSCCRC = CRCVAL
2819 0767 32 1B 74    STA  DSCCRC/2+X
2820                ;                    INCREMENT THE PIECE COUNT
2821 076A 3E 10       MVI  A,10H           WORK1[0] = 1
2822 076C 32 60 74    STA  WORK1/2+X
2823 076F 11 07 01    LXI  D,1*100H+PCESIZ
2824                ;                    D = ONESIZ = 1
2825                ;                    E = PCESIZ
2826 0772 01 2E C0    LXI  B,(WORK1+1-1)*100H+(PCEREG+PCESIZ-1)
2827                ;                    B = OFFSET, WORK1[I=ONESIZ-1]
2828                ;                    C = OFFSET, PCEREG[J=PCESIZ-1]
2829 0775 C3 F8 06    JMP  DECADD          DECADD(PCEREG[J],WORK1[I],
2830                ;                          ( @C       , @B      ,
2831                ;                          ( I/O      , I       ,
2832                ;
2833                ;                          PCESIZ,ONESIZ)
2834                ;                           E     , D     )
2835                ;                           I     , I     )
2836                ;                    RETURN
```

DOSTAT

```
2839                ;DOSTAT()(MRSTS1,MRSTS2,NORFLG)
2840                ;        (BITSTR,BITSTR,BITSTR)
2841                ;        ( I     , I/O   , I/O   )
2842                ;        ( RAM   , RAM   , RAM   )
2843                ;        ( NC    , C     , C     )
2844                ;
2845                ;REGISTERS DESTROYED
2846                ;PSW DESTROYED
2847                ;
2848                ;UPDATE METER STATUS TO AGREE WITH SWITCHES AND SENSORS
2849                ;
2850                DOSTAT;              ****ENTRY POINT
2851                ;                    FETCH PRESENT SWITCH VALUES
2852 0778 CD 31 0C    CALL RDSTS           RDSTS(TRPSW,PRVSW)
2853                ;                          ( B     , A     )
2854                ;                          ( O     , O     )
2855 077B E6 01       ANI  1               C = PRVSW = PRVSW .AND. HEX01
2856 077D 4F          MOV  C,A
2857 077E 78          MOV  A,B             B = TRPSW = TRPSW .AND. HEX08
2858 077F E6 08       ANI  8
2859 0781 47          MOV  B,A
2860 0782 81          ADD  C               C = NEWSWS = PRVSW + TRPSW
```

```
2861 0793 4F          MOV  C,A
2862 0794 21 25 74    LXI  H,MRSTS2/2+X   HL = ADDRESS, MRSTS2
2863                ;                     SAVE ENTRY STATUS
2864 0797 7E          MOV  A,M            A = MRSTS2
2865 0798 57          MOV  D,A            D = OLDST2 = MRSTS2
2866                ;                     UPDATE STATUS
2867                ;                     MRSTS2.TRPSW = TRPSW
2868                ;                     MRSTS2.PRVMOD = PRVSW
2869 079B E6 F6       ANI  0F6H           MRSTS2 = MRSTS2.AND.HEXF6.OR.NEWSWS
2870 079D B1          ORA  C
2871 079C 77          MOV  M,A
2872                ;                     CHECK METER STATUS
2873 079D CD 4E 0F    CALL LSTATE         LSTATE(FATMOD,NORMOD,SERMOD,PRVMOD)
2874                ;                           (PSW:S ,PSW:Z ,PSW:P ,PSW:CY)
2875                ;                           ( 0    , 0    , 0    , 0    )
2876 07A0 F8          RM                  IF FATMOD .EQ. FALSE
2877                ;                       READ CYCLE SWITCH
2878 07A1 CD AF 0B    CALL RDCYC            RDCYC(INCYC,INCYC,ADRESS,MRSTS1)
2879                ;                             ( A   ,PSW:C, HL   , @HL  )
2880                ;                             ( 0   , 0   , 0    , -    )
2881 07A4 3E 04       MVI  A,BADCYC         A = BADCYC
2882                ;                       IF INCYC .EQ. TRUE
2883                ;                         CYCLE SWITCH SAYS METER NOT HOME
2884                ;                         DECLARE DEAD METER, BAD SWITCH
2885 07A6 DA 85 10    JC   NVMDED             NVMDED(BADCYC,ERRFLG)
2886                ;                               ( A    ,PSW:Z )
2887                ;                               ( I    , 0    )
2888                ;                       ELSE
2889                ;                         CALC SEQ SWITCH CLOSURE VALUE
2890 07A9 7A          MOV  A,D
2891 07AA A0          ANA  B
2892 07AB A8          XRA  B
2893 07AC 4F          MOV  C,A                C = CLOSUR = OLDST2.TRPSW .AND.
2894                ;                                    TRPSW .XOR. TRPSW
2895                ;                         DEFINE TRIP REQUEST VALUE
2896 07AD 7E          MOV  A,M                A=TRPREQ=MRSTS1.ENABLD.AND.CLOSUR
2897 07AE 17          RAL
2898 07AF A1          ANA  C
2899                ;                         UPDATE TRIP REQUEST STATUS
2900                ;                         NORFLG.TRPREQ = TRPREQ
2901 07A0 23          INX  H                  HL = ADDRESS, NORFLG
2902 07A1 23          INX  H
2903 07A2 B6          ORA  M                  NORFLG = TRPREQ .OR. NORFLG
2904 07A3 77          MOV  M,A
2905                ;                       ENDIF
2906                ;                     ENDIF
2907 07A4 C9          RET                 RETURN
```

DOTRIP

```
2910                ;DOTRIP()(MRSTS1,NORFLG,PORTA )
2911                ;        (BITSTR,BITSTR,BITSTR)
2912                ;        ( 0    , 0    , 0    )
2913                ;        ( RAM  , RAM  , 7001 )
2914                ;        ( C    , C    , C    )
2915                ;
2916                ;REGISTERS DESTROYED
2917                ;PSW DESTROYED
2918                ;
2919                ;TRIP METER
2920                ;
2921                DOTRIP;             ****ENTRY POINT
2922 07A5 CD DE 0E    CALL DBLANK       TURN OFF DISPLAY
2923                ;                   CHECK CYCLE SWITCH WHILE METER HOME
2924 07A8 CD AF 0B    CALL RDCYC        RDCYC(INCYC,INCYC,ADRESS,MRSTS1)
2925                ;                         ( A   ,PSW:C, HL   , @HL  )
2926                ;                         ( 0   , 0   , 0    , -    )
2927 07AB 3E 04       MVI  A,BADCYC     A = BADCYC
2928                ;                   IF INCYC .EQ. TRUE
```

```
2929                ;                          CYCLE SWITCH SAYS METER NOT HOME
2930                ;                          DECLARE DEAD METER, BAD SWITCH
2931 07AD DA 85 10    JC   NVMDED              NVMDED(BADCYC,ERRFLG)
2932                ;                                ( A    ,PSW:Z )
2933                ;                                ( I    , 0    )
2934                ;                        ELSE
2935                ;                          CYCLE SWITCH SAYS METER IS HOME
2936                ;                          INDICATE TRIP HAS STARTED
2937 07B0 7E          MOV  A,M                 A = MRSTS1
2938 07B1 F6 81       ORI  81H                 MRSTS1.UNKSEL = TRUE
2939                ;                          MRSTS1.QUEREG = TRUE
2940 07B3 77          MOV  M,A
2941 07B4 23          INX  H                   HL = ADDRESS, NORFLG
2942 07B5 23          INX  H
2943 07B6 7E          MOV  A,M                 NORFLG.TRPREQ = FALSE
2944 07B7 E6 F7       ANI  0F7H
2945 07B9 F6 40       ORI  40H                 NORFLG.QUEPOS = TRUE
2946 07BB 77          MOV  M,A
2947                ;                          TRIP METER
2948 07BC CD 7C 18    CALL MVTRIP              MVTRIP(ERROR)
2949                ;                                ( A    )
2950                ;                                ( 0    )
2951 07BF B7          ORA  A                   IF ERROR .NE. 0
2952                ;                            DECLARE TRIP ERROR
2953 07C0 C2 80 08    JNZ  FATERR              FATERR(ERROR,ERRFLG)
2954                ;                                ( A    ,PSW:Z )
2955                ;                                ( I    , 0    )
2956                ;                          ELSE
2957                ;                            TRIP STARTED OK
2958                ;                            START AC MOTOR TO CONTINUE CYCLE
2959 07C3 21 01 70    LXI  H,PORTA             HL = ADDRESS, PORTA
2960 07C6 7E          MOV  A,M                 PORTA = PORTA .AND. HEXEF
2961 07C7 E6 EF       ANI  0EFH
2962 07C9 77          MOV  M,A
2963 07CA F3          DI                       DISABLE INTERRUPT
2964 07CB CD 44 07    CALL DOACCT              ACCOUNT FOR TRIP
2965                ;                          PREVENT DOUBLE ACCOUNTING
2966 07CE 21 24 74    LXI  H,MRSTS1/2+X        HL = ADDRESS, MRSTS1
2967 07D1 7E          MOV  A,M                 MRSTS1.INCYC = TRUE
2968 07D2 F6 02       ORI  2
2969 07D4 77          MOV  M,A
2970 07D5 FB          EI                       ENABLE INTERRUPT
2971                ;                          CHECK CYCLE SWITCH WHILE NOT HOME
2972 07D6 01 B8 0B    LXI  B,3000              BC = N = 3000 ;FOR 300 MSEC LOOP
2973                DOTR01;                    LOOP
2974 07D9 CD AF 0B    CALL RDCYC                 RDCYC(INCYC,INCYC,ADRESS,MRSTS1)
2975                ;                                ( A    ,PSW:C, HL    , @HL  )
2976                ;                                ( 0    , 0    , 0    , -    )
2977                ;                            IF INCYC .EQ. TRUE
2978 07DC DA ED 07    JC   DOTR02                  BREAK
2979                ;                            ENDIF
2980 07DF CD 19 0B    CALL NPAUSE                NPAUSE(N  ,ZROFLG)
2981                ;                                (BC ,PSW:Z )
2982                ;                                (I/O, 0    )
2983 07E2 C2 D9 07    JNZ  DOTR01                IF N .EQ. 0
2984                ;                              TIMEOUT
2985                ;                              CYC SWT SAYS MOTOR STILL HOME
2986                ;                              FATAL ERROR, NOT IN CYCLE
2987 07E5 3E 18       MVI  A,NINCYC              A = NINCYC
2988 07E7 CD 80 08    CALL FATERR                FATERR(NINCYC,ERRFLG)
2989                ;                                ( A    ,PSW:Z )
2990                ;                                ( I    , 0    )
2991 07EA C3 A0 08    JMP  FINTRP                TRY TO DRIVE METER HOME
2992                ;                              RETURN
2993                ;                            ENDIF
2994                DOTR02;                    ENDLOOP
2995                ;                          CYCLE SWITCH SAYS CYCLE STARTED
2996                ;                          MOVE FROM TRIP TO LOCK
2997 07ED CD 96 18    CALL MVLOCK              MVLOCK(ERROR)
2998                ;                                ( A    )
```

```
2999                ;
3000 07F0 B7          ORA  A
3001                ;
3002 07F1 C4 80 08    CNZ  FATERR
3003                ;
3004                ;
3005                ;
3006                ;
3007 07F4 01 10 27    LXI  B,10000
3008                DOTR03:
3009 07F7 CD AF 0E    CALL RDCYC
3010                ;
3011                ;
3012                ;
3013 07FA D2 0D 08    JNC  DOTR04
3014                ;
3015 07FD CD 19 0B    CALL NPAUSE
3016                ;
3017                ;
3018 0800 C2 F7 07    JNZ  DOTR03
3019                ;
3020                ;
3021 0803 E5          PUSH H
3022 0804 CD D0 08    CALL FINTR4
3023 0807 E1          POP  H
3024 0808 3E FB       MVI  A,0FBH
3025                ;
3026 080A C3 0F 08    JMP  DOTR05
3027                ; >>JUMP AHEAD<<
3028                ;
3029                ;
3030                DOTR04;
3031                ;
3032                ;
3033 080D 3E 7B       MVI  A,7BH
3034                ;
3035                ;
3036                DOTR05;
3037                ;
3038 080F A6          ANA  M
3039 0810 77          MOV  M,A
3040                DOTR06;
3041                ;
3042 0811 21 01 70    LXI  H.PORTA
3043 0814 7E          MOV  A,M
3044 0815 F6 10       ORI  10H
3045 0817 77          MOV  M,A
3046                ;
3047                ;
3048 0818 C9          RET
```

```
        ( 0    )
IF ERROR .NE. 0
  DECLARE LOCK ERROR
  FATERR(ERROR,ERRFLG)
        ( A    ,PSW:Z )
        ( I    , 0    )
ENDIF
CHECK CYCLE SWITCH WHEN HOME AGAIN
BC = N = 10000 ;FOR 1 SEC LOOP
LOOP
  RDCYC(INCYC,INCYC,ADDRESS,MRSTS1)
        ( A    ,PSW:C, HL    , @HL  )
        ( 0    , 0    , 0    , -    )
  IF INCYC .EQ. FALSE
    BREAK
  ENDIF
  NPAUSE(N  ,ZROFLG)
        (BC ,PSW:Z )
        (I/O, 0    )
  IF N .EQ. 0
    TIMEOUT
    CYC SWT SAYS MOTOR NOT HOME
    SAVE HL
    FATAL ERROR, SLOW TRIP
    RESTORE HL
    A = MASK, WILL SET:
    MRSTS1.ENABLD = FALSE
    DISABLE METER
    STOP AC MOTOR
    RETURN
  ENDIF
ENDLOOP
CYCLE SWITCH SAYS METER CAME HOME
INDICATE TRIP COMPLETION
A = MASK, WILL SET:
MRSTS1.ENABLD = FALSE
MRSTS1.UNKSEL = FALSE
>>TARGET OF JUMP AHEAD<<
UPDATE MRSTS1 ACCORDING TO MASK
MRSTS1 = MASK .AND. MRSTS1

****ALTERNATE ENTRY POINT
STOP AC MOTOR
HL = ADDRESS, PORTA
PORTA = PORTA .OR. HEX10

  ENDIF
ENDIF
RETURN
```

```
ENDENT

3051                ;ENDENT(ERRFLG)(NORFLG)
3052                ;      (BIT   )(BITSTR)
3053                ;      ( 0    )( I    )
3054                ;      (PSW:Z )( RAM  )
3055                ;      ( C    )( NC   )
3056                ;
3057                ;PSW DESTROYED
3058                ;REGISTERS DESTROYED
3059                ;
3060                ;PROCESS END OF ENTRY HEADER
3061                ;
3062                ENDENT;
3063 0819 3A 26 74    LDA  NORFLG/2+X
3064                ;
3065 081C 2F          CMA
3066 081D E6 30       ANI  30H
3067                ;
```

```
****ENTRY POINT
IF(NORFLG.CMBIN .AND.
   NORFLG.AMTIN) .NE. TRUE

  PROCEEDURAL ERROR
```

```
3068 081F C2 A1 0B   JNZ  PROERR          PROERR(ERRFLG)
3069                ;                           (PSW:Z )
3070                ;                           ( 0    )
3071                ;                     ELSE
3072 0822 CD 4E 0F   CALL LSTATE          LSTATE(FATMOD,NORMOD,SERMOD,PRVMOD)
3073                ;                           (PSW:S ,PSW:Z ,PSW:P ,PSW:CY)
3074                ;                           ( 0    , 0    , 0    , 0    )
3075                ;                       IF SERMOD .EQ. TRUE
3076                ;                         SERVICE MODE END OF ENTRY
3077 0825 EA 63 0C   JPE  SEREOE            SEREOE(ERRFLG)
3078                ;                              (PSW:Z )
3079                ;                              ( 0    )
3080                ;                       ELSE
3081                ;                       IF PRVMOD .EQ. TRUE
3082                ;                         MANUAL RESET
3083 0828 DA E9 09   JC   MANRST            MANRST(ERRFLG)
3084                ;                              (PSW:Z )
3085                ;                              ( 0    )
3086                ;                       ELSE
3087                ;                         VARIABLE REMOTE RESET
3088 082B C3 BE 13   JMP  VRMRS             VRMRS(ERRFLG)
3089                ;                           (PSW:Z )
3090                ;                           ( 0    )
3091                ;                       ENDIF
3092                ;                     ENDIF
```

ENTAMT

```
3095                ;ENTAMT/ENTCMB(MSGBUF)(AMTBUF,CMBBUF,NORFLG)
3096                ;             (NIBSTR)(NIBSTR,NIBSTR,BITSTR)
3097                ;             ( I    )( 0    , 0    , 0    )
3098                ;             ( @B   )( RAM  , RAM  , RAM  )
3099                ;             ( NC   )( C    , C    , C    )
3100                ;REGISTERS DESTROYED
3101                ;PSW DESTROYED
3102                ;
3103                ;MOVE FIELD, FORMAT AND VALUE
3104                ;FROM MESSAGE BUFFER TO APPROPRIATE RESET BUFFER
3105                ;
3106                ENTAMT;               ****ENTRY POINT FOR RESET AMOUNT
3107 082E 0E E0      MVI  C,AMTBUF       C = OFFSET, DEST = OFFSET, AMTBUF
3108                ;                     SET TO SET NORFLG.AMTIN = TRUE
3109 0830 3E 10      MVI  A,10H          A = MASK = HEX10
3110 0832 C3 39 08   JMP  ENTCM1
3111                ; >>JUMP AHEAD<<
3112                ENTCMB;               ****ENTRY POINT FOR RESET COMBINATION
3113 0835 0E F0      MVI  C,CMBBUF       C = OFFSET, DEST = OFFSET, CMBBUF
3114                ;                     SET TO SET NORFLG.CMBIN = TRUE
3115 0837 3E 20      MVI  A,20H          A = MASK = HEX20
3116                ENTCM1;               >>TARGET OF JUMP AHEAD<<
3117 0839 21 26 74   LXI  H,NORFLG/2+X   HL = ADDRESS, NORFLG
3118                ;                     UPDATE FLAG
3119 083C B6         ORA  M              NORFLG = NORFLG .OR. MASK
3120 083D 77         MOV  M,A
3121                ;                     FETCH COUNT FROM MESSAGE FORMAT
3122 083E CD 35 0F   CALL GETNIB         GETNIB(CNT,ZERO,MSGBUF)
3123                ;                           ( A ,PSW:Z, @B   )
3124                ;                           ( 0 , 0   , I    )
3125                ;                     INCLUDE LEAD ZERO AND FORMAT IN COUNT
3126 0841 C6 03      ADI  3              CNT = (CNT+3) .AND. HEXFE
3127 0843 E6 FE      ANI  0FEH
3128                ;                     MOVE MESSAGE TO DESTINATION BUFFER
3129 0845 C3 B3 0F   JMP  MVLNIB          MVLNIB(DEST,MSGBUF,CNT,PSW)
3130                ;                           ( @C , @B   , A ,PSW)
3131                ;                           ( 0  , I    , I , 0 )
3132                ;                     RETURN
```

ENTSER

```
3135                ;ENTSER()(MRSTS1)
3136                ;        (BITSTR)
```

```
3137                ;        ( O    )
3138                ;        ( RAM  )
3139                ;        ( C    )
3140                ;
3141                ;PSW DESTROYED
3142                ;REGISTERS DESTROYED
3143                ;
3144                ;ENTER SERVICE MODE
3145                ;
3146                ENTSER;              ****ENTRY POINT
3147 0848 21 24 74    LXI  H,MRSTS1/2+X  HL = ADDRESS, MRSTS1
3148 084B 7E          MOV  A,M           MRSTS1.SERMOD = TRUE
3149 084C F6 08       ORI  08H
3150 084E E6 FB       ANI  0FBH          MRSTS1.ENABLD = FALSE
3151 0850 77          MOV  M,A
3152 0851 C9          RET                RETURN

EXTSER

3155                ;EXTSER()(MRSTS1,NORFLG)
3156                ;        (BITSTR,BITSTR)
3157                ;        ( O    , O    )
3158                ;        ( RAM  , RAM  )
3159                ;        ( C    , C    )
3160                ;
3161                ;PSW DESTROYED
3162                ;REGISTERS DESTROYED
3163                ;
3164                ;EXIT SERVICE MODE
3165                ;
3166                EXTSER;              ****ENTRY POINT
3167 0852 21 24 74    LXI  H,MRSTS1/2+X  HL = ADDRESS, MRSTS1
3168 0855 7E          MOV  A,M           MRSTS1.SERMOD = FALSE
3169 0856 E6 F7       ANI  0F7H
3170 0858 77          MOV  M,A
3171 0859 23          INX  H             HL = ADDRESS, NORFLG
3172 085A 23          INX  H
3173 085B 7E          MOV  A,M           NORFLG.COMDSB = FALSE
3174 085C E6 FB       ANI  0FBH
3175 085E 77          MOV  M,A
3176 085F C9          RET                RETURN

EXTTRP

3179                ;EXTTRP()(KDCTRL,MRSTS1,MTRCHR,SERFLG)
3180                ;        (BITSTR,BITSTR,BITSTR,BITSTR)
3181                ;        ( I    , I    , I    , I    )
3182                ;        ( RAM  , RAM  , RAM  , RAM  )
3183                ;        ( NC   , NC   , NC   , NC   )
3184                ;
3185                ;REGISTERS DESTROYED
3186                ;PSW DESTROYED
3187                ;
3188                ;INITIATE TRIP IN RESPONSE TO EXTERNAL MESSAGE
3189                ;
3190                EXTTRP;              ****ENTRY POINT
3191                ;                    SET TO REACH PROERR VIA RETURN
3192 0860 21 A1 0B    LXI  H,PROERR
3193 0863 E5          PUSH H
3194 0864 3A 27 74    LDA KDCTRL/2+X     PSW:CY = KDCTRL.KBDDSB
3195 0867 1F          RAR
3196                ;                    IF KDCTRL.KBDDSB .EQ. FALSE
3197                ;                      KEYBOARD HAS NOT BEEN DISABLED
3198 0868 D0          RNC                  PROERR(ERRFLG)
3199                ;                    ELSE
3200 0869 21 24 74    LXI  H,MRSTS1/2+X  HL = ADDRESS, MRSTS1
3201 086C 7E          MOV  A,M           PSW:Z =DISABL=MRSTS1.ENABLD .EQ. FALSE
3202 086D E6 04       ANI  4
3203                ;                    IF DISABL .EQ. TRUE
3204                ;                      METER IS DISABLED
```

```
3205 086F C8          RZ                    PROERR(ERRFLG)
3206                ;                     ELSE
3207 0870 2B          DCX  H                HL = ADDRESS, MTRCHR
3208 0871 3A 10 74    LDA  SERFLG/2+X       A.2 = (.NOT. SERFLG.SNOLCK) .OR.
3209                ;                             MTRCHR.TRPCTL
3210 0874 17          RAL
3211 0875 2F          CMA
3212 0876 B6          ORA  M
3213 0877 E6 20       ANI  20H              PSW:Z = TRPLCK = A.2 .EQ. FALSE
3214                ;                       IF TRPLCK .EQ. TRUE
3215                ;                         RESPONSE TO EXT TRIP IS FORBIDDEN
3216 0879 C8          RZ                      PROERR(ERRFLG)
3217                ;                       ELSE
3218                ;                         EXTERNAL TRIPPING ALLOWED
3219 087A E1          POP  H                  CLEAN UP STACK
3220 087B C3 A5 07    JMP  DOTRIP             TRIP METER
3221                ;                       ENDIF
3222                ;                     ENDIF
3223                ;                     RETURN
```

FATERR

```
3226                ;FATERR(CODE,ERRFLG)(MRSTS2,ERRCOD,NORFLG,ERRCNT)
3227                ;      (BYTE,BIT   )(BITSTR,BYTE  ,BITSTR,NIBSTR)
3228                ;      ( I  , 0    )( 0    , 0    , 0    , 0    )
3229                ;      ( A  ,PSW:Z )( RAM  , RAM  , RAM  , RAM  )
3230                ;      ( C  , C    )( C    , C    , C    , C    )
3231                ;
3232                ;PSW DESTROYED
3233                ;REGISTERS DESTROYED
3234                ;
3235                ;PROCESS FATAL ERROR
3236                ;
3237                FATINT;               ****ENTRY POINT FROM INTERRUPT VECTOR
3238                ;                     INDICATE WATCHDOG INTERRUPT OR
3239                ;                     INCORRECTLY ENABLED TEST INTERRUPT
3240 087E 3E 17       MVI  A,BARF         A = BARF
3241                FATERR;               ****ENTRY POINT
3242 0880 21 25 74    LXI  H,MRSTS2/2+X   HL = ADDRESS, MRSTS2
3243 0883 46          MOV  B,M            IF MRSTS2.FATMOD .EQ. FALSE
3244 0884 04          INR  B
3245 0885 FA 9E 08    JM   FATE01
3246 0888 32 0A 74    STA  ERRCOD/2+X       ERRCOD = CODE
3247 088B 7E          MOV  A,M              MRSTS2.FATMOD = TRUE
3248 088C F6 80       ORI  80H
3249 088E 77          MOV  M,A
3250 088F 23          INX  H                HL = ADDRESS, NORFLG
3251 0890 7E          MOV  A,M              NORFLG.QUESTS = TRUE
3252 0891 F6 80       ORI  80H
3253 0893 77          MOV  M,A
3254 0894 21 0B 74    LXI  H,ERRCNT/2+X     HL = ADDRESS, ERRCNT
3255 0897 7E          MOV  A,M              ERRCNT[0..1] = ERRCNT[0..1]+1
3256 0898 3C          INR  A
3257 0899 27          DAA
3258 089A 77          MOV  M,A
3259 089B CD 64 04    CALL PERDSP           MAKE ERROR DISPLAY
3260                FATE01;               ENDIF
3261 089E AF          XRA  A              PSW:Z = ERRFLG = TRUE
3262 089F C9          RET                 RETURN
```

FINTRP

```
3265                ;FINTRP()(MRSTS1,PORTA )
3266                ;        (BITSTR,BITSTR)
3267                ;        ( 0    , 0    )
3268                ;        ( RAM  , 7001 )
3269                ;        ( C    , C    )
3270                ;
3271                ;REGISTERS DESTROYED
3272                ;PSW DESTROYED
3273                ;
```

```
3274                ;ATTEMPT TO DRIVE METER HOME
3275                ;
3276                FINTRP;                 ****ENTRY POINT
3277                ;                       START AC MOTOR
3278 08A0 21 01 70   LXI  H,PORTA           HL = ADDRESS, PORTA
3279 08A3 7E         MOV  A,M               PORTA = PORTA .AND. HEXEF
3280 08A4 E6 EF      ANI  0EFH
3281 08A6 77         MOV  M,A
3282                ;                       DRIVE METER FOR 0.2 SEC. TO INSURE
3283                ;                       THAT METER AT START OF TRIP CYCLE IS
3284                ;                       DRIVEN FAR ENOUGH TO MAKE THE CYCLE
3285                ;                       SWITCH AGREE WITH THE METER STATE.
3286 08A7 01 D0 07   LXI  B,2000            BC = N = 2000; FOR 0.2 SEC. LOOP
3287                FINTR1;                 DO UNTIL N .EQ. 0
3288 08AA CD 19 0B   CALL NPAUSE              NPAUSE(N  ,ZROFLG)
3289                ;                               (BC ,PSW:Z )
3290                ;                               (I/O, O    )
3291 08AD C2 AA 08   JNZ  FINTR1
3292                ;                       ENDDO
3293                ;                       NOW DRIVE METER HOME
3294 08B0 01 40 1F   LXI  B,8000            BC = N = 8000; FOR 0.8 SEC. LOOP
3295                FINTR2;                 LOOP
3296                ;                         READ CYCLE SWITCH
3297 08B3 CD AF 0B   CALL RDCYC               RDCYC(INCYC,INCYC,ADRESS,MRSTS1)
3298                ;                                ( A   ,PSW:C, HL   , @HL  )
3299                ;                                ( O   , O   , O    , -    )
3300                ;                         IF INCYC .EQ. FALSE
3301 08B6 D2 BF 08   JNC  FINTR3                BREAK
3302                ;                         ENDIF
3303 08B9 CD 19 0B   CALL NPAUSE              NPAUSE(N  ,ZROFLG)
3304                ;                               (BC ,PSW:Z )
3305                ;                               (I/O, O    )
3306 08BC C2 B3 08   JNZ  FINTR2              IF N .EQ. 0
3307                ;                           BREAK
3308                ;                         ENDIF
3309                FINTR3;                 ENDLOOP
3310 08BF CD 11 08   CALL DOTR06            STOP AC MOTOR
3311                ;                       READ CYCLE SWITCH
3312 08C2 CD AF 0B   CALL RDCYC             RDCYC(INCYC,INCYC,ADRESS,MRSTS1)
3313                ;                            ( A   ,PSW:C, HL   , @HL  )
3314                ;                            ( O   , O   , O    , -    )
3315 08C5 F5         PUSH PSW               SAVE A, PSW
3316                ;                       COPY INCYC INTO MRSTS1
3317 08C6 E6 82      ANI  82H
3318 08C8 57         MOV  D,A
3319 08C9 7E         MOV  A,M
3320 08CA E6 7D      ANI  7DH
3321 08CC B2         ORA  D
3322 08CD 77         MOV  M,A               MRSTS1.UNKSEL = INCYC
3323                ;                       MRSTS1.INCYC  = INCYC
3324 08CE F1         POP  PSW               RESTORE A, PSW
3325 08CF D0         RNC                    IF INCYC .EQ. TRUE
3326                ;                         CYC SWT SAYS METER DIDN'T COME HOME
3327                FINTR4;                   ****ALTERNATE ENTRY POINT
3328                ;                         FATAL ERROR, SLOW TRIP
3329 08D0 3E 08      MVI  A,TRPTIM            A = TRPTIM
3330 08D2 C3 80 08   JMP  FATERR              FATERR(TRPTIM,ERRFLG)
3331                ;                                ( A    ,PSW:Z )
3332                ;                                ( I    , O    )
3333                ;                       ENDIF
3334                ;                       RETURN
```

HDRONY

```
3337                ;HDRONY(HEADER,ERRFLG)(NORFLG,XMTBUF)
3338                ;      (BYTE  ,BIT   )(BITSTR,NIBSTR)
3339                ;      ( I    , O    )( O    , I    )
3340                ;      ( A    ,PSW:Z )( RAM  , RAM  )
3341                ;      ( NC   , C    )( C    , NC   )
3342                ;
```

```
3343                ;REGISTERS DESTROYED
3344                ;PSW DESTROYED
3345                ;
3346                ;INITIATE PROCESSING  RELATED TO HEADERS WHICH CONSIST
3347                ;OF A HEADER NOT FOLLOWED BY DATA
3348                ;
3349                HDRONY;                 ****ENTRY POINT
3350 08D5 B7          ORA  A                PSW:Z = ERRFLG = HEADER .EQ. HEX00
3351 08D6 F5          PUSH PSW              SAVE A, PSW
3352 08D7 21 1F 09    LXI  H,HDR002         SET TO RETURN TO ENDCASE
3353 08DA E5          PUSH H
3354                ;                       CASE (HEADER)
3355 08DB FE 41       CPI  HENABL             **41: ENABLE METER
3356 08DD CA F3 05    JZ   CMDENB
3357 08E0 FE 42       CPI  HDISAB             **42: DISABLE METER
3358 08E2 CA CD 05    JZ   CMDDSB
3359 08E5 FE 46       CPI  HSETSV             **46: ENTER SERVICE MODE
3360 08E7 CA 48 08    JZ   ENTSER
3361 08EA FE 47       CPI  HCLRSV             **47: EXIT SERVICE MODE
3362 08EC CA 52 08    JZ   EXTSER
3363 08EF FE 4E       CPI  HEXTRP             **4E: EXTERNAL TRIP
3364 08F1 CA 60 08    JZ   EXTTRP
3365 08F4 FE 50       CPI  HREQST             **50: STATUS REQUEST
3366 08F6 C8          RZ                            CONTINUE
3367 08F7 FE 62       CPI  HENAKB             **62: ENABLE KEYBOARD
3368 08F9 CA 14 0F    JZ   ENAKBD
3369 08FC FE 63       CPI  HDISKB             **63: DISABLE KEYBOARD
3370 08FE CA 02 0F    JZ   DSBKBD
3371 0901 21 1C 09    LXI  H,HDR001           SET TO RETURN TO ALTERNATE ENDCASE
3372 0904 E3          XTHL
3373 0905 FE 40       CPI  HREQAC             **40: ACCESS CODE REQUEST
3374 0907 CA EE 12    JZ   ACCODE                   ACCODE(ERRFLG)
3375                ;                                     (PSW:Z )
3376                ;                                     ( 0    )
3377 090A FE 43       CPI  HENDEN             **43: END OF ENTRY
3378 090C CA 19 08    JZ   ENDENT                   ENDENT(ERRFLG)
3379                ;                                     (PSW:Z )
3380                ;                                     ( 0    )
3381 090F FE 51       CPI  HREQPO             **51: SELECTION VALUE REQUEST
3382 0911 CA 48 0C    JZ   SELVAL                   SELVAL(ERRFLG)
3383                ;                                     (PSW:Z )
3384                ;                                     ( 0    )
3385 0914 FE 5C       CPI  HREQSN             **5C: SERIAL NUMBER REQUEST
3386 0916 CA 8D 06    JZ   DBLH01                   DBLH01(TRUE ,ERRFLG)
3387                ;                                     (PSW:Z,PSW:Z )
3388                ;                                     ( I   , 0    )
3389                ;                           **ELSE: DOUBLY DEFINED HEADER
3390 0919 C3 71 06    JMP  DBLHDR                   DBLHDR(HEADER,ERRFLG)
3391                ;                                     ( A    ,PSW:Z )
3392                ;                                     ( I    , 0    )
3393                HDR001;                 ALTERNATE ENDCASE, SAVES NEW ERRFLG
3394                ;                         PSW:Z = ERRFLG
3395 091C C1          POP  B                  A = HEADER
3396 091D 78          MOV  A,B
3397 091E F5          PUSH PSW                SAVE A, PSW
3398                HDR002;                 ENDCASE
3399 091F 21 26 74    LXI  H,NORFLG/2+X       HL = ADDRESS, NORFLG
3400 0922 3A 50 74    LDA  XMTBUF/2+X         IF XMTBUF[0..1] .EQ. 0
3401 0925 B7          ORA  A
3402 0926 C2 2D 09    JNZ  HDR003
3403                ;                         QUE DEFAULT STATUS MESSAGE
3404 0929 7E          MOV  A,M                NORFLG.QUESTS = TRUE
3405 092A F6 80       ORI  80H
3406 092C 77          MOV  M,A
3407                HDR003;                 ENDIF
3408 092D F1          POP  PSW                A = HEADER
3409 092E F5          PUSH PSW
3410 092F FE 42       CPI  HDISAB             IF HEADER .NE. HDISAB
3411 0931 CA 3F 09    JZ   HDR005
3412 0934 E6 F0       ANI  0F0H                 IF (HEADER .AND. HEXF0) .NE. HEX50
```

```
3413 0936 FE 50        CPI  50H
3414 0938 CA 3F 09     JZ   HDR004
3415                 ;                          CANCEL ANY RESET IN PROGRESS
3416 093B 7E           MOV  A,M
3417 093C E6 CF        ANI  0CFH
3418 093E 77           MOV  M,A                   NORFLG.CMBIN = FALSE
3419                 ;                            NORFLG.AMTIN = FALSE
3420                 HDR004;                    ENDIF
3421                 HDR005;                  ENDIF
3422 093F F1           POP  PSW               A = HEADER
3423                 ;                        PSW:Z = ERRFLG
3424 0940 C9           RET                    RETURN
```

HDRPLS

```
3427                 ;HDRPLS(HEADER,MSGBUF,ERRFLG)(NORFLG)
3428                 ;      (BYTE  ,NIBSTR,BIT   )(BITSTR)
3429                 ;      ( I    , I    , 0    )( 0    )
3430                 ;      ( A    , @B   ,PSW:Z )( RAM  )
3431                 ;      ( NC   , NC   , C    )( C    )
3432                 ;
3433                 ;REGISTERS DESTROYED
3434                 ;PSW DESTROYED
3435                 ;
3436                 ;INITIATE PROCESSING RELATED TO HEADERS WHICH CONSIST
3437                 ;OF A HEADER ASSOCIATED WITH DATA
3438                 ;
3439                 HDRPLS;                  ****ENTRY POINT
3440 0941 B7           ORA  A                 PSW:Z = ERRFLG = HEADER .EQ. HEX00
3441 0942 F5           PUSH PSW               SAVE A, PSW
3442 0943 21 26 74     LXI  H,NORFLG/2+X      HL = ADDRESS, NORFLG
3443                 ;                        CHECK FOR INTERRUPTED RESET SEQUENCE
3444 0946 FE C5        CPI  HENTAM            IF HEADER .NE. HENTAM
3445 0948 CA 54 09     JZ   HDRP02
3446 094B FE C6        CPI  HENTCO              IF HEADER .NE. HENTCO
3447 094D CA 54 09     JZ   HDRP01
3448 0950 7E           MOV  A,M
3449 0951 E6 CF        ANI  0CFH
3450 0953 77           MOV  M,A                   NORFLG.CMBIN. = FALSE
3451                 ;                            NORFLG.AMTIN = FALSE
3452                 HDRP01;                    ENDIF
3453                 HDRP02;                  ENDIF
3454                 ;                        QUE STATUS MESSAGE
3455 0954 7E           MOV  A,M               NORFLG.QUESTS = TRUE
3456 0955 F6 80        ORI  80H
3457 0957 77           MOV  M,A
3458 0958 F1           POP  PSW               A = HEADER
3459 0959 F5           PUSH PSW
3460 095A 21 7C 09     LXI  H,HDRP04          SET TO RETURN TO ENDCASE
3461 095D E5           PUSH H
3462                 ;                        CASE (HEADER)
3463 095E FE C5        CPI  HENTAM              **C5: ENTER AMOUNT
3464 0960 CA 2E 08     JZ   ENTAMT                    ENTAMT(MSGBUF)
3465                 ;                                      ( @B   )
3466                 ;                                      ( I    )
3467 0963 FE C6        CPI  HENTCO              **C6: ENTER COMBINATION
3468 0965 CA 35 08     JZ   ENTCMB                    ENTCMB(MSGBUF)
3469                 ;                                      ( @B   )
3470                 ;                                      ( I    )
3471 0968 21 79 09     LXI  H,HDRP03          SET TO RETURN TO ALTERNATE ENDCASE
3472 096B E3           XTHL
3473 096C FE C0        CPI  HSETMN              **C0: ENTER SERIAL NUMBER
3474 096E CA 38 0A     JZ   MSERNO                    MSERNO(MSGBUF,ERRFLG)
3475                 ;                                      ( @B   ,PSW:Z )
3476                 ;                                      ( I    , 0    )
3477 0971 FE C1        CPI  HSETPO              **C1: SET POSTAGE
3478 0973 CA 9F 0C     JZ   SETPOS                    SETPOS(MSGBUF,ERRFLG)
3479                 ;                                      ( @B   ,PSW:Z )
3480                 ;                                      ( I    , 0    )
3481                 ;                          **ELSE: PROCESS ERROR
```

```
3482 0976 C3 A1 0B   JMP   PROERR              PROERR(ERRFLG)
3483                ;                                (PSW:Z )

HDRPLS

3484                ;                                ( 0    )
3485                HDRP03;                ALTERNATE ENDCASE, SAVES NEW ERRFLG
3486 0979 C1          POP  B               A = HEADER
3487 097A 78          MOV  A,B             PSW:Z = ERRFLG
3488 097B F5          PUSH PSW             SAVE A, PSW
3489                HDRP04;               ENDCASE
3490 097C F1          POP  PSW             A = HEADER
3491                ;                      PSW:Z = ERRFLG
3492 097D C9          RET                  RETURN

IDLE

3495                ;IDLE()(CTLBKT,KDCTRL,MRSTS1,NORFLG,RECBUF,XMTBUF)
3496                ;      (BYTE  ,BITSTR,BITSTR,BITSTR,BYTSTR,BYTSTR)
3497                ;      ( I    , I    , I/O  , I    , I    , I    )
3498                ;      ( RAM  , RAM  , RAM  , RAM  , RAM  , RAM  )
3499                ;      ( NC   , NC   , C    , NC   , NC   , NC   )
3500                ;
3501                ;MAINLINE IDLE LOOP
3502                ;
3503                IDLE;                 LOOP
3504 097E FB          EI                   ENABLE INTERRUPTS
3505                ;                      SET TO RESTART LOOP
3506 097F 21 7E 09    LXI  H,IDLE          HL = ADDRESS, IDLE
3507 0982 E5          PUSH H               PUSH HL, USED BY RETURN STATEMENTS
3508                ;                      UPDATE METER STATUS:
3509 0983 CD 78 07    CALL DOSTAT          WITH RESPECT TO SWITCHES/SENSORS
3510 0986 CD 23 0B    CALL POSUPD          WITH RESPECT TO POSTAGE SETTING
3511 0989 CD 68 10    CALL NVMCHG          WITH RESPECT TO NONVOLATILE MEMORY
3512 098C 3A 50 74    LDA  XMTBUF/2+X      A = XMTBUF[0]
3513 098F B7          ORA  A               IF XMTBUF[0] .NE. 0
3514 0990 C2 15 0E    JNZ  XMIT              TRANSMIT MESSAGE
3515                ;                      ELSE
3516 0993 3A 26 74    LDA  NORFLG/2+X      A = NORFLG
3517 0996 4F          MOV  C,A             C = NORFLG
3518 0997 17          RAL                  PSW:CY = NORFLG.QUESTS
3519                ;                      IF NORFLG.QUESTS .EQ. TRUE
3520 0998 DA F4 0A    JC   MTRSTS            TRANSMIT METER STATUS
3521                ;                      ELSE
3522 099B 17          RAL                  PSW:CY = NORFLG.QUEPOS
3523 099C D2 A4 09    JNC  IDLE01          IF NORFLG.QUEPOS .EQ. TRUE
3524                ;                        REQUEST POSTAGE SETTING
3525 099F 3E 51       MVI  A,HREQPO          A = HREQPO
3526 09A1 C3 C7 0D    JMP  XEQHDR            XEQHDR(HREQPO,ERRFLG)
3527                ;                              ( A    ,PSW:Z )
3528                ;                              ( I    , 0    )
3529                IDLE01;
3530                ;                      ELSE
3531 09A4 CD 4E 0F    CALL LSTATE          LSTATE(FATMOD,NORMOD,SERMOD,PRVMOD)
3532                ;                            (PSW:S ,PSW:Z ,PSW:P ,PSW:CY)
3533                ;                            ( 0    , 0    , 0    , 0    )
3534 09A7 C2 D1 09    JNZ  IDLE03          IF NORMOD .EQ. TRUE
3535 09AA 21 24 74    LXI  H,MRSTS1/2+X      HL = ADDRESS, MRSTS1
3536 09AD 7E          MOV  A,M               PSW:CY = MRSTS1.QUEREG
3537 09AE 1F          RAR
3538 09AF D2 D1 09    JNC  IDLE02            IF MRSTS1.QUEREG .EQ. TRUE
3539                ;                          TRIP HAS COMPLETED NORMALLY
3540 09B2 B7          ORA  A                     MRSTS1.QUEREG = FALSE
3541 09B3 17          RAL
3542 09B4 77          MOV  M,A
3543 09B5 21 2B 74    LXI  H,CTLBKT/2+X          HL = ADDRESS, CTLBKT
3544 09B8 3E 41       MVI  A,41H                 PSW:Z = CTLBKT .EQ. HEX41
3545 09BA AE          XRA  M
3546 09BB 3E 52       MVI  A,HREQAR              A = HREQAR
3547                ;                            IF CTLBKT .EQ. HEX41
```

```
3548                ;                                  REQUEST ASCENDING REGISTER
3549 09BD CA C7 0D   JZ   XEQHDR                       XEQHDR(HREQAR,ERRFLG)
3550                ;                                        ( A    ,PSW:Z )
3551                ;                                        ( I    , O    )
3552                ;                                ELSE
3553 09C0 3E 31      MVI  A,31H                      PSW:Z = CTLBKT .EQ. HEX31
3554 09C2 AE         XRA  M
3555 09C3 3E 53      MVI  A,HREQDR                   A = HREQDR
3556                ;                                IF CTLBKT .EQ. HEX31
3557                ;                                  REQUEST DESCENDING REGISTER
3558 09C5 CA C7 0D   JZ   XEQHDR                       XEQHDR(HREQDR,ERRFLG)
3559                ;                                        ( A    ,PSW:Z )
3560                ;                                        ( I    , O    )
3561                ;                                ELSE
3562 09C8 3E 21      MVI  A,21H                      PSW:Z = CTLBKT .EQ. HEX21
3563 09CA AE         XRA  M
3564 09CB 3E 55      MVI  A,HREQPC                   A = HREQPC
3565                ;                                IF CTLBKT .EQ. HEX21
3566                ;                                  REQUEST PIECE COUNT
3567 09CD CA C7 0D   JZ   XEQHDR                       XEQHDR(HREQPC,ERRFLG)
3568                ;                                        ( A    ,PSW:Z )
3569                ;                                        ( I    , O    )
3570                ;                                ENDIF
3571 09D0 C9         RET
3572                IDLE02;                        ENDIF
3573                IDLE03;                      ELSE
3574 09D1 3A 48 74   LDA  RECBUF/2+X              A = RECBUF[0]
3575 09D4 B7         ORA  A                       IF RECBUF[0] .NE. 0
3576 09D5 C2 EE 09   JNZ  MESAGE                    PROCESS MESSAGE
3577                ;                            ELSE
3578 09D8 3E 08      MVI  A,08H                   PSW:Z = NORFLG.TRPREQ .EQ. FALSE
3579 09DA A1         ANA  C
3580 09DB CA E6 09   JZ   IDLE04                  IF NORFLG.TRPREQ .EQ. TRUE
3581 09DE 3A 27 74   LDA  KDCTRL/2+X                PSW:CY = KDCTRL.KBDDSB
3582 09E1 1F         RAR
3583                ;                                IF KDCTRL.KBDDSB .EQ. FALSE
3584 09E2 D2 A5 07   JNC  DOTRIP                        PROCESS TRIP REQUEST
3585                ;                                ENDIF
3586 09E5 C9         RET
3587                IDLE04;                        ELSE
3588 09E6 C3 2E 03   JMP  KEYBRD                      PROCESS KEYBOARD
3589                ;                              ENDIF
3590                ;                            ENDLOOP
```

MANRST

```
3593                ;MANRST
3594                ;
3595                ;REGISTERS DESTROYED
3596                ;PSW DESTROYED
3597                ;
3598                ;MANUAL METER RESET
3599                ;
3600                MANRST;                  ****ENTRY POINT
3601                ;                        DECLARE SOFTWARE ERROR
3602 09E9 3E 02      MVI  A,SFTWRE           A = SFTWRE
3603 09EB C3 80 08   JMP  FATERR             FATERR(SFTWRE,ERRFLG)
3604                ;                              ( A    ,PSW:Z )
3605                ;                              ( I    , O    )
3606                ;                        RETURN
```

MESAGE

```
3609                ;MESAGE()(RECBUF,XMTBUF,DBUF  )
3610                ;        (NIBSTR,NIBSTR,NIBSTR)
3611                ;        ( I/O  , I    , O    )
3612                ;        ( RAM  , RAM  , RAM  )
3613                ;        ( C    , NC   , C    )
3614                ;
```

```
                ;PSW DESTROYED
                ;REGISTERS DESTROYED
                ;
                ;PROCESS MESSAGE RECEIVED FROM EXTERNAL DEVICE
                ;
                MESAGE;                 ****ENTRY POINT
                ;                       REMEMBER IF XMTBUF CLEAR ON ENTRY
09EE 3A 50 74     LDA  XMTBUF/2+X       PSW:Z = XMTCLR = XMTBUF[0..1] .EQ. 0
09F1 B7           ORA  A
09F2 F5           PUSH PSW              SAVE A, PSW
09F3 21 48 74     LXI  H,RECBUF/2+X     HL = ADDRESS, RECBUF[0..1]
                ;                       FETCH MESSAGE SIZE, IN BYTES
09F6 4E           MOV  C,M              C = SIZE = RECBUF[0..1]
                ;                       FLAG MESSAGE AS PROCESSED
09F7 36 00        MVI  M,0              RECBUF[0..1] = 0
09F9 23           INX  H                HL = ADDRESS, RECBUF[2..3]
09FA 0D           DCR  C                C = SIZE-1
09FB C2 1A 0A     JNZ  MESAG3           IF (SIZE-1) .EQ. 0
09FE 7E           MOV  A,M                A = HEADER = RECBUF[2..3]
                ;                         PROCESS MESSAGE WITHOUT DATA
09FF CD D5 08     CALL HDRONY             HDRONY(HEADER,ERRFLG)
                ;                                ( A    ,PSW:Z )
                ;                                ( I    , O    )
0A02 CA 17 0A     JZ   MESAG2             IF ERRFLG .EQ. FALSE
0A05 FE 51        CPI  HREQPO               IF HEADER .EQ. HREQPO
0A07 C2 17 0A     JNZ  MESAG1
                ;                                REVERT TO SETTING DISPLAY
0A0A 01 80 A2     LXI  B,(XMTBUF+2)*100H+DBUF+0
                ;                                B = OFFSET, XMTBUF[2]
                ;                                C = OFFSET, DBUF[0]
0A0D 3A 50 74     LDA  XMTBUF/2+X                A = NIBCNT = XMTBUF[0..1]*2
0A10 87           ADD  A
0A11 CD B3 0F     CALL MVLNIB                    MVLNIB(DBUF[0],XMTBUF[2],NIBCNT,
                ;                                      ( @C    , @B      , A    ,
                ;                                      ( O     , I       , I    ,
                ;
                ;                                      NONBCD,ZERO )
                ;                                      PSW:S ,PSW:Z)
                ;                                       O    , O   )
0A14 CD 5A 05     CALL VALDSP                    DISPLAY CONTENTS OF DBUF
                MESAG1;                        ENDIF
                MESAG2;                      ENDIF
0A17 C3 31 0A     JMP  MESAG6
                MESAG3;                    ELSE
                ;                            CHECK FORMAT AGAINST MESSAGE SIZE
0A1A 06 94        MVI  B,RECBUF+4            B = OFFSET, RECBUF[4]
0A1C CD 35 0F     CALL GETNIB                GETNIB(NIBCNT,ZERO ,RECBUF[4])
                ;                                ( A    ,PSW:Z, @B      )
                ;                                ( O    , O   , I       )
0A1F 3C           INR  A                     A = BYTCNT = (NIBCNT+1)/2
0A20 B7           ORA  A
0A21 1F           RAR
0A22 0D           DCR  C                     C = SIZE-2
0A23 B9           CMP  C                     IF BYTCNT .EQ. (SIZE-2)
0A24 C2 2E 0A     JNZ  MESAG4
                ;                              PROCESS MESSAGE WITH DATA
0A27 7E           MOV  A,M                     A = HEADER = RECBUF[2..3]
0A28 CD 41 09     CALL HDRPLS                  HDRPLS(HEADER,RECBUF[4],ERRFLG)
                ;                                     ( A    , @B      ,PSW:Z )
                ;                                     ( I    , I       , O    )
0A2B C3 31 0A     JMP  MESAG5
                MESAG4;                    ELSE
                ;                              BAD MESSAGE, PROCEEDURAL ERROR
0A2E CD A1 0B     CALL PROERR                  PROERR(ERRFLG)
                ;                                     (PSW:Z )
                ;                                     ( O    )
                MESAG5;                    ENDIF
                MESAG6;                  ENDIF
                :                        CHECK FOR OVERLAY OF TRANSMIT BUFFER
```

```
3684 0A31 F1          POP  PSW          PSW:Z = XMTCLR
3685 0A32 3E 12       MVI  A,BUFOVR     A = BUFOVR
3686                ;                   IF XMTCLR .EQ. FALSE
3687                ;                     BUFFER OVERLAY, FATAL ERROR
3688 0A34 C4 80 08    CNZ  FATERR         FATERR(BUFOVR,ERRFLG)
3689                ;                           ( A    ,PSW:Z )
3690                ;                           ( I    , 0    )
3691                ;                   ENDIF
3692 0A37 C9          RET               RETURN

MSERNO

3695                ;MSERNO(MSGBUF,ERRFLG)(ASCCRC,ASCREG,CTLCRC,DSCCRC,DSCREG,
3696                ;      (NIBSTR,BIT   )(BYTE  ,NIBSTR,BYTE  ,BYTE  ,NIBSTR,
3697                ;      ( I    , 0    )( 0    , 0    , 0    , 0    , 0    ,
3698                ;      ( @B   ,PSW:Z )( RAM  , RAM  , RAM  , RAM  , RAM  ,
3699                ;      ( NC   , C    )( C    , C    , C    , C    , C    ,
3700                ;
3701                ;      ERRCNT,ERRCOD,PCEREG,SERFLG,SERNUM)
3702                ;      NIBSTR,BYTE  ,NIBSTR,BITSTR,NIBSTR)
3703                ;       0    , 0    , 0    , I/O  , I/O  )
3704                ;       RAM  , RAM  , RAM  , RAM  , RAM  )
3705                ;       C    , C    , C    , C    , C    )
3706                ;
3707                ;PSW DESTROYED
3708                ;REGISTERS DESTROYED
3709                ;
3710                ;REDEFINE UNLOCKED SERIAL NUMBER OR
3711                ;LOCK SERIAL NUMBER TO PREVENT FURTHER REDEFINITION
3712                ;
3713                MSERNO;             ****ENTRY POINT
3714                ;                   SET TO REACH PROERR VIA RETURN
3715 0A38 21 A1 0B    LXI  H,PROERR
3716 0A3B E5          PUSH H
3717                ;                   CONVERT OFFSET INTO ADDRESS
3718 0A3C 16 74       MVI  D,X/100H     DE = ADDRESS, MSGBUF[0..1]
3719 0A3E AF          XRA  A
3720 0A3F 78          MOV  A,B
3721 0A40 1F          RAR
3722 0A41 5F          MOV  E,A
3723                ;                   ADJUST OFFSET
3724 0A42 04          INR  B            B = OFFSET, MSGBUF[3]
3725 0A43 04          INR  B
3726 0A44 04          INR  B
3727                ;                   CHECK FOR VARIOUS ERROR CONDITIONS
3728 0A45 CD 4E 0F    CALL LSTATE       LSTATE(FATMOD,NORMOD,SERMOD,PRVMOD)
3729                ;                         (PSW:S ,PSW:Z ,PSW:P ,PSW:CY)
3730                ;                         ( 0    , 0    , 0    , 0    )
3731                ;                   IF FATMOD .EQ. TRUE
3732                ;                     METER HAS FATALED
3733 0A48 F8          RM                  PROERR(ERRFLG)
3734                ;                     RETURN
3735                ;                   ELSE
3736                ;                   IF SERMOD .EQ. FALSE
3737                ;                     METER NOT IN SERVICE MODE
3738 0A49 E0          RPO                 PROERR(ERRFLG)
3739                ;                     RETURN
3740                ;                   ELSE
3741 0A4A 3A 10 74    LDA  SERFLG/2+X   PSW:Z = OPEN = SERFLG.SNOLCK .EQ. TRUE
3742 0A4D E6 10       ANI  10H
3743                ;                   IF OPEN .EQ. FALSE
3744                ;                     METER NUMBER ALREADY LOCKED
3745 0A4F C0          RNZ                 PROERR(ERRFLG)
3746                ;                     RETURN
3747                ;                   ELSE
3748 0A50 1A          LDAX D            PSW:Z = FMTOK = MSGBUF[0..1].EQ.HEX8F
3749 0A51 FE 8F       CPI  8FH
3750                ;                   IF FMTOK .EQ. FALSE
3751                ;                     NOT 8 CHARACTERS WITHOUT DECIMAL
```

```
3752 0A53 C0          RNZ                    PROERR(ERRFLG)
3753                ;                        RETURN
3754                ;                      ELSE
3755 0A54 13          INX  D               DE = ADDRESS, MSGBUF[2..3]
3756 0A55 1A          LDAX D               A = MSGBUF[2..3]
3757 0A56 FE 20       CPI  20H             PSW:CY = CODEOK = MSGBUF[2..3].LT.HEX20
3758                ;                      IF CODEOK .EQ. FALSE
3759                ;                        CODE IS NOT 0 OR 1
3760 0A58 D0          RNC                    PROERR(ERRFLG)
3761                ;                        RETURN
3762                ;                      ENDIF
3763                ;                      PROCESS ACCORDING TO CODE IN MSGBUF[2]
3764 0A59 FE 10       CPI  10H             PSW:CY = CODE0 = MSGBUF[2..3].LT.HEX10
3765 0A5B 3E 07       MVI  A,7             A = NIBCNT = 7
3766 0A5D D2 6D 0A    JNC MSERN1           IF CODE0 .EQ. TRUE
3767                ;                        SERIAL NUMBER IS BEING ENTERED
3768                ;                        CHECK INPUT DATA
3769 0A60 48          MOV  C,B               C = OFFSET, MSGBUF[3]
3770 0A61 CD B3 0F    CALL MVLNIB            MVLNIB(MSGBUF[3],MSGBUF[3],NIBCNT,
3771                ;                               ( @C      , @B      , A    ,
3772                ;                               ( O       , I       , I    ,
3773                ;
3774                ;                               NONBCD,ZROFLG)
3775                ;                               PSW:S ,PSW:Z )
3776                ;                                O    , O    )
3777                ;                        IF NONBCD .EQ. TRUE
3778                ;                          BAD INPUT
3779 0A64 F8          RM                     PROERR(ERRFLG)
3780                ;                        ELSE
3781                ;                          STORE NEW SERIAL NUMBER
3782 0A65 0E 21       MVI  C,SERNUM          C = OFFSET, SERNUM
3783 0A67 CD B3 0F    CALL MVLNIB            MVLNIB(SERNUM[0],MSGBUF[3],NIBCNT,
3784                ;                               ( @C      , @B      , A    ,
3785                ;                               ( O       , I       , I    ,
3786                ;
3787                ;                               NONBCD,ZROFLG)
3788                ;                               PSW:S ,PSW:Z )
3789                ;                                O    , O    )
3790                ;                        ENDIF
3791 0A6A E1          POP  H                 CLEAN UP STACK
3792 0A6B 0C          INR  C                 PSW:Z = ERRFLG = (C+1).EQ.0 = FALSE
3793 0A6C C9          RET
3794               MSERN1;                 ELSE
3795                ;                        SERIAL NUMBER IS BEING LOCKED
3796                ;                        CHECK INPUT DATA
3797 0A6D 50          MOV  D,B               D = OFFSET, MSGBUF[3]
3798 0A6E 1E 21       MVI  E,SERNUM          E = OFFSET, SERNUM[0]
3799 0A70 CD BE 0E    CALL CMPARE            CMPARE(MSGBUF[3],SERNUM[0],NIBCNT,
3800                ;                               ( @D      , @E      , A    ,
3801                ;                               ( I       , I       , I    ,
3802                ;
3803                ;                               NEGFLG,ZROFLG)
3804                ;                               PSW:S ,PSW:Z )
3805                ;                                O    , O    )
3806                ;                        IF ZROFLG .EQ. FALSE
3807                ;                          INPUT DOESN'T MATCH SERIAL NUMBER
3808 0A73 C0          RNZ                    PROERR(ERRFLG)
3809                ;                        ELSE
3810 0A74 CD 9E 12    CALL NVMWR               WRITE NEW ACTIVE SERVICE BLOCK
3811                ;                          NO BLOCK IS NOW OPEN
3812                ;                          LOCK SERIAL NUMBER
3813 0A77 21 10 74    LXI  H,SERFLG/2+X        HL = ADDRESS, SERFLG
3814 0A7A 7E          MOV  A,M                 SERFLG.SNOLCK = TRUE
3815 0A7B F6 10       ORI  10H
3816 0A7D 77          MOV  M,A
3817                ;                          UPDATE DATA FOR NORMAL BLOCK
3818                ;                          CLEAR PIECE COUNT REGISTER
3819                ;                          CLEAR ASCENDING REGISTER
```

```
3820                ;                          CLEAR DESCENDING REGISTER
3821 0A7E AF         XRA A                     A = NULL = 0
3822 0A7F 01 28 1A   LXI  B,(4+PCESIZ+DSCSIZ+ASCSIZ)*100H+PCEREG
3823                ;                          B = NIBCNT = 4+PCESIZ+DSCSIZ+ASCSIZ
3824                ;                          C = OFFSET, PCEREG
3825 0A82 CD 24 0F   CALL FILNIB               FILNIB(PCEREG,NULL,NIBCNT)
3826                ;                                ( @C   , A  , B    )
3827                ;                                ( O    , I  , I    )
3828                ;                          CLEAR ERROR CODE
3829 0A85 32 0A 74   STA  ERRCOD/2+X           ERRCOD = 0
3830                ;                          CLEAR ERROR COUNT
3831 0A88 32 0B 74   STA  ERRCNT/2+X           ERRCNT = 0
3832                ;                          STORE NEW CONTROL SUM CRC
3833 0A8B CD 4E 06   CALL CTLSUM               CTLSUM(CSMCRC,ERRFLG)
3834                ;                                ( D    ,PSW:Z )
3835                ;                                ( O    , O    )
3836 0A8E 7A         MOV  A,D                  CTLCRC = CSMCRC .
3837 0A8F 32 08 74   STA  CTLCRC/2+X
3838                ;                          STORE NEW ASCENDING REGISTER CRC
3839 0A92 01 38 08   LXI  B,ASCSIZ*100H+ASCREG
3840                ;                          B = NIBCNT = ASCSIZ
3841                ;                          C = OFFSET, ASCREG
3842 0A95 CD B1 0E   CALL CRC                  CRC(ASCREG,NIBCNT,CRCVAL)
3843                ;                             ( @C   , B    , D    )
3844 0A98 7A         MOV  A,D                  ASCCRC = CRCVAL
3845 0A99 32 20 74   STA  ASCCRC/2+X
3846                ;                          STORE NEW DESCENDING REGISTER CRC
3847 0A9C 01 2F 07   LXI  B,DSCSIZ*100H+DSCREG
3848                ;                          B = NIBCNT = DSCSIZ
3849                ;                          C = OFFSET, DSCREG
3850 0A9F CD B1 0E   CALL CRC                  CRC(DSCREG,NIBCNT,CRCVAL)
3851                ;                             ( @C   , B    , D    )
3852                ;                             ( I    , I    , O    )
3853 0AA2 7A         MOV  A,D                  DSCCRC = CRCVAL
3854 0AA3 32 1B 74   STA  DSCCRC/2+X
3855 0AA6 E1         POP  H                    CLEAN UP STACK
3856                ;                          WRITE NORMAL BLOCK AND
3857                ;                          OPEN ERASED SERVICE BLOCK
3858 0AA7 C3 19 12   JMP  NVMSTO               NVMSTO(ERRFLG)
3859                ;                                (PSW:Z )
3860                ;                                ( O    )
3861                ;                        ENDIF
3862                ;                      ENDIF
3863                ;                      RETURN
```

MSG2MU

```
3866                ;MSG2MU(FMTNIB,DSTSIZ,ERRFLG)(WORK1 ,DEFDCM,DIEDCM)
3867                ;      (NIBSTR,UBYTE ,BIT   )(NIBSTR,BYTE  ,BYTE  )
3868                ;      ( I    , I    , O    )( O    , I    , I    )
3869                ;      ( @B   , D    ,PSW:Z )( RAM  , RAM  , RAM  )
3870                ;      ( NC   , NC   , C    )( C    , NC   , NC   )
3871                ;
3872                ;PSW DESTROYED
3873                ;REGISTERS DESTROYED
3874                ;
3875                ;TRANSFORM FORMAT AND DATA IN MESSAGE FORMAT INTO A  METER
3876                ;UNIT FORMAT BCD STRING RIGHT JUSTIFIED IN WORK1.
3877                ;
3878                MSG2MU;              ****ENTRY POINT
3879                ;                    CLEAR OUTPUT BLOCK
3880 0AAA 3E C0      MVI  A,WORK1        A = OFFSET, WORK1[J=0]
3881 0AAC CD 85 0E   CALL CLRBLK         CLRBLK(WORK1)
3882                ;                          ( @A  )
3883                ;                          ( O   )
3884 0AAF 2E 01      MVI  L,1            L = FLAGV = 1; WHICH DECREMENTS TO 0
3885                ;                    PRODUCING:
3886                ;                    PSW:Z = ERRFLG = TRUE
3887                ;                    CALCULATE TOTAL CHARACTER COUNT
3888                ;                    INCLUDING POSSIBLE LEADING ZERO
```

```
3889                ;                          B = OFFSET, FMTNIB[I=0]
3890 0AB1 CD 35 0F   CALL GETNIB               GETNIB(NTOTAL,ZERO ,FMTNIB[I])
3891                ;                                ( A    ,PSW:Z, @B      )
3892                ;                                ( 0    , 0   , I       )
3893 0AB4 3C         INR  A                    H = NTOTAL = (NTOTAL+1) .AND. HEXFE
3894 0AB5 E6 FE      ANI  0FEH
3895 0AB7 67         MOV  H,A
3896                ;                          CALCULATE COUNT OF CHARACTERS TO RIGHT
3897                ;                          OF DECIMAL POINT
3898 0AB8 04         INR  B                    B = OFFSET, FMTNIB[I=1]
3899 0AB9 CD 35 0F   CALL GETNIB               GETNIB(NFRAC,ZERO ,FMTNIB[I])
3900                ;                                ( A   ,PSW:Z, @B      )
3901                ;                                ( 0   , 0   , I       )
3902                ;                          CHECK FOR UNSPECIFIED DECIMAL POSITION
3903 0ABC FE 0F      CPI  0FH                  IF NFRAC .EQ. HEX0F
3904 0ABE C2 C4 0A   JNZ  MSG2M1
3905                ;                            USE DEFAULT DECIMAL POSITION
3906 0AC1 3A 36 74   LDA  DEFDCM/2+X              A = NFRAC = DEFDCM
3907               MSG2M1;                     ENDIF
3908                ;                          CHECK FOR TOO MANY FRACTIONAL DIGITS
3909 0AC4 4F         MOV  C,A                  C = NFRAC
3910 0AC5 3A 35 74   LDA  DIEDCM/2+X           A = DIEDCM
3911 0AC8 B9         CMP  C                    IF DIEDCM .GE. NFRAC
3912 0AC9 DA F2 0A   JC   MSG2M5
3913                ;                            THERE IS ROOM FOR FRACTIONAL DIGITS
3914                ;                            CALCULATE INDEX FOR LOW ORDER DIGIT
3915 0ACC 2F         CMA                        A = J = 15-DIEDCM+NFRAC
3916 0ACD C6 10      ADI  16
3917 0ACF 81         ADD  C
3918                ;                            CHECK DATA LENGTH AND ALIGNMENT WITH
3919                ;                            RESPECT TO WORK AREA
3920 0AD0 BC         CMP  H                     IF DINDEX .GE. NTOTAL
3921 0AD1 DA F2 0A   JC   MSG2M4
3922                ;                              DATA FITS IN WORK AREA
3923                ;                              MOVE DATA INTO WORK AREA
3924 0AD4 C6 C0      ADI  WORK1                     C = OFFSET, WORK1[J]
3925 0AD6 4F         MOV  C,A
3926 0AD7 78         MOV  A,B                       B = OFFSET, FMTNIB[I=NTOTAL+1]
3927 0AD8 84         ADD  H
3928 0AD9 47         MOV  B,A
3929 0ADA 7C         MOV  A,H                       A = NTOTAL
3930 0ADB CD C2 0F   CALL MVRNIB                    MVRNIB(WORK1[J],FMTNIB[I],NTOTAL,
3931                ;                                     ( @C     , @B      , A    ,
3932                ;                                     ( 0      , I       , I    ,
3933                ;
3934                ;
3935                ;                              NONBCD,ZROFLG)
3936                ;                              PSW:S ,PSW:Z )
3937                ;                               0    , 0    )
3938                ;                              CHECK CHARACTERS MOVED
3939 0ADE FA F2 0A   JM   MSG2M3                   IF NONBCD .EQ. FALSE
3940                ;                                ONLY NUMERIC CHARS WERE MOVED.
3941                ;                                CHECK DATA LENGTH WITH RESPECT TO
3942                ;                                DECLARED SIZE OF DESTINATION.
3943                ;                                SET INDEX TO LEFT OF DECLARED
3944                ;                                HIGH ORDER DIGIT POSITION.
3945 0AE1 7A         MOV  A,D                       A = I = 15-DSTSIZ
3946 0AE2 2F         CMA
3947 0AE3 C6 10      ADI  16
3948                ;                                CALCULATE NUMBER OF DIGIT
3949                ;                                POSITIONS ABOVE HIGH ORDER
3950                ;                                DIGIT POSITION
3951 0AE5 67         MOV  H,A                       H = NTOTAL = 16-DSTSIZ
3952 0AE6 24         INR  H
3953                ;                                SCAN POSITIONS ABOVE HIGH ORDER
3954                ;                                DIGIT POSITION
3955 0AE7 C6 C0      ADI  WORK1                     B = OFFSET, WORK1[I]
3956 0AE9 47         MOV  B,A
3957 0AEA 7C         MOV  A,H                       A = NTOTAL
3958 0AEB CD 0F 10   CALL RSCAN                     RSCAN(WORK1[I],NTOTAL,
```

```
3959                ;                                  ( @B      , A     ,
3960                ;                                  ( I       , I     ,
3961                ;
3962                ;                                  NONBCD,ZROFLG)
3963                ;                                  PSW:S ,PSW:Z )
3964                ;                                   0     , 0     )
3965                ;                            CHECK CHARACTERS SCANNED
3966 0AEE C2 F2 0A    JNZ  MSG2M2                IF ZROFLG .EQ. FALSE
3967                ;                              DECLARED DATA LENGTH EXCEEDED
3968 0AF1 2C          INR  L                       L = FLAGV = 2; DECREMENTS TO 1
3969                ;                              PRODUCING:
3970                ;                              PSW:Z = ERRFLG = FALSE
3971               MSG2M2;                       ENDIF
3972               MSG2M3;                     ENDIF
3973               MSG2M4;                   ENDIF
3974               MSG2M5;                 ENDIF
3975 0AF2 2D          DCR  L                 PSW:Z = ERRFLG
3976 0AF3 C9          RET                    RETURN
MTRSTS

3979               ;MTRSTS()(XMTBUF,KDCTRL,MRSTS1,MRSTS2,NORFLG)
3980               ;        (BYTSTR,BITSTR,BITSTR,BITSTR,BITSTR)
3981               ;        ( 0    , I    , I    , I    , 0    )
3982               ;        ( RAM  , RAM  , RAM  , RAM  , RAM  )
3983               ;        ( C    , NC   , NC   , NC   , C    )
3984               ;
3985               ;ALL REGISTERS DESTROYED
3986               ;PSW DESTROYED
3987               ;
3988               ;PUT CURRENT STATUS MESSAGE INTO TRANSMIT BUFFER
3989               ;
3990               MTRSTS;                 ****ENTRY POINT
3991 0AF4 21 03 80    LXI  H,HSTAT*100H+3
3992                ;                       L = BYTCNT = 3
3993                ;                       H = HSTAT
3994 0AF7 22 50 74    SHLD XMTBUF/2+X+0     XMTBUF[0] = BYTCNT
3995                ;                       XMTBUF[1] = HSTAT
3996 0AFA 11 52 74    LXI  D,XMTBUF/2+X+2
3997                ;                       DE = ADDRESS, XMTBUF[2]
3998 0AFD 21 24 74    LXI  H,MRSTS1/2+X     HL = ADDRESS, MRSTS1
3999                ;                       XMTBUF[2].0 = 0
4000                ;                       XMTBUF[2].1 = MRSTS1.DATDOR
4001                ;                       XMTBUF[2].2 = MRSTS1.INSFND
4002                ;                       XMTBUF[2].3 = MRSTS1.LOWPOS
4003                ;                       XMTBUF[2].4 = MRSTS1.SERMOD
4004                ;                       XMTBUF[2].5 = MRSTS1.ENABLD
4005                ;                       XMTBUF[2].6 = 0
4006                ;                       XMTBUF[2].7 = MRSTS1.QUEREG
4007 0B00 7E          MOV  A,M
4008 0B01 E6 7D       ANI  7DH
4009 0B03 12          STAX D
4010 0B04 23          INX  H                HL = ADDRESS, MRSTS2
4011 0B05 13          INX  D                DE = ADDRESS, XMTBUF[3]
4012                ;                       XMTBUF[3].0 = MRSTS2.FATMOD
4013                ;                       XMTBUF[3].1 = KDCTRL.KBDDSB
4014                ;                       XMTBUF[3].2..7 = 0
4015 0B06 7E          MOV  A,M
4016 0B07 E6 80       ANI  80H
4017 0B09 47          MOV  B,A
4018 0B0A 3A 27 74    LDA  KDCTRL/2+X
4019 0B0D 0F          RRC
4020 0B0E 0F          RRC
4021 0B0F E6 40       ANI  40H
4022 0B11 B0          ORA  B
4023 0B12 12          STAX D
4024 0B13 23          INX  H                HL = ADDRESS, NORFLG
4025 0B14 7E          MOV  A,M              NORFLG.QUESTS = FALSE
4026 0B15 E6 7F       ANI  7FH
4027 0B17 77          MOV  M,A
4028 0B18 C9          RET                   RETURN
```

NPAUSE

```
                    ;NPAUSE(N   ,ZROFLG)
                    ;      (WORD,BIT   )
                    ;      (I/O ,O     )
                    ;      (BC  ,PSW:Z )
                    ;      ( C  , C    )
                    ;
                    ;REGISTERS DESTROYED
                    ;PSW DESTROYED
                    ;
                    ;PAUSE FOR ABOUT 100 USEC, AND DECREMENT N
                    ;
                    NPAUSE;              ****ENTRY POINT
                    ;                    PAUSE
0B19 3E 0A            MVI  A,10          A = 10
                    NPAUS1;              DO UNTIL A = 0
0B1B 3D               DCR  A               A = A-1
0B1C C2 1B 0B         JNZ  NPAUS1
                    ;                    ENDDO
                    ;                    DECREMENT N
0B1F 0B               DCX  B             BC = N = N-1
                    ;                    DEFINE STATUS OF N
0B20 78               MOV  A,B           PSW:Z = ZROFLG = N .EQ. 0
0B21 B1               ORA  C
0B22 C9               RET                RETURN
```

POSUPD

```
                    ;POSUPD()(WORK1 ,LOWWRN,POSREG,ASCREG,DSCREG,
                    ;        (NIBSTR,NIBSTR,NIBSTR,NIBSTR,NIBSTR,
                    ;        ( I/O  , I    , I    , I    , I    ,
                    ;        ( RAM  , RAM  , RAM  , RAM  , RAM  ,
                    ;        ( C    , NC   , NC   , C    , C    ,
                    ;
                    ;         ASCCRC,DSCCRC,UNLOCK,MRSTS1,MRSTS2)
                    ;         BYTE  ,BYTE  ,NIBSTR,BITSTR,BITSTR)
                    ;          I    , I    , I    , I/O  , I    )
                    ;          RAM  , RAM  , RAM  , RAM  , RAM  )
                    ;          NC   , NC   , NC   , C    , NC   )
                    ;
                    ;PSW DESTROYED
                    ;REGISTERS DESTROYED
                    ;
                    ;UPDATE METER STATUS FOR CURRENT POSTAGE SETTING
                    ;
                    POSUPD:              ****ENTRY POINT
                    ;-----------------------------------------------------
                    ;                    BUILD WARNING VALUE SAME LENGTH AS
                    ;                    DESCENDING REGISTER STARTING AT
                    ;                    WORK1[0]
                    ;                    CLEAR WORK AREA
0B23 3E C0            MVI  A,WORK1       A = OFFSET, WORK1
0B25 CD 85 0E         CALL CLRBLK        CLRBLK(WORK1)
                    ;                          ( @A  )
                    ;                          ( 0   )
0B28 06 1D            MVI  B,LOWWRN+1    B = OFFSET, LOWWRN[1]
0B2A CD 35 0F         CALL GETNIB        GETNIB(EXPONT,ZROFLG,LOWWRN[1])
                    ;                          ( A    ,PSW:Z , @B      )
                    ;                          ( 0    , 0    , I       )
0B2D 2F               CMA                A = -EXPONT-1
0B2E C6 C7            ADI  WORK1+DSCSIZ  C = OFFSET, WORK1[DSCSIZ-1-EXPONT]
0B30 4F               MOV  C,A
0B31 05               DCR  B             B = OFFSET, LOWWRN[0]
0B32 3E 01            MVI  A,1           A = NIBCNT = 1
0B34 CD B3 0F         CALL MVLNIB        MVLNIB(WORK1[DSCSIZ-1-EXPONT],
                    ;                          ( @C                  ,
                    ;                          ( 0                   ,
                    ;
                    ;                            LOWWRN[0],NIBCNT,NONBCD,ZROFLG)
```

```
4098                ;                                  @B      , A    ,PSW:S ,PSW:Z )
4099                ;                                  I       , I    , 0    , 0    )
4100                ;-----------------------------------------------------------
4101                ;                        INITIALIZE FOR CALLS TO POSUP1
4102 0B37 21 24 74   LXI  H,MRSTS1/2+X  HL = ADDRESS, MRSTS1
4103 0B3A 7E         MOV  A,M
4104 0B3B E6 CF      ANI  0CFH
4105 0B3D 77         MOV  M,A           MRSTS1.INSFND = FALSE
4106                ;                   MRSTS1.LOWPOS = FALSE
4107                ;-----------------------------------------------------------
4108                ;                   COMPARE DESCENDING REGISTER WITH
4109                ;                   WARNING VALUE
4110 0B3E 06 10      MVI  B,10H         B.LOWPOS = TRUE
4111 0B40 CD 85 0B   CALL POSUP1        IF DSCREG .LT. WORK1[0]
4112                ;                     MRSTS1.LOWPOS = B.LOWPOS = TRUE
4113                ;                   ENDIF
4114                ;-----------------------------------------------------------
4115                ;                   BUILD POSTAGE SETTING REGISTER SAME
4116                ;                   LENGTH AS DESCENDING REGISTER
4117                ;                   STARTING AT WORK1[0]
4118                ;                   CLEAR WORK AREA
4119 0B43 3E C0      MVI  A,WORK1       A = OFFSET, WORK1
4120 0B45 CD 85 0E   CALL CLRBLK        CLRBLK(WORK1)
4121                ;                         ( @A   )
4122                ;                         ( 0    )
4123 0B48 01 C3 42   LXI  B,POSREGA100H+WORK1+0+DSCSIZ-NBANKS
4124                ;                   B = OFFSET, POSREG
4125                ;                   C = OFFSET, WORK1[0+DSCSIZ-NBANKS]
4126 0B4B 3E 04      MVI  A,NBANKS      A = NBANKS
4127 0B4D CD B3 0F   CALL MVLNIB        MVLNIB(WORK1[0+DSCSIZ-NBANKS],
4128                ;                         ( @C                  ,
4129                ;                         ( 0                   ,
4130                ;
4131                ;                         POSREG,NBANKS,NONBCD,ZROFLG)
4132                ;                          @B   , A    ,PSW:S ,PSW:Z )
4133                ;                          I    , I    , 0    , 0    )
4134                ;-----------------------------------------------------------
4135                ;                   COMPARE DESCENDING REGISTER WITH
4136                ;                   POSTAGE SETTING
4137 0B50 06 20      MVI  B,20H         B.INSFND = TRUE
4138 0B52 CD 85 0B   CALL POSUP1        IF DSCREG .LT. WORK1[0]
4139                ;                     MRSTS1.INSFND = B.INSFND = TRUE
4140                ;                   ENDIF
4141                ;-----------------------------------------------------------
4142                ;                   CHECK ASCENDING REGISTER CRC
4143 0B55 01 38 08   LXI  B,ASCSIZA100H+ASCREG
4144                ;                   B = ASCSIZ
4145                ;                   C = OFFSET, ASCREG[0]
4146 0B58 3A 20 74   LDA  ASCCRC/2+X    A = ASCCRC
4147 0B5B CD 92 0B   CALL POSUP2        IF ASCCRC INCORRECT
4148                ;                     FILL ASCREG WITH HEX0F
4149                ;                     DECLARE DEAD METER. BAD CRC
4150                ;                   ENDIF
4151                ;-----------------------------------------------------------
4152                ;                   CHECK DESCENDING REGISTER CRC
4153 0B5E 01 2F 07   LXI  B,DSCSIZA100H+DSCREG
4154                ;                   B = DSCSIZ
4155                ;                   C = OFFSET, DSCREG[0]
4156 0B61 3A 1B 74   LDA  DSCCRC/2+X    A = DSCCRC
4157 0B64 CD 92 0B   CALL POSUP2        IF DSCCRC INCORRECT
4158                ;                     FILL DSCREG WITH HEX0F
4159                ;                     DECLARE DEAD METER. BAD CRC
4160                ;                   ENDIF
4161                ;-----------------------------------------------------------
4162                ;                   CHECK CONTROL SUM CRC
4163                ;                   MRSTS2.FATMOD WILL BE USED VS ERRFLG
4164 0B67 CD 3A 06   CALL CONSUM        CONSUM(ERRFLG)
4165                ;                         (PSW:Z )
4166                ;                         ( 0    )
4167                ;-----------------------------------------------------------
```

```
4168                ;                          ENABLE OR DISABLE METER
4169 0B6A 01 24 74   LXI  B,MRSTS1/3+X  BC = ADDRESS, MRSTS1
4170 0B6D 0A         LDAX B
4171 0B6E E6 68      ANI  68H
4172 0B70 67         MOV  H,A           H = FLAGS = MRSTS1.DATDOR,
4173                ;                               MRSTS1.INSFND,
4174                ;                               MRSTS1.SERMOD
4175 0B71 03         INX  B             BC = ADDRESS, MRSTS2
4176 0B72 0A         LDAX B
4177 0B73 E6 81      ANI  81H
4178 0B75 B4         ORA  H             A = FLAGS = FLAGS .OR.
4179                ;                               MRSTS2.FATMOD,
4180                ;                               MRSTS2.PRVMOD
4181                ;                          IF FLAGS .NE. 0
4182 0B76 C2 D3 05   JNZ  DISABL          DISABLE
4183                ;                          ELSE
4184                ;                          COMPARE $ UNLOCK VALUE WITH SETTING
4185 0B79 11 18 42   LXI  D,POSREG*100H+UNLOCK
4186                ;                          D = OFFSET, POSREG
4187                ;                          E = OFFSET, UNLOCK
4188 0B7C 3E 04      MVI  A,NBANKS         A = NBANKS
4189 0B7E CD 8E 0E   CALL CMPARE           CMPARE(POSREG,UNLOCK,NBANKS,
4190                ;                                ( @D   , @E   , A    ,
4191                ;                                ( I    , I    , I    ,
4192                ;
4193                ;                                NEGFLG,ZROFLG)
4194                ;                                PSW:S ,PSW:Z )
4195                ;                                 0    , 0    )
4196 0B81 FC F9 05   CM   ENABLE           IF NEGFLG .EQ. TRUE
4197                ;                          ENABLE
4198                ;                          ENDIF
4199                ;                          ENDIF
4200                ;-----------------------------------------------------------
4201 0B84 C9         RET                    RETURN
4202                ;-----------------------------------------------------------
4203                ;-----------------------------------------------------------
4204                ;-----------------------------------------------------------
4205                POSUP1;                 ****LOCAL ENTRY POINT
4206 0B85 11 C0 2F   LXI  D,DSCREG*100H+WORK1+0
4207                ;                      D = OFFSET, DSCREG[0]
4208                ;                      E = OFFSET, WORK1[0]
4209 0B88 3E 07      MVI  A,DSCSIZ         A = DSCSIZ
4210 0B8A CD 8E 0E   CALL CMPARE           CMPARE(DSCREG[0],WORK1[0],DSCSIZ,
4211                ;                                ( @D      , @E      , A    ,
4212                ;                                ( I       , I       , I    ,
4213                ;
4214                ;                                NEGFLG,ZROFLG)
4215                ;                                PSW:S ,PSW:Z )
4216                ;                                 0    , 0    )
4217 0B8D F0         RP                     IF NEGFLG .EQ. TRUE
4218 0B8E 7E         MOV  A,M               MRSTS1.FLAG = B.FLAG = TRUE
4219 0B8F B0         ORA  B
4220 0B90 77         MOV  M,A
4221                ;                      ENDIF
4222 0B91 C9         RET                    RETURN
4223                ;-----------------------------------------------------------
4224                ;-----------------------------------------------------------
4225                ;-----------------------------------------------------------
4226                POSUP2;                 ****LOCAL ENTRY POINT
4227 0B92 CD B1 0E   CALL CRC               CRC(REGSTR[0],REGSIZ,CRCVAL)
4228                ;                          ( @C      , B    , D    )
4229                ;                          ( I       , I    , O    )
4230 0B95 BA         CMP  D                 PSW:Z = NOERR = REGCRC .EQ. CRCVAL
4231 0B96 C8         RZ                     IF NOERR .EQ. FALSE
4232                ;                          FILL BAD REGISTER WITH HEXOF
4233 0B97 3E 0F      MVI  A,0FH             A = HEXOF
4234 0B99 C3 24 0F   JMP  FILNIB            FILNIB(REGSTR[0],HEXOF,REGSIZ)
4235                ;                                ( @C      , A    , B    )
4236                ;                                ( O       , I    , I    )
4237                ;                          DECLARE DEAD METER. BAD CRC
```

```
4238 0B9C 3E 00      MVI  A,BADCRC        A = CODE = BADCRC
4239 0B9E C3 85 10   JMP NVMDED           NVMDED(CODE,ERRFLG)
4240                ;                          ( A  ,PSW:Z )
4241                ;                          ( I  , 0    )
4242                ;                    ENDIF
4243                ;                    RETURN
4244                ;-----------------------------------------------------
4245                ;-----------------------------------------------------
4246                ;-----------------------------------------------------

PROERR

4249                ;PROERR(ERRFLG)(XMTBUF)
4250                ;      (BIT   )(BYTSTR)
4251                ;      ( 0    )( 0    )
4252                ;      (PSW:Z )( RAM  )
4253                ;      ( C    )( C    )
4254                ;
4255                ;REGISTERS DESTROYED
4256                ;PSW DESTROYED
4257                ;
4258                ;PROCESS PROCEDURAL ERROR
4259                ;
4260                PROERR;              ****ENTRY POINT
4261 0BA1 CD F4 0A   CALL MTRSTS         PUT STATUS MESSAGE IN TRANSMIT BUFFER
4262 0BA4 11 53 74   LXI  D,XMTBUF/2+X+3
4263                ;                    DE =  ADDRESS, XMTBUF[3]
4264                ;                    DECLARE PROCEDURAL ERROR
4265 0BA7 1A         LDAX D              XMTBUF[3].PROERR = TRUE
4266 0BA8 F6 02      ORI  2
4267 0BAA 12         STAX D
4268 0BAB AF         XRA  A              PSW:Z = ERRFLG = TRUE
4269 0BAC C3 64 04   JMP  PERDSP         MAKE PROCEDURAL ERROR DISPLAY
4270                ;                    RETURN

RDCYC

4273                ;RDCYC(INCYC ,INCYC,ADRESS,MRSTS1)(DATA1 )
4274                ;     (BITSTR,BIT  ,ADRESS,BITSTR)(BITSTR)
4275                ;     ( 0    , 0   , 0    , -    )( I    )
4276                ;     ( A    ,PSW:C, HL   , @HL  )( 6800 )
4277                ;     ( C    , C   , C    , NC   )( NC   )
4278                ;
4279                ;REGISTERS NOT CHANGED
4280                ;PSW DESTROYED
4281                ;
4282                ;RETURN STATUS OF METER CYCLE SWITCH
4283                ;
4284                RDCYC;               ****ENTRY POINT
4285                ;                    DEFINE ADDRESS FOR CALLING ROUTINES
4286 0BAF 21 24 74   LXI  H,MRSTS1/2+X   HL = ADDRESS, MRSTS1
4287                ;                    READ CYCLE SWITCH
4288 0BB2 3A 00 68   LDA  DATA1          A = INCYC,INCYCN = DATA1.2,DATA1.3
4289 0BB5 E6 30      ANI  30H
4290 0BB7 C2 C2 0B   JNZ  RDCYC1         IF BOTH SIDES OF SWITCH CLOSED
4291                ;                      DECLARE DEAD METER; BAD CYCLE SWITCH
4292 0BBA 3E 04      MVI  A,BADCYC        A = BADCYC
4293 0BBC CD 85 10   CALL NVMDED          NVMDED(BADCYC,ERRFLG)
4294                ;                          ( A    ,PSW:Z )
4295                ;                          ( I    , 0    )
4296 0BBF C3 B6 01   JMP PWRDN            ABORT
4297                RDCYC1;              ELSE
4298 0BC2 17         RAL                  PSW:C = INCYC = DATA1.2
4299 0BC3 17         RAL
4300 0BC4 17         RAL
4301 0BC5 9F         SBB  A               A.0..7 = INCYC
4302 0BC6 C9         RET                  RETURN
4303                ;                    ENDIF
```

RECEVE

```
                    ;RECEVE()(SID,SOD,SOE,RECBUF,NORFLG)
                    ;        (BIT,BIT,BIT,BYTSTR,BITSTR)
                    ;        ( I , O , O , O    , I    )
                    ;        (RIM,SIM,SIM, RAM  , RAM  )
                    ;        ( NC, C , C , C    , NC   )
                    ;
                    ;REGISTERS DESTROYED
                    ;PSW DESTROYED
                    ;
                    ;RECEIVE INCOMING MESSAGE IF EXTERNAL RTS IS PRESENT.
                    ;RECBUF[0], THE MESSAGE BYTE COUNT, IS CLEARED IF A
                    ;REQUEST TO SEND IS DETECTED.
                    ;
                    RECEVE;                 ****ENTRY POINT
0BC7 3A 26 74         LDA  NORFLG/2+X       IF NORFLG.COMDSB .EQ. TRUE
0BCA E6 04            ANI  4
                    ;                         COMMUNICATIONS ARE DISABLED
0BCC C0               RNZ                       RETURN
                    ;                       END IF
0BCD 20               RIM                   INPUT BIT
                    ;                       A.0 = BIT = RIM.SID ;RTS OR IDLE
0BCE B7               ORA A                 IF RIM.SID .NE. RTS
                    ;                         NO INCOMING REQUEST TO SEND PRESENT
0BCF F0               RP                        RETURN
                    ;                       ENDIF
                    ;                       STOP TIMER
0BD0 CD 34 01         CALL STPTMR           STPTMR(WASOFF)
                    ;                             (PSW:Z )
                    ;                             ( 0    )
0BD3 21 27 0C         LXI  H,RECE06         SET TO REACH QUIT ROUTINE VIA RETURN
0BD6 E5               PUSH H
0BD7 21 48 74         LXI  H,RECBUF/2+X     HL = ADDRESS, RECBUF[N=0]
                    ;                       (2 MVI VS 1 LXI FOR T3 = 100.012 USEC)
0BDA 06 00            MVI  B,0              B = BYTCNT = 0
0BDC 0E 80            MVI  C,80H            C = SIMA2 .AND. HEXFF, WHERE
                    ;                           SIM.SOE = ENABLD = 1
0BDE 70               MOV  M,B              RECBUF[0] = 0

                    RECE01;                 DO UNTIL BIT .EQ. EOM
0BDF 3E C0            MVI  A,0C0H             SIM.SOD = ONEBIT=1 ;CTS,OR EOB ECHO
                    ;                         SIM.SOE = ENABLD = 1
0BE1 30               SIM                     OUTPUT ONEBIT
0BE2 11 FB FD         LXI  D,-261             DE = COUNT ;FOR T13 = 3.494 MSEC
                    RECE02;                   DO UNTIL (BIT .EQ. START) .OR.
                    ;                           (COUNT .GE. 0)
0BE5 20               RIM                       INPUT BIT
                    ;                           A.0 = BIT = RIM.SID ;START,RTS,EOB
0BE6 13               INX  D                    DE = COUNT = COUNT+1
0BE7 A2               ANA  D                    A.0 = BIT .AND. COUNT.0
0BE8 FA E5 0B         JM   RECE02
                    ;                         ENDDO
                    ;
0BEB B2               ORA  D                  IF COUNT .GE. 0
                    ;                           T13 TIMEOUT OCCURRED
                    ;                           START NOT RECEIVED AFTER RTS
0BEC F0               RP                          QUIT
                    ;                         ENDIF
                    ;                         THE FIRST BYTE'S START BIT HAS BEEN
                    ;                         READ. IT WILL BE READ AGAIN AND
                    ;                         ECHOED LATER.
                    ;                         POINT AT NEXT BYTE IN RECBUF.
0BED 23               INX  H                  HL = ADDRESS, RECBUF[N=N+1]
                    ;                         CHECK FOR BUFFER OVERFLOW
0BEE 04               INR  B                  B = BYTCNT = BYTCNT+1
0BEF 3E 07            MVI  A,7                IF 7 .LT. BYTCNT
0BF1 B8               CMP  B
                    ;                           TRYING TO RECEIVE 8TH BYTE
0BF2 D8               RC                          QUIT
```

```
4374                ;                          ENDIF
4375                ;                          SET TO INPUT 10 BITS
4376                ;                          1 START, 8 DATA, AND 1 EOB OR EOM
4377 0BF5 16 0A      MVI  D,10                 D = BITCNT = 10

4378               RECE03;                     LOOP ;BREAK ON BITCNT .EQ. 0
4379                 RIM                         INPUT BIT
4380 0BF5 20        ;                            A.0 = BIT = RIM.SID
4381                 RAL                         PSW:CY  = BIT
4382 0BF6 17         MOV  A,C                    PSW:CY,A = SIM*2
4383 0BF7 79         RAR                         A = SIM
4384 0BF8 1F        ;                            SIM.SOD = ECHO = BIT
4385                ;                            SIM.SOE = ENABLD = 1
4386                 SIM                         OUTPUT 10 ECHO BITS
4387 0BF9 30         DCR  D                      D = BITCNT = BITCNT-1
4388 0BFA 15        ;                            IF BITCNT .EQ. 0
4389                 JZ   RECE04                   BREAK
4390 0BFB CA 0C 0C  ;                            ENDIF
4391                 RAL                         PSW:CY = BIT
4392 0BFE 17        ;                            SHIFT 9 BITS INTO BUFFER
4393                ;                            1 START,(LOST); 8 DATA,(KEPT)
4394                 MOV  A,M                    PSW:CY,A = RECBUF[N]*2
4395 0BFF 7E         RAR                         RECBUF[N] = (PSW:CY,A)/2
4396 0C00 1F         MOV  M,A
4397 0C01 77         MOV  M,A                    DELAY ;BIT PERIOD = 103.923 USEC
4398 0C02 77         MVI  A,7
4399 0C03 3E 07      DCR  A
4400 0C05 3D         JP   $-1
4401 0C06 F2 05 0C   JMP  RECE03
4402 0C09 C3 F5 0B  RECE04;                      ENDLOOP
4403                 ORA  A                      CHECK FOR EOM
4404 0C0C B7         JM   RECE01
4405 0C0D FA DF 0B  ;                           ENDDO
4406                 MVI  A,33                  DELAY ;T8 = 1264.965 USEC
4407 0C10 3E 21      DCR  A
4408 0C12 3D         JP   $-1
4409 0C13 F2 12 0C  ;                           CHECK FOR NO-ERROR PULSE
4410                 RIM                        INPUT BIT
4411 0C16 20        ;                           A.0 = BIT = RIM.SID
4412                 ORA  A                     IF BIT .EQ. ACK
4413 0C17 B7         JP   RECE05
4414 0C18 F2 1F 0C  ;                             MESSAGE RECEIVED WITHOUT ERROR
4415                ;                             PUT NONZERO BYTE COUNT IN BUFFER
4416                 MOV  A,B                      RECBUF[0] = BYTCNT
4417 0C1B 78         STA  RECBUF/2+X
4418 0C1C 32 48 74  RECE05;                     ENDIF
4419                 POP  PSW                   CLEAN UP STACK
4420 0C1F F1         MVI  D,34                  DELAY ;T15 = 1560.533 USEC
4421 0C20 16 22      DCR  D
4422 0C22 15         JP   $-1
4423 0C23 F2 22 0C   RET                        RETURN
4424 0C26 C9        ;
4425                RECE06;                     QUIT RECEIVE ROUTINE
4426                 MVI  A,40H                 SIM.SOD = IDLE = 0
4427 0C27 3E 40     ;                           SIM.SOE = ENABLD = 1
4428                 SIM                        OUTPUT IDLE
4429 0C29 30         MVI  D,194                 DELAY ;T15 = 1558.298 USEC
4430 0C2A 16 C2      DCR  D
4431 0C2C 15         JP   $-1
4432 0C2D F2 2C 0C   RET                        RETURN
4433 0C30 C9
```

REDSTS

```
4436                ;REDSTS(TRPSW,PRVSW)(PORTA ,PORTC )
4437                ;      (BYTE ,BYTE )(BITSTR,BITSTR)
4438                ;      ( D   , D   )( I/O  , I    )
4439                ;      ( B   , A   )( 7001 , 7003 )
4440                ;      ( C   , C   )( C    , NC   )
4441                ;
4442                ;REGISTERS DESTROYED
```

```
                    ;PSW DESTROYED
                    ;
                    ;RETURNS VALUES FOR TRIP SWITCH AND PRIVELEGED SWITCH
                    ;OFF = HEX00
                    ;ON  = HEXFF
                    ;
                    REDSTS;                 ****ENTRY POINT
                    ;                       FETCH PORTA IMAGE
                    ;                       SENSOR LEDS ASSUMED TO BE OFF
0C31 21 01 70         LXI  H,PORTA          HL = ADDRESS, PORTA
0C34 56               MOV  D,M              D = LEDOFF = PORTA
                    ;                       TURN SENSOR LEDS ON
0C35 7A               MOV  A,D              PORTA = PORTA .AND. HEXDF
0C36 E6 DF            ANI  0DFH
0C38 77               MOV  M,A
                    ;                       READ SENSORS
0C39 3A 03 70         LDA  PORTC
0C3C 07               RLC
0C3D 07               RLC
0C3E 07               RLC                   PSW:CY = TRPBIT = PORTC.2
0C3F 4F               MOV  C,A              C.0    = PRVBIT = PORTC.3
0C40 9F               SBB  A                B = TRPSW = TRPBIT*HEXFF
0C41 47               MOV  B,A
0C42 79               MOV  A,C              A = PRVSW = (.NOT. PRVBIT)*HEXFF
0C43 07               RLC
0C44 3F               CMC
0C45 9F               SBB  A
                    ;                       TURN SENSOR LEDS OFF
0C46 72               MOV  M,D              PORTA = LEDOFF
0C47 C9               RET                   RETURN
```

SELVAL

```
                    ;SELVAL(ERRFLG)(NORFLG,MRSTS1,POSREG)
                    ;      (BIT    )(BITSTR,BITSTR,NIBSTR)
                    ;      ( 0     )( 0    , I    , I    )
                    ;      (PSW:Z  )( RAM  , RAM  , RAM  )
                    ;      ( C     )( C    , NC   , NC   )
                    ;
                    ;REGISTERS DESTROYED
                    ;PSW DESTROYED
                    ;
                    ;PROCESS SELECTION VALUE REQUEST
                    ;
                    SELVAL;                 ****ENTRY POINT
0C48 21 26 74         LXI  H,NORFLG/2+X     HL = ADDRESS, NORFLG
0C4B 7E               MOV  A,M              NORFLG.QUEPOS = FALSE
0C4C E6 BF            ANI  0BFH
0C4E 77               MOV  M,A
0C4F 3A 24 74         LDA  MRSTS1/2+X       IF MRSTS1.UNKSEL .EQ. TRUE
0C52 B7               ORA  A
                    ;                         SELECTION VALUE IS UNKNOWN
0C53 FA A1 0B         JM   PROERR               PROERR(ERRFLG)
                    ;                                 (PSW:Z )
                    ;                                 ( 0    )
                    ;                         RETURN
                    ;                       ELSE
                    ;                         FLAG VERIFICATION OF SELECTION VALUE
0C56 7E               MOV  A,M                  NORFLG.UNVSEL = FALSE
0C57 E6 FD            ANI  0FDH
0C59 77               MOV  M,A
0C5A 11 60 0C         LXI  D,SELV01             DE = ADDRESS, SELV01
                    ;                         PUT REPLY IN TRANSMIT BUFFER
0C5D C3 5B 0D         JMP  VALREQ               VALREQ(POSREG,POSFMT,HPSET,ERRFLG)
                    ;                                 (@@DE+0,@DE+1 ,@DE+2,PSW:Z )
                    ;                                 ( I    , I    , I    , 0    )
                    ;                         RETURN
                    ;                       ENDIF
                    SELV01:                 ARGUMENT LIST FOR VALREQ
0C60 42 40 81         DB   POSREG,POSFMT,HPSET
```

SEREOE

```
4514                ;SEREOE(ERRFLG)(CMBBUF,LOWWRN,SETLIM,AMTBUF,WORK1 ,UNLOCK)
4515                ;      (BIT   )(NIBSTR,NIBSTR,NIBSTR,NIBSTR,NIBSTR,NIBSTR)
4516                ;      ( O    )( I    , O    , O    , I    , I/O  , O    )
4517                ;      (PSW:Z )( RAM  , RAM  , RAM  , RAM  , RAM  , RAM  )
4518                ;      ( C    )( C    , C    , C    , NC   , C    , C    )
4519                ;
4520                ;PSW DESTROYED
4521                ;REGISTERS DESTROYED
4522                ;
4523                ;PERFORM SERVICE FUNCTIONS WHICH ARE INITIATED BY THE
4524                ;ENTRY OF AN AMOUNT AND COMBINATION
4525                ;
4526                SEREOE;                 ***ENTRY POINT
4527                ;                       CHECK METER STATUS
4528 0C63 CD 4E 0F   CALL LSTATE            LSTATE(FATMOD,NORMOD,SERMOD,PRVMOD)
4529                ;                             (PSW:S ,PSW:Z ,PSW:P ,PSW:C )
4530                ;                             ( O    , O    , O    , O    )
4531                ;                       IF FATMOD .EQ. TRUE
4532                ;                         PROCESS ERROR
4533 0C66 FA A1 0B   JM   PROERR            PROERR(ERRFLG)
4534                ;                               (PSW:Z )
4535                ;                               ( O    )
4536                ;                       ELSE
4537                ;                         CHECK FORMAT BYTE IN CMBBUF
4538 0C69 21 78 74   LXI  H,CMBBUF/2+X      HL = ADDRESS, CMBBUF[0..1]
4539 0C6C 7E         MOV  A,M               IF CMBBUF[0..1] .NE. HEX1F
4540 0C6D FE 1F      CPI  1FH
4541                ;                           BAD FORMAT, PROCEEDURAL ERROR
4542 0C6F C2 A1 0B   JNZ  PROERR                PROERR(ERRFLG)
4543                ;                                (PSW:Z )
4544                ;                                ( O    )
4545                ;                         ELSE
4546                ;                         CHECK FOR OUT OF RANGE COMBINATION
4547 0C72 23         INX  H                 HL = ADDRESS, CMBBUF[2..3]
4548 0C73 7E         MOV  A,M               A = CMBBUF[2..3]
4549 0C74 FE 04      CPI  4                 IF CMBBUF[2..3] .GE. 4
4550                ;                           BAD COMBINATION, PROCEEDURAL ERROR
4551 0C76 D2 A1 0B   JNC  PROERR                PROERR(ERRFLG)
4552                ;                                (PSW:Z )
4553                ;                                ( O    )
4554                ;                         ELSE
4555                ;                         --CASE (CMBBUF[2..3])
4556 0C79 11 1E 07   LXI  D,DSCSIZ*100H+LOWWRN
4557 0C7C FE 01      CPI  1                    **01:
4558                ;                             CHANGE LOW POSTAGE WARN LIMIT
4559 0C7E CA FB 0C   JZ   SRVCNV                   SRVCNV(LOWWRN,DSCSIZ,ERRFLG)
4560                ;                                    ( @E   , D    ,PSW:Z )
4561                ;                                    ( O    , I    , O    )
4562 0C81 11 1E 05   LXI  D,(NBANKS+1)*100H+SETLIM
4563 0C84 FE 02      CPI  2                    **02:
4564                ;                             CHANGE SETTING LIMIT
4565 0C86 CA FB 0C   JZ   SRVCNV                   SRVCNV(SETLIM,NBANKS+1,ERRFLG)
4566                ;                                    ( @E   , D      ,PSW:Z )
4567                ;                                    ( O    , I      , O    )
4568 0C89 06 E0      MVI  B,AMTBUF
4569                ;                             **03:
4570                ;                             CHANGE SERIAL NUMBER
4571 0C8B F2 38 0A   JP   MSERNO                   MSERNO(AMTBUF,ERRFLG)
4572                ;                                    ( @B   ,PSW:Z )
4573                ;                                    ( I    , O    )
4574                ;                             **00:
4575 0C8E 15         DCR  D                        D = NBANKS
4576                ;                             CHANGE DOLLAR UNLOCK VALUE
4577 0C8F CD AA 0A   CALL MSG2MU                   MSG2MU(AMTBUF,NBANKS,ERRFLG)
4578                ;                                    ( @B   , D    ,PSW:Z )
4579                ;                                    ( I    , I    , O    )
4580                ;                             IF ERRFLG .EQ. TRUE
4581                ;                               BAD AMOUNT, PROCEEDURAL ERROR
```

```
4582 0C92 CA A1 0B   JZ   PROERR                PROERR(ERRFLG)
4583                ;                                (PSW:Z )
4584                ;                                ( 0    )
4585                ;                           ELSE
4586                ;                             REDEFINE $ UNLOCK VALUE
4587 0C95 3E 04      MVI  A,NBANKS                A = NBANKS
4588 0C97 01 18 CC   LXI  B,(WORK1+16-NBANKS)*100H+UNLOCK
4589                ;                             B = OFFSET, WORK1[16-NBANKS]
4590                ;                             C = OFFSET, UNLOCK
4591 0C9A CD B3 0F   CALL MVLNIB                  MVLNIB(UNLOCK,WORK1[16-NBANKS],
4592                ;                                ( @C   , @B              ,
4593                ;                                ( 0    , I               ,
4594                ;
4595                ;                             NBANKS,NONBCD,ZERO )
4596                ;                              A    ,PSW:S ,PSW:Z)
4597                ;                              I    , 0    , 0   )
4598 0C9D 0C         INR  C                       PSW:Z = ERRFLG = FALSE
4599                ;                           ENDIF
4600                ;                        --ENDCASE
4601                ;                        ENDIF
4602                ;                      ENDIF
4603 0C9E C9         RET                    RETURN
```

SETPOS

```
4606                ;SETPOS(MSGBUF,ERRFLG)(SETLIM,WORK1 ,WORK2 ,MRSTS1,
4607                ;      (NIBSTR,BIT   )(NIBSTR,NIBSTR,NIBSTR,BITSTR,
4608                ;      ( I    , 0    )( I    , 0    , 0    , 0    ,
4609                ;      ( @B   ,PSW:Z )( RAM  , RAM  , RAM  , RAM  ,
4610                ;      ( NC   , C    )( NC   , C    , C    , C    ,
4611                ;
4612                ;      NORFLG,POSREG)
4613                ;      BITSTR,NIBSTR)
4614                ;       0    , 0    )
4615                ;       RAM  , RAM  )
4616                ;       C    , C    )
4617                ;
4618                ;REGISTERS DESTROYED
4619                ;PSW DESTROYED
4620                ;
4621                ;PROCESS SET POSTAGE COMMAND
4622                ;
4623                SETPOS:              ****ENTRY POINT
4624                ;                    SET TO REACH PROERR VIA RETURN
4625 0C9F 21 A1 0B   LXI  H,PROERR
4626 0CA2 E5         PUSH H
4627 0CA3 CD 4E 0F   CALL LSTATE         LSTATE(FATMOD,NORMOD,SERMOD,PRVMOD)
4628                ;                          (PSW:S ,PSW:Z ,PSW:P ,PSW:CY)
4629                ;                          ( 0    , 0    , 0    , 0    )
4630                ;                     IF NORMOD .EQ. FALSE
4631                ;                       METER NOT IN NORMAL MODE
4632 0CA6 C0         RNZ                    PROERR(ERRFLG)
4633                ;                     ELSE
4634                ;                       PUT NEW SETTING VALUE INTO WORK1
4635 0CA7 16 04      MVI  D,NBANKS          D = NIBCNT = NBANKS
4636 0CA9 CD AA 0A   CALL MSG2MU            MSG2MU(MSGBUF,NIBCNT,ERRFLG)
4637                ;                            ( @B   , D    ,PSW:Z )
4638                ;                            ( I    , I    , 0    )
4639 0CAC F5         PUSH PSW               SAVE A,PSW
4640 0CAD 21 24 74   LXI  H,MRSTS1/2+X      HL = ADDRESS, MRSTS1
4641 0CB0 7E         MOV  A,M               MRSTS1.ENABLD = FALSE
4642 0CB1 E6 FB      ANI  0FBH
4643 0CB3 77         MOV  M,A
4644 0CB4 F1         POP  PSW               RESTORE A,PSW
4645                ;                       IF ERRFLG .EQ. TRUE
4646                ;                         NEW SETTING VALUE IS IMPROPER
4647 0CB5 C8         RZ                      PROERR(ERRFLG)
4648                ;                       ELSE
4649                ;                         FETCH SETTING LIMIT EXPONENT
4650 0CB6 06 1F      MVI  B,SETLIM+1          B = OFFSET, SETLIM[1]
```

```
4651 0CB8 CD 3E 0F   CALL GETNIB            GETNIB(EXPONT,ZROFLG,SETLIM[1])
4652                ;                             ( A    ,PSW:Z , @B      )
4653                ;                             ( 0    , 0    , I       )
4654                ;                       CALCULATE WORK2 INDEX FOR MANTISSA
4655 0CBB 2F         CMA                    A = -EXPONT-1
4656 0CBC C6 10      ADI  16                C = I = 15-EXPONT
4657 0CBE 4F         MOV  C,A
4658                ;                       CLEAR WORK2
4659 0CBF 3E D0      MVI  A,WORK2           A = OFFSET, WORK2
4660 0CC1 CD 85 0E   CALL CLRBLK            CLRBLK(WORK2)
4661                ;                             ( @A  )
4662                ;                             ( 0   )
4663                ;                       PUT SET LIMIT MANTISSA INTO WORK2
4664 0CC4 81         ADD  C                 C = OFFSET, WORK2[I]
4665 0CC5 4F         MOV  C,A
4666 0CC6 05         DCR  B                 B = OFFSET, SETLIM[0]
4667 0CC7 CD 35 0F   CALL GETNIB            GETNIB(MANTIS,ZROFLG,SETLIM[0])
4668                ;                             ( A    ,PSW:Z , @B      )
4669                ;                             ( 0    , 0    , I       )
4670 0CCA CD EE 0F   CALL PUTNIB            PUTNIB(WORK2[I],MANTIS)
4671                ;                             ( @C     , A    )
4672                ;                             ( 0      , I    )
4673                ;                       COMPARE NEW SETTING VS SETTING LIM
4674 0CCD 11 DB CB   LXI  D,(WORK1+15-NBANKS)*100H+(WORK2+15-NBANKS)
4675                ;                       D = OFFSET, WORK1[N=15-NBANKS]
4676                ;                       E = OFFSET, WORK2[N]
4677 0CD0 3E 05      MVI  A,NBANKS+1        A = NIBCNT = NBANKS+1
4678 0CD2 CD 8E 0E   CALL CMPARE            CMPARE(WORK1[N],WORK2[N],NIBCNT,
4679                ;                             ( @D     , @E     , A    ,
4680                ;                             ( I      , I      , I    ,
4681                ;
4682                ;                             NEGFLG,ZROFLG)
4683                ;                             PSW:S ,PSW:Z )
4684                ;                              0    , 0    )
4685                ;                       IF NEGFLG .EQ. FALSE
4686                ;                         NEW SETTING EXCEEDS LIMIT
4687 0CD5 F0         RP                       PROERR(ERRFLG)
4688                ;                       ELSE
4689 0CD6 F1         POP  PSW                 CLEAN UP STACK
4690                ;                         SET POSTAGE
4691 0CD7 11 26 74   LXI  D,NORFLG/2+X        DE = ADDRESS, NORFLG
4692 0CDA 1A         LDAX D                   NORFLG.LATDSB = FALSE
4693 0CDB E6 FE      ANI  0FEH
4694 0CDD F6 02      ORI  2                   NORFLG.UNVSEL = TRUE
4695 0CDF 12         STAX D
4696 0CE0 7E         MOV  A,M                 MRSTS1.UNKSEL = TRUE
4697 0CE1 F6 80      ORI  80H
4698 0CE3 77         MOV  M,A
4699 0CE4 E5         PUSH H                   SAVE HL
4700 0CE5 CD 25 1A   CALL MVPOST              MVPOST(ERROR)
4701                ;                             ( A   )
4702                ;                             ( 0   )
4703 0CE8 E1         POP  H                   RESTORE HL
4704 0CE9 B7         ORA  A                   PSW:Z = NOERR = ERROR .EQ. 0
4705                ;                         IF NOERR .EQ. FALSE
4706                ;                           METER DID NOT SET
4707 0CEA C2 80 08   JNZ  FATERR                FATERR(ERROR,ERRFLG)
4708                ;                                ( A   ,PSW:Z )
4709                ;                                ( I   , 0    )
4710                ;                         ELSE
4711                ;                           REPORT SUCCESSFUL SETTING
4712 0CED 01 42 CC   LXI  B,(WORK1+16-NBANKS)*100H+POSREG
4713                ;                           B = OFFSET, WORK1[N]
4714                ;                           C = OFFSET, POSREG
4715 0CF0 3E 04      MVI  A,NBANKS              A = NIBCNT = NBANKS
4716 0CF2 CD B3 0F   CALL MVLNIB                MVLNIB(POSREG,WORK1[N],NBANKS,
4717                ;                                ( @C   , @B     , A    ,
4718                ;                                ( 0    , I      , I    ,
4719                ;
```

```
4720                ;                                   NONBCD,ZROFLG)
4721                ;                                   PSW:S ,PSW:Z )
4722                ;                                    0    , 0    )
4723 0CF5 7E          MOV  A,M                    MRSTS1.UNKSEL = FALSE
4724 0CF6 E6 7F       ANI  7FH
4725 0CF8 77          MOV  M,A
4726                ;                             CLEAR ERROR FLAG
4727 0CF9 0C          INR  C                      C = OFFSET, POSREG[1]
4728                ;                             PSW:Z = ERRFLG = C.EQ.0=FALSE
4729                ;                           ENDIF
4730                ;                         ENDIF
4731                ;                       ENDIF
4732                ;                     ENDIF
4733 0CFA C9          RET                 RETURN
                                                15
SRVCNV

4736                ;SRVCNV(SRVREG,MAXCNT,ERRFLG)(AMTBUF,DIEDCM)
4737                ;      (NIBSTR,BYTE  ,BIT   )(NIBSTR,BYTE  )
4738                ;      ( 0    , I    , 0    )( I    , I    )
4739                ;      ( @E   , D    ,PSW:Z )( RAM  , RAM  )
4740                ;      ( C    , C    , C    )( NC   , NC   )
4741                ;
4742                ;PSW DESTROYED
4743                ;REGISTERS DESTROYED
4744                ;
4745                ;CONVERT MESSAGE FORMATTED VALUE IN AMTBUF INTO A
4746                ;SPECIAL SERVICE REGISTER FORMAT IN THE FORM:
4747                ;MANTISSA*10**EXPONENT, IN WHICH
4748                ;SRVREG[0] = MANTISSA
4749                ;SRVREG[1] = EXPONENT
4750                ;
4751                SRVCNV;                 ****ENTRY POINT
4752                ;                       SET TO REACH PROERR VIA RETURN
4753 0CFB 21 A1 0B    LXI  H,PROERR
4754 0CFE E5          PUSH H
4755                ;                       FETCH VALUES FROM MESSAGE FORMAT
4756 0CFF 06 E1       MVI  B,AMTBUF+1       B = OFFSET, AMTBUF[1]
4757 0D01 CD 35 0F    CALL GETNIB           GETNIB(DECPOS,ZROFLG,AMTBUF[1])
4758                ;                             ( A    ,PSW:Z , @B      )
4759                ;                             ( 0    , 0    , I       )
4760 0D04 6F          MOV  L,A              L = DECPOS
4761 0D05 05          DCR  B                B = OFFSET, AMTBUF[0]
4762 0D06 CD 35 0F    CALL GETNIB           GETNIB(MSGCNT,ZROFLG,AMTBUF[0])
4763                ;                             ( A    ,PSW:Z , @B      )
4764                ;                             ( 0    , 0    , I       )
4765 0D09 67          MOV  H,A              H = MSGCNT
4766                ;                       IF ZROFLG .EQ. TRUE
4767                ;                         NO VALUE WAS ENTERED
4768 0D0A C8          RZ                      PROERR(ERRFLG)
4769                ;                       ELSE
4770                ;                       POINT TO RIGHT OF H/O MESSAGE DIGIT
4771 0D0B E6 01       ANI  1                B = OFFSET, AMTBUF[I=
4772                ;                                   (MSGCNT .AND. HEX01)+3]
4773 0D0D C6 E3       ADI AMTBUF+3
4774 0D0F 47          MOV  B,A
4775 0D10 4F          MOV  C,A              C = OFFSET, AMTBUF[I]
4776                ;                       SCAN DIGITS TO RIGHT OF H/O MSG DIGIT
4777 0D11 7D          MOV  A,H              A = NIBCNT = MSGCNT-1
4778 0D12 3D          DCR  A
4779 0D13 CD BC 0F    CALL MVLNIB           MVLNIB(AMTBUF[I],AMTBUF[I],NIBCNT,
4780                ;                             ( @C      , @B      , A    ,
4781                ;                             ( 0       , I       , I    ,
4782                ;
4783                ;                             NONBCD,ZROFLG)
4784                ;                             PSW:S ,PSW:Z )
4785                ;                              0    , 0    )
4786                ;                       IF ZROFLG .EQ. FALSE
4787                ;                         NOT ALL DIGITS SCANNED WERE ZEROES
4788 0D16 C0          RNZ                     PROERR(ERRFLG)
```

```
4789                ;                          ELSE
4790 0D17 3A 35 74   LDA  DIEDCM/2+X           A = DIEDCM-DECPOS
4791 0D1A 95         SUB  L
4792                ;                          IF (DIEDCM-DECPOS) .LT. 0
4793                ;                            BAD DECIMAL IN MESSAGE FORMAT
4794 0D1B D8         RC                          PROERR(ERRFLG)
4795                ;                          ELSE
4796                ;                          CALCULATE EXPONENT
4797 0D1C 84         ADD  H                     L = EXPONT = MSGCNT-1+DIEDCM-DECPOS
4798 0D1D 3D         DCR  A
4799 0D1E 6F         MOV  L,A
4800 0D1F BA         CMP  D                     IF EXPONT .GE. MAXCNT
4801                ;                            MESSAGE IS TOO LONG
4802 0D20 D0         RNC                         PROERR(ERRFLG)
4803                ;                          ELSE
4804                ;                          FETCH H/O MESSAGE DIGIT AS MANTISSA
4805 0D21 05         DCR  B                     B = OFFSET, AMTBUF[I=I-1]
4806 0D22 CD 35 0F   CALL GETNIB                GETNIB(MANTIS,ZROFLG,AMTBUF[I])
4807                ;                                 ( A    ,PSW:Z , @B      )
4808 0D25 FE 0A      CPI  10                    IF MANTIS .GE. 10
4809                ;                            NON BCD CHAR IN MESSAGE
4810 0D27 D0         RNC                         PROERR(ERRFLG)
4811                ;                          ELSE
4812 0D28 C1         POP  B                      CLEAN UP STACK
4813                ;                            PUT MANTISSA IN SERVICE REGISTER
4814 0D29 4B         MOV  C,E                    C = OFFSET, SRVREG[0]
4815 0D2A CD EE 0F   CALL PUTNIB                 PUTNIB(SRVREG[0],MANTIS)
4816                ;                                  ( @C      , A    )
4817                ;                                  ( 0       , I    )
4818                ;                            PUT EXPONENT IN SERVICE REGISTER
4819 0D2D 0C         INR  C                      C = OFFSET, SRVREG[1]
4820 0D2E 7D         MOV  A,L                    A = EXPONT
4821 0D2F CD EE 0F   CALL PUTNIB                 PUTNIB(SRVREG[1],EXPONT)
4822                ;                                  ( @C      , A    )
4823                ;                                  ( 0       , I    )
4824 0D32 0C         INR  C                      PSW:Z = ERRFLG = FALSE
4825                ;                          ENDIF
4826 0D33 C9         RET                        RETURN
```

SRVREQ

```
4829                ;SRVREQ(SRVVAL,SRVHDR,ERRFLG)(WORK1 ,WORK2 ,DIEDCM)
4830                ;      (NIBSTR,BYTE  ,BIT   )(NIBSTR,NIBSTR,BYTE  )
4831                ;      ( I    , I    , O    )( O    , O    , I    )
4832                ;      ( @B   , C    ,PSW:Z )( RAM  , RAM  , RAM  )
4833                ;      ( NC   , C    , C    )( C    , C    , NC   )
4834                ;
4835                ;PSW DESTROYED
4836                ;REGISTERS DESTROYED
4837                ;
4838                ;EXPAND COMPRESSED SERVICE REGISTER TO WORK BUFFER.
4839                ;CALL VALREQ TO BUILD MESSAGE IN XMTBUF.
4840                ;
4841                SRVREQ;                    ****ENTRY POINT
4842                ;                          CLEAR WORK AREA
4843 0D34 3E C0      MVI A,WORK1               A = OFFSET, WORK1
4844 0D36 CD 85 0E   CALL CLRBLK               CLRBLK(WORK1)
4845                ;                                 ( @A  )
4846                ;                                 ( O   )
4847 0D39 21 6A 74   LXI  H,(WORK2+4)/2+X
4848                ;                          HL = ADDRESS, WORK2[4..5]
4849 0D3C 71         MOV  M,C                  WORK2[4..5] = SRVHDR
4850 0D3D 0E C4      MVI  C,WORK1+4            C = OFFSET, WORK1[4]
4851                ;                          MOVE MANTISSA INTO WORK AREA
4852 0D3F 3E 01      MVI  A,1                  A = NIBCNT = 1
4853 0D41 CD B3 0F   CALL MVLNIB                MVLNIB(WORK1[4],SRVVAL[0],NIBCNT,PSW)
4854                ;                                 ( @C      , @B      , A    ,PSW)
4855                ;                                 ( O       , I       , I    , O )
4856 0D44 04         INR  B                    B = OFFSET, SRVVAL[1]
4857                ;                          FETCH EXPONENT
```

```
4858 0D45 CD 35 0F   CALL GETNIB        GETNIB(EXPONT,PSW,SRVVAL[1])
4859                ;                         ( A    ,PSW, @B      )
4860                ;                         ( O    , O , I       )
4861 0D48 3C         INR  A             A = NIBCNT = EXPONT+1
4862 0D49 07         RLC                B = FORMAT = HEX10*NIBCNT
4863 0D4A 07         RLC
4864 0D4B 07         RLC
4865 0D4C 07         RLC
4866 0D4D 47         MOV  B,A
4867 0D4E 3A 35 74   LDA  DIEDCM/2+X    A = FORMAT = FORMAT+DIEDCM
4868 0D51 80         ADD  B
4869 0D52 2B         DCX  H             HL = ADDRESS, WORK2[2..3]
4870 0D53 77         MOV  M,A           WORK2[2..3] = FORMAT
4871 0D54 2B         DCX  H             HL = ADDRESS, WORK2[0..1]
4872 0D55 36 C4      MVI  M,WORK1+4     WORK2[0..1] = OFFSET, WORK1[4]
4873 0D57 EB         XCHG               DE = ADDRESS, WORK2[0..1]
4874                ;                   PUT REPLY INTO TRANSMIT BUFFER
4875 0D58 C3 5B 0D   JMP  VALREQ        VALREQ(WORK1[4],WORK2[2],WORK2[4],
4876                ;                         (@@DE+0  ,@DE+1   ,@DE+2   ,
4877                ;                         ( I      , I      , I      ,
4878                ;
4879                ;                         ERRFLG)
4880                ;                         PSW:Z )
4881                ;                          O    )
4882                ;                   RETURN
```

VALREQ

```
4885                ;VALREQ(SOURCE,VALFMT,ANSHDR,ERRFLG)(DIEDCM,DEFDCM,XMTBUF)
4886                ;      (NIBSTR,BYTE  ,BYTE  ,BYTE  )(BYTE  ,BYTE  ,NIBSTR)
4887                ;      ( I    , I    , I    , O    )( I    , I    , O    )
4888                ;      (@@DE+0, @DE+1, @DE+2,PSW:Z )( RAM  , RAM  , RAM  )
4889                ;      ( NC   , NC   , NC   , C    )( NC   , NC   , C    )
4890                ;
4891                ;PSW DESTROYED
4892                ;ALL REGISTERS DESTROYED
4893                ;
4894                ;BUILD VALUE REPLY MESSAGE IN TRANSMIT BUFFER
4895                ;
4896                VALREQ;             ****ENTRY POINT
4897                ;                   FETCH OFFSET OF SOURCE
4898 0D5B EB         XCHG               HL = ADDRESS, (OFFSET, SOURCE[L=0])
4899 0D5C 46         MOV  B,M           B = OFFSET, SOURCE[L=0]
4900                ;                   FETCH FORMAT TEMPLATE FOR MESSAGE
4901 0D5D 23         INX  H             HL = ADDRESS, VALFMT
4902 0D5E 7E         MOV  A,M           E = DECPOS = VALFMT[1]
4903 0D5F E6 0F      ANI  0FH
4904 0D61 5F         MOV  E,A
4905 0D62 7E         MOV  A,M           D = NDIGIT = VALFMT[0]
4906 0D63 AB         XRA  E
4907 0D64 0F         RRC
4908 0D65 0F         RRC
4909 0D66 0F         RRC
4910 0D67 0F         RRC
4911 0D68 57         MOV  D,A
4912                ;                   FETCH HEADER FOR REPLY
4913 0D69 23         INX  H             HL = ADDRESS, ANSHDR
4914 0D6A 4E         MOV  C,M           C = ANSHDR
4915                ;                   SCAN FOR MOST SIGNIFICANT DIGIT
4916                VALR01:             DO WHILE SOURCE[L] .EQ. 0
4917 0D6B CD 35 0F   CALL GETNIB          GETNIB(LDIGIT,ZROFLG,SOURCE[L])
4918                ;                         ( A    , PSW:Z, @B      )
4919                ;                         ( O    , O    , I       )
4920 0D6E C2 78 0D   JNZ  VALR02
4921 0D71 04         INR  B               B = OFFSET, SOURCE[L=L+1]
4922 0D72 15         DCR  D               D = NDIGIT = NDIGIT-1
4923 0D73 C2 6B 0D   JNZ  VALR01          IF NDIGIT .EQ. 0
4924 0D76 14         INR  D                 D = NDIGIT = 1
4925 0D77 05         DCR  B                 B = OFFSET, SOURCE[L=L-1]
4926                ;                       BREAK
```

```
4927                ;                          ENDIF
4928                VALR02;                  ENDDO
4929 0D78 1C          INR  E                 IF DECPOS .EQ. 0
4930 0D79 1D          DCR  E
4931 0D7A C2 9E 0D    JNZ  VALR05
4932                ;                          METER CHARACTERISTCS WILL
4933                ;                          DETERMINE FORMAT.
4934                ;                          ADJUST VALUES SO THAT AT LEAST ONE
4935                ;                          DIGIT WILL BE TO LEFT OF DECIMAL.
4936 0D7D 2A 35 74    LHLD DIEDCM/2+X          L = DIEDCM
4937                ;                          H = DEFDCM
4938 0D80 5D          MOV  E,L                 E = DECPOS = DIEDCM
4939 0D81 7D          MOV  A,L                 A = ADJUST = DIEDCM+1-NDIGIT
4940 0D82 3C          INR  A
4941 0D83 92          SUB  D

VALREQ

4942 0D84 FA 8D 0D    JM   VALR03              IF ADJUST .GE. 0
4943 0D87 6F          MOV  L,A                   L = ADJUST
4944 0D88 82          ADD  D                     D = NDIGIT = NDIGIT+ADJUST
4945 0D89 57          MOV  D,A
4946 0D8A 78          MOV  A,B                   B = OFFSET, SOURCE[L=L-ADJUST]
4947 0D8B 95          SUB  L
4948 0D8C 47          MOV  B,A
4949                VALR03;                    ENDIF
4950                ;                          SUPPRESS TRAILING ZERO IN THE
4951                ;                          EVENT DIEDCM .GT. DEFDCM
4952 0D8D C5          PUSH B                   SAVE BC
4953 0D8E 78          MOV  A,B                 B = OFFSET, SOURCE[R=L+NDIGIT-1]
4954 0D8F 82          ADD  D
4955 0D90 3D          DCR  A
4956 0D91 47          MOV  B,A
4957 0D92 CD 35 0F    CALL GETNIB              GETNIB(RDIGIT,ZROFLG,SOURCE[R])
4958                ;                                ( A    , PSW:Z, @B      )
4959                ;                                ( D    , D    , I       )
4960 0D95 C1          POP  B                   B = SOURCE[L]
4961                ;                          C = ANSHDR
4962 0D96 C2 9E 0D    JNZ  VALR04              IF RDIGIT .EQ. 0
4963                ;                            TRAILING ZERO IS PRESENT
4964 0D99 7A          MOV  A,D                   D = NDIGIT = NDIGIT+DEFDCM-DECPOS
4965 0D9A 93          SUB  E
4966 0D9B 84          ADD H
4967 0D9C 57          MOV  D,A
4968 0D9D 5C          MOV  E,H                   E = DECPOS = DEFDCM
4969                VALR04;                    ENDIF
4970                VALR05:                  ENDIF
4971                ;                          CLEAR TRANSMIT BUFFER
4972 0D9E 3E A0       MVI  A,XMTBUF            A = OFFSET, XMTBUF
4973 0DA0 CD 85 0E    CALL CLRBLK              CLRBLK(XMTBUF)
4974                ;                                ( @A   )
4975                ;                                ( D    )
4976                ;                          BUILD MESSAGE IN TRANSMIT BUFFER
4977 0DA3 7A          MOV  A,D                 L = MSGSIZ = 2+(NDIGIT+1)/2
4978 0DA4 B7          ORA  A
4979 0DA5 1F          RAR
4980 0DA6 CE 02       ACI  2
4981 0DA8 6F          MOV  L,A
4982 0DA9 61          MOV  H,C                 H = ANSHDR
4983 0DAA 22 50 74    SHLD XMTBUF/2+X          XMTBUF[0..1] = MSGSIZ
4984                ;                          XMTBUF[2..3] = ANSHDR
4985 0DAD 0E A4       MVI  C,XMTBUF+4          C = OFFSET, XMTBUF[4]
4986 0DAF 7A          MOV  A,D                 A = NDIGIT
4987 0DB0 CD EE 0F    CALL PUTNIB              PUTNIB(XMTBUF[4],NDIGIT)
4988                ;                                ( @C      , A    )
4989                ;                                ( D       , I    )
4990 0DB3 0C          INR  C                   C = OFFSET, XMTBUF[5]
4991 0DB4 7B          MOV  A,E                 A = DECPOS
4992 0DB5 CD EE 0F    CALL PUTNIB              PUTNIB(XMTBUF[5],DECPOS)
4993                ;                                ( @C      , A    )
```

```
4994                ;                                  ( O       , I     )
4995 0DB8 0C          INR  C              C = OFFSET, XMTBUF[I=6+(NDIGIT.MOD.2)]
4996 0DB9 7A          MOV  A,D
4997 0DBA E6 01       ANI  1
4998 0DBC 81          ADD  C
4999 0DBD 4F          MOV  C,A
5000 0DBE 7A          MOV  A,D            A = NDIGIT
5001 0DBF CD B3 0F    CALL MVLNIB         MVLNIB(XMTBUF[I],SOURCE[L],NDIGIT,
5002                ;                          ( @C      , @B      , A     ,
5003                ;                          ( O       , I       , I     ,
5004                ;
5005                ;                           NONBCD,ZROFLG)
5006                ;                           PSW:S ,PSW:Z )
5007                ;                            O     , O     )
5008 0DC2 FA A1 0B    JM   PROERR         IF NONBCD .EQ. TRUE
5009                ;                       PROCESS ERROR
5010                ;                       PROERR(ERRFLG)
5011                ;                             ( A     )
5012                ;                             ( O     )
5013                ;                       RETURN
5014                ;                     ELSE
5015 0DC5 0C          INR  C                PSW:Z = ERRFLG = FALSE
5016 0DC6 C9          RET                   RETURN
5017                ;                     ENDIF
```

XEQHDR

```
5020                ;XEQHDR(HEADER,ERRFLG)(DBUF  ,XMTBUF,NORFLG)
5021                ;      (BYTE  ,BIT   )(NIBSTR,NIBSTR,BITSTR)
5022                ;      ( I    , O    )( I/O  , I    , O    )
5023                ;      ( A    ,PSW:Z )( RAM  , RAM  , RAM  )
5024                ;      ( NC   , C    )( C    , NC   , C    )
5025                ;
5026                ;PSW = DESTROYED
5027                ;
5028                ;SUPERVISES THE EXECUTION OF INTERNALLY GENERATED HEADERS
5029                ;
5030                XEQHDR;              ****ENTRY POINT
5031 0DC7 E5          PUSH H             SAVE HL
5032 0DC8 D5          PUSH D             SAVE DE
5033 0DC9 C5          PUSH B             SAVE BC
5034 0DCA 47          MOV  B,A           B = HEADER
5035                ;                    STOP TIMER
5036 0DCB CD 34 01    CALL STPTMR        STPTMR(WASOFF)
5037                ;                          (PSW:Z )
5038                ;                          ( O    )
5039 0DCE 3A 40 74    LDA  DBUF/2+X      A = DBUF[0..1]
5040 0DD1 B7          ORA  A             PSW:Z = DBUF[0..1] .EQ. 0
5041 0DD2 78          MOV  A,B           A = HEADER
5042 0DD3 C2 E7 0D    JNZ  XEQH02        IF DBUF[0..1] .EQ. 0
5043                ;                      DISPLAY HAS KEYENTERED DATA
5044 0DD6 FE C4       CPI  HSETDA            IF(HEADER .LT .0) .AND.
5045                ;                        (HEADER .NE. HSETDA)
5046 0DD8 CA E7 0D    JZ   XEQH01
5047 0DDB B7          ORA  A
5048 0DDC F2 E7 0D    JP   XEQH01
5049                ;                        PROCESS HEADER WITH DATA IN DBUF
5050 0DDF 06 82       MVI  B,DBUF+2          B = OFFSET, DBUF[2]
5051 0DE1 CD 41 09    CALL HDRPLS            HDRPLS(HEADER,DBUF[2],ERRFLG)
5052                ;                               ( A     , @B    ,PSW:Z)
5053                ;                               ( I     , I     , O   )
5054 0DE4 C3 EA 0D    JMP  XEQH03
5055                XEQH01:                ELSE
5056                ;                        PROCESS HEADER WITHOUT DATA
5057                ;                        HDRONY(HEADER,ERRFLG)
5058                ;                               ( A     ,PSW:Z)
5059                ;                               ( I     , O   )
5060                ;                      ENDIF
5061                XEQH02:              ELSE
5062                ;                      PROCESS HEADER WITHOUT DATA
```

```
5063 0DE7 CD D5 08   CALL HDRONY          HDRONY(HEADER,ERRFLG)
5064               ;                            ( A    ,PSW:Z)
5065               ;                            ( I    , O    )
5066               XEQH03;              ENDIF
5067 0DEA CA 11 0E   JZ   XEQH07        IF ERRFLG .EQ. FALSE
5068 0DED F5         PUSH PSW             SAVE A, PSW
5069 0DEE 3A 50 74   LDA  XMTBUF/2+X      A = BYTCNT = XMTBUF[0..1]
5070 0DF1 B7         ORA  A               PSW:Z = BYTCNT .EQ. 0
5071               ;                      PSW:CY = 0
5072 0DF2 CA 02 0E   JZ   XEQH04          IF BYTCNT .NE. 0
5073               ;                        CONVERT BYTE COUNT TO NIBBLE COUNT
5074 0DF5 17         RAL                    A = NIBCNT = 2*BYTCNT
5075 0DF6 01 80 A2   LXI  B,(XMTBUF+2)*100H+DBUF
5076               ;                        B = OFFSET, XMTBUF[2]
5077               ;                        C = OFFSET, DBUF[0]
5078               ;                        MOVE DATA INTO DBUF
5079 0DF9 CD B3 0F   CALL MVLNIB            MVLNIB(DBUF[0],XMTBUF[2],NIBCNT)
5080               ;                              ( @C    , @B      , A    )
5081               ;                              ( O     , I       , I    )
5082 0DFC CD 5A 05   CALL VALDSP            MOVE DBUF INTO DISPLAY
5083 0DFF C3 10 0E   JMP  XEQH06
5084               XEQH04;                ELSE
5085               ;                        BYTCNT .EQ. 0
5086               ;                        COMMAND AFFECTED STATUS ONLY
5087 0E02 3A 40 74   LDA  DBUF/2+X          IF DBUF[0..1] = HEX00
5088 0E05 B7         ORA  A
5089 0E06 C2 10 0E   JNZ  XEQH05
5090               ;                          KEYENTERED DISPLAY UNCHANGED
5091               ;                          QUE POSTAGE REQUEST
5092 0E09 21 26 74   LXI  H,NORFLG/2+X        HL = ADDRESS, NORFLG
5093 0E0C 7E         MOV  A,M                 NORFLG.QUEPOS = TRUE
5094 0E0D F6 40      ORI  40H
5095 0E0F 77         MOV  M,A
5096               XEQH05;                  ENDIF
5097               XEQH06;                ENDIF
5098 0E10 F1         POP  PSW             A = HEADER
5099               ;                      PSW:Z = ERRFLG
5100               XEQH07;              ENDIF
5101 0E11 C1         POP  B               RESTORE BC
5102 0E12 D1         POP  D               RESTORE DE
5103 0E13 E1         POP  H               RESTORE HL
5104 0E14 C9         RET                  RETURN
```

XMIT

```
5107               ;XMIT()(SID,SOD,SOE,XMTBUF,NORFLG)
5108               ;      (BIT,BIT,BIT,BYTSTR,BYTSTR)
5109               ;      ( I , O , O , I/O  , I    )
5110               ;      (RIM,SIM,SIM, RAM  , RAM  )
5111               ;      ( NC, C , C , C    , NC   )
5112               ;
5113               ;REGISTERS DESTROYED
5114               ;PSW DESTROYED
5115               ;
5116               ;ATTEMPT TO TRANSMIT MESSAGE IN XMTBUF.
5117               ;ONE ATTEMPT ONLY.  XMTBUF[0], THE MESSAGE BYTE COUNT,
5118               ;IS CLEARED WHETHER OR NOT THE MESSAGE IS ACTUALLY SENT.
5119               ;XMTBUF[0] IS ASSUMED .GT. 0, AND .LE. 7 ON ENTRY.
5120               ;
5121               XMIT;                  ****ENTRY POINT
5122               ;                      FETCH BYTE COUNT OF OUTBOUND MESSAGE
5123 0E15 21 50 74   LXI  H,XMTBUF/2+X    HL =  ADDRESS, XMTBUF[N=0]
5124 0E18 4E         MOV  C,M             C = BYTCNT = XMTBUF[N]
5125               ;                      CANCEL MSG BY CLEARING XMTBUF[0]
5126 0E19 36 00      MVI  M,0             XMTBUF[N] = 0
5127 0E1B 3A 26 74   LDA  NORFLG/2+X      IF NORFLG.COMDSB .EQ. TRUE
5128 0E1E E6 04      ANI  4
5129               ;                        COMMUNICATIONS ARE DISABLED
5130 0E20 C0         RNZ                      RETURN
5131               ;                      ENDIF
```

```
                  ;                        STOP TIMER
0E21 CD 34 01       CALL STPTMR            STPTMR(WASOFF)
                  ;                              (PSW:Z )
                  ;                              ( 0    )
0E24 E5             PUSH H                 SAVE HL
0E25 C5             PUSH B                 SAVE BC
0E26 CD C7 0B       CALL RECEIVE           IF INCOMING RTS IS PRESENT
                  ;                          RECEIVE MESSAGE
                  ;                        ENDIF
0E29 3E C0          MVI  A,0C0H            SIM.SOD = RTS = 1
                  ;                        SIM.SOE = ENABLD = 1
0E2B 30             SIM                    OUTPUT RTS
0E2C C1             POP  B                 RESTORE BC
0E2D E1             POP  H                 RESTORE HL
0E2E 16 D9          MVI  D,217             D = COUNT ;FOR T13 = 3.509 MSEC
                  XMIT01;                  DO UNTIL BIT .EQ. CTS
0E30 15             DCR  D                   COUNT = COUNT-1
0E31 CA 7B 0E       JZ   XMIT06              IF COUNT+1 .EQ. 0
                  ; >>JUMP AHEAD<<             TIMEOUT HAS OCCURRED
                  ;                            QUIT
                  ;                          ENDIF
0E34 20             RIM                      INPUT BIT
                  ;                          A.0 = BIT = RIM.SID ;CTS OR IDLE
0E35 B7             ORA  A                   CHECK BIT
0E36 F2 30 0E       JP   XMIT01
                  ;                        ENDDO

                  XMIT03;                  DO UNTIL BYTCNT .EQ. 0
                  ;                          DEFINE STOP BIT
0E39 3E 01          MVI  A,1                 IF 1 .LT. BYTCNT
0E3B B9             CMP  C
                  ;                            THIS IS NOT LAST BYTE
                  ;                            PSW:CY = STOP = EOB = 1
                  ;                          ELSE
                  ;                            THIS IS THE LAST BYTE
                  ;                            PSW:CY = STOP = EOM = 0
                  ;                          ENDIF
0E3C 23             INX  H                   HL = ADDRESS, XMTBUF[N=N+1]
0E3D 3E 12          MVI  A,18                DELAY ;FOR T4 = 178.234 USEC
0E3F 3D             DCR  A
0E40 F2 3F 0E       JP   $-1
                  ;                          SET TO OUTPUT 9 BITS FROM LOOP
                  ;                          8 DATA, AND 1 EOB OR EOM
0E43 06 0A          MVI  B,9+1               BITCNT = 10 = 9+1
0E45 3E 40          MVI  A,40H               SIM.SOD = START = 0
                  ;                          SIM.SOE = ENABLD = 1
0E47 57             MOV  D,A                 D.0 = OUTBIT = START
0E48 30             SIM                      OUTPUT = START
                  ;                          LOAD 8 DATA BITS
0E49 7E             MOV A,M                  A = XMTBUF[N]
                  ;                          SAVE 8 DATA BITS AND 1 STOP BIT
0E4A F5             PUSH PSW

                  XMIT04;                  LOOP ;BREAK IF BITCNT .EQ. 0
0E4B 3E 06          MVI  A,6                   DELAY ;BIT PERIOD = 103.923 USEC
0E4D 3D             DCR  A
0E4E F2 4D 0E       JP   $-1
0E51 F0             RP
0E52 F1             POP  PSW                     GET NEXT BIT
0E53 1F             RAR                          PSW.CY = OUTBIT
0E54 D5             PUSH PSW
0E55 3E 80          MVI  A,80H                   PSW:CY,A = SIM*2
0E57 1F             RAR                          A = SIM
                  ;                              SIM.SOD = OUTBIT
                  ;                              SIM.SOE = ENABLD = 1
0E58 5A             MOV  E,D                     E.0 = PRVBIT = OUTBIT
0E59 57             MOV  D,A                     D.0 = OUTBIT
0E5A 05             DCR  B                       BITCNT = BITCNT-1
                  ;                              IF BITCNT .EQ. 0
0E5B CA 63 0E       JZ   XMIT05                    BREAK
```

```
5202                ;                                ENDIF
5203 0E7D 30          SIM                            OUTPUT OUTBIT
5204 0E7E 20          RIM                            READ ECHO
5205                ;                                A.0 = ECHO = RIM.SID
5206 0E80 AB          XRA  E                         IF ECHO .NE. PRVBIT
5207 0E81 F2 4B 0E    JP   XMIT04
5208 0E84 F1          POP  PSW                         CLEAN UP STACK
5209 0E85 C3 7B 0E    JMP  XMIT06                      QUIT
5210                ; >>JUMP AHEAD<<
5211                ;                                ENDIF
5212                XMIT05;                        ENDLOOP
5213 0E68 F1          POP  PSW                     CLEAN UP STACK
5214 0E69 20          RIM                          READ ECHO
5215                ;                              A.0 = ECHO = RIM.SID
5216 0E6A AB          XRA  E                       IF ECHO .NE. STOP
5217 0E6B FA 7B 0E    JM   XMIT06                    QUIT
5218                ; >>JUMP AHEAD<<
5219                ;                              ENDIF
5220 0E6E 0D          DCR  C                       C = BYTCNT = BYTCNT-1
5221 0E6F C2 39 0E    JNZ  XMIT03
5222                ;                            ENDDO

5224 0E72 3E C0       MVI  A,0C0H                SIM.SOD = ACK = 1
5225                ;                            SIM.SOE = ENABLD = 1
5226 0E74 30          SIM                        OUTPUT ACK
5227 0E75 16 29       MVI  D,41                  DELAY ;T7 = 336.914 USEC
5228 0E77 15          DCR  D
5229 0E78 F2 77 0E    JP   $-1
5230                XMIT06;                      >>TARGET OF JUMP AHEAD<<
5231                ;                            QUIT XMIT ROUTINE
5232 0E7B 3E 40       MVI  A,40H                 SIM.SOD = IDLE = 0
5233                ;                            SIM.SOE = ENABLD = 1
5234 0E7D 30          SIM                        OUTPUT IDLE
5235 0E7E 16 C8       MVI  D,200                 DELAY ;T14 = 1606.908 USEC
5236 0E80 15          DCR  D
5237 0E81 F2 80 0E    JP   $-1
5238 0E84 C9          RET                        RETURN
```

CLRBLK

```
5241                ;CLRBLK(BLOCK )
5242                ;       (NIBSTR)
5243                ;       ( O    )
5244                ;       ( @A   )
5245                ;       ( C    )
5246                ;
5247                ;PSW:S, Z, P, CY = NO CHANGE
5248                ;
5249                ;CLEAR A 16 NIBBLE BLOCK TO ZEROS
5250                ;BLOCK[0..15] = 0
5251                ;
5252                CLRBLK;                    ****ENTRY POINT
5253 0E85 F5          PUSH PSW                 SAVE A, PSW
5254 0E86 C5          PUSH B                   SAVE BC
5255 0E87 4F          MOV  C,A                 C = OFFSET, BLOCK
5256 0E88 AF          XRA  A                   A = NIBVAL = 0
5257 0E89 06 10       MVI  B,16                B = NIBCNT = 16
5258 0E8B C3 26 0F    JMP  FILN01              FILNIB(BLOCK,NIBVAL,NIBCNT)
5259                ;                                ( @C  , A    , B    )
5260                ;                                ( O   , I    , I    )
5261                ;                          RESTORE BC
5262                ;                          RESTORE A, PSW
5263                ;                          RETURN
```

CMPARE

```
5266                ;CMPARE(MINUEN,SUBTRA,NNIB ,SGNFLG,ZROFLG)
5267                ;       (NIBSTR,NIBSTR,BYTE ,BIT   ,BIT   )
5268                ;       ( I    , I    , I   , O    , O    )
5269                ;       ( @D   , @E   , A   ,PSW:S ,PSW:Z )
5270                ;       ( NC   , NC   , NC  , C    , C    )
```

```
                ;
                ;PSW:CY = NO CHANGE
                ;PSW:S, Z, P CHANGED
                ;
                ;COMPARE EQUAL LENGTH BCD NIBBLE STRINGS
                ;
                CMPARE;                 ****ENTRY POINT
0E8E E5           PUSH H                SAVE HL
0E8F F5           PUSH PSW              SAVE A, PSW
0E90 C5           PUSH B                SAVE BC
0E91 D5           PUSH D                SAVE DE
0E92 67           MOV  H,A              H = COUNT = NNIB
                CMPAR1;                 DO WHILE COUNT .GT. 0
0E93 25           DCR  H                  H = COUNT-1
0E94 FA A9 0E     JM   CMPAR2
0E97 43           MOV  B,E                B = OFFSET,
                ;                             SUBTRAC[INDEX = NNIB-COUNT]
0E98 CD 35 0F     CALL GETNIB            GETNIB(SDIGIT,ZERO ,SUBTRAC[INDEX])
                ;                              ( A    ,PSW:Z, @B          )
                ;                              ( 0    , 0   , I          )
0E9B 4F           MOV  C,A                C = SDIGIT
0E9C 42           MOV  B,D                B = OFFSET,
                ;                             MINUEN[MINDEX = NNIB-COUNT]
0E9D CD 35 0F     CALL GETNIB            GETNIB(MDIGIT,ZERO ,MINUEN[MINDEX])
                ;                              ( A    ,PSW:Z, @B          )
                ;                              ( 0    , 0   , I          )
0EA0 91           SUB  C                  A = DIFRNC = MDIGIT-SDIGIT
0EA1 C2 A9 0E     JNZ  CMPAR2            IF DIFRNC .NE. 0
                ;                          BREAK
                ;                        ENDIF
0EA4 1C           INR  E                  E = OFFSET,
                ;                             SUBTRAC[INDEX = NNIB-(COUNT-1)]
0EA5 14           INR  D                  D = OFFSET,
                ;                             MINUEN[MINDEX = NNIB-(COUNT-1)]
                ;                        H = COUNT = COUNT-1
0EA6 C3 93 0E     JMP  CMPAR1
                CMPAR2;                 ENDDO
0EA9 D1           POP  D                RESTORE DE
0EAA C1           POP  B                RESTORE BC
                ;                       IF NNIB .EQ. 0
0EAB 67           MOV  H,A                H = DIFRNC = NNIB = 0
                ;                       ELSE
                ;                         H = DIFRNC
                ;                       ENDIF
0EAC F1           POP  PSW              RESTORE A, PSW:CY
                ;                       OUTPUT PSW:S = SGNFLG
                ;                       OUTPUT PSW:Z = ZROFLG
0EAD 24           INR  H
0EAE 25           DCR  H
0EAF E1           POP  H                RESTORE HL
0EB0 C9           RET                   RETURN
```

CRC

```
                ;CRC(BLOCK ,NIBCNT,CRCVAL)
                ;   (NIBSTR,UBYTE ,UBYTE )
                ;   ( I    , I    , O    )
                ;   ( @C   , B    , D    )
                ;   ( NC   , NC   , C    )
                ;
                ;PSW = NO CHANGE
                ;
                ;COMPUTE CRC FOR BLOCK OF NIBCNT NIBBLES
                ;
                CRC;                    ****ENTRY POINT
0EB1 C5           PUSH B                SAVE BC
0EB2 F5           PUSH PSW              SAVE A, PSW
0EB3 78           MOV  A,B              A = NIBCNT
0EB4 41           MOV  B,C              B = OFFSET, BLOCK[N = 0]
0EB5 4F           MOV  C,A              C = NIBCNT
```

```
0EB6 16 FF      MVI  D,0FFH        D = CRCVAL = HEXFF
                CRC1:              DO UNTIL NIBCNT = 0
0EB8 CD 35 0F   CALL GETNIB          GETNIB(NIBVAL,ZERO ,BLOCK[N])
                ;                          ( A    ,PSW:Z, @B     )
                ;                          ( O    , O   , I      )
0EBB CD C6 0E   CALL CRCNIB          CRCNIB(NIBVAL,CRCVAL)
                ;                          ( A    , D    )
                ;                          ( I    , I/O  )
0EBE 04         INR  B               B = OFFSET, BLOCK[N = N+1]
0EBF 0D         DCR  C               NIBCNT = NIBCNT-1
0EC0 C2 B8 0E   JNZ  CRC1
                ;                  ENDDO
0EC3 F1         POP  PSW           RESTORE A, PSW
0EC4 C1         POP  B             RESTORE BC
0EC5 C9         RET
```

CRCNIB

```
                ;CRCNIB(NIBVAL,CRCVAL)
                ;      (BYTE  ,BYTE  )
                ;      ( I    , I/O  )
                ;      ( A    , D    )
                ;      ( NC   , C    )
                ;
                ;PSW DESTROYED
                ;
                ;INCLUDE NIBBLE INTO DEVELOPING VALUE OF CRC
                ;
                CRCNIB;            ****ENTRY POINT
0EC6 C5         PUSH B             SAVE BC
0EC7 06 04      MVI  B,4           B = BITCNT = 4
                ;                  SHIFT BITS TO HIGH ORDER OF NIBVAL
0EC9 07         RLC                A = NIBVAL = NIBVAL*HEX10
0ECA 07         RLC
0ECB 07         RLC
0ECC 07         RLC
                ;                  ROTATE NIBVAL ONE BIT AT A TIME
                ;                  BACK INTO ITS ORIGINAL FORM WHILE
                ;                  MODIFYING CRCVAL TO REFLECT
                ;                  THE BIT'S VALUE
                CRCNI1:            DO UNTIL BITCNT .EQ. 0
0ECD 07         RLC                  CY = NIBBIT
                ;                    A = NIBVAL = ((NIBVAL*2) .AND.
                ;                        HEXFF)+NIBBIT
0ECE 4F         MOV  C,A             C = NIBVAL
0ECF 7A         MOV  A,D             A = CRCVAL
0ED0 17         RAL                  CY = CRCBIT
                ;                    A = CRCVAL = ((CRCVAL*2) .AND.
                ;                                 HEXFF)+NIBBIT
0ED1 D2 D6 0E   JNC  CRCNI2          IF CRCBIT = 1
0ED4 EE 9B      XRI  9BH               A = CRCVAL = CRCVAL .XOR. HEX9B
                CRCNI2:              ENDIF
0ED6 57         MOV  D,A             D = CRCVAL
0ED7 79         MOV  A,C             A = NIBVAL
0ED8 05         DCR  B               B = BITCNT = BITCNT-1
0ED9 C2 CD 0E   JNZ  CRCNI1
                ;                  ENDDO
0EDC C1         POP  B             RESTORE BC
0EDD C9         RET                RETURN
```

DBLANK

```
                ;DBLANK()(PORTA )
                ;        (BITSTR)
                ;        ( I/O  )
                ;        ( 7001 )
                ;        ( C    )
                ;
                ;REGISTERS DESTROYED
                ;PSW DESTROYED
```

```
5408                ;
5409                ;DISPLAY BLANKING ROUTINE
5410                ;
5411                DBLANK;                 ****ENTRY POINT
5412                ;                       PREVENT INTERRUPT DISPLAY REFRESH
5413 0EDE CD 34 01   CALL STPTMR            STPTMR(WASOFF)
5414                ;                             (PSW:Z )
5415                ;                             ( 0    )
5416                ;                       FLUSH POSSIBLE NOISE OUT OF DISPLAY
5417 0EE1 CD F6 0E   CALL DFLUSH            DFLUSH(ADDRESS,PORTA)
5418                ;                             ( HL    , @HL )
5419                ;                             ( 0       -   )
5420                ;                       (PORTA .AND HEXOF) .EQ. HEXOF, FOR
5421                ;                       3 DARK BITS AND IDLE DISPLAY CLOCK
5422 0EE4 7E         MOV  A,M
5423 0EE5 E6 F1      ANI  0F1H
5424 0EE7 77         MOV  M,A               PORTA = PORTA .AND. HEXF1, FOR
5425                ;                       3 START BITS AND IDLE DISPLAY CLOCK
5426 0EE8 35         DCR  M                 PULSE DISPLAY CLOCK
5427 0EE9 34         INR  M
5428                ;                       SET TO OUTPUT 35*3 DARK BITS
5429 0EEA F6 0F      ORI  0FH
5430 0EEC 77         MOV  M,A               PORTA = PORTA .OR. HEXOF, FOR
5431                ;                       3 DARK BITS AND IDLE DISPLAY CLOCK
5432 0EED 3E 23      MVI  A,34              A = COUNT = 34
5433                DBLAN1;                 *****ALTERNATE ENTRY POINT
5434                DBLAN2:                 DO UNTIL COUNT .LT. 0
5435 0EEF 35         DCR  M                   PULSE DISPLAY CLOCK
5436 0EF0 34         INR  M
5437 0EF1 3D         DCR  A                   A = COUNT = COUNT-1
5438 0EF2 F2 EF 0E   JP   DBLAN2
5439                ;                       ENDDO
5440 0EF5 C9         RET
```

DFLUSH

```
5443                ;DFLUSH(ADDRES)(PORTA )
5444                ;      (ADDRES)(BITSTR)
5445                ;      ( 0    )( I/O  )
5446                ;      ( HL   )( 7001 )
5447                ;      ( C    )( C    )
5448                ;
5449                ;REGISTERS DESTROYED
5450                ;PSW DESTROYED
5451                ;
5452                ;FLUSH POSSIBLE NOISE OUT OF DISPLAY SHIFT REGISTER
5453                ;
5454                DFLUSH;                 ****ENTRY POINT
5455 0EF6 21 01 70   LXI  H,PORTA           HL = ADDRESS, PORTA
5456 0EF9 7E         MOV  A,M
5457 0EFA F6 0F      ORI  0FH
5458 0EFC 77         MOV  M,A               PORTA = PORTA .OR. HEXOF, FOR
5459                ;                       3 DARK BITS AND IDLE DISPLAY CLOCK
5460                ;                       CLOCK 36*3 DARK BITS INTO DISPLAY
5461 0EFD 3E 23      MVI  A,35              A = COUNT = 35
5462 0EFF C3 EF 0E   JMP  DBLAN1
5463                ;                       RETURN
```

DSBKBD

```
5466                ;DSBKBD()(KDCTRL,CHRBKT,CTLBKT)
5467                ;        (BITSTR,BYTE  ,BYTE  )
5468                ;        ( 0    , 0    , 0    )
5469                ;        ( RAM  , RAM  , RAM  )
5470                ;        ( C    , C    , C    )
5471                ;
5472                ;PSW:S, Z, P, CY = NO CHANGE
5473                ;
5474                ;DISABLE KEYBOARD
5475                ;
```

```
5476                DSBKBD;              ****ENTRY POINT
5477 0F02 F5          PUSH PSW           SAVE A, PSW
5478                ;                    PREVENT KDIO FROM SCANNING KEYBOARD
5479 0F03 3A 27 74    LDA  KDCTRL/2+X    KDCTRL.KBDDSB = TRUE
5480 0F06 F6 01       ORI  01H
5481 0F08 32 27 74    STA  KDCTRL/2+X
5482                ;                    CLEAR OUTPUT OF DBOUNCE ROUTINE
5483 0F0B AF          XRA  A             CHRBKT = HEX00
5484 0F0C 32 20 74    STA  CHRBKT/2+X
5485 0F0F 32 21 74    STA  CTLBKT/2+X    CTLBKT = HEX00
5486 0F12 F1          POP  PSW           RESTORE A, PSW
5487 0F13 C9          RET                RETURN
ENAKBD

5490                ;ENAKBD()(KEYBKT,KDCTRL)
5491                ;        (BYTE  ,BITSTR)
5492                ;        ( 0    , 0    )
5493                ;        ( RAM  , RAM  )
5494                ;        ( C    , C    )
5495                ;
5496                ;PSW:S, Z, P, CY = NO CHANGE
5497                ;
5498                ;ENABLE KEYBOARD
5499                ;
5500                ENAKBD;              ****ENTRY POINT
5501 0F14 F5          PUSH PSW           SAVE A, PSW
5502                ;                    FORCE KDIO TO RESYNC KEYBOARD SCAN
5503 0F15 3E 80       MVI  A,MULKEY      KEYBKT = MULKEY
5504 0F17 32 2A 74    STA  KEYBKT/2+X
5505                ;                    ALLOW KDIO TO SCAN KEYBOARD
5506 0F1A 3A 27 74    LDA  KDCTRL/2+X    KDCTRL.KBDDSB = FALSE
5507 0F1D E6 FE       ANI  0FEH
5508 0F1F 32 27 74    STA  KDCTRL/2+X
5509 0F22 F1          POP  PSW           RESTORE A, PSW
5510 0F23 C9          RET                RETURN
FILNIB

5513                ;FILNIB(DEST  ,NIBVAL,NIBCNT)
5514                ;      (NIBSTR,BYTE  ,UBYTE )
5515                ;      ( 0    , I    , I    )
5516                ;      ( @C   , A    , B    )
5517                ;      ( C    , NC   , NC   )
5518                ;
5519                ;PSW:S, Z, P, CY = NO CHANGE
5520                ;
5521                ;FILL A NIBBLE STRING WITH A VALUE
5522                ;DEST[0..NIBCNT-1] = NIBVAL
5523                ;
5524                FILNIB;              ****ENTRY POINT
5525 0F24 F5          PUSH PSW           SAVE A, PSW
5526 0F25 C5          PUSH B             SAVE BC
5527                FILN01;              ****SPECIAL JUMP ENTRY
5528                ;                    C = OFFSET, DESTIN = 0]
5529                ;                    FILL NIBCNT NIBBLES IN DEST WITH NIBVAL
5530 0F26 04          INR  B             CONDITION NIBCNT FOR DO WHILE
5531                FILN02;              DO WHILE NIBCNT .NE. 0
5532 0F27 05          DCR  B               B = NIBCNT-1
5533 0F28 CA 32 0F    JZ   FILN03
5534                ;                      PUT NIBVAL INTO DEST
5535 0F2B CD EE 0F    CALL PUTNIB            PUTNIB(DEST[N],NIBVAL)
5536                ;                          ( @C    , A    )
5537                ;                          ( 0     , I    )
5538                ;                      POINT AT NEXT NIBBLE TO RIGHT
5539 0F2E 0C          INR  C               C = OFFSET, DESTIN+1]
5540                ;                      B = NIBCNT = NIBCNT-1
5541 0F2F C3 27 0F    JMP  FILN02
5542                FILN03;              ENDDO
5543 0F32 C1          POP  B             RESTORE BC
5544 0F33 F1          POP  PSW           RESTORE A, PSW
5545 0F34 C9          RET                RETURN
```

GETNIB

```
5548                ;GETNIB(NIBVAL,ZERO ,SOURCE)
5549                ;       (BYTE  ,BIT  ,NIB   )
5550                ;       ( O    , O   , I    )
5551                ;       ( A    ,PSW:Z, @B   )
5552                ;       ( C    , C   , NC   )
5553                ;
5554                ;PSW:CY = NO CHANGE
5555                ;PSW:S, Z, P CHANGED; CORRESPOND TO VALUE OF NIBVAL
5556                ;
5557                ;FETCH HIGH ORDER 4 BIT VALUE FROM SOURCE[N=EVEN]
5558                ;OR LOW ORDER 4 BIT VALUE FROM SOURCE[N=ODD],
5559                ;AND PLACE IT IN LOW ORDER OF NIBVAL.
5560                ;CLEAR HIGH ORDER OF NIBVAL.
5561                ;NIBVAL = SOURCE[N],   ZERO = NIBVAL .EQ. 0
5562                ;
5563                GETNIB;             ****ENTRY POINT
5564 0F35 E5          PUSH H            SAVE HL
5565 0F36 F5          PUSH PSW          SAVE A, PSW
5566                ;                   FLAG WHETHER L/O NIBBLE OF BYTE WANTED
5567 0F37 AF          XRA  A            A = OFFSET, SOURCE[N]/2
5568 0F38 78          MOV  A,B
5569 0F39 1F          RAR
5570                ;                   PSW:CY = ODD = TRUE, IF N = ODD
5571                ;                   CALCULATE ADDRESS OF SOURCE
5572 0F3A 26 74       MVI  H,X/100H     HL = ADDRESS, SOURCE[N]
5573 0F3C 6F          MOV  L,A
5574                GETN01:             ****SPECIAL JUMP ENTRY
5575                ;                   FETCH BYTE CONTAINING DESIRED NIBBLE
5576 0F3D 7E          MOV  A,M          A = SOURCE[N]
5577                ;                   CHECK WHETHER NIBBLE IN HIGH ORDER
5578 0F3E DA 45 0F    JC   GETN02       IF ODD .EQ. FALSE
5579                ;                     MOVE H/O NIBBLE TO L/O
5580 0F41 0F          RRC                 A = SOURCE[N] = SOURCE[N]/HEX10
5581 0F42 0F          RRC
5582 0F43 0F          RRC
5583 0F44 0F          RRC
5584                GETN02:             ENDIF
5585                ;                   CLEAR HIGH ORDER NIBBLE
5586 0F45 E6 0F       ANI  0FH          H = NIBVAL = SOURCE[N] .AND. HEX0F
5587 0F47 67          MOV  H,A
5588 0F48 F1          POP  PSW          RESTORE PSW:CY
5589 0F49 7C          MOV  A,H          A = NIBVAL
5590                ;                   INDICATE NIBVAL STATUS
5591 0F4A 3C          INR  A            PSW:Z = ZERO = NIBVAL .EQ. 0
5592 0F4B 3D          DCR  A
5593 0F4C E1          POP  H            RESTORE HL
5594 0F4D C9          RET               RETURN
```

LSTATE

```
5597                ;LSTATE(FATMOD,NORMOD,SERMOD,PRVMOD)(MRSTS1,MRSTS2)
5598                ;       (BIT   ,BIT   ,BIT   ,BIT   )(BITSTR,BITSTR)
5599                ;       ( O    , O    , O    , O    )( I    , I    )
5600                ;       (PSW:S ,PSW:Z ,PSW:P ,PSW:CY)(RAM   ,RAM   )
5601                ;       ( C    , C    , C    , C    )( NC   , NC   )
5602                ;
5603                ;PSW:S = MINUS STATUS IF FATAL MODE
5604                ;PSW:Z = ZERO STATUS IF NORMAL MODE
5605                ;PSW:P = EVEN PARITY STATUS IF SERVICE MODE
5606                ;PSW:CY= 1 IF PRIVILEGED MODE
5607                ;
5608                ;COPIES METER STATE FLAGS INTO PSW FOR EASY TESTING
5609                ;
5610                LSTATE;             ****ENTRY POINT
5611 0F4E E5          PUSH H            SAVE HL
5612 0F4F F5          PUSH PSW          H = A, SAVED FOR RETURN
5613 0F50 E1          POP  H
5614 0F51 3A 25 74    LDA  MRSTS2/2+X   L = MRSTS2.FATMOD + MRSTS2.PRVMOD
```

```
0F54 E6 81      ANI  81H            (PSW:S POS  ) , (PSW:CY POS )
0F56 6F         MOV  L,A
0F57 3A 24 74   LDA  MRSTS1/2+X   A = MRSTS1.SERMOD
0F5A E6 08      ANI  08H            (           )
0F5C 0F         RRC                 (PSW:P POS  )
0F5D B5         ORA  L            A = FATMOD, PRVMOD, SERMOD
                ;                   (PSW:S, PSW:CY, PSW:P)
0F5E C2 63 0F   JNZ  LSTAT1       IF NO STATUS BITS ARE SET
0F61 3E 40      MVI  A,40H          A = NORMOD
                ;                     (PSW:Z)
                LSTAT1:           ENDIF
0F63 6F         MOV  L,A          L = A = STATUS
0F64 E5         PUSH H            RESTORE A; PSW = STATUS
0F65 F1         POP  PSW
0F66 E1         POP  H            RESTORE HL
0F67 C9         RET               RETURN
```

MOVBIT

```
                ;MOVBIT(SOURCE,SBIT ,DEST  ,DBIT ,VALUE)
                ;      (BITSTR,UBYTE,BITSTR,UBYTE,BIT  )
                ;      ( I    , I   , O    , I   , O   )
                ;      ( @H   , L   , @D   , E   ,PSW:Z)
                ;      ( NC   , NC  , C    , NC  , C   )
                ;
                ;PSW:CY = NO CHANGE
                ;PSW:S, Z, P CHANGED; CORRESPOND TO VALUE OF BIT
                ;
                ;MOVE BIT FROM BIT POSITION SBIT IN SOURCE TO BIT POSITION
                ;DBIT IN DEST.  VALUE INDICATES WHETHER BIT IS 0 OR 1.
                ;BIT 0 IS HIGH ORDER BIT OF STRING.
                ;DEST[DBIT] = SOURCE[SBIT]
                ;
                MOVBIT;           ****ENTRY POINT
0F68 E5         PUSH H            SAVE HL
0F69 C5         PUSH B            SAVE BC
0F6A F5         PUSH PSW          SAVE A, PSW
0F6B D5         PUSH D            SAVE DE
                ;                 H = SRCOFS = OFFSET, SOURCE
                ;                 BUILD SOURCE ADDRESS AND MASK
0F6C CD 8A 0F   CALL MOVB01       MOVB01(SRCOFS,SBIT,SRCADR,SMASK)
                ;                   ( H    , L  , HL   , A   )
                ;                   ( I    , I  , O    , O   )
                ;                 HL = SRCADR = ADDRESS, SOURCE.SBIT
0F6F 47         MOV  B,A          B = SMASK
0F70 7E         MOV  A,M          PSW:CY = SOURCE.SBIT
0F71 A0         ANA  B
0F72 C6 FF      ADI  0FFH
                ;                 IF SOURCE.SBIT .NE. 0
0F74 9F         SBB  A              B = SRCBIT = HEXFF
0F75 47         MOV  B,A
                ;                 ELSE
                ;                   B = SRCBIT = HEX00
                ;                 ENDIF
0F76 E1         POP  H            H = DSTOFS = OFFSET, DEST
                ;                 L = DBIT
0F77 E5         PUSH H            RESAVE HL
                ;                 BUILD DESTINATION ADDRESS AND MASK
0F78 CD 8A 0F   CALL MOVB01       MOVB01(DSTOFS,DBIT,DSTADR,DMASK)
                ;                       ( H    , L  , HL   , A   )
                ;                       ( I    , I  , O    , O   )
                ;                 HL = DSTADR = ADDRESS, DEST.DBIT
0F7B 4F         MOV  C,A          C = DMASK
0F7C A0         ANA  B            B = DSTBIT = DMASK .AND. SRCBIT
0F7D 47         MOV  B,A
0F7E 79         MOV  A,C          A = DEST.DBIT = 0
0F7F 2F         CMA
0F80 A6         ANA  M
0F81 B0         ORA  B            DEST.DBIT = DEST.DBIT .OR. DSTBIT
```

```
0F82 77          MOV  M,A
0F83 D1          POP  D            RESTORE DE
0F84 F1          POP  PSW          RESTORE A, PSW:CY
0F85 04          INR  B            PSW:Z = DSTBIT .EQ. 0
0F86 05          DCR  B
0F87 C1          POP  B            RESTORE BC
0F88 E1          POP  H            RESTORE HL
0F89 C9          RET               RETURN
                ;MOVB01(NIBOFS,BITNO,BYTADR,MASK)
                ;      (OFFSET,UBYTE,ADDR  ,BYTE)
                ;      ( I    , I   , O    , O  )
                ;      ( H    , L   , HL   , A  )
                ;      ( C    , C   , C    , C  )
                ;
                ;PSW:S, Z, P, CY DESTROYED
                ;REGISTER DE DESTROYED
                ;
                ;CONVERT NIBBLE OFFSET AND BIT NUMBER INTO ADDRESS OF
                ;BYTE CONTAINING BIT.  A BIT SELECTION MASK IS ALSO
                ;PRODUCED
                ;
                MOVB01;           ****ENTRY POINT FOR MOVBIT ONLY
0F8A 7D          MOV  A,L          E = ((BITNO/4)+NIBOFS)/2
0F8B 1F          RAR
0F8C 1F          RAR
0F8D E6 3F       ANI  3FH
0F8F 84          ADD  H
0F90 1F          RAR
0F91 5F          MOV  E,A
0F92 7C          MOV  A,H          PSW:CY = NIBOFS .MOD. 2
0F93 1F          RAR
0F94 7D          MOV  A,L          A = BITNO
0F95 D2 9A 0F    JNC  MOVB02       IF PSW:CY .EQ. 1
                ;                    NIBOFS NOT ON BYTE BOUNDARY
0F98 DE 04       SBI  4              MAKE CORRECTION TO BITNO
                MOVB02;           ENDIF
0F9A E6 07       ANI  07H          A = BITNUM, WITHIN BYTE
0F9C 16 00       MVI  D,0          DE = ((BITNO/4)+NIBOFS)/2
0F9E 21 00 74    LXI  H,X          HL = BYTADR
0FA1 19          DAD  D
0FA2 E5          PUSH H            SAVE BYTADR
0FA3 5F          MOV  E,A          DE = BITNUM
0FA4 21 AF 0F    LXI  H,MOVB03     HL = ADDRESS, MASK
0FA7 19          DAD  D
0FA8 7E          MOV  A,M          A = MASK
0FA9 E1          POP  H            HL = BYTADR
0FAA C9          RET               RETURN
                ;
                MOVB03;           MASK TABLE
0FAB 80          DB   80H          0 BIT MASK; HIGH ORDER
0FAC 40          DB   40H          1
0FAD 20          DB   20H          2
0FAE 10          DB   10H          3
0FAF 08          DB   08H          4
0FB0 04          DB   04H          5
0FB1 02          DB   02H          6
0FB2 01          DB   01H          7 BIT MASK; LOW ORDER
```

MVLNIB

```
                ;MVLNIB(DEST  ,SOURCE,NIBCNT,NONBCD,ZERO  )
                ;      (NIBSTR,NIBSTR,BYTE  ,BIT   ,BIT   )
                ;      ( O    , I    , I    , O    , O    )
                ;      ( @C   , @B   , A    ,PSW:S ,PSW:Z )
                ;      ( C    , NC   , NC   , C    , C    )
                ;
                ;PSW:CY = NO CHANGE
                ;PSW:S, Z, P CHANGED
                ;
```

```
                ;FOR A STRING ADDRESSED AT THE LEFT SIDE,
                ;FROM RIGHT TO LEFT MOVE NIBCNT NIBBLES FROM SOURCE TO
                ;DEST.  THE NONBCD AND ZERO FLAGS REFER TO THE LARGEST
                ;NIBBLE VALUE MOVED.
                ;DEST[0..NIBCNT-1] = SOURCE[0..NIBCNT-1]
                ;
                MVLNIB;                 ****ENTRY POINT
0FB3 C5           PUSH B                SAVE  BC
                MVLN01;                 ****SPECIAL JUMP ENTRY
0FB4 F5           PUSH PSW              SAVE A, PSW
0FB5 D5           PUSH D                SAVE DE
0FB6 3D           DCR  A                D = NIBCNT-1
0FB7 57           MOV  D,A
0FB8 80           ADD  B                B = OFFSET, SOURCE[N=NIBCNT-1]
0FB9 47           MOV  B,A
0FBA 7A           MOV  A,D              A = NIBCNT-1
0FBB 81           ADD  C                C = OFFSET, DEST[N=NIBCNT-1]
0FBC 4F           MOV  C,A
0FBD D1           POP  D                RESTORE DE
0FBE F1           POP  PSW              RESTORE A, PSW
0FBF C3 C3 0F     JMP  MVRN01           MVRNIB(DEST[N],SOURCE[N],NIBCNT,
                ;                             ( @C    , @B      , A    ,
                ;                             ( 0     , I       , I    ,
                ;
                ;                             NONBCD,ZERO )
                ;                             PSW:S ,PSW:Z)
                ;                              0    , 0   )
                ;                       RESTORE BC
                ;                       RETURN
                ;MVRNIB(DEST  ,SOURCE,NIBCNT,NONBCD,ZERO )
                ;      (NIBSTR,NIBSTR,BYTE  ,BIT   ,BIT  )
                ;      ( 0    , I    , I    , 0    , 0   )
                ;      ( @C   , @B   , A    ,PSW:S ,PSW:Z)
                ;      ( C    , NC   , NC   , C    , C   )
                ;
                ;PSW:CY = NO CHANGE
                ;PSW:S, Z, P CHANGED
                ;
                ;FOR A STRING ADDRESSED AT THE RIGHT SIDE,
                ;FROM RIGHT TO LEFT MOVE NIBCNT NIBBLES FROM SOURCE TO
                ;DEST.  THE NONBCD AND ZERO FLAGS REFER TO THE LARGEST
                ;NIBBLE VALUE MOVED.
                ;DEST[1-NIBCNT..0] = SOURCE[1-NIBCNT..0]
                ;
                MVRNIB;                 ****ENTRY POINT
0FC2 C5           PUSH B                SAVE BC
                MVRN01;                 ****SPECIAL JUMP ENTRY
0FC3 F5           PUSH PSW              SAVE A, PSW
0FC4 E5           PUSH H                SAVE HL
0FC5 67           MOV  H,A              H = NIBCNT
                ;                       B = OFFSET, SOURCE[N=0]
                ;                       C = OFFSET, DEST[N=0]
                ;                       SET FLAGS FOR RETURN IF NIBCNT .LE. 0
0FC6 2E 00        MVI  L,0              L = FLAGV = 0; WHICH WILL PRODUCE:
                ;                       PSW:Z = ZERO = TRUE
                ;                       PSW:S = NONBCD = FALSE
                ;                       MOVE NIBCNT NIBBLES
                MVRN02;                 DO WHILE NIBCNT .GT. 0
0FC8 25           DCR  H                  H = NIBCNT-1
0FC9 FA E7 0F     JM   MVRN03
                ;                         MOVE ONE NIBBLE
0FCC CD 35 0F     CALL GETNIB             GETNIB(NIBVAL,ZERO ,SOURCE[N])
                ;                               ( A    ,PSW:Z, @B      )
                ;                               ( 0    , 0   , I       )
0FCF CD EE 0F     CALL PUTNIB             PUTNIB(DEST[N],NIBVAL)
                ;                               ( @C    , A    )
                ;                               ( 0     , I    )
                ;                         CHECK FOR NONZERO NIBBLE
0FD2 CA DF 0F     JZ   MVRN04             IF ZERO .EQ. FALSE
```

```
5824                ;                          CHECK FOR NO PREVIOUS FLAGS
5825 0FD5 2C          INR  L                   IF FLAGV .EQ. 0
5826 0FD6 2D          DCR  L
5827 0FD7 C2 D8 0F    JNZ  MVRN03
5828 0FDA 2C          INR  L                     L = FLAGV = 1
5829                ;                            WHICH WILL PRODUCE:
5830                ;                            PSW:Z = ZERO = FALSE
5831                ;                            PSW:S = NONBCD = FALSE
5832                MVRN03;                    ENDIF
5833                MVRN04;                  ENDIF
5834                ;                        CHECK FOR NONBCD NIBBLE
5835 0FD8 FE 0A       CPI  10                IF NIBVAL .GE. 10
5836 0FDD DA E2 0F    JC   MVRN05
5837 0FE0 2E 80       MVI  L,80H               L = FLAGV = HEX80
5838                ;                            WHICH WILL PRODUCE:
5839                ;                            PSW:Z = ZERO = FALSE
5840                ;                            PSW:S = NONBCD = TRUE
```

MVRNIB

```
5841                MVRN05;                    ENDIF
5842                ;                          MOVE INDICES FROM RIGHT TO LEFT
5843 0FE2 05          DCR  B                   B = OFFSET, SOURCE[N=N-1]
5844 0FE3 0D          DCR  C                   C = OFFSET.DEST[N=N-1]
5845                ;                          H = NIBCNT = NIBCNT-1
5846 0FE4 C3 C8 0F    JMP  MVRN02
5847                MVRN06;                  ENDDO
5848 0FE7 4D          MOV  C,L                 C = FLAGV
5849 0FE8 E1          POP  H                   RESTORE HL
5850 0FE9 F1          POP  PSW                 RESTORE A, PSW:CY
5851 0FEA 0C          INR  C                   PSW = STATUS, FLAGV
5852 0FEB 0D          DCR  C
5853 0FEC C1          POP  B                   RESTORE BC
5854 0FED C9          RET                      RETURN
```

PUTNIB

```
5857                ;PUTNIB(DEST  ,NIBVAL)
5858                ;      (NIBBLE,BYTE  )
5859                ;      ( 0    , I    )
5860                ;      ( @C   , A    )
5861                ;      ( C    , NC   )
5862                ;
5863                ;PSW:S, Z, P, CY = NO CHANGE
5864                ;
5865                ;INSERT LOW ORDER 4 BITS OF NIBVAL INTO DEST
5866                ;DEST = NIBVAL .AND. HEX0F
5867                ;
5868                PUTNIB;                  ****ENTRY POINT
5869 0FEE E5          PUSH H                 SAVE HL
5870 0FEF C5          PUSH B                 SAVE BC
5871 0FF0 F5          PUSH PSW               SAVE A, PSW
5872                ;                        CLEAR H/O NIBBLE OF NIBVAL
5873 0FF1 E6 0F       ANI  0FH               B = NIBVAL = NIBVAL .AND. HEX0F
5874 0FF3 47          MOV  B,A
5875                ;                        FLAG WHETHER NIBBLE GOES INTO L/O
5876                ;                        OF BYTE CONTAINING DEST
5877 0FF4 AF          XRA  A                 PSW:CY = OFFSET, DEST .MOD. 2
5878 0FF5 79          MOV  A,C
5879 0FF6 1F          RAR
5880                ;                        A = (OFFSET, DEST)/2
5881 0FF7 26 74       MVI  H,X/100H          HL = ADDRESS, DEST
5882 0FF9 6F          MOV  L,A
5883                ;                        MAKE MASK TO CLEAR L/O OF BYTE
5884 0FFA 0E F0       MVI  C,0F0H            C = MASK = HEXF0
5885                ;                        CHECK WHETHER NIBBLE GOES IN H/O
5886 0FFC DA 07 10    JC   PUTN01            IF PSW:CY .EQ. 0
5887                ;                          MAKE MASK TO CLEAR H/O OF BYTE
5888 0FFF 0E 0F       MVI  C,0FH               C = MASK = HEX0F
5889                ;                          SHIFT L/O NIBBLE OF NIBVAL TO H/O
```

```
5890 1001 78          MOV  A,B            B = NIBVAL = NIBVAL * HEX10
5891 1002 07          RLC
5892 1003 07          RLC
5893 1004 07          RLC
5894 1005 07          RLC
5895 1006 47          MOV  B,A
5896                PUTN01;               ENDIF
5897                ;                     FETCH BYTE CONTAINING DEST
5898 1007 7E          MOV  A,M            A = DEST
5899                ;                     MAKE HOLE IN BYTE FOR NIBBLE
5900 1008 A1          ANA  C              A = DEST = 0
5901                ;                     PUT NIBBLE IN HOLE
5902 1009 B0          ORA  B              DEST = NIBVAL
5903 100A 77          MOV  M,A
5904 100B F1          POP  PSW            RESTORE A, PSW
5905 100C C1          POP  B              RESTORE BC
5906 100D E1          POP  H              RESTORE HL
5907 100E C9          RET                 RETURN
```

RSCAN

```
5910                ;RSCAN(SOURCE,NIBCNT,NONBCD,ZERO  )
5911                ;     (NIBSTR,BYTE  ,BIT   ,BIT   )
5912                ;     ( I    , I    , O    , O    )
5913                ;     ( @B   , A    ,PSW:S ,PSW:Z )
5914                ;     ( NC   , NC   , C    , C    )
5915                ;
5916                ;PSW:CY= NO CHANGE
5917                ;PSW:S, Z, P CHANGED
5918                ;
5919                ;FOR A STRING ADDRESSED AT THE RIGHT SIDE,
5920                ;FROM RIGHT TO LEFT SCAN NIBCNT NIBBLES.
5921                ;THE NONBCD AND ZERO FLAGS REFER TO THE LARGEST
5922                ;NIBBLE SCANNED.
5923                ;SCAN SOURCE[1-NIBCNT..0]
5924                ;
5925                RSCAN;                ****ENTRY POINT
5926 100F C5          PUSH B              SAVE BC
5927                ;                     SCAN BY MOVING SOURCE INTO ITSELF
5928 1010 48          MOV  C,B            C = OFFSET, SOURCE
5929 1011 C3 C3 0F    JMP  MVRN01         MVRNIB(SOURCE,SOURCE,NIBCNT,
5930                ;                           ( @C   , @B   , A    ,
5931                ;                           ( O    , I    , I    ,
5932                ;
5933                ;                            NONBCD,ZERO  )
5934                ;                           PSW:S ,PSW:Z )
5935                ;                            O    , O    )
5936                ;                     RESTORE BC
5937                ;                     RETURN
```

TDBITM

```
5940                ;TDBITM(SOURCE,BITCNT,DEST  ,DBIT  ,SBIT  )
5941                ;      (BITSTR,UBYTE ,BITSTR,UBYTE ,BYTSTR)
5942                ;      ( I    , I    , O    , I    , I    )
5943                ;      ( @H   , L    , @D   , E    , @BC  )
5944                ;      ( NC   , C    , C    , C    , NC   )
5945                ;
5946                ;REGISTERS DESTROYED
5947                ;PSW DESTROYED
5948                ;
5949                ;TABLE DRIVEN BIT MOVE ROUTINE.
5950                ;MOVES BITCNT BITS INTO DEST STARTING AT DEST.DBIT;
5951                ;THE SOURCE BITS ARE SOURCE.SBIT[0] THROUGH
5952                ;SOURCE.SBIT[BITCNT-1]
5953                ;
5954                TDBITM;               ****ENTRY POINT
5955 1014 7D          MOV  A,L            A = BITCNT = BITCNT+1
5956 1015 3C          INR  A
5957                ;                     BC = ADDRESS, SBIT[N=0]
```

```
5958                    TDBIT1;                 DO WHILE BITCNT .NE. 0
5959 1016 3D              DCR  A                  A =  BITCNT = BITCNT-1
5960 1017 C8              RZ
5961 1018 F5              PUSH PSW                SAVE A, PSW
5962 1019 0A              LDAX B                  L = SBIT[N]
5963 101A 6F              MOV  L,A
5964                    ;                         MOVE BIT
5965 101B CD 68 0F        CALL MOVBIT             MOVBIT(SOURCE,SBIT[N],DEST,DBIT,VALUE)
5966                    ;                                ( @H   , L     , @D , E  ,PSW:Z)
5967                    ;                                ( I    , I     , O  , I  , O   )
5968 101E F1              POP  PSW                A = BITCNT
5969 101F 03              INX B                   BC = ADDRESS, SBIT[N=N+1]
5970 1020 1C              INR  E                  E = DBIT = DBIT+1
5971 1021 C3 16 10        JMP  TDBIT1
5972                    ;                       ENDDO
5973                    ;                       RETURN
```

VCALL

```
5976                    ;VCALL(RTNADR)
5977                    ;     (ADDR  )
5978                    ;     ( I    )
5979                    ;     ( HL   )
5980                    ;
5981                    ;REGISTER AND STATUS CHANGES DEPEND ON ROUTINE @HL
5982                    ;
5983                    ;VECTOR CALL TO ROUTINE WHOSE ADDRESS IS IN HL
5984                    ;
5985                    VCALL;                  ****ENTRY POINT
5986 1024 E9              PCHL                  GO TO ROUTINE @HL
5987                    ;                       RETURN VIA RTS IN THAT ROUTINE
```

VCALLS

```
5990                    ;VCALLS(RTNADR)
5991                    ;      (ADDR  )
5992                    ;      ( I    )
5993                    ;      ( HL   )
5994                    ;      ( NC   )
5995                    ;
5996                    ;PSW:S, Z, P, CY = NO CHANGE
5997                    ;
5998                    ;VECTOR CALL TO ROUTINE @HL
5999                    ;
6000                    VCALLS;                 ****ENTRY POINT
6001 1025 C5              PUSH B                SAVE ALL REGISTERS
6002 1026 D5              PUSH D
6003 1027 E5              PUSH H
6004 1028 F5              PUSH PSW
6005                    ;                       VECTOR CALL TO ROUTINE @HL
6006 1029 CD 24 10        CALL VCALL            VCALL(RTNADR)
6007                    ;                            ( HL   )
6008                    ;                            ( I    )
6009                    ;                       RESTORE ALL REGISTERS
6010 102C F1              POP  PSW
6011 102D E1              POP  H
6012 102E D1              POP  D
6013 102F C1              POP  B
6014 1030 C9              RET
```

NVM30F

```
6017                    ;NVM30F()(PORTA )
6018                    ;        (BITSTR)
6019                    ;        ( I/O  )
6020                    ;        ( 7001 )
6021                    ;        ( C    )
6022                    ;
6023                    ;REGISTERS NOT CHANGED
6024                    ;PSW NOT CHANGED
```

```
                    ;
                    ;REMOVE 30 VOLTS FROM NONVOLATILE MEMORY TO DISABLE
                    ;WRITING AND ERASING.
                    ;
                    NVM30F;                 ****ENTRY POINT
1031 F5               PUSH PSW              SAVE A,PSW
1032 C5               PUSH B                SAVE BC
                    ;                       REMOVE 30 VOLTS FROM NVM
1033 3A 01 70         LDA  PORTA            PORTA = PORTA .OR. HEX40
1036 F6 40            ORI  40H
1038 32 01 70         STA  PORTA
                    ;                       PAUSE FOR 10 MSEC TO ALLOW NVM
                    ;                       VOLTAGE TO TRANSITION FROM
                    ;                       -30 TO +5
103B 01 64 00         LXI  B,100            BC = LOOPCT = 100
                    NVM30G;                 DO UNTIL LOOPCT .EQ. 0
103E CD 19 0B         CALL NPAUSE             NPAUSE(LOOPCT,ZROFLG)
                    ;                               ( BC   ,PSW:Z )
                    ;                               ( I/O  , 0    )
1041 C2 3E 10         JNZ  NVM30G
                    ;                       ENDDO
1044 C1               POP  B                RESTORE BC
1045 F1               POP  PSW              RESTORE A,PSW
1046 C9               RET                   RETURN
```

NVM30T

```
                    ;NVM30T()(PORTA )
                    ;        (BITSTR)
                    ;        ( I/O  )
                    ;        ( 7001 )
                    ;        ( C    )
                    ;
                    ;REGISTERS NOT CHANGED
                    ;PSW NOT CHANGED
                    ;
                    ;APPLY 30 VOLTS TO NONVOLATILE MEMORY TO ENABLE
                    ;WRITING AND ERASING.
                    ;
                    NVM30T;                 ****ENTRY POINT
1047 F5               PUSH PSW              SAVE A,PSW
                    ;                       SUPPLY 30 VOLTS TO NVM
1048 3A 01 70         LDA  PORTA            PORTA = PORTA .AND. HEXBF
104B E6 BF            ANI  0BFH
104D 32 01 70         STA  PORTA
                    ;                       DELAY ABOUT 100 USEC BEFORE RETURNING
1050 3E 0B            MVI  A,11
1052 3D               DCR  A
1053 C2 52 10         JNZ  $-1
1056 F1               POP  PSW              RESTORE A,PSW
1057 C9               RET                   RETURN
```

NVMBYT

```
                    ;NVMBYT(ADRESS,NVMRED[J],BYTE)
                    ;      (ADRESS,NIBSTR   ,BYTE)
                    ;      ( I/O  , I       , 0  )
                    ;      ( HL   , @HL     , A  )
                    ;      ( C    , NC      , C  )
                    ;
                    ;PSW DESTROYED
                    ;REGISTERS NOT CHANGED
                    ;
                    ;ASSEMBLE 2 NIBBLES FROM NVM INTO A SINGLE BYTE
                    ;
                    NVMBYT;                 ****ENTRY POINT
1058 C5               PUSH B                SAVE BC
1059 7E               MOV  A,M              B = HINIB = NVMRED[J]*HEX10
105A 87               ADD  A
105B 07               ADD  A
```

```
6093 105C 87          ADD  A
6094 105D 87          ADD  A
6095 105E 47          MOV  B,A
6096                ;                        POINT AT NEXT NIBBLE
6097 105F CD EB 11    CALL NVMNXT            NVMNXT(ADRESS,NVMRED[J=J+2])
6098                ;                              ( HL   , @HL        )
6099                ;                              ( I/O  , -          )
6100 1062 7E          MOV  A,M               A = LOWNIB = NVMRED[J] .AND. HEXOF
6101 1063 E6 0F       ANI  0FH
6102 1065 B0          ORA  B                 A = BYTE = LOWNIB .OR. HINIB
6103 1066 C1          POP  B                 RESTORE BC
6104 1067 C9          RET                    RETURN
NVMCHG
6107                ;NVMCHG()(NVMCTL)
6108                ;        (NIBSTR)
6109                ;        ( I    )
6110                ;        ( RAM  )
6111                ;        ( NC   )
6112                ;
6113                ;A,PSW DESTROYED
6114                ;REGISTERS DESTROYED
6115                ;
6116                ;PROVIDES NVM NORMAL BLOCK IF METER IN NORMAL MODE.
6117                ;PROVIDES NVM SERVICE BLOCK IF METER NOT IN NORMAL MODE.
6118                ;
6119                ;NVMCTL[0] = F IF NO BLOCK IS OPEN
6120                ;          = 0 IF NORMAL BLOCK IS OPEN
6121                ;          = 1 IF SERVICE BLOCK IS OPEN
6122                ;NVMCTL[1] = NUMBER OF OPEN BLOCK
6123                ;
6124                NVMCHG;                  ****ENTRY POINT
6125                ;                        FETCH BLOCK TYPE
6126 1068 06 66       MVI  B,NVMCTL          B = OFFSET, NVMCTL[0]
6127 106A CD 35 0F    CALL GETNIB            GETNIB(BLKTYP,ZROFLG,NVMCTL[0])
6128                ;                              ( A    ,PSW:Z , @B      )
6129                ;                              ( 0    , 0    , I       )
6130 106D FE 02       CPI  2                 IF BLKTYP .LT. 2
6131 106F D0          RNC
6132                ;                          A BLOCK IS OPEN
6133                ;                          DETERMINE METER STATUS
6134 1070 CD 4E 0F    CALL LSTATE            LSTATE(FATMOD,NORMOD,SERMOD,PRVMOD)
6135                ;                                (PSW:S ,PSW:Z ,PSW:P ,PSW:C )
6136                ;                                ( 0    , 0    , 0    , 0    )
6137 1073 CA 77 10    JZ   NVMCH1            IF NORMOD .EQ. FALSE
6138                ;                            A SERVICE BLOCK IS REQUIRED
6139 1076 3D          DCR  A                     A = DIFRNC = BLKTYP-(SRVTYP=1)
6140                NVMCH1;                  ELSE
6141                ;                            A NORMAL BLOCK IS REQUIRED
6142                ;                            A = DIFRNC = BLKTYP-(NORHDR=0)
6143                ;                        ENDIF
6144 1077 B7          ORA  A                 IF DIFRNC .NE. 0
6145 1078 C8          RZ
6146                ;                            CURRENT BLOCK NOT REQUIRED
6147 1079 CD DE 0E    CALL DBLANK                STOP CLOCK. BLANK DISPLAY
6148                ;                            CLOSE CURRENT BLOCK
6149 107C F3          DI                         DISABLE INTERRUPTS
6150 107D CD 9E 12    CALL NVMWR                 NVMWR(ERRFLG)
6151                ;                                (PSW:Z )
6152                ;                                ( 0    )
6153 1080 FB          EI                         ENABLE INTERRUPTS
6154                ;                            IF ERRFLG .EQ. FALSE
6155                ;                              OPEN REQUIRED BLOCK
6156 1081 C2 C4 11    JNZ  NVMOPN                NVMOPN(ERRFLG)
6157                ;                                      (PSW:Z )
6158                ;                                      ( 0    )
6159                ;                            ENDIF
6160                ;                          ENDIF
6161                ;                        ENDIF
6162 1084 C9          RET                    RETURN
```

NVMDED

```
                    ;NVMDED(CODE,ERRFLG)(SERFLG,NVMRED)
                    ;       (BYTE,BIT   )(BIT   ,NIBSTR)
                    ;       ( I  , 0    )( 0    , I    )
                    ;       ( A  ,PSW:Z )( RAM  , NVM  )
                    ;       ( C  , C    )( C    , NC   )
                    ;
                    ;A,PSW DESTROYED
                    ;REGISTERS DESTROYED
                    ;
                    ;FLAG METER DEAD AND INDICATE ERROR
                    ;
                    NVMDED;                 ****ENTRY POINT
1085 47               MOV  B,A              B = CODE
                    ;                       TEST SPECIAL NVM LOCATION
1086 3A BE 46         LDA  NVMRED+KILCOD    IF NVMRED[KILCOD] .EQ. HEX0F
1089 3C               INR  A
108A E6 0F            ANI  0FH
108C C2 A0 10         JNZ NVMDE2
                    ;                         LOCATION STILL CLEAR
                    ;                         WRITE ERROR CODE TO LOCATION
108F 78               MOV  A,B                A[1] = CODE
1090 21 BE 02         LXI  H,KILCOD           H = BASE = KILCOD
1093 CD 47 10         CALL NVM30T             TURN ON -30 V TO NVM
1096 CD 61 12         CALL NVMWN              NVMWN(CODE,BASE,ERRFLG)
                    ;                             (A[1], HL ,PSW:Z )
                    ;                             ( I  , I  , 0    )
                    NVMDE1;                   ****ENTRY POINT
                    ;                             NVMDE1(CODE,ERRFLG)
                    ;                                   ( B  ,PSW:Z )
                    ;                                   ( I  , 0    )
                    ;                         FLAG METER DEAD
1099 21 10 74         LXI  H,SERFLG/2+X       HL = ADDRESS, SERFLG
109C 7E               MOV  A,M                SERFLG.DEAD = TRUE
109D F6 80            ORI  80H
109F 77               MOV  M,A
                    NVMDE2;                 ENDIF
10A0 CD 31 10         CALL NVM30F             TURN OFF -30 V TO NVM
                    ;                         DECLARE FATAL ERROR
10A3 78               MOV  A,B                A = DEDCOD = HEX20+CODE
10A4 F6 20            ORI  20H
10A6 C3 80 08         JMP  FATERR             FATERR(DEDCOD,ERRFLG)
                    ;                                 ( A    ,PSW:Z )
                    ;                                 ( I    , 0    )
                    ;                         RETURN
```

NVMDXB

```
                    ;NVMDXB(ERRFLG,BLKCTL)
                    ;       (BIT   ,NIBSTR)
                    ;       ( 0    , I    )
                    ;       (PSW:Z , B    )
                    ;       ( C    , NC   )
                    ;
                    ;A,PSW DESTROYED
                    ;REGISTERS DESTROYED
                    ;
                    ;DEACTIVATES NVM BLOCK
                    ;
                    NVMDXB;                 ****ENTRY POINT
                    ;                       MOVE NVM CONTROL BYTE TO ACCUMULATOR
10A9 78               MOV  A,B              A = BLKCTL
                    ;                       FORM BASE VALUE FOR BLOCK
10AA CD 91 11         CALL NVMMAP           NVMMAP(BLKCTL,BASE,BLKTYP)
                    ;                             ( A    , HL , A[1] )
                    ;                             ( I    , 0  , 0    )
                    ;                       WRITE NUL HEADER TO DEACTIVATE BLOCK
10AD AF               XRA  A                A[1] = NULHDR = 0
```

```
6231 10AE C3 61 12   JMP  NVMWN          NVMWN(NULHDR,BASE,ERRFLG)
6232                ;                         ( A[1] , HL ,PSW:Z )
6233                ;                         ( I    , I  , O    )
6234                ;                    RETURN

NVMER

6237                ;NVMER(ERRFLG)(NVMCTL,NVMERS,NVMRED,SERFLG)
6238                ;     (BIT   )(NIBSTR,NIBSTR,NIBSTR,BITSTR)
6239                ;     ( O    )( I    , O    , I    , I    )
6240                ;     (PSW:Z )( RAM  , NVM  , NVM  , RAM  )
6241                ;     ( C    )( NC   , C    , NC   , C    )
6242                ;
6243                ;A,PSW DESTROYED
6244                ;REGISTERS DESTROYED
6245                ;
6246                ;ERASE A BLOCK OF NONVOLATILE MEMORY
6247                ;
6248                NVMER;               ****ENTRY POINT
6249                ;                    GET CONTROL BYTE TO ERASE NEXT BLOCK
6250 10B1 CD 9F 11   CALL NVMNBK         NVMNBK(ERRFLG,OLDCTL,NXTCTL,
6251                ;                          (PSW:Z , B    , C    ,
6252                ;                          ( O    , O    , O    ,
6253                ;
6254                ;                          ADRESS,NVMCTL)
6255                ;                           HL   , @HL  )
6256                ;                           O    , -    )
6257 10B4 C8         RZ                  IF ERRFLG .EQ. FALSE
6258                ;                      SET TO CHECK AND ERASE NEXT BLOCK
6259 10B5 79         MOV  A,C              NVMCTL = NXTCTL .OR. HEXF0
6260 10B6 F6 F0      ORI  0F0H
6261 10B8 77         MOV  M,A
6262                ;                      FETCH BLOCK LENGTH
6263 10B9 CD DF 11   CALL NVMPRP           NVMPRP(NIBCNT,OFFSET,RAMC[1])
6264                ;                            ( B    , C    , @C   )
6265                ;                            ( O    , O    , -    )
6266 10BC C5         PUSH B                SAVE BC
6267                ;                      FETCH BASE ADDRESS OF CURRENT BLOCK
6268 10BD 7E         MOV  A,M              A = NVMCTL
6269 10BE CD 91 11   CALL NVMMAP           NVMMAP(NVMCTL,BASE,BLKTYP)
6270                ;                            ( A    , HL , A[1] )
6271                ;                            ( I    , O  , O    )
6272 10C1 E5         PUSH H                SAVE HL
6273                ;                      FORM NVM READ ADDRESS
6274 10C2 11 00 44   LXI  D,NVMRED         HL = ADDRESS, NVMRED[J=BASE]
6275 10C5 19         DAD  D
6276 10C6 E5         PUSH H                SAVE HL
6277                ;                      INITIALIZE CRC VALUE
6278 10C7 16 FF      MVI  D,0FFH           D = CRCVAL = HEXFF
6279                ;                      CHECK BLOCK HEADER
6280 10C9 7E         MOV  A,M              A = BLKHDR[0] = NVMRED[J]
6281 10CA E6 0F      ANI  0FH              IF BLKHDR[0] .EQ. 0
6282 10CC C2 EB 10   JNZ  NVMER4
6283                ;                        BLOCK IS INACTIVE AND NOT ERASED
6284                ;                        POINT AT START OF BLOCK'S DATA
6285 10CF 23         INX  H                   HL = ADDRESS, NVMRED[J=J+2]
6286 10D0 23         INX  H
6287                ;                        CHECK BLOCK CHECKSUM
6288                NVMER1;                  LOOP - WITH 1 BREAK
6289 10D1 05         DCR  B                     B = NIBCNT = NIBCNT-1
6290 10D2 FA DF 10   JM   NVMER2                IF NIBCNT .LT. 0
6291                ;                              BREAK
6292                ;                           ENDIF
6293                ;                           DEVELOP CRC
6294 10D5 7E         MOV  A,M                   A = DATA = NVMRED[J]
6295 10D6 CD C6 0E   CALL CRCNIB                CRCNIB(DATA,CRCVAL)
6296                ;                                ( A  , D    )
6297                ;                                ( I  , O    )
6298                ;                           POINT AT NEXT DATA
```

```
10D9 CD BB 11   CALL NVMNXT
                ;
                ;
10DC C3 D1 10   JMP  NVMER1
                NVMER2;
                ;
10DF CD 58 10   CALL NVMBYT
                ;
                ;
10E2 BA         CMP  D
10E3 CA EB 10   JZ   NVMER3
                ;
10E6 3E 02      MVI  A,NVMRET
10E8 CD 85 10   CALL NVMDED
                ;
                ;
                NVMER3;
                NVMER4;
10EB D1         POP  D
10EC E1         POP  H
10ED 01 00 40   LXI  B,NVMERS
10F0 09         DAD  B
10F1 F1         POP  PSW
10F2 C6 04      ADI  4
10F4 47         MOV  B,A
10F5 3A 10 74   LDA  SERFLG/2+X
10F8 B7         ORA  A
10F9 F2 FE 10   JP   NVMER5
10FC AF         XRA  A
10FD C9         RET
                NVMER5;
10FE CD 47 10   CALL NVM30T
                NVMER6;
1101 05         DCR  B
                ;
                ;
1102 FA 31 10   JM   NVM30F
                ;
                ;
1105 F3         DI
                ;
1106 77         MOV  M,A
                ;
1107 C5         PUSH B
1108 01 64 00   LXI  B,100
                NVMER7;
110B CD 19 0B   CALL NPAUSE
                ;
                ;
110E C2 0B 11   JNZ  NVMER7
                ;
1111 C1         POP  B
                ;
1112 1A         LDAX D
1113 7B         MOV  A,E
1114 E6 3F      ANI  3FH
1116 CA 1A 11   JZ   NVMER8
                ;
1119 FB         EI
                NVMER8;
                ;
111A CD BB 11   CALL NVMNXT
                ;
                ;
                ;
111D 1A         LDAX D
111E F6 F0      ORI  0F0H
1120 4F         MOV  C,A
                ;
1121 EB         XCHG
```

```
NVMNXT(ADRESS,NVMRED[J=J+?])
      ( HL   , @HL        )
      ( I/O  , -          )

ENDLOOP
FETCH CRC FROM NVM
NVMBYT(ADRESS,NVMRED[J],NVMCRC)
      ( HL   , @HL     , A    )
      ( I/O  , I       , O    )
IF NVMCRC .NE. CRCVAL

  DECLARE DEAD METER. WEAK NVM
  A = NVMRET
  NVMDED(NVMRET,ERRFLG)
      ( A    ,PSW:Z )
      ( I    , O    )
 .ENDIF
ENDIF
DE = ADDRESS, NVMRED[J=BASE]
HL = BASE
HL = ADDRESS, NVMERS[I=BASE]

B = NIBCNT = NIBCNT+4

IF SERFLG.DEAD .EQ. TRUE

  PSW:Z = ERRFLG = TRUE

ELSE
  SUPPLY 30 VOLTS TO NVM
  LOOP - WITH 2 BREAKS
    B = NIBCNT = NIBCNT-1
    IF NIBCNT .LT. 0
      PSW:Z = ERRFLG = FALSE
      REMOVE 30 VOLTS FROM NVM
      BREAK
    ENDIF
    DISABLE INTERRUPTS
    START ERASE FUNCTION
    NVMERS[J] = DUMMY
    PAUSE FOR 10 MSEC
    SAVE BC
    BC = LOOPCT = 100
    DO UNTIL LOOPCT .EQ. 0
      NPAUSE(LOOPCT,ZROFLG)
          ( BC   ,PSW:Z )
          ( I/O  , O    )

    ENDDO
    RESTORE BC
    STOP ERASE FUNCTION
    A = GARBAGE = NVMRED[J]
    A=(ADDRESS,NVMRED[J]).AND.HEX3F

    IF A .EQ. 0
      HEADER[0] NOT JUST ERASED
      ENABLE INTERRUPTS
    ENDIF
    ADVANCE ERASE ADDRESS
    NVMNXT(ADRESS,NVMERS[I=I+?])
      ( HL   , @HL        )
      ( I/O  , -          )
    READ ERASED NIBBLE
    C = DATA = NVMRED[J] .AND. HEXF0

    ADVANCE READ ADDRESS
```

```
6369 1122 CD BB 11   CALL NVMNXT              NVMNXT(ADRESS,NVMRED[J=J+?])
6370                ;                               ( HL   , @HL         )
6371                ;                               ( I/O  , -           )
6372 1125 EB         XCHG
6373                ;                          CHECK FOR PROPER ERASURE
6374 1126 0C         INR  C                     IF DATA+1 .NE. 0
6375 1127 CA 01 11   JZ   NVMER6
6376                ;                            BAD ERASURE
6377                ;                            DECLARE DEAD METER. BAD NVM
6378 112A 3E 01      MVI  A,NVMBAD               A = NVMBAD
6379 112C C3 85 10   JMP  NVMDED                 NVMDED(NVMBAD,ERRFLG)
6380                ;                                 ( A    ,PSW:Z )
6381                ;                                 ( I    , 0    )
6382                ;                            BREAK
6383                ;                          ENDIF
6384                ;                        ENDLOOP
6385                ;                      ENDIF
6386                ;                    ENDIF
6387                ;                    RETURN
NVMFND
6390                ;NVMFND(ERRFLG)(NVMCTL,NVMRED)
6391                ;      (BIT   )(NIBSTR,NIBSTR)
6392                ;      ( 0    )( I/O  , I    )
6393                ;      (PSW:Z )( RAM  , NVM  )
6394                ;      ( C    )( C    , NC   )
6395                ;
6396                ;A,PSW DESTROYED
6397                ;REGISTERS DESTROYED
6398                ;
6399                ;FIND CURRENT BLOCK CORRESPONDING TO METER MODE
6400                ;
6401                NVMFND;              ****ENTRY POINT
6402 112F 11 33 74   LXI  D,NVMCTL/2+X   DE = ADDRESS, NVMCTL[0..1]
6403 1132 1A         LDAX D              PSW:CY = OPEN = NVMCTL[0] .LT. 2
6404 1133 FE 20      CPI  20H
6405 1135 3E 02      MVI  A,SFTWRE       A = SFTWRE
6406                ;                    IF OPEN .EQ. TRUE
6407                ;                      LOOKING FOR BLOCK IS INAPPROPRIATE
6408                ;                      DECLARE DEAD METER. SOFTWARE ERROR
6409 1137 DA 85 10   JC   NVMDED            NVMDED(SFTWRE,ERRFLG)
6410                ;                            ( A    ,PSW:Z )
6411                ;                            ( I    , 0    )
6412                ;                    ELSE
6413                ;                      SET TO LOCATE ACTIVE SERVICE HEADER
6414 113A 06 F1      MVI  B,0F1H           B = TEST = HEXF1
6415                ;                      SET TO INCREMENT TO BLOCK 0
6416 113C 1A         LDAX D                NVMCTL[1] = HEX0F
6417 113D F6 0F      ORI  0FH
6418 113F 12         STAX D
6419                ;                      THERE ARE 2 SERVICE BLOCKS
6420 1140 0E 02      MVI  C,2              C = BLKCTR = 2
6421                ;                      DETERMINE METER MODE
6422 1142 CD 4E 0F   CALL LSTATE           LSTATE(FATMOD,NORMOD,SERMOD,PRVMOD)
6423                ;                            (PSW:S ,PSW:Z ,PSW:P ,PSW:C )
6424                ;                            ( 0    , 0    , 0    , 0    )
6425 1145 C2 4E 11   JNZ  NVMFN1            IF NORMOD .EQ. TRUE
6426                ;                        SET TO INCREMENT TO BLOCK 2
6427 1148 1A         LDAX D                 NVMCTL[1] = HEX01
6428 1149 A0         ANA  B
6429 114A 12         STAX D
6430                ;                        SET TO LOCATE ACTIVE NORMAL HEADER
6431 114B 05         DCR  B                 B = TEST = HEXF0
6432                ;                        THERE ARE 14 NORMAL BLOCKS
6433 114C 0E 0E      MVI  C,14              C = BLKCTR = 14
6434                NVMFN1;                ENDIF
6435                NVMFN2;                LOOP - WITH 2 BREAKS
6436                ;                        INCREMENT BLOCK NUMBER
6437 114E 1A         LDAX D                 NVMCTL[1] = NVMCTL[1]+1
6438 114F 3C         INR  A
```

```
6439 1150 F6 F0      ORI  0F0H
6440 1152 12         STAX D
6441                ;                          FETCH CORRESPONDING BASE ADDRESS
6442 1153 CD 91 11   CALL NVMMAP                NVMMAP(NVMCTL,BASE,BLKTYP)
6443                ;                                ( A    , HL , A[1] )
6444                ;                                ( I    , O  , O    )
6445                ;                          CONVERT TO READ ADDRESS
6446 1156 C5         PUSH B                     SAVE BC
6447 1157 01 00 44   LXI  B,NVMRED              HL = ADDRESS, NVMRED[J=BASE]
6448 115A 09         DAD  B
6449 115B C1         POP  B                     RESTORE BC
6450 115C 0D         DCR  C                     C = BLKCTR = BLKCTR-1
6451                ;                          PSW:S = DONE = BLKCTR .LT. 0
6452 115D 3E 01      MVI  A,NVMBAD              A = NVMBAD
6453                ;                          IF DONE .EQ. TRUE
6454                ;                            DECLARE DEAD METER. BAD NVM
6455 115F FA 85 10   JM   NVMDED                 NVMDED(NVMBAD,ERRFLG)
6456                ;                                  ( A    ,PSW:Z )
6457                ;                                  ( I    , O    )
6458                ;                            BREAK
6459                ;                          ENDIF
6460                ;                          FETCH BLOCK HEADER
6461 1162 CD 58 10   CALL NVMBYT                NVMBYT(ADRESS,NVMRED[J],HEADER)
6462                ;                                ( HL   , @HL     , A    )
6463                ;                                ( I/O  , I       , O    )
6464 1165 B8         CMP  B                     IF HEADER .EQ. TEST
6465 1166 C2 4E 11   JNZ  NVMFN2
6466 1169 04         INR  B                       PSW:Z = ERRFLG = FALSE
6467 116A C9         RET                          BREAK
6468                ;                          ENDIF
6469                ;                        ENDLOOP
6470                ;                      ENDIF
6471                ;                      RETURN
```

NVMLOD

```
6474                ;NVMLOD()(NORFLG,NVMCTL,MRSTS1)
6475                ;        (BITSTR,NIBSTR,BITSTR)
6476                ;        ( O    , O    , O    )
6477                ;        ( RAM  , RAM  , RAM  )
6478                ;        ( C    , C    , C    )
6479                ;
6480                ;A,PSW DESTROYED
6481                ;REGISTERS DESTROYED
6482                ;
6483                ;INITIALIZATION. LOAD NONVOLATILE MEMORY
6484                ;
6485                NVMLOD;                 ****ENTRY POINT
6486 116B 21 26 74   LXI  H,NORFLG/2+X      HL = ADDRESS, NORFLG
6487                ;                       SENT STATUS AND POSTAGE AFTER POWERUP
6488 116E 7E         MOV  A,M               NORFLG.QUESTS = NORFLG.QUEPOS = TRUE
6489 116F F6 C0      ORI  0C0H
6490 1171 77         MOV  M,A
6491                ;                       DECLARE THAT NO BLOCK IS OPEN
6492 1172 3E F0      MVI  A,0F0H            NVMCTL = HEXF0
6493 1174 32 33 74   STA  NVMCTL/2+X
6494                ;                       METER GUARANTEED TO BE IN NORMAL MODE
6495                ;                       SEARCH FOR NORMAL BLOCK
6496 1177 CD 2F 11   CALL NVMFND            NVMFND(ERRFLG)
6497                ;                             (PSW:Z )
6498                ;                             ( O    )
6499                ;                       IF ERRFLG .EQ. FALSE
6500 117A C4 EE 11   CNZ NVMRD                LOAD NORMAL BLOCK
6501                ;                       ENDIF
6502 117D 21 24 74   LXI  H,MRSTS1/2+X      HL = ADDRESS, MRSTS1
6503                ;                       SET TO LOAD SERVICE BLOCK
6504                ;                       INITIALIZE CHECK DATE STATUS
6505 1180 7E         MOV  A,M               MRSTS1.DATDOR = MRSTS1.SERMOD = TRUE
6506 1181 F6 48      ORI  48H
6507 1183 77         MOV  M,A
```

```
6508 1184 E5          PUSH H            SAVE HL
6509                ;                   SEARCH FOR SERVICE BLOCK
6510 1185 CD 2F 11    CALL NVMFND       NVMFND(ERRFLG)
6511                ;                         (PSW:Z )
6512                ;                         ( O    )
6513                ;                   IF ERRFLG .EQ. FALSE
6514 1188 C4 EE 11    CNZ  NVMRD          LOAD SERVICE BLOCK
6515                ;                   ENDIF
6516 118D E1          POP  H            RESTORE HL
6517                ;                   RETURN TO NORMAL MODE
6518                ;                   DISABLE METER
6519 118C 7E          MOV  A,M          MRSTS1.SERMOD = MRSTS1.ENABLD = FALSE
6520 118D E6 F3       ANI  0F3H
6521 118F 77          MOV  M,A
6522 1190 C9          RET               RETURN
```

NVMMAP

```
6525                ;NVMMAP(NVMCTL,BASE  ,BLKTYP)
6526                ;      (NIBSTR,ADRESS,NIBSTR)
6527                ;      ( I    , O    , O    )
6528                ;      ( A    , HL   , A[1] )
6529                ;      ( C    , C    , C    )
6530                ;
6531                ;PSW DESTROYED
6532                ;REGISTERS NOT CHANGED
6533                ;
6534                ;MAPS BLOCK NUMBER IN L/O NIBBLE OF ACCUMULATOR INTO
6535                ;CORRESPONDING NONVOLATILE MEMORY ADDRESS
6536                ;
6537                NVMMAP;             ****ENTRY POINT
6538 1191 0F          RRC               A = NVMCTL[1]*HEX10+NVMCTL[0]
6539 1192 0F          RRC
6540 1193 0F          RRC
6541 1194 0F          RRC
6542 1195 F5          PUSH PSW          SAVE A,PSW
6543 1196 E6 F0       ANI  0F0H         HL = BASE = NVMCTL[1]*HEX40
6544 1198 6F          MOV  L,A
6545 1199 26 00       MVI  H,0
6546 119B 29          DAD  H
6547 119C 29          DAD  H
6548 119D F1          POP  PSW          RESTORE A,PSW
6549                ;                   A[1] = BLKTYP = NVMCTL[0]
6550 119E C9          RET               RETURN
```

NVMNBK

```
6553                ;NVMNBK(ERRFLG,OLDCTL,NXTCTL,ADRESS,NVMCTL)(NVMCTL)
6554                ;      (BIT   ,NIBSTR,NIBSTR,ADRESS,NIBSTR)(NIBSTR)
6555                ;      ( O    , O    , O    , O    , -    )( I    )
6556                ;      (PSW:Z , B    , C    , HL   , @HL  )( RAM  )
6557                ;      ( C    , C    , C    , C    , -    )( NC   )
6558                ;
6559                ;A,PSW DESTROYED
6560                ;REGISTERS DESTROYED
6561                ;
6562                ;DEVELOP CONTROL BYTE VALUES FOR DEACTIVATING BLOCK OF
6563                ;CURRENT TYPE, AND FOR OPENING NEXT BLOCK.
6564                ;
6565                NVMNBK;             ****ENTRY POINT
6566                ;                   SET NVMCTL TO INDICATE ACTIVE CLOSED
6567                ;                   BLOCK CORRESPONDING TO CURRENT STATUS
6568 119F CD 2F 11    CALL NVMFND       NVMFND(ERRFLG)
6569                ;                         (PSW:Z )
6570                ;                         ( O    )
6571 11A2 C8          RZ                IF ERRFLG .EQ. FALSE
6572                ;                     NVMCTL[0] = HEXF, NO FILES OPEN
6573                ;                     NVMCTL[1] = ACTIVE BLOCK NUMBER
6574 11A3 21 33 74    LXI  H,NVMCTL/2+X   HL = ADDRESS, NVMCTL
6575 11A6 46          MOV  B,M            B = OLDCTL = NVMCTL
```

```
6576 11A7 0E 02      MVI  C,2            C = NVMCTL = HEX02
6577 11A9 7E         MOV  A,E            A = OLDCTL+1
6578 11AA 3C         INR  A
6579 11AB CA B9 11   JZ   NVMNB1         IF OLDCTL+1 .EQ. 0
6580               ; >>JUMP AHEAD<<         OLD BLOCK WAS 15
6581               ;                        NEWCTL SET FOR BLOCK 2, NORMAL
6582               ;                        PSW:Z = ERRFLG = FALSE
6583               ;                      ELSE
6584               ;                        OLD BLOCK WAS NOT 15
6585 11AE E6 0F      ANI  0FH               A=OLDBLK+1=(OLDCTL+1).AND.HEX0F
6586 11B0 4F         MOV  C,A               C = OLDBLK+1
6587 11B1 DE 03      SBI  3                 A = OLDBLK-2
6588 11B3 F2 B9 11   JP   NVMNB1            IF OLDBLK-2 .GE. 0
6589               ; >>JUMP AHEAD<<           OLD BLOCK WAS 2 TO 14
6590               ;                          NEWCTL SET FOR BLK 3 TO 15, NORM
6591               ;                          PSW:Z = ERRFLG = FALSE
6592               ;                        ELSE
6593               ;                          OLD BLOCK WAS 0 OR 1
6594               ;                          SET NEWCTL FOR BLK 0 OR 1, SERVC
6595 11B6 EE EF      XRI  0EFH                C=NEWCTL=(OLDBLK-2).XOR.HEXEF
6596 11B8 4F         MOV  C,A
6597               ;                        ENDIF
6598               ;                      ENDIF
6599               NVMNB1;                >>TARGET OF JUMP AHEAD<<
6600 11B9 B1         ORA  C               PSW:Z = ERRFLG = FALSE
6601 11BA C9         RET
6602               ;                    ENDIF
6603               ;                    RETURN
```

NVMNXT

```
6606               ;NVMNXT(ADRESS)
6607               ;      (ADRESS)
6608               ;      ( I/O  )
6609               ;      ( HL   )
6610               ;      ( C    )
6611               ;
6612               ;A,PSW DESTROYED
6613               ;REGISTERS NOT CHANGED
6614               ;
6615               ;ADVANCE ADDRESS TO NEXT HIGHER LOCATION SKIPPING XXXF
6616               ;
6617               NVMNXT;              ****ENTRY POINT
6618 11BB 23         INX  H             HL = ADRESS = ADRESS+1
6619 11BC 7D         MOV  A,L           IF ADRESS[3] .EQ. HEX0F
6620 11BD E6 0F      ANI  0FH
6621 11BF FE 0F      CPI  0FH
6622 11C1 C0         RNZ
6623 11C2 23         INX  H               HL = ADRESS = ADRESS+1
6624               ;                    ENDIF
6625 11C3 C9         RET                  RETURN
```

NVMOPN

```
6628               ;NVMOPN(ERRFLG)(NVMCTL,SERFLG)
6629               ;      (BIT  )(NIBSTR,BITSTR)
6630               ;      ( 0    )( 0    , I    )
6631               ;      (PSW:Z )( RAM  , RAM  )
6632               ;      ( C    )( C    , C    )
6633               ;
6634               ;A,PSW DESTROYED
6635               ;REGISTERS DESTROYED
6636               ;
6637               ;OPENS NVM BLOCK
6638               ;
6639               NVMOPN;              ****ENTRY POINT
6640 11C4 3A 10 74   LDA  SERFLG/2+X    IF SERFLG.DEAD .EQ. TRUE
6641 11C7 F6 7F      ORI  7FH             PSW:Z = ERRFLG = TRUE
6642 11C9 2F         CMA
6643                                    ELSE
```

```
6644                ;                          PSW:Z = ERRFLG = FALSE
6645                ;                        ENDIF
6646 11CA C8          RZ                     IF ERRFLG .EQ. FALSE
6647                ;                          ERASE NEXT BLOCK
6648 11CB CD B1 10    CALL NVMER               NVMER(ERRFLG)
6649                ;                                (PSW:Z )
6650                ;                                ( 0    )
6651 11CE C8          RZ                       IF ERRFLG .EQ. FALSE
6652 11CF CD 47 10    CALL NVM30T                TURN ON -30V TO NVM
6653                ;                            DEVELOP CONTROL BYTES FOR OPENING
6654                ;                            NEXT BLOCK AND DEACTIVATING
6655                ;                            OLD BLOCK
6656 11D2 CD 9F 11    CALL NVMNBK                NVMNBK(ERRFLG,OLDCTL,NXTCTL,
6657                ;                                  (PSW:Z , B    , C    ,
6658                ;                                  ( 0    , 0    , 0    ,
6659                ;
6660                ;                                  ADRESS,NVMCTL)
6661                ;                                   HL   , @HL  )
6662                ;                                   0    , -    )
6663 11D5 F3          DI                         DISABLE INTERRUPTS
6664                ;                            OPEN NEXT BLOCK
6665 11D6 71          MOV  M,C                   NVMCTL = NXTCTL
6666                ;                            DEACTIVATE OLD BLOCK
6667 11D7 CD A9 10    CALL NVMDXB                NVMDXB(ERRFLG,OLDCTL)
6668                ;                                  (PSW:Z , B    )
6669                ;                                  ( 0    , I    )
6670 11DA FB          EI                         ENABLE INTERRUPTS
6671 11DB CD 31 10    CALL NVM30F                TURN OFF -30V TO NVM
6672                ;                          ENDIF
6673                ;                        ENDIF
6674 11DE C9          RET                    RETURN
```

NVMPRP

```
6677                ;NVMPRP(NIBCNT,OFFSET,RAM[I])(NVMCTL)
6678                ;      (BYTE  ,OFFSET,NIBSTR)(NIBSTR)
6679                ;      ( 0    , 0    , -    )( I    )
6680                ;      ( B    , C    , @C   )( RAM  )
6681                ;      ( C    , C    , NC   )( NC   )
6682                ;
6683                ;A,PSW DESTROYED
6684                ;REGISTERS NOT CHANGED
6685                ;
6686                ;RETURN RAM PARAMETERS CORRESPONDING TO NVM BLOCK TYPE
6687                ;
6688                NVMPRP;                ****ENTRY POINT
6689 11DF 06 22       MVI  B,NORSIZ        B = NIBCNT = NORSIZ
6690 11E1 0E 28       MVI  C,NORSTR        C = OFFSET = NORSTR
6691 11E3 3A 33 74    LDA  NVMCTL/2+X      IF NVMCTL[1] .LT. 2
6692 11E6 E6 0E       ANI  0EH
6693 11E8 C0          RNZ
6694 11E9 06 28       MVI  B,SRVSIZ          B = NIBCNT = SRVSIZ
6695 11EB 0E 00       MVI  C,SRVSTR          C = OFFSET = SRVSTR
6696                ;                      ENDIF
6697 11ED C9          RET                    RETURN
```

NVMRD

```
6700                ;NVMRD()(NVMCTL,RAM[I],NVMRED)
6701                ;       (NIBSTR,NIBSTR,NIBSTR)
6702                ;       ( I    , 0    , I    )
6703                ;       ( RAM  , RAM  , NVM  )
6704                ;       ( NC   , C    , NC   )
6705                ;
6706                ;A,PSW DESTROYED
6707                ;REGISTERS DESTROYED
6708                ;
6709                ;READ NONVOLATILE MEMORY INTO RAM
6710                ;
6711                NVMRD;                 ****ENTRY POINT
```

```
6712                ;                          GET RAM DESTINATION PARAMETERS
6713 11EE CD DF 11   CALL NVMPRP               NVMPRP(NIBCNT,OFFSET,RAM[I])
6714                ;                                ( B    , C    , @C   )
6715                ;                                ( O    , O    , -    )
6716                ;                          DEFINE NVM SOURCE BASE
6717 11F1 3A 33 74   LDA  NVMCTL/2+X           A = NVMCTL
6718 11F4 CD 91 11   CALL NVMMAP               NVMMAP(NMVCTL,BASE,BLKTYP)
6719                ;                                ( A    , HL , A[1] )
6720                ;                                ( I    , O  , O    )
6721                ;                          FORM NVM READ ADDRESS OF SOURCE DATA
6722 11F7 11 02 44   LXI  D,NVMRED+2           HL = ADDRESS, NVMRED[J=BASE+2]
6723 11FA 19         DAD  D
6724                ;                          INITIALIZE CRC VALUE
6725 11FB 16 FF      MVI  D,OFFH               D = CRCVAL = HEXFF
6726               NVMRD1;                     LOOP - WITH 1 BREAK
6727 11FD 05         DCR  B                      B = NIBCNT = NIBCNT-1
6728 11FE FA 0F 12   JM   NVMRD2                 IF NIBCNT .LT. 0
6729                ;                              BREAK
6730                ;                            ENDIF
6731                ;                            COPY NVM TO RAM
6732 1201 7E         MOV  A,M                    A = NVMRED[J]
6733 1202 CD EE 0F   CALL PUTNIB                 PUTNIB(RAM[I],NVMRED[J])
6734                ;                                  ( @C   , A        )
6735                ;                                  ( O    , I        )
6736                ;                            UPDATE CRC
6737 1205 CD C6 0E   CALL CRCNIB                 CRCNIB(NVMRED[J],CRCVAL)
6738                ;                                  ( A        , D    )
6739                ;                                  ( I        , I/O  )
6740 1208 0C         INR  C                      C = OFFSET, RAM[I=I+1]
6741                ;                            CALCULATE NEXT NVM SOURCE ADDRESS
6742 1209 CD BB 11   CALL NVMNXT                 NVMNXT(ADRESS,NVMRED[J=J+2])
6743                ;                                  ( HL   , @HL          )
6744                ;                                  ( I/O  , -            )
6745 120C C3 FD 11   JMP  NVMRD1
6746               NVMRD2;                     ENDDO
6747                ;                          CHECK CRC VALUES
6748 120F CD 58 10   CALL NVMBYT               NVMBYT(ADRESS,NVMRED[J],NVMCRC)
6749                ;                                ( HL   , @HL     , A    )
6750                ;                                ( I/O  , I       , O    )
6751 1212 BA         CMP  D                    IF NVMCRC .NE. CRCVAL
6752 1213 C8         RZ
6753                ;                            DECLARE DEAD METER. BAD CRC
6754 1214 3E 00      MVI  A,BADCRC               A = BADCRC
6755 1216 C3 85 10   JMP  NVMDED                 NVMDED(BADCRC,ERRFLG)
6756                ;                                  ( A    ,PSW:Z )
6757                ;                                  ( I    , O    )
6758                ;                          ENDIF
6759                ;                          RETURN
```

NVMSTO

```
6762               ;NVMSTO(ERRFLG)(MRSTS1,MRSTS2,NVMCTL)
6763               ;      ( BIT  )(BITSTR,BITSTR,NIBSTR)
6764               ;      (  O   )( I/O  , I/O  , O    )
6765               ;      (PSW:Z )( RAM  , RAM  , RAM  )
6766               ;      (  C   )( C    , C    , C    )
6767               ;
6768               ;A,PSW DESTROYED
6769               ;REGISTERS DESTROYED
6770               ;
6771               ;STARTING WITH NO NVM BLOCKS OPEN:
6772               ;WRITE NEW ACTIVE NVM BLOCK NOT CORRESPONDING TO CURRENT
6773               ;METER MODE.
6774               ;OPEN AN ERASED BLOCK CORRESPONDING TO CURRENT METER MODE.
6775               ;
6776               NVMSTO;                     ****ENTRY POINT
6777 1219 CD 4E 0F   CALL LSTATE               LSTATE(FATMOD,NORMOD,SERMOD,PRVMOD)
6778                ;                                (PSW:S ,PSW:Z ,PSW:P ,PSW:C )
6779                ;                                ( O    , O    , O    , O    )
6780 121C F2 21 12   JP   NVMST1                IF FATMOD .EQ. TRUE
```

```
6781 121F AF          XRA  A                ERRFLG = PSW:Z = TRUE
6782 1220 C9          RET
6783                NVMST1;               ELSE
6784                ;                       ERASE BLOCK FOR UNTOGGLED NORMOD
6785 1221 CD B1 10    CALL NVMER            NVMER(ERRFLG)
6786                ;                            (PSW:Z )
6787                ;                            ( 0    )
6788                ;                       IF ERRFLG .EQ. TRUE
6789 1224 CA B6 01    JZ   PWRDN              REINITIALIZE METER
6790                ;                       ELSE
6791                ;                         SET TO TOGGLE NORMOD INDIRECTLY BY
6792                ;                         TOGGLING THE SERVICE OR PRIVILEGED
6793                ;                         MODE FLAGS
6794 1227 21 24 74    LXI  H,MRSTS1/2+X       HL=ADDRESS,MRSTS?=ADDRESS,MRSTS1
6795 122A 1E 08       MVI  E,08H              E.M = E.SERMOD = TRUE
6796 122C EA 32 12    JPE  NVMST2             IF LSTATE(SERMOD) .EQ. FALSE
6797 122F 23          INX  H                    HL=ADDRESS,MRSTS?=ADDRESS,MRSTS2
6798 1230 1E 01       MVI  E,01H                E.M = E.PRVMOD = TRUE
6799                NVMST2;                 ENDIF
6800                ;                       TOGGLE NORMOD
6801 1232 7B          MOV  A,E                MRSTS?.M = MRSTS?.M .XOR. E.M
6802 1233 AE          XRA  M
6803 1234 77          MOV  M,A
6804 1235 E5          PUSH H                  SAVE HL
6805 1236 D5          PUSH D                  SAVE DE
6806                ;                       ERASE BLOCK FOR TOGGLED NORMOD
6807 1237 CD B1 10    CALL NVMER              NVMER(ERRFLG)
6808                ;                            (PSW:Z )
6809                ;                            ( 0    )
6810                ;                       IF ERRFLG .EQ. TRUE
6811 123A CA B6 01    JZ   PWRDN              REINITIALIZE METER
6812                ;                       ELSE
6813 123D F3          DI                        DISABLE INTERRUPTS
6814                ;                         SET TO STORE BLK FOR TOG NORMOD
6815 123E CD 9F 11    CALL NVMNBK               NVMNBK(ERRFLG,OLD,NXT,ADR,NVMCTL)
6816                ;                                (PSW:Z , B , C , HL, @HL  )
6817                ;                                ( 0    , 0 , 0 , 0 , -    )
6818                ;                         IF ERRFLG .EQ. TRUE
```

NVMSTO

```
6819 1241 CA B6 01    JZ   PWRDN                REINITIALIZE METER
6820                ;                       ELSE
6821 1244 CD 47 10    CALL NVM30T               TURN ON -30 V TO NVM
6822 1247 E5          PUSH H                    SAVE HL
6823                ;                         DEACTIVATE BLK FOR TOG NORMOD
6824 1248 CD A9 10    CALL NVMDXB               NVMDXB(ERRFLG,OLD)
6825                ;                                (PSW:Z , B )
6826                ;                                ( 0    , I )
6827                ;                         OPEN BLK FOR TOG NORMOD
6828 124B E1          POP  H                    RESTORE HL
6829 124C 71          MOV  M,C                  NVMCTL = NXT
6830                ;                         STORE BLK FOR TOGLED NORMOD
6831 124D CD 9E 12    CALL NVMWR                NVMWR(ERRFLG)
6832                ;                                (PSW:Z )
6833                ;                                ( 0    )
6834                ;                         RETURN TO UNTOGGLED NORMOD
6835 1250 D1          POP  D                    RESTORE DE
6836 1251 E1          POP  H                    RESTORE HL
6837 1252 7B          MOV  A,E                  MRSTS?.M =
6838 1253 AE          XRA  M                          MRSTS?.M .XOR. E.M
6839 1254 77          MOV  M,A
6840                ;                         GET CONTROL BYTES
6841 1255 CD 9F 11    CALL NVMNBK               NVMNBK(ERRFLG,OLD,NXT,
6842                ;                                (PSW:Z , B , C ,
6843                ;                                ( 0    , 0 , 0 ,
6844                ;
6845                ;                                ADDRESS,NVMCTL)
6846                ;                                 HL   , @HL  )
6847                ;                                 0    , -    )
```

```
6848                ;                                OPEN ERASED BLOCK
6849 1258 71          MOV  M,C                       NVMCTL = NXT
6850 1259 CD 47 10    CALL NVM30T                    TURN ON -30 V TO NVM
6851                ;                                DEACTIVATE OLD BLOCK
6852 125C CD A9 10    CALL NVMDXB                    NVMDXB(ERRFLG,OLD)
6853                ;                                      (PSW:Z , B )
6854                ;                                      ( 0    , I )
6855 125F FB          EI                             ENABLE INTERRUPTS
6856 1260 C9          RET
6857                ;                            ENDIF
6858                ;                          ENDIF
6859                ;                        ENDIF
6860                ;                      ENDIF
6861                ;                      RETURN

NVMWN

6864                ;NVMWN(DATA  ,BASE  ,ERRFLG)(NVMRED,NVMWRT)
6865                ;     (NIBBLE,ADDRESS,BIT   )(NIBSTR,NIBSTR)
6866                ;     ( I    , I    , O    )( I    , O    )
6867                ;     ( A[1] , HL   ,PSW:Z )( NVM  , NVM  )
6868                ;     ( C    , NC   , C    )( NC   , C    )
6869                ;
6870                ;A,PSW DESTROYED
6871                ;REGISTERS NOT CHANGED
6872                ;
6873                ;WRITE NIBBLE TO NONVOLATILE MEMORY
6874                ;
6875                NVMWN;                  ****ENTRY POINT
6876 1261 C5          PUSH B                SAVE REGISTERS
6877 1262 D5          PUSH D
6878 1263 E5          PUSH H
6879 1264 E5          PUSH H
6880 1265 01 00 48    LXI  B,NVMWRT         DE = ADDRESS, NVMWRT[BASE]
6881 1268 09          DAD  B
6882 1269 EB          XCHG
6883 126A E1          POP  H                HL = ADDRESS, NVMRED[BASE]
6884 126B 01 00 44    LXI  B,NVMRED
6885 126E 09          DAD  B
6886 126F F5          PUSH PSW              SAVE A,PSW
6887                ;                       START WRITING DATA
6888 1270 12          STAX D                NVMWRT[BASE] = DATA
6889                ;                       DELAY FOR 1 MSEC
6890 1271 01 0A 00    LXI  B,10             BC = LOOPCT = 10
6891                NVMWN1;                 DO UNTIL LOOPCT .EQ. 0
6892 1274 CD 19 0B    CALL NPAUSE             NPAUSE(LOOPCT,ZROFLG)
6893                ;                               ( BC   ,PSW:Z )
6894                ;                               ( I/O  , O    )
6895 1277 C2 74 12    JNZ NVMWN1
6896                ;                       ENDDO
6897                ;                       STOP WRITE FUNCTION
6898 127A 7E          MOV  A,M              A = GARBAGE = NVMRED[BASE]
6899 127B C1          POP  B                B = DATA
6900                ;                       C = GARBAGE
6901 127C 7E          MOV  A,M              A = SAVDAT = NVMRED[BASE]
6902 127D 90          SUB  B                A = TEST = (SAVDAT-DATA) .AND. HEXOF
6903 127E E6 0F       ANI  0FH
6904 1280 C2 87 12    JNZ  NVMWN2           IF TEST .EQ. 0
6905                ;                         SAVDAT .EQ. DATA
6906 1283 3C          INR  A                    PSW:Z = ERRFLG = FALSE
6907 1284 C3 9A 12    JMP NVMWN4
6908                NVMWN2;                 ELSE
6909                ;                         SAVDAT .NE. DATA
6910 1287 01 9A 12    LXI  B,NVMWN3             SET TO RETURN TO ENDIF
6911 128A C5          PUSH B
6912 128B 01 42 B9    LXI  B,-(NVMRED+KILCOD)
6913                ;                         BC = -(ADDRESS, NVMRED[KILCOD])
6914 128E 09          DAD  B                    HL = BASE-KILCOD
6915 128F 7C          MOV  A,H                  PSW:Z = (BASE-KILCOD).EQ.0
6916 1290 B5          ORA  L
```

```
6917 1291 3E 01      MVI  A,NVMBAD        A = NVMBAD
6918 1293 47         MOV  B,A             B = NVMBAD
6919               ;                      IF (BASE-KILCOD).EQ.0
6920               ;                        DECLARE DEAD METER. BAD NVM
6921               ;                        DO NOT WRITE NVMBAD INTO NVM
6922 1294 CA 99 10   JZ   NVMDE1            NVMDE1(NVMBAD,ERRFLG)
6923               ;                              ( B    ,PSW:Z )
6924               ;                              ( I    , 0    )
6925               ;                      ELSE
6926               ;                        DECLARE DEAD METER. BAD NVM
6927               ;                        WRITE NVMBAD INTO NVM
6928 1297 C2 85 10   JNZ  NVMDED            NVMDED(NVMBAD,ERRFLG)
6929               ;                              ( A    ,PSW:Z )
6930               ;                              ( I    , 0    )
6931               NVMWN3;                  ENDIF
6932               NVMWN4;                ENDIF
6933 129A E1         POP  H               RESTORE REGISTERS
6934 129B D1         POP  D
6935 129C C1         POP  B
6936 129D C9         RET

NVMWR

6939               ;NVMWR(ERRFLG)(NVMCTL,RAM[I],SERFLG)
6940               ;     (BIT   )(NIBSTR,NIBSTR,BITSTR)
6941               ;     ( 0    )( I/O  , I    , I    )
6942               ;     (PSW:Z )( RAM  , RAM  , RAM  )
6943               ;     ( C    )( C    , NC   , NC   )
6944               ;
6945               ;A,PSW DESTROYED
6946               ;REGISTERS DESTROYED
6947               ;
6948               ;WRITE BLOCK FROM RAM TO NONVOLATILE MEMORY
6949               ;
6950               NVMWR;                 ****ENTRY POINT
6951               ;                      FETCH RAM SOURCE PARAMETERS
6952 129E CD DF 11   CALL NVMPRP          NVMPRP(NIBCNT,OFFSET,RAM[I])
6953               ;                              ( B    , C    , @C   )
6954               ;                              ( 0    , 0    , -    )
6955 12A1 79         MOV  A,C             C = NIBCNT
6956 12A2 48         MOV  C,B
6957 12A3 47         MOV  B,A             B = OFFSET, RAM[I]
6958               ;                      INITIALIZE CRC VALUE
6959 12A4 16 FF      MVI  D,0FFH          D = CRCVAL = HEXFF
6960 12A6 3A 33 74   LDA NVMCTL/2+X       A = NVMCTL
6961 12A9 FE 20      CPI  20H             IF NVMCTL[0] .LT. 2
6962 12AB D2 E6 12   JNC  NVMWR3
6963 12AE CD 47 10   CALL NVM30T            TURN ON -30 V TO NVM
6964               ;                        FETCH NVM DESTINATION BASE
6965 12B1 CD 91 11   CALL NVMMAP            NVMMAP(NVMCTL,BASE,BLKTYP)
6966               ;                              ( A    , HL , A[1] )
6967               ;                              ( I    , 0  , 0    )
6968               ;                        STORE BLOCK TYPE IN NVM HEADER
6969 12B4 23         INX  H               HL = BASE +1
6970 12B5 CD 61 12   CALL NVMWN             NVMWN(BLKTYP,BASE+1,ERRFLG)
6971               ;                              ( A[1] , HL   ,PSW:Z )
6972               ;                              ( I    , I    , 0    )
6973               ;                        POINT AT START OF DATA IN NVM
6974 12B8 23         INX  H               HL = BASE+2
6975               NVMWR1;                LOOP - WITH 1 BREAK
6976 12B9 0D         DCR  C                 C = NIBCNT = NIBCNT-1
6977 12BA FA CD 12   JM   NVMWR2            IF NIBCNT .LT. 0
6978               ;                          BREAK
6979               ;                        ENDIF
6980               ;                        FETCH DATA FROM RAM
6981 12BD CD 35 0F   CALL GETNIB            GETNIB(DATA ,ZROFLG,RAM[I])
6982               ;                              ( A[1],PSW:Z , @B   )
6983               ;                              ( 0   , 0    , I    )
6984               ;                        UPDATE CRC VALUE
6985 12C0 CD C6 0E   CALL CRCNIB            CRCNIB(DATA ,CRCVAL)
```

```
6986                ;                                  ( A[1], D    )
6987                ;                                  ( I   , 0    )
6988                ;                          WRITE DATA TO NVM
6989 12C3 CD 61 12    CALL NVMWN               NVMWN(DATA ,BASE+?,ERRFLG)
6990                ;                                ( A[1], HL   ,PSW:Z )
6991                ;                                ( I   , I    , 0    )
6992                ;                          POINT AT NEXT DATA LOCATIONS
6993 12C6 04          INR  B                   B = OFFSET, RAM[I=I+1]
6994 12C7 CD BB 11    CALL NVMNXT              NVMNXT(ADRESS,BASE+?)
6995                ;                                  ( HL   , @HL  )
6996                ;                                  ( I/O  , -    )
6997 12CA C3 B9 12    JMP NVMWR1
6998                NVMWR2;                  ENDDO
6999                ;                        STORE CRC IN NVM
7000 12CD 7A          MOV  A,D                 A[1] = CRCVAL[0]
7001 12CE 0F          RRC
7002 12CF 0F          RRC
7003 12D0 0F          RRC
7004 12D1 0F          RRC
7005 12D2 CD 61 12    CALL NVMWN               NVMWN(CRCVAL[0],BASE+?,ERRFLG)
7006                ;                                ( A[1]    , HL   ,PSW:Z )
7007                ;                                ( I       , I    , 0    )
7008 12D5 CD BB 11    CALL NVMNXT              NVMNXT(ADRESS,BASE+?)
7009                ;                                ( HL   , @HL  )
7010                ;                                ( I/O  , -    )
7011 12D8 7A          MOV  A,D                 A[1] = CRCVAL[1]
7012 12D9 CD 61 12    CALL NVMWN               NVMWN(CRCVAL[1],BASE+?,ERRFLG)
7013                ;                                ( A[1]    , HL   ,PSW:Z )
7014                ;                                ( I       , I    , 0    )
7015                ;                          INDICATE BLOCK NOT OPEN
7016 12DC 21 33 74    LXI  H,NVMCTL/2+X        HL = ADDRESS, NVMCTL
7017 12DF 3E F0       MVI  A,0F0H              NVMCTL[0] = HEX0F
7018 12E1 B6          ORA  M
7019 12E2 77          MOV  M,A
7020 12E3 CD 31 10    CALL NVM30F              TURN OFF -30V TO NVM
7021                NVMWR3;                  ENDIF
7022 12E6 3A 10 74    LDA  SERFLG/2+X          IF SERFLG.DEAD .EQ. TRUE
7023 12E9 E6 80       ANI  80H                   PSW:Z = ERRFLG = TRUE
7024 12EB EE 80       XRI  80H
7025                ;                        ELSE
7026                ;                          PSW:Z = ERRFLG = FALSE
7027                ;                        ENDIF
7028 12ED C9          RET                      RETURN
```

ACCODE

```
7031                ;ACCODE(ERRFLG)(WORK1 ,DSCREG,RSTCNT,SERFLG)
7032                ;      (BIT   )(NIBCTR,NIBSTR,NIBBLE,BITSTR)
7033                ;      ( 0    )( 0    , I    , I    , I    )
7034                ;      (PSW:Z )( RAM  , RAM  , RAM  , RAM  )
7035                ;      ( C    )( C    , NC   , NC   , NC   )
7036                ;
7037                ;A,PSW DESTROYED
7038                ;REGISTERS DESTROYED
7039                ;
7040                ;BUILD ACCESS CODE MESSAGE IN TRANSMIT BUFFER
7041                ;
7042                ACCODE;                  ****ENTRY POINT
7043                ;                        CLEAR WORK AREA
7044 12EE 3E C0       MVI  A,WORK1             A = OFFSET, WORK1
7045 12F0 CD 85 0E    CALL CLRBLK              CLRBLK(WORK1)
7046                ;                                  ( @A  )
7047                ;                                  ( 0   )
7048                ;                          PUT 10 DGT CONTROL SUM IN WORK1[0..9]
7049 12F3 CD 3A 06    CALL CONSUM              CONSUM(ERRFLG)
7050                ;                                  (PSW:Z )
7051                ;                                  ( 0    )
7052                ;                          IF ERRFLG .EQ. TRUE
7053                ;                            PROCESS ERROR
7054 12F6 CA A1 0B    JZ   PROERR                PROERR(ERRFLG)
```

```
7055                ;                                (PSW:Z )
7056                ;                                ( 0    )
7057                ;                          ELSE
7058                ;                            MOVE CONTROL SUM TO WORK1[6..15]
7059 12FD 01 C6 C0    LXI  B,(WORK1+0)*100H+(WORK1+6)
7060                ;                            B = OFFSET, WORK1[0]
7061                ;                            C = OFFSET, WORK1[6]
7062 12FC 3E 0A       MVI  A,10                  A = NIBCNT = 10
7063 12FE CD B3 0F    CALL MVLNIB                MVLNIB(WORK1[6],WORK1[0],NIBCNT,
7064                ;                                ( @C     , @B     , A    ,
7065                ;                                ( 0      , I      , I    ,
7066                ;
7067                ;                                NONBCD,ZROFLG)
7068                ;                                PSW:S ,PSW:Z )
7069                ;                                 0    , 0    )
7070                ;                            PUT DESC REGISTER IN WORK1[0..4]
7071 1301 01 C0 C7    LXI  B,DSCREG*100H+WORK1
7072                ;                            B = OFFSET, DSCREG[0]
7073                ;                            C = OFFSET, WORK1[0]
7074 1304 3E 05       MVI  A,5                   A = NIBCNT = 5
7075 1306 CD B3 0F    CALL MVLNIB                MVLNIB(WORK1[0],DSCREG[0],NIBCNT,
7076                ;                                ( @C     , @B     , A    ,
7077                ;                                ( 0      , I      , I    ,
7078                ;
7079                ;                                NONBCD,ZROFLG)
7080                ;                                PSW:S ,PSW:Z )
7081                ;                                 0    , 0    )
7082                ;                            PARSE RSTCNT INTO RESET NUMBER AND
7083                ;                            RESET BIT
7084 1309 01 C5 12    LXI  B,RSTCNT*100H+(WORK1+5)
7085                ;                            B = OFFSET, RSTCNT
7086                ;                            C = OFFSET, WORK1[5]
7087 130C CD 35 0F    CALL GETNIB                GETNIB(RSTCNT,ZROFLG,RSTCNT)
7088                ;                                ( A    ,PSW:Z , @B   )
7089                ;                                ( 0    , 0    , I    )
7090 130F 0F          RRC
7091 1310 57          MOV  D,A                   D[1] = RSTCNT/2
7092                ;                            D[0].0 = RSTBIT = RSTCNT .MOD. 2
7093 1311 07          RLC                        A = RSTBIT
7094 1312 E6 01       ANI 01H
7095                ;                            PUT RSTBIT INTO WORK1[5]
7096 1314 CD EE 0F    CALL PUTNIB                PUTNIB(WORK1[5],RSTBIT)
7097                ;                                ( @C     , A    )
7098                ;                                ( 0      , I    )
7099                ;                            EXTRACT RESET NUMBER FROM RIGHTMOST
7100                ;                            DIGIT OF WORK1[0..4] WHICH WILL NOT
7101                ;                            BE TRANSFORMED INTO A NON BCD DIGIT.
7102 1317 0D          DCR  C                     C = OFFSET, WORK1[I=4]
7103 1318 41          MOV  B,C                   B = OFFSET, WORK1[I=4]
7104 1319 1E 05       MVI  E,5                   E = NIBCNT = 5
7105               ACCOD1;                       DO UNTIL NIBCNT .EQ. 0; WITH 1 BREAK
7106 131B CD 35 0F    CALL GETNIB                  GETNIB(BCDDGT,ZROFLG,WORK1[I])
7107                ;                                  ( A    ,PSW:Z , @B     )
7108                ;                                  ( 0    , 0    , I     )
7109 131E FE 08       CPI  8                       IF BCDDGT .LT. 8
7110 1320 D2 3A 13    JNC  ACCOD2
7111 1323 AA          XRA  D                         BCDDGT = BCDDGT .XOR. RSTNO
7112 1324 CD EE 0F    CALL PUTNIB                    PUTNIB(WORK1[I],BCDDGT)
7113                ;                                    ( @C     , A    )
7114                ;                                    ( 0      , I    )
7115 1327 C3 30 13    JMP  ACCOD3                    BREAK
7116               ACCOD2;                       ENDIF
7117 132A 05          DCR  B                     B = OFFSET, WORK1[I=I-1]
7118 132B 0D          DCR  C                     C = OFFSET, WORK1[I=I-1]
7119 132C 1D          DCR  E                     E = NIBCNT = NIBCNT-1
7120 132D C2 1B 13    JNZ  ACCOD1
7121               ACCOD3;                       ENDDO
7122                ;                            CALCULATE SRC OF WORK AREA
7123 1330 01 C0 10    LXI  B,16*100H+WORK1
```

```
7124                ;                          B = NIBCNT = 16
7125                ;                          C = OFFSET, WORK1[0]
7126 1332 CD B1 0E   CALL CRC                  CRC(WORK1[0],NIBCNT,CRCVAL)
7127                ;                             ( @C     , B    , D    )
7128                ;                             ( I      , I    , O    )
7129 1336 3A 10 74   LDA  SERFLG/2+X           PSW:Z=NVMOK=SERFLG.WEKWOM .EQ. FALSE
7130 1339 E6 20      ANI  20H
7131 133B 7A         MOV  A,D                  A = CRCVAL
7132 133C CA 40 13   JZ   ACCOD4               IF NVMOK .EQ. FALSE
7133 133F 2F         CMA                         A = CRCVAL = .NOT. CRCVAL
7134                ACCOD4;                    ENDIF
7135                ;                          COMPLETE ACCESS CODE IN WORK[0..7]
7136                ;                          AS FOLLOWS:
7137                ;                          WORK1[4].0..3 = WORK1[4].0..3
7138                ;                          WORK1[5].1..2 = WORK1[5].1..2 .OR.
7139                ;                                          CRCVAL.0..1
7140                ;                          WORK1[6].0 = 0
7141                ;                          WORK1[6].1..3 = CRCVAL.2..4
7142                ;                          WORK1[7].0 = 0
7143                ;                          WORK1[7].1..3 = CRCVAL.5..7
7144 1340 57         MOV  D,A                  D = CRCVAL
7145 1341 E6 F8      ANI  0F8H                 D = FCRC2
7146 1343 82         ADD  D
7147 1344 57         MOV  D,A
7148 1345 17         RAL                       A = FCRC1
7149 1346 17         RAL
7150 1347 17         RAL
7151 1348 E6 06      ANI  6
7152 134A 21 62 74   LXI  H,(WORK1+4)/2+X HL = ADDRESS, WORK1[4..5]
7153 134D B6         ORA  M                    WORK1[4..5] = WORK1[4..5] .OR. FCRC1
7154 134E 77         MOV  M,A
7155 134F 7A         MOV  A,D                  A = FCRC3 = FCRC2 .AND. HEX77
7156 1350 E6 77      ANI  77H
7157 1352 23         INX  H                    HL = ADDRESS, WORK1[6..7]
7158 1353 77         MOV  M,A                  WORK1[6..7] = FCRC3
7159                ;                          BUILD ACCESS CODE MSG IN XMIT BUFFER
7160 1354 11 5A 13   LXI  D,ACCOD5             DE = ADDRESS, ACCOD5
7161 1357 C3 5F 0D   JMP  VALREQ               VALREQ(WORK1 ,ACCFMT,HACODE,ERRFLG)
7162                ;                                (@@DE+0,@DE+1 ,@DE+2 ,PSW:Z )
7163                ;                                ( I    , I    , I    , O    )
7164                ;                          ENDIF
7165                ;                          RETURN
7166                ACCOD5;                    ARGUEMENTS FOR VALREQ
7167 135A C0 8F 90   DB   WORK1,ACCFMT,HACODE
```

(INOCT

```
7170                ;BINOCT(BINARY,OCTAL ,DIGCNT)
7171                ;      (BITSTR,NIBSTR,BYTE  )
7172                ;      ( I    , O    , I    )
7173                ;      ( @H   , @D   , B    )
7174                ;      ( NC   , C    , C    )
7175                ;
7176                ;A,PSW DESTROYED
7177                ;REGISTERS DESTROYED
7178                ;
7179                ;INSERT BITS FROM BIT STRING 3 AT A TIME INTO A PREVIOUSLY
7180                ;CLEARED NIBBLE STRING.
7181                ;DIGCNT ASSUMED .NE. 0.
7182                ;
7183                BINOCT;                    ****ENTRY POINT
7184 135D 78         MOV  A,B                  E = DBIT = DIGCNT*4-1
7185 135E 07         RLC
7186 135F 07         RLC
7187 1360 3D         DCR  A
7188 1361 5F         MOV  E,A
7189 1362 90         SUB  B                    L = SBIT = DBIT-DIGCNT
7190 1363 6F         MOV  L,A
7191                BINOC1;                    DO UNTIL DBIT .LT. 0
7192                ;                            SET TO MOVE 3 BITS INTO OCTAL NIBBLE
```

```
7193 1364 0E 07      MVI  C,3              C = BITCNT = 3
7194               BINOC2;                 DO UNTIL BITCNT .EQ. 0
7195               ;                         MOVE 3 L/O BITS INTO NIBBLE
7196 1366 CD 68 0F   CALL MOVBIT             MOVBIT(BINARY,SBIT,DSTAL,DBIT,ZRO)
7197               ;                                ( @H   , L  , @D  , E  ,P:Z)
7198               ;                                ( I    , I  , O   , I  , O )
7199 1369 2D         DCR  L                  L = SBIT = SBIT-1
7200 136A 1D         DCR  E                  E = DBIT = DBIT-1
7201 136B 0D         DCR  C                  C = BITCNT = BITCNT-1
7202 136C C2 66 13   JNZ  BINOC2
7203               ;                       ENDDO
7204               ;                       SKIP OVER H/O BIT IN NIBBLE
7205 136F 1D         DCR  E                  E = DBIT = DBIT-1
7206 1370 F2 64 13   JP   BINOC1
7207               ;                     ENDDO
7208 1373 C9         RET                   RETURN

VRCDR

7211               ;VRCDR(ERRFLG)(DSCREG,DSCCRC)
7212               ;     (BIT   )(NIBSTR,BYTE  )
7213               ;   ( O    )( O    , O    )
7214               ;     (PSW:Z )( RAM  , RAM  )
7215               ;     ( C    )( C    , C    )
7216               ;
7217               ;A,PSW DESTROYED
7218               ;REGISTERS DESTROYED
7219               ;
7220               ;CLEAR VARIABLE RMRS DESCENDING REGISTER
7221               ;
7222               VRCDR;                ****ENTRY POINT
7223               ;                     PERFORM RULE CHECKING AND REFORMATTING
7224 1374 CD 03 14   CALL VRPREP         VRPREP(ERRFLG)
7225               ;                           (PSW:Z )
7226               ;                           ( O    )
7227 1377 C8         RZ                  IF ERRFLG .EQ. FALSE
7228               ;                       CLEAR DESCENDING REGISTER
7229 1378 AF         XRA  A                A = NIBVAL = 0
7230 1379 06 07      MVI  B,DSCSIZ         B = DSCSIZ
7231 137B 0E 2F      MVI  C,DSCREG         C = OFFSET, DSCREG
7232 137D CD 24 0F   CALL FILNIB           FILNIB(DSCREG,NIBVAL,DSCSIZ)
7233               ;                             ( @C   , A    , B    )
7234               ;                             ( O    , I    , I    )
7235               ;                       UPDATE DESCENDING REGISTER CRC
7236 1380 CD 81 0E   CALL CRC              CRC(DSCREG,DSCSIZ,CRCVAL)
7237               ;                          ( @C   , B    , D    )
7238               ;                          ( I    , I    , O    )
7239 1383 7A         MOV  A,D              DSCCRC = CRCVAL
7240 1384 32 1D 74   STA  DSCCRC/2+X
7241               ;                       CHECK METER STATUS
7242 1387 CD 4E 0F   CALL LSTATE           LSTATE(FATMOD,NORMOD,SERMOD,PRVMOD)
7243               ;                             (PSW:S ,PSW:Z ,PSW:P ,PSW:C )
7244               ;                             ( O    , O    , O    , O    )
7245               ;                       IF FATMOD .EQ. FALSE
7246               ;                         EXECUTE RESET
7247 138A F2 03 14   JP   VRXEQ              VRXEQ(ERRFLG)
7248               ;                             (PSW:Z )
7249               ;                             ( O    )
7250               ;                       ELSE
7251               ;                         DECLARE DEAD METER. FATAL RESET
7252 138D 3E 07      MVI  A,FATRST           A = FATRST
7253 138F C3 95 10   JMP  NVMDED             NVMDED(FATRST,ERRFLG)
7254               ;                                ( A    ,PSW:Z )
7255               ;                                ( I    , O    )
7256               ;                       ENDIF
7257               ;                     ENDIF
7258               ;                     RETURN
```

VRCLR

```
                    ;VRCLR(ERRFLG)(AMTBUF)
                    ;     (BIT   )(NIBSTR)
                    ;     ( 0    )( I    )
                    ;     (PSW:Z )( RAM  )
                    ;     ( C    )( NC   )
                    ;
                    ;A,PSW DESTROYED
                    ;REGISTERS DESTROYED
                    ;
                    ;SELECT VARIABLE RMRS CLEAR REGISTER FUNCTION
                    ;
                    VRCLR;                 ****ENTRY POINT
                    ;                      SELECT FUNCTION VIA AMOUNT FORMAT
1392 21 70 74         LXI  H,AMTBUF/2+X    HL = ADDRESS, AMTBUF[0..1]
1395 7E               MOV  A,M             A = AMTBUF[0..1]
                    ;                      CASE (AMTBUF[0..1])
1396 FE 1F            CPI  1FH               **1F: CLEAR RESET ERROR COUNTER
1398 CA A2 13         JZ   VRCREC                  VRCREC(ERRFLG,ADRESS,AMTBUF)
                    ;                                (PSW:Z , HL   , @HL  )
                    ;                                ( 0    , I    , -    )
139B FE 22            CPI  22H               **22: CLEAR DESCENDING REGISTER
139D CA 74 13         JZ   VRCDR                   VRCDR(ERRFLG)
                    ;                                (PSW:Z )
                    ;                                ( 0    )
                    ;                        **ELSE:
                    ;                              PROCESS ERROR
13A0 C3 A1 0B         JMP  PROERR                  PROERR(ERRFLG)
                    ;                                (PSW:Z )
                    ;                                ( 0    )
                    ;                      ENDCASE
                    ;                      RETURN
```

VRCREC

```
                    ;VRCREC(ERRFLG,ADRESS,AMTBUF)(AMTBUF)
                    ;     (BIT   ,ADRESS,NIBSTR)(NIBSTR)
                    ;     ( 0    , I    , -    )( 0    )
                    ;     (PSW:Z , HL   , @HL  )( RAM  )
                    ;     ( C    , C    , -    )( C    )
                    ;
                    ;A,PSW DESTROYED
                    ;REGISTERS DESTROYED
                    ;
                    ;CLEAR VARIABLE RMRS RESET ERROR COUNTER
                    ;
                    VRCREC;                ****ENTRY POINT
                    ;                      CHECK AMOUNT BUFFER
13A3 23               INX  H               HL = ADDRESS, AMTBUF[2..3]
13A4 7E               MOV  A,M             IF AMTBUF[2..3] .EQ. HEX00
13A5 B7               ORA  A
                    ;                        DON'T CLEAR DES REG BY MISTAKE
13A6 CA A1 0B         JZ   PROERR              PROERR(ERRFLG)
                    ;                                (PSW:Z )
                    ;                                ( 0    )
                    ;                      ELSE
                    ;                        CHECK METER STATUS
13A9 CD 4D 0F         CALL LSTATE              LSTATE(FATMOD,NORMOD,SERMOD,PRVMOD)
                    ;                                (PSW:S ,PSW:Z ,PSW:P ,PSW:C )
                    ;                                ( 0    , 0    , 0    , 0    )
                    ;                        IF FATMOD .EQ. TRUE
                    ;                          PROCESS ERROR
13AC FA A1 0B         JM   PROERR              PROERR(ERRFLG)
                    ;                                (PSW:Z )
                    ;                                ( 0    )
                    ;                        ELSE
                    ;                          ALTER AMOUNT FORMAT
13AF 3A 35 74         LDA  DIEDCM/2+X          A = DIEDCM
13B2 0E 01            MVI  C,AMTBUF+1          C = OFFSET, AMTBUF[1]
```

```
7328 13B4 CD EE 0F   CALL PUTNIB            PUTNIB(AMTBUF[1],DIEDCM)
7329                ;                             ( @C      , A    )
7330                ;                             ( 0       , I    )
7331                ;                          PERFORM RULE CHECK AND REFORMATTING
7332 13B7 CD 03 14   CALL VRPRE1            VRPRE1(ERRFLG)
7333                ;                             (PSW:Z )
7334                ;                             ( 0    )
7335                ;                          IF ERRFLG .EQ. FALSE
7336                ;                            EXECUTE RESET
7337 13BA C2 03 14   JNZ  VRXEQ                VRXEQ(ERRFLG)
7338                ;                              (PSW:Z )
7339                ;                              ( 0    )
7340                ;                          ENDIF
7341                ;                        ENDIF
7342                ;                      ENDIF
7343 13BD C9         RET                   RETURN

RMRS

7346                ;VRMRS(ERRFLG)(CMBBUF)
7347                ;     (BIT   )(NIBSTR)
7348                ;     ( 0    )( I    )
7349                ;     (PSW:Z )( RAM  )
7350                ;     ( C    )( NC   )
7351                ;
7352                ;A,PSW DESTROYED
7353                ;REGISTERS DESTROYED
7354                ;
7355                ;SELECT VARIABLE RMRS FUNCTION
7356                ;
7357                VRMRS;                 ****ENTRY POINT
7358                ;                      SELECT FUNCTION VIA COMBINATION FORMAT
7359 13BE 3A 78 74   LDA  CMBBUF/2+X       A = CMBBUF[0..1]
7360                ;                      CASE (CMBBUF[0..1])
7361 13C1 FE 4F      CPI  4FH                ***4F: CLEAR REGISTERS
7362 13C3 CA 92 13   JZ   VRCLR                     VRCLR(ERRFLG)
7363                ;                                  (PSW:Z )
7364                ;                                  ( 0    )
7365 13C6 FE 6F      CPI  6FH                ***6F: RESET POSTAGE
7366 13C8 CA CE 13   JZ   VRSET                     VRSET(ERRFLG)
7367                ;                                  (PSW:Z )
7368                ;                                  ( 0    )
7369                ;                          ***ELSE:
7370                ;                                PROCESS ERROR
7371 13CB C3 A1 0D   JMP  PROERR                      PROERR(ERRFLG)
7372                ;                                     (PSW:Z )
7373                ;                                     ( 0    )
7374                ;                      ENDCASE
7375                ;                      RETURN

VRSET

7378                ;VRSET(ERRFLG)(AMTBUF,DSCREG,DSCCRC)
7379                ;     (BIT   )(NIBSTR,NIBSTR,BYTE  )
7380                ;     ( 0    )( I    , 0    , 0    )
7381                ;     (PSW:Z )( RAM  , RAM  , RAM  )
7382                ;     ( C    )( NC   , C    , C    )
7383                ;
7384                ;A,PSW DESTROYED
7385                ;REGISTERS DESTROYED
7386                ;
7387                ;RESET VARIABLE RMRS DESCENDING REGISTER
7388                ;
7389                VRSET;                 ****ENTRY POINT
7390                ;                      CHECK METER STATUS
7391 13CE CD 4E 0F   CALL LSTATE           LSTATE(FATMOD,NORMOD,SERMOD,PRVMOD)
7392                ;                            (PSW:S ,PSW:Z ,PSW:P ,PSW:C )
7393                ;                            ( 0    , 0    , 0    , 0    )
7394                ;                      IF NORMOD .EQ. FALSE
7395                ;                        PROCESS ERROR
```

```
7396 13D1 C2 A1 0B   JNZ  PROERR          PROERR(ERRFLG)
7397                ;                          (PSW:Z )
7398                ;                          ( 0    )
7399                ;                     ELSE
7400                ;                       CHECK AMOUNT FORMAT
7401 13D4 3A 70 74   LDA  AMTBUF/2+X       IF AMTBUF[1] .EQ. HEX0F
7402 13D7 E6 0F      ANI  0FH
7403 13D9 FE 0F      CPI  0FH
7404                ;                         PROCESS ERROR. NO DECIMAL ENTERED
7405 13DB CA A1 0B   JZ   PROERR            PROERR(ERRFLG)
7406                ;                          (PSW:Z )
7407                ;                          ( 0    )
7408                ;                       ELSE
7409                ;                         PERFORM RULE CHECK AND REFORMATTING
7410 13DE CD 03 14   CALL VRPREP            VRPREP(ERRFLG)
7411                ;                          (PSW:Z )
7412                ;                          ( 0    )
7413 13E1 C5         PZ                     IF ERRFLG .EQ. FALSE
7414                ;                         CALC NEW DESC REGISTER VALUE
7415 13E2 0E E7      MVI  C,AMTBUF+8-1        C = OFFSET, AMTBUF[7]
7416 13E4 06 35      MVI  B,DSCREG+DSCSIZ-1   B = OFFSET, DSCREG[I=DSCSIZ-1]
7417 13E6 11 07 07   LXI  D,DSCSIZ+100H+DSCSIZ
7418                ;                          D = DSCSIZ
7419                ;                          E = DSCSIZ
7420 13E9 CD F8 06   CALL DECADD              DECADD(AMTBUF[7],DSCREG[I],
7421                ;                              ( @C      , @B      ,
7422                ;                              ( I/O     , I       ;
7423                ;
7424                ;                              DSCSIZ,DSCSIZ,OVRFLO)
7425                ;                               D    , E    ,PSW:C )
7426                ;                               I    , I    , O    )
7427                ;                          IF OVRFLO .EQ. TRUE
7428                ;                            PROCESS ERROR. OVERFLOW
7429 13EC DA A1 0B   JC   PROERR               PROERR(ERRFLG)
7430                ;                                (PSW:Z )
7431                ;                                ( 0    )
7432                ;                          ELSE
7433                ;                            UPDATE DESCENDING REGISTER
7434 13EF 0E 2F      MVI  C,DSCREG              C = OFFSET, DSCREG
7435 13F1 06 E1      MVI  B,AMTBUF+8-DSCSIZ     B = OFFSET, AMTBUF[I=8-DSCSIZ]
7436 13F3 3E 07      MVI  A,DSCSIZ              A = DSCSIZ
7437 13F5 CD B3 0F   CALL MVLNIB                MVLNIB(DSCREG,AMTBUF[I],DSCSIZ,
7438                ;                              ( @C    , @B      , A    ,
7439                ;                              ( O     , I       , I    ,
7440                ;
7441                ;                              NONBCD,NONZRO)
7442                ;                              PSW:S ,PSW:Z )
7443                ;                               O    , O    )
7444                ;                            UPDATE DESC REGISTER CRC
7445 13F8 47         MOV  B,A                   B = DSCSIZ
7446 13F9 CD B1 0E   CALL CRC                   CRC(DSCREG,DSCSIZ,CRCVAL)
7447                ;                              ( @C    , B    , D    )
7448                ;                              ( I     , I    , O    )
7449 13FC 7A         MOV  A,D                   DSCCRC = CRCVAL
7450 13FD 32 1B 74   STA  DSCCRC/2+X
7451                ;                            EXECUTE RESET
7452 1400 C3 03 14   JMP  VRXEQ                 VRXEQ(ERRFLG)
7453                ;                              (PSW:Z )
7454                ;                              ( 0    )
7455                ;                          ENDIF
7456                ;                        ENDIF
7457                ;                      ENDIF
7458                ;                    ENDIF
7459                ;                    RETURN
7460                ;  Recharging programs have been deleted.
7461               VRPREP;
7462               VRPRE1; and
7463               VRXEQ;  are two (2) of the modules which have been removed for security
7464               ;  purposes.  One suitable system for the deleted set of modules
7465               ;  is disclosed in U. S. Patent No. 4,097,923 for REMOTE POSTAGE
```

```
;   METER CHARGING SYSTEM USING AN ADVANCED MICROCOMPUTERIZED
;   POSTAGE METER issued on June 27,1978 to Alton B. Eckert, Howell
;   A. Jones, Jr. and Frank T. Check, Jr.  This patent is hereby
;   incorporated by reference into the subject patent application.
; (*****************************************************************)
;
;THIS IS THE DEMO PROGRAM FOR 6 STEPS/DIGIT MECHANISM
;   USED FOR 45 DEG ENCODER  & 30 DEG SENSOR MOUNTING
;Objective
;   Position the stepper motor through specified number of steps.
;   Flag the errors if
;                    1. the move fails
;                    2. if the sensors are not in home position
;                       after the completion of a move
;Level:
;   Calls RENC , BKLASH routines
;   utilizes look up table setup for determining the step count
;   requirements for retries.
;   Exits with the power held on to both motors.  It is the duty of the
;   invoking routine to judiciously hold the appropriate home phase.
;Procedure MOVCLS(MOTOR,RETRIES,MCOUNT,SPEED:ERROR)
;ERROR := 0
;Input (PORT.SENSOR,SENSPTN)
;SENSPTN := SENSPTN and MSNMASK
;If SENSPTN = (BCDO or BODC or BCDO or BCDC) then PASSFLAG := 0
;                                                go to Loop1
;                                            else ERROR := 5
;                                                End MOVCLS
;Loop1:     Do while (RETRIES > 0 and MCOUNT <> 0 and ERROR > 0 )
;           If PASSFLAG = 0 then  ECOUNT := MCOUNT * 2
;                                 MSTEP := MCOUNT * 6
;           Input (PORT.SENSOR,SENSPTN)
;           If MOTOR = BANK then
;                        SENSPTN := (SENSPTN / 4) and MASKDSENSR
;           If SENSPTN = 11 then MOTPTN := PHASE1    (....  11H..)
;                        else MOTPTN := PHASE2           44H
;           If MCOUNT > 0 then MOTPTN := MOTPTN * 4
;           Input (PORTB,MOTHPTN)
;           IF MOTOR = BANK then MOTPTN := MOTPTN and MASKMSN
;                                MOTHPTN := MOTHPTN and MASKLSN
;                                MOTHPTN := MOTHPTN or MOTPTN
;                        else MOTPTN := MOTPTN and MASKLSN
;                                MOTHPTN := MOTHPTN and MASKMSN
;                                MOTHPTN := MOTHPTN or MOTPTN
;           Output ( PORTB,MOTHPTN)
;           If MCOUNT > 0 then  MSTEP := MSTEP-1
;                               MOTPTN := MOTPTN * 2
;                         else  MSTEP := MSTEP + 1
;                               MOTPTN := MOTPTN / 2
;           For X = 1 to SPEED by 1
;                   Procedure RENC (MOTOR,SPEED,OLDPTN :ERROR,ADJCOUNT)
;           End For
;           If MSTEP <> 0 then
;                   If ERROR = 0 then Continue Do
;           else For Y =1 to 60 by 1
;                        Procedure RENC (MOTOR.OLDPTN: ERROR,ADJCOUNT)
;                End For
;           MSTEP := MSTEP (look-up)
;           PASSFLAG := PASSFLAG + 1
;           Continue Do
;   End Do
;   If RETRIES = 0 or MCOUNT = 0 then
;                                Procedure BKLASH
;If ERROR > 0 THEN End
;If BNKPAT = 01 then ERROR := 5; End
;            else if BNKPAT = 10 then ERROR :5; End
;                                else if MCOUNT = 0 THEN    End
;                                                 else ERROR := 6;End
;If DGTPAT = 01 then ERROR := 5; End
;           else if DGTPAT = 10 then ERROR := 5 ; End
```

```
                    ;                                   else if MCOUNT = 0 then End
                    ;                                                   else ERROR := 6
                    ;End movcls
                    ;
                    ;
                    ; PARAM     (*C-REG*) COUNT : BYTE; (*- FOR CW, + FOR CCW*)
                    ;   (*E-REG*) MOTOR : MOTORS; (*1 FOR BANK, 0 FOR DIGIT*)
                    ;   (*H-REG*) SPEED : BYTE  ;Stepping speed of motor
                    ;   (*L-REG*) TRIES : BYTE;
                    ;
                    ; VAR       (*B-REG*) ENC_COUNT : BYTE;
                    ;   (*C-REG*) MOT_COUNT : BYTE;
                    ;   (*D-REG*) PATTERN : BYTE;
                    ;
0000                BOD0        EQU     0000B
0003                BODC        EQU     0011B
000C                BCD0        EQU     1100B
000F                BCDC        EQU     1111B
0000                PFLAG0      EQU     00
0003                DGTMSK      EQU     03H
000C                BNKMSK      EQU     0CH
000F                LSNMSK      EQU     0FH
00F0                MSNMSK      EQU     0F0H
0011                PHASE1      EQU     11H
0044                PHASE2      EQU     44H
0003                SENSOL      EQU     03H
0005                ERROR5      EQU     05H
0006                ERROR6      EQU     06H
                    MOVCLS:                                             ; BEGIN
1403 AF                 XRA     A       ; ERROR := NO_ERRORS;
1404 32 38 74           STA     ERROR
                  ;
                  ;
1407 3A 00 68     MOVC4:        LDA     PORT2A  ;Combination sensor check
140A E6 0F              ANI     LSNMSK
140C FE 00              CPI     BOD0
140E CA 23 14           JZ      MOVC7
1411 FE 03              CPI     BODC
1413 CA 23 14           JZ      MOVC7
1416 FE 0C              CPI     BCD0
1418 CA 23 14           JZ      MOVC7
141B FE 0F              CPI     BCDC
141D CA 23 14           JZ      MOVC7
1420 C3 F9 14           JMP     MOVC60
                  ;
                  ;
1423 3E 00        MOVC7:        MVI     A,PFLAG0  ;Passflag:=0
1425 F5                 PUSH    PSW
1426 7D           MOVC05:       MOV     A,L     ; WHILE (TRIES > 0) AND (COUNT <> 0)
1427 B7                 ORA     A       ;       AND (ERROR = NO_ERRORS) DO
1428 CA DB 14           JZ      MOVC50  ;branch here to movc70 for backlash correction
142B 79                 MOV     A,C
142C B7                 ORA     A
142D CA DB 14           JZ      MOVC50  ;branch here to movc70 for backlash correction
1430 3A 38 74           LDA     ERROR
1433 B7                 ORA     A
1434 C2 DB 14           JNZ     MOVC50
                                        ;     BEGIN
1437 F1                 POP     PSW     ;Passflag check.
1438 B7                 ORA     A
1439 F5                 PUSH    PSW     ;
143A C2 56 14           JNZ     MOVC8
143D 79           MOVC11:       MOV     A,C             ;
143E 87                 ADD     A
143F 47                 MOV     B,A             ;ENC COUNT=2*COUNT
1440 87                 ADD     A
1441 80                 ADD     B               ;STEP = 6*COUNT
1442 4F                 MOV     C,A
                  ;
                  ;
```

```
7607 1443 7B            MOV     A,E
7608 1444 B7            ORA     A
7609 1445 3A 00 68      LDA     PORT2A
7610 1448 CA 4D 14      JZ      MOVC6
7611                ;
7612                ;
7613 144B 0F            RRC                     ;BANK MOTOR
7614 144C 0F            RRC                     ;
7615                                    ;     CASE SIGN (MOT_COUNT) OF
7616 144D E6 03     MOVC6:      ANI     DGTMSK          ;
7617 144F 16 44         MVI     D,PHASE2                ;
7618 1451 CA 56 14      JZ      MOVC8                   ;
7619 1454 16 11         MVI     D,PHASE1
7620                MOVC8:                      ;
7621 1456 79            MOV     A,C                     ;
7622 1457 B7            ORA     A                       ;
7623 1458 7A            MOV     A,D                     ;
7624                                    ;
7625 1459 FA 5F 14      JM      MOVC15          ;
7626 145C 07            RLC
7627 145D 07            RLC
7628                                    ;                               ;
7629 145E 57        MOVC10:     MOV     D,A     ;                   AND PHASED AND PHASEA;
7630                MOVC15:                     ;     END;
7631 145F 7B            MOV     A,E     ;         REPEAT
7632 1460 B7            ORA     A         CASE MOTOR OF
7633 1461 7A            MOV     A,D
7634 1462 CA 73 14      JZ      MOVC20
7635 1465 E6 F0         ANI     MSNMSK
7636 1467 C5            PUSH    B
7637 1468 47            MOV     B,A
7638 1469 3A 02 70      LDA     PORTB
7639 146C E6 0F         ANI     LSNMSK
7640 146E B0            ORA     B
7641 146F C1            POP     B
7642 1470 C3 7E 14      JMP     MOVC25
7643 1473 E6 0F     MOVC20:     ANI     LSNMSK  ;           DIGIT: PORTB := (PATTERN OR PHASEOFF B
7644 1475 C5            PUSH    B
7645 1476 47            MOV     B,A
7646 1477 3A 02 70      LDA     PORTB                   ;
7647 147A E6 F0         ANI     MSNMSK                  ;
7648 147C B0            ORA     B                       ;
7649 147D C1            POP     B                       ;
7650                                    ;               IS BEING MOVED
7651 147E 32 02 70 MOVC25:      STA     PORTB   ;         END;
7652 1481 79            MOV     A,C     ;         CASE SIGN (MOT_COUNT) OF
7653 1482 B7            ORA     A
7654 1483 7A            MOV     A,D
7655 1484 FA 8C 14      JM      MOVC30
7656                                    ;             +1: BEGIN
7657 1487 0D            DCR     C       ;                 MOT_COUNT := MOT_COUNT - 1;
7658 1488 07            RLC             ;                 PATTERN := PATTERN ROL 1
7659 1489 C3 8E 14      JMP     MOVC35  ;                 END;
7660                MOVC30:                     ;             -1: BEGIN
7661 148C 0C            INR     C       ;                 MOT_COUNT := MOT_COUNT - 1:
7662 148D 0F            RRC             ;                 PATTERN := PATTERN ROR 1
7663                                    ;                 END;
7664 148E 57        MOVC35:     MOV     D,A     ;         END;
7665 148F C5            PUSH    B       ;         READ_ENCODERS (10, MOTOR, ENC_COUNT)
7666 1490 49            MOV     C,B
7667 1491 D5            PUSH    D
7668 1492 E5            PUSH    H
7669 1493 6C            MOV     L,H
7670 1494 CD 99 10      CALL    RENC
7671 1497 E1            POP     H
7672 1498 D1            POP     D
7673 1499 79            MOV     A,C
7674 149A C1            POP     B
7675 149B 47            MOV     B,A
```

```
7676 149C 79            MOV     A,C     ;     UNTIL (MOT_COUNT = 0) OR (ERROR <> NO_ERRORS);
7677 149D B7            ORA     A
7678 149E CA A8 14      JZ      MOVC40
7679 14A1 3A 38 74      LDA     ERROR
7680 14A4 B7            ORA     A
7681 14A5 CA 5F 14      JZ      MOVC15
7682 14A8 C5        MOVC40:     PUSH    B       ;     READ_ENCODERS (60, MOTOR, ENC_COUNT);
7683 14A9 48            MOV     C,B
7684 14AA D5            PUSH    D
7685 14AB E5            PUSH    H
7686 14AC 2E 3C         MVI     L,60.
7687 14AE CD 99 19      CALL    RENC
7688 14B1 E1            POP     H
7689 14B2 D1            POP     D
7690 14B3 79            MOV     A,C
7691 14B4 C1            POP     B
7692 14B5 47            MOV     B,A
7693 14B6 B7            ORA     A       ;     COUNT := ENC_COUNT / 2;
7694 14B7 F2 BC 14      JP      MOVC45
7695 14BA 2F            CMA
7696 14BB 3C            INR     A
7697 14BC E5        MOVC45:     PUSH    H
7698 14BD D5            PUSH    D
7699 14BE 16 00         MVI     D,00H   ;Step error computation/lookup
7700 14C0 5F            MOV     E,A
7701 14C1 21 00 15      LXI     H,TABBASE
7702 14C4 19            DAD     D
7703 14C5 4E            MOV     C,M
7704 14C6 78            MOV     A,B
7705 14C7 B7            ORA     A
7706 14C8 F2 CF 14      JP      MOVC42
7707 14CB 79            MOV     A,C
7708 14CC 2F            CMA
7709 14CD 3C            INR     A
7710 14CE 4F            MOV     C,A
7711 14CF D1        MOVC42:     POP     D
7712 14D0 E1            POP     H
7713 14D1 2D            DCR     L
7714 14D2 F1            POP     PSW
7715 14D3 3C            INR     A                       ;PASSFLAG:=PASSFLAG+1
7716 14D4 F5            PUSH    PSW
7717 14D5 C3 26 14      JMP     MOVC05
7718                ;
7719                ;
7720                ;
7721 14D8 CD 1B 15 MOVC70:      CALL    BKLASH
7722 14DB F1       MOVC50:      POP     PSW             ;retrieve passflag;
7723 14DC 3A 38 74      LDA     ERROR
7724 14DF B7            ORA     A
7725 14E0 C0            RNZ
7726                    ;
7727                ;
7728                ;
7729 14E1 3A 39 74      LDA     BNKPAT  ; IF BANK_PAT NOT IN [00H, 03H]
7730 14E4 B7            ORA     A       ;    OR DIGIT_PAT NOT IN [00H,03H] THEN
7731 14E5 CA ED 14      JZ      MOVC55
7732 14E8 FE 03         CPI     SENSCL
7733 14EA C2 F9 14      JNZ     MOVC60
7734 14ED 3A 3A 74 MOVC55:      LDA     DGTPAT
7735 14F0 B7            ORA     A
7736 14F1 CA FF 14      JZ      MOVC65
7737 14F4 FE 03         CPI     SENSCL
7738 14F6 CA FF 14      JZ      MOVC65
7739                                    ;     BEGIN
7740 14F9 3E 05    MOVC60:      MVI     A,ERROR5        ;     ERROR := NOT_HOME;
7741 14FB 32 38 74      STA     ERROR
7742 14FE C9            RET             ;     RETURN
7743                                    ;     END;
7744 14FF 79       MOVC65:      MOV     A,C     ; IF COUNT <> 0 THEN ERROR := MOVE_FAILED
```

```
1500 B7          ORA     A
1501 C8          RZ
1502 3E 06       MVI     A,ERROR6
1504 32 38 74    STA     ERROR
1507 C9          RET
                                  ; END;
                ;
                ;
1508 00         TABBASE:DB  0
1509 04          DB      4H
150A 06          DB      6D
150B 08          DB      8D
150C 0C          DB      12D
150D 10          DB      16D
150E 12          DB      18D
150F 14          DB      20D
1510 18          DB      24D
1511 1C          DB      28D
1512 1E          DB      30D
1513 22          DB      34D
1514 24          DB      36D
1515 28          DB      40D
1516 2A          DB      42D
1517 2C          DB      44D
1518 30          DB      48D
1519 34          DB      52D
151A 36          DB      54D
                ;
                ;
                ;BACKLASH CORRECTION ROUTINE
                ;This routine advances the digit stepper motor by one step
                ;beyond the expected settling point and then drives one
                ;step backwards  to the final settling point
                ;None of the registers are affected.
                ;This routine will be invoked only if all retries are exhausted or if al
                ;motor phases are applied.
                ;This routine will not be invoked in case of an error condition arises
                ;in RENC routine before the specified number of pulses are applied
                ;
151B F5         BKLASH:     PUSH    PSW
151C C5             PUSH    B
151D 7B             MOV     A,E             ;motor type check
151E B7             ORA     A
151F C2 3C 15       JNZ     BKL50
1522 3A 02 70       LDA     PORTB
1525 F5             PUSH    PSW
1526 E6 F0          ANI     MSNMSK
1528 F5             PUSH    PSW
1529 7A             MOV     A,D             ;D register has the next pattern output
152A E6 0F          ANI     LSNMSK
152C 47             MOV     B,A
152D F1             POP     PSW
152E B0             ORA     B
152F 32 02 70       STA     PORTB
1532 CD A9 17       CALL    DEL30M          ;forward pulse
1535 F1             POP     PSW
1536 32 02 70       STA     PORTB
1539 CD A9 17       CALL    DEL30M          ;backward pulse to final settling point
153C C1         BKL50:      POP     B
153D F1             POP     PSW
153E C9             RET
                ;
                ;
                ;   LEDON ROUTINE
                ;   TURNS ON THE STROBE FOR LEDS
                ;
                ;
153F F5         LEDON:      PUSH    PSW             ;SAVE CONTENTS
1540 3A 01 70       LDA     PORTA           ;LOADS THE CURRENT STATUS
```

```
7817 1543 E6 DF        ANI     0DFH            ;BIT RESET
7818 1545 32 01 70     STA     PORTA           ;PORT RESET
7819 1548 F1           POP     PSW
7820 1549 C9           RET                     ;
7821                ;
7822                ;
7823                ;  LEDOFF ROUTINE
7824                ;  TURNS THE STROBE OFF
7825                ;
7826                ;
7827 154A F5        LEDOFF:     PUSH    PSW                     ;
7828 154B 3A 01 70     LDA     PORTA                   ;
7829 154E F6 20        ORI     20H                     ;
7830 1550 32 01 70     STA     PORTA                   ;
7831 1553 F1           POP     PSW             ;
7832 1554 C9           RET                             ;
7833                ;
7834                ;
7835                ;
7836                ;
7837                ;
7839                ;
7840                ;  DELAY ROUTINES
7841                ;
7842                ;
7843 1555 00        DEL300:     NOP
7844 1556 00           NOP             ;ADJUST TIME
7845 1557 CD 64 15     CALL    DEL75   ;75 MICRO SECS
7846 155A CD 64 15     CALL    DEL75   ;
7847 155D CD 64 15     CALL    DEL75           ;
7848 1560 CD 64 15     CALL    DEL75           ;
7849 1563 C9           RET                     ;
7850                ;
7851                ;
7852                ;
7853 1564 F5        DEL75:      PUSH    PSW                     ;
7854 1565 3E 0A        MVI     A,0AH                   ;
7855 1567 3D        DEL1:       DCR     A                       ;
7856 1568 C2 67 15     JNZ     DEL1                    ;
7857 156B F1           POP     PSW                     ;
7858 156C C9           RET                             ;
7859                ;
7860                ;
7862                ;  SENSOR INITIALISATION ROUTINE
7863                ;
7864                ;
7865 156D           INITSM:
7866 156D CD 3F 15 SENSR:      CALL    LEDON                   ;LED STROBE ON
7867 1570 CD 64 15     CALL    DEL75                   ;SETTLING TIME
7868 1573 3A 00 68     LDA     PORT2AD
7869 1576 47           MOV     B,A                     ;
7870 1577 E6 03        ANI     DGTMSK
7871 1579 CA 9E 15     JZ      SENS35
7872 157C FE 03        CPI     DGTMSK
7873 157E C2 A3 15     JNZ     SENS40
7874 1581 3E 02        MVI     A,02H
7875 1583 32 02 70 SENS35:     STA     PORTB
7876 1586 CD A9 17     CALL    DEL30M
7877 1589 3A 00 68     LDA     PORT2AD
7878 158C 47           MOV     B,A
7879 158D E6 03        ANI     DGTMSK                  ;
7880 158F 32 3A 74     STA     DGTPAT                  ;DIGIT PATTERN
7881 1592 78           MOV     A,B                     ;
7882 1593 0F           RRC                             ;
7883 1594 0F           RRC                             ;
7884 1595 E6 03        ANI     DGTMSK                  ;
7885 1597 32 39 74     STA     BNKPAT                  ;BANK PATTERN
7886 159A CD 4A 15     CALL    LEDOFF
7887 159D C9           RET                             ;
7888                ;
```

```
7889                ;
7890 159E 3E 08     SENS35:     MVI     A,08H
7891 15A0 C3 83 15      JMP     SENS25
7892                ;
7893                ;
7894 15A3 3E 0F     SENS40:     MVI     A,15D
7895 15A5 32 38 74      STA     ERROR
7896 15A8 C3 9E 15      JMP     SENS35
7897                ;
7898                ; (*************************************************************)
7899                ;Objective: To compare present encoder status to previous encoder value
7900                ;           and determine the deviation as no change, clockwise movement
7901                ;           of one step, counterclockwise movement of one step or as an
7902                ;           error, which corresponds to a two step jump in the status.
7903                ;
7904                ;           Does not call any subroutines
7905                ;
7906                ;
7907                ; FUNCTION (*A-REG*) ENCODER_MOVE : BYTE;
7908                ;
7909                ; PARAM     (*C-REG*) PATTERN : ENCODER_PATTERNS;
7910                ;   (*E-REG*) NEW_PATTERN : ENCODER_PATTERNS;
7911                ;
7912                ENCMOV:                     ; BEGIN
7913 15AB 79            MOV     A,C     ; CASE PATTERN ROL 2 OR NEW_PATTERN OF
7914 15AC 07            RLC
7915 15AD 07            RLC
7916 15AE B3            ORA     E
7917 15AF 5F            MOV     E,A
7918 15B0 AF            XRA     A
7919 15B1 57            MOV     D,A
7920 15B2 21 B8 15      LXI     H,ENCT
7921 15B5 19            DAD     D
7922 15B6 7E            MOV     A,M
7923 15B7 C9            RET
7924 15B8 00        ENCT:       DB      0       ;     00H: ENCODER_MOVE := 0;
7925 15B9 01            DB       1      ;     01H: ENCODER_MOVE := +1;
7926 15BA FF            DB      -1      ;     02H: ENCODER_MOVE := -1;
7927 15BB 02            DB      +2      ;     03H: ENCODER_MOVE := +2;
7928 15BC FF            DB      -1      ;     04H: ENCODER-MOVE := -1;
7929 15BD 00            DB      0       ;     05H: ENCODER_MOVE := 0;
7930 15BE 02            DB      +2      ;     06H: ENCODER_MOVE := +2;
7931 15BF 01            DB      +1      ;     07H: ENCODER_MOVE := +1;
7932 15C0 01            DB      +1      ;     08H: ENCODER_MOVE := +1;
7933 15C1 02            DB      +2      ;     09H: ENCODER_MOVE := +2;
7934 15C2 00            DB      0       ;     0AH: ENCODER_MOVE := 0;
7935 15C3 FF            DB      -1      ;     0BH: ENCODER_MOVE := -1;
7936 15C4 02            DB      +2      ;     0CH: ENCODER_MOVE := +2;
7937 15C5 FF            DB      -1      ;     0DH: ENCODER_MOVE := -1;
7938 15C6 01            DB      +1      ;     0EH: ENCODER_MOVE := +1;
7939 15C7 00            DB      0       ;     0FH: ENCODER_MOVE := 0;
7940                                    ; END
7941                                    ; END;
7942                ; (*************************************************************)
7943                ;THIS SEGMENT IS USED TO MOVE THE BANK & DIGIT IN TO HOME
7944                ;POSITION UPON DETECTION OF AN ERROR IN ATTEMPT TO
7945                ;POSITION THE RACKS TO 00.00
7946                ;
7947                ; PROCEDURE ENDMOV_CLOSED;
7948                ;
7949                ; PARAM     (*C-REG*) COUNT : BYTE; (*- FOR CW, + FOR CCW*)
7950                ;   (*E-REG*) MOTOR : MOTORS; (*1 FOR BANK, 0 FOR DIGIT*)
7951                ;
7952                ; VAR       (*B-REG*) ENC_COUNT : BYTE;
7953                ;   (*C-REG*) MOT_COUNT : BYTE;
7954                ;   (*D-REG*) PATTERN : BYTE;
7955                ;
7956                ;
7957                ;
7958                ;
7959                ;
```

```
7960 00F0          MSNMASK     EQU     0F0H
7961 000F          LSNMASK     EQU     0FH
7962 0014          NUMRD1      EQU     20D
7963 003C          SETLTIM     EQU     60D
7964               ;
7965               ;
7966               ;
7967               ;
7968               ;
7969 15C8 AF       ENDMOV:     XRA     A                       ;     REPEAT
7970 15C9 32 38 74     STA     ERROR
7971 15CC 7B       ENDM05:     MOV     A,E     ;         CASE MOTOR OF
7972 15CD B7           ORA     A
7973 15CE 7A           MOV     A,D
7974 15CF CA E0 15     JZ      ENDM20          ;MOTOR(BANK,DIGIT)
7975               ;
7976               ;
7977 15D2 E6 F0        ANI     MSNMASK
7978 15D4 C5           PUSH    B
7979 15D5 47           MOV     B,A
7980 15D6 3A 02 70     LDA     PORTB
7981 15D9 E6 0F        ANI     LSNMASK
7982 15DB B0           ORA     B
7983 15DC C1           POP     B
7984 15DD C3 DD 15     JMP     ENDM05
7985               ;
7986               ;
7987 15E0 E6 0F    ENDM20:     ANI     LSNMASK     ;   DIGIT: PORTB := (PATTERN OR PHASEBOFF ROL 4)
7988 15E2 C5           PUSH    B
7989 15E3 47           MOV     B,A
7990 15E4 3A 02 70     LDA     PORTB                   ;
7991 15E7 E6 F0        ANI     MSNMASK                 ;
7992 15E9 B0           ORA     B                       ;
7993 15EA C1           POP     B                       ;
7994                                   ;               IS BEING MOVED
7995 15EB 32 02 70 ENDM25:     STA     PORTB   ;         END;
7996 15EE 79           MOV     A,C     ;         CASE SIGN (MOT_COUNT) OF
7997 15EF B7           ORA     A
7998 15F0 7A           MOV     A,D
7999 15F1 FA F9 15     JM      ENDM30
8000                                   ;             +1: BEGIN
8001 15F4 0D           DCR     C       ;                 MOT_COUNT := MOT_COUNT - 1;
8002 15F5 07           RLC             ;                 PATTERN := PATTERN ROL 1
8003 15F6 C3 FB 15     JMP     ENDM35  ;                 END;
8004               ;
8005               ;
8006               ENDM30:                         ;             -1: BEGIN
8007 15F9 0C           INR     C       ;                 MOT_COUNT := MOT_COUNT - 1;
8008 15FA 0F           RRC             ;                 PATTERN := PATTERN ROR 1
8009                                   ;                 END;
8010 15FB 57       ENDM35:     MOV     D,A     ;         END;
8011 15FC C5           PUSH    B       ;         READ_ENCODERS (10, MOTOR, ENC_COUNT)
8012 15FD 48           MOV     C,B
8013 15FE D5           PUSH    D
8014 15FF E5           PUSH    H
8015 1600 2E 14        MVI     L,NUMRD1
8016 1602 CD 99 19     CALL    RENC
8017 1605 E1           POP     H
8018 1606 D1           POP     D
8019 1607 79           MOV     A,C
8020 1608 C1           POP     B
8021 1609 47           MOV     B,A
8022 160A 79           MOV     A,C     ;     UNTIL (MOT_COUNT = 0) OR (ERROR <> NO_ERRORS);
8023 160B B7           ORA     A
8024 160C C2 CD 15     JNZ     ENDM05
8025               ;
8026               ;
8027 160F C5       ENDM40:     PUSH    B       ;     READ_ENCODERS (60, MOTOR, ENC_COUNT);
8028 1610 48           MOV     C,B
8029 1611 D5           PUSH    D
```

```
8030 1612 E5          PUSH    H
8031 1613 2E 3C       MVI     L,SETLTIM
8032 1615 CD 99 19    CALL    RENC
8033 1618 E1          POP     H
8034 1619 D1          POP     D
8035 161A 79          MOV     A,C
8036 161B C1          POP     B
8037 161C 47          MOV     B,A
8038 161D B7          ORA     A       ;     COUNT := ENC_COUNT / 2;
8039 161E 3E 07       MVI     A,07H                   ;ERROR 7
8040 1620 C8          RZ                              ;NORMAL EXIT
8041              ;
8042              ;
8043 1621 32 38 74    STA     ERROR
8044 1624 C9          RET                             ;ERROR EXIT
8045              ;
8046 0044         HDWAN1      EQU     044H
8047 0088         HDPHASE     EQU     88H
8048 0000         SENS00      EQU     00H
8049 0001         SENS01      EQU     01H
8050 0002         SENS02      EQU     02H
8051 0003         SENS03      EQU     03H
8052 0004         SENS04      EQU     04H
8053 0005         SENS05      EQU     05H
8054 0006         SENS06      EQU     06H
8055 0007         SENS07      EQU     07H
8056 0008         SENS08      EQU     08H
8057 0009         SENS09      EQU     09H
8058 000A         SENS10      EQU     0AH
8059 000B         SENS11      EQU     0BH
8060 000C         SENS12      EQU     0CH
8061 000D         SENS13      EQU     0DH
8062 000E         SENS14      EQU     0EH
8063 000F         SENS15      EQU     0FH
8064 0003         SENMSK      EQU     03H
8065              ;
8066              ;
8067 1625 CD 6D 15 SEKPOS:    CALL    SENSR
8068 1628 CD 3F 15    CALL    LEDON
8069 162B CD 3B 16    CALL    HDSEEK
8070 162E CD 4A 15    CALL    LEDOFF
8071 1631 CD BC 18    CALL    MODLN
8072 1634 CD B0 18    CALL    ERRHDR
8073 1637 C4 B5 18    CNZ     EXTERR
8074 163A C9          RET
8076              ;
8077              ;
8078              ;
8079              ;
8080              ;
8081              ;Procedure HDSEEK
8082              ;Objective
8083              ;    This segment initialises the print wheels to 00.00 position.
8084              ;    Prior to the movement of the racks this segment aligns the
8085              ;    bank and digit motors to legitimate home positions. The 00.00
8086              ;    location is attained by hitting against the mechanical blocks.
8087              ;    Three retries will be provided before coming to the conclusion
8088              ;    that an error in movement is detected.
8089              ;Level
8090              ;;
8091              ;
8092              ;   RCOUNTERB := 4
8093              ;   RCOUNTERC := 8                  ;RETRY COUNTERS
8094              ;SEKP00:RCOUNTERB:= RCOUNTERB-1
8095              ;   IF RCOUNTERB = 0 then ERROR := 13 ;     End.
8096              ;   MOTPATN := HOMEPHASE-1
8097              ;   Output(PORTB,MOTPATN)
8098              ;   Procedure TIMEDELAY(30msec)
8099              ;   MOTPATN := HOMEPHASE
8100              ;   Output (PORTB,MOTPATN)
```

```
8101    ;   Procedure TIMEDELAY(30msec)
8102    ;   RCOUNTERC := RCOUNTERC - 1
8103    ;   If RCOUNTERC = 0 then ERROR := 12 ;              End.
8104    ;   Input (PORT.SENSOR,SENSRPTN)
8105    ;   SENSRPTN := SENSRPTN.LSNMASK
8106    ;   Case SENSRPTN   00,03,12,15     SEKP85
8107    ;                   01,02,13,14     SEKP01
8108    ;                   04,07,08,11     SEKP02
8109    ;                   05,06,09,10     SEKP03
8110    ;
8111    ;   SEKP01: Procedure BALIGN(,TYPE 2 ERROR)
8112    ;           If TYPE2ERROR = FALSE then go to STEP0
8113    ;           else MOTPTN:= NOPHASEON
8114    ;                Output (PORTB,MOTPTN)
8115    ;                Procedure TIMEDELAY (30msec)
8116    ;                Go to SEEKP00
8117    ;   SEKP02: Procedure BALIGN(TYPE2ERROR)
8118    ;           If TYPE2ERROR = FALSE then go to STEP0
8119    ;           else MOTPTN := NOPHASEON
8120    ;                Procedure TIMEDELAY(30msec)
8121    ;                Go to SEEKP00
8122    ;   SEKP03: Procedure BALIGN(TYPE2 ERROR)
8123    ;           If TYPE2ERROR = FALSE then go to STEP0
8124    ;           else  Procedure BALIGN(TYPE2ERROR)
8125    ;           If TYPE2ERROR = FALSE then go to STEP0
8126    ;           else Input (PORTB,MOTPTN)
8127    ;                MOTPTN := MOTPTN.LSNMSK
8128    ;                Output (PORTB,MOTPTN)
8129    ;                Procedure TIMEDELAY(30msec)
8130    ;                Procedure BALIGN(TYPE2ERROR)
8131    ;                If TYPE2ERROR = TRUE then Input (PORTB,MOTPTN)
8132    ;                                          MOTPTN := NOPHASEON
8133    ;                                          Output(PORTB,MOTPTN)
8134    ;                                          Procedure TIMEDELAY(30msec)
8135    ;                                          Go to SEEKP00
8136    ;                else        Input (PORTB,MOTPTN)
8137    ;                            MOTPTN:=(( MOTPTN.LSNMSK)+HOMEPHASEBANK))
8138    ;                            Output (PORTB,MOTPTN)
8139    ;                            Procedure TIMEDELAY(30msec)
8140    ;                            Go to STEP0
8141    ;   SEKP85:
8142    ;           Procedure PTNCHK(DIGIT:PTNFLAG)
8143    ;           If PTNFLAG <> 0 then go to SEKP00
8144    ;           Procedure PTNCHK(BANK,PTNFLAG)
8145    ;           If PTNFLAG <> 0 then go to SEKP00
8146    ;end case
8147    ;
8148    ;   SEKP05: Procedure MOVE(DIGIT,CCW,1,SPD8:ERROR)
8149    ;           Do while ERROR = 0
8150    ;                   Procedure MOVE(DIGIT,CCW,1,SPD8:ERROR)
8151    ;           End do.
8152    ;           Procedure SELDRN(:DRN)
8153    ;           Procedure POHOME(DRN:ERROR)
8154    ;           If ERROR <>0 then End hdseek.
8155    ;
8156    ;           Procedure MOVE(BANK,CCW,1,SPD8:ERROR)
8157    ;           Do while ERROR = 0
8158    ;                   Procedure MOVE (BANK,CCW,1,SPD8:ERROR)
8159    ;           end do.
8160    ;           If BNKPAT = 01 then DRN:=CW else DRN:=CCW
8161    ;           Procedure POHOME(DRN,ERROR)
8162    ;           If ERROR <> 0 then End Hdseek.
8163    ;           Procedure MOVE(BANK,CW,4,SPD8:ERROR)
8164    ;           If ERROR <> 0 then End Hdseek.
8165    ;           For BANK:=0 TO 4 by 1 Do
8166    ;                   Procedure MOVE(DIGIT,CCW,1,SPD8:ERROR)
8167    ;                   Do while ERROR =FALSE
8168    ;                           Procedure MOVE(DIGIT,CCW,1,SPD8:ERROR)
8169    ;                   end do
8170    ;                   Procedure SELDRN(:DRN)
```

```
8171                ;                    Procedure POHOME(DRN:ERROR)
8172                ;                    If ERROR = TRUE then End hdseek.
8173                ;                    Procedure MOVE(DIGIT,CW,9,SPDS:ERROR)
8174                ;                    If ERROR = TRUE then End Hdseek.
8175                ;                    BANK:= BANK+1
8176                ;                    If BANK = 2 then
8177                ;                              Procedure MOVE(BANK,CCW,1,SPDS:ERROR)
8178                ;                              If ERROR = TRUE then end Hdseek.
8179                ;                    end do
8180                ;              end for.
8181                ;              Procedure MOVE (BANK,CW,2,SPDS:ERROR)
8182                ;              If ERROR = TRUE then end hdseek.
8183                ;              Procedure MOVE (DIGIT,CW,2,SPDS:ERROR)
8184                ;              If ERROR = TRUE then end hdseek.
8185                ;              Input (PORTB.MOTPTN)
8186                ;              MOTPTN:=MOTPTN.MSNMSK
8187                ;              Output(PORTB,MOTPTN)
8188                ;END.
8189                ;
8190                ;
8191 163B 01 08 04 HDSEEK:     LXI     B,408H                    ;RETRY COUNT
8192 163E C5            PUSH    B
8193 163F C1        SEKP00:     POP     B
8194 1640 05            DCR     B
8195 1641 CA 5A 16      JZ      EREXIT
8196                ;
8197                ;
8198 1644 C5            PUSH    B
8199 1645 3E 44         MVI     A,HPHAM1
8200 1647 32 02 70      STA     PORTB
8201 164A CD A9 17      CALL    DEL30M
8202 164D 3E 88         MVI     A,HPHASE
8203 164F 32 02 70      STA     PORTB
8204 1652 CD A9 17      CALL    DEL30M
8205 1655 C1        STEP0:      POP     B
8206 1656 0D            DCR     C
8207 1657 C2 60 16      JNZ     CSTEP0
8208 165A 3E 0C     EREXIT:     MVI     A,12D
8209 165C 32 38 74      STA     ERROR
8210 165F C9            RET
8211                ;
8212                ;
8213 1660 C5        CSTEP0:     PUSH    B
8214 1661 3A 00 69      LDA     PORT2A
8215 1664 E6 0F         ANI     LSNMSK
8216                ;
8217                ;
8218 1666 21 73 16      LXI     H,BASE5
8219 1669 16 00         MVI     D,00H
8220 166B 87            ADD     A
8221 166C 5F            MOV     E,A
8222 166D 19            DAD     D
8223 166E 5E            MOV     E,M
8224 166F 23            INX     H
8225 1670 56            MOV     D,M
8226 1671 EB            XCHG
8227 1672 E9            PCHL
8229                ;
8230                ;
8231 1673 D2 16     BASE5:      DW      SEKP05
8232 1675 93 16         DW      SEKP01
8233 1677 93 16         DW      SEKP01
8234 1679 D2 16         DW      SEKP05
8235 167B A5 16         DW      SEKP02
8236 167D AF 16         DW      SEKP03
8237 167F AF 16         DW      SEKP03
8238 1681 A5 16         DW      SEKP02
8239 1683 A5 16         DW      SEKP02
8240 1685 AF 16         DW      SEKP03
8241 1687 AF 16         DW      SEKP03
```

```
8242 1689 A5 16          DW      SEKP02
8243 168B D2 16          DW      SEKP85
8244 168D 93 16          DW      SEKP01
8245 168F 93 16          DW      SEKP01
8246 1691 D2 16          DW      SEKP85
8248                ;
8249                ;
8250                ;    JZ      SEKP90
8251                ;                        ;CHECKING DIGIT POSITION
8252                ;    CPI     SENS01
8253                ;    JZ      SEKP01
8254                ;
8255                ;    CPI     SENS02
8256                ;    JZ      SEKP01
8257                ;;
8258                ;    CPI     SENS13
8259                ;    JZ      SEKP01
8260                ;;
8261                ;    CPI     SENS14
8262                ;    JZ      SEKP01
8263                ;;
8264                ;    CPI     SENS04
8265                ;    JZ      SEKP02
8266                ;;
8267                ;    CPI     SENS07
8268                ;    JZ      SEKP02
8269                ;;
8270                ;    CPI     SENS08
8271                ;;   JZ      SEKP02
8272                ;;
8273                ;    CPI     SENS11
8274                ;    JZ      SEKP02
8275                ;;;
8276                ;    CPI     SENS05
8277                ;    JZ      SEKP03
8278                ;;
8279                ;    CPI     SENS06
8280                ;    JZ      SEKP03
8281                ;;
8282                ;    CPI     SENS09
8283                ;    JZ      SEKP03
8284                ;;
8285                ;    CPI     SENS10
8286                ;    JZ      SEKP03
8287                ;;
8288                ;    CPI     SENS03
8289                ;    JZ      SEKP90
8290                ;;
8291                ;    JMP     SEKP05
8292                ;
8294                ;
8295                ;                   DIGIT NOT IN HOME
8296 1693 CD E7 17 SEKP01:     CALL    DALIGN
8297 1696 B7           ORA     A
8298 1697 CA 55 16     JZ      STEP0          ;No Error condition
8299                                          ;Digit aligned and phased
8300                                          ;Bank aligned and phased
8301 169A
8302                                          ;Type 1 error
8303                                          ;Digit aligned and phased
8304                                          ;Bank not aligned and/or phased
8305                                          ;
8306 169A 3E 00    SEKP04:     MVI     A,00H          ;Type 2 error
8307                                          ;Digit not aligned and/or phased
8308                                          ;Bank don't care
8309 169C 32 02 70 SEP11:      STA     PORTB
8310 169F CD A9 17     CALL    DEL30M
8311 16A2 C3 3F 16     JMP     SEKP00
8312 16A5 CD 12 18 SEKP02:     CALL    BALIGN
```

```
8313 16A8 B7            ORA     A
8314 16A9 CA 55 16      JZ      STEP0           ;No Error condition
8315                                            ;Digit aligned and phased
8316                                            ;Bank aligned and phased
8317                                            ;
8318                                            ;Type 1 Error
8319                                            ;Bank aligned and phased
8320                                            ;Digit not aligned and/or phased
8321 16AC C3 9A 16      JMP     SEKP04
8322 16AF CD E7 17 SEKP03:      CALL    DALIGN
8323 16B2 B7            ORA     A
8324 16B3 CA 55 16      JZ      STEP0           ;NO error condition
8325                ;
8326                ;
8327 16B6
8328                                            ;Type 2 error
8329 16B6 CD 12 18      CALL    BALIGN
8330 16B9 B7            ORA     A
8331 16BA CA 55 16      JZ      STEP0           ;No error condition
8332                ;
8333                ;
8334                                            ;Type 1 Error condition
8335                ;
8336                ;
8337 16BD 3A 02 70      LDA     PORTB
8338 16C0 E6 0F         ANI     LSNMSK
8339 16C2 32 02 70      STA     PORTB
8340 16C5 CD A9 17      CALL    DEL30M
8341                ;
8342                ;
8343                ;
8344                ;
8345 16C8 CD E7 17      CALL    DALIGN
8346 16CB B7            ORA     A
8347 16CC C2 9A 16      JNZ     SEKP04
8348                ;
8349                ;
8350                ;
8351                ;   LDA     PORTB
8352                ;   ANI     LSNMSK
8353                ;   ORI     80H
8354                ;   STA     PORTB
8355                ;   CALL    DEL30M
8356 16CF C3 55 16      JMP     STEP0
8357                ;;
8358                ;
8359                ;
8360                ;
8361 16D2 1E 00     SEKP05:     MVI     E,00
8362 16D4 CD 2A 19      CALL    PINCHK
8363 16D7 C2 3F 16      JNZ     SEKP00
8364 16DA 1C            INR     E
8365 16DB CD 2A 19      CALL    PINCHK
8366 16DE C2 3F 16      JNZ     SEKP00
8368                ;;
8369                ;
8370 16E1 C1        SEKP05:     POP     B
8371 16E2 3A 3A 74 SEKP06:      LDA     DGTPAT
8372 16E5 F5            PUSH    PSW
8373 16E6 0E 01         MVI     C,1                     ;
8374 16E8 1E 00         MVI     E,00                    ;DIGIT MOTOR
8375 16EA 21 03 08      LXI     H,803H                  ;RE TRIES
8376 16ED CD 03 14      CALL    MOVCLS                  ;EXIT FROM LOCK TRY
8377 16F0 3A 38 74      LDA     ERROR                   ;
8378 16F3 B7            ORA     A                       ;
8379 16F4 C2 FB 16      JNZ     SEKP07
8380 16F7 F1            POP     PSW
8381 16F8 C3 E2 16      JMP     SEKP06                  ;
8382                ;
```

```
                    ;
                    ;
16FB F1             SEKP07:     POP     PSW
16FC CD 40 18           CALL    SELDRN
                    ;
16FF CD C5 18       SEKP19:     CALL    POHOME
                    ;
1702 C0                 RNZ
1703                SEKP10:
1703 0E 01              MVI     C,01                    ;CLOCKWISE 1STEP
1705 1E 01              MVI     E,01
1707 21 03 09           LXI     H,903H                  ;BANK MOTOR
170A CD 03 14           CALL    MOVCLS                  ;BANK POSITION IDENTIFICATION
170D 3A 38 74           LDA     ERROR                   ;
1710 B7                 ORA     A                       ;
1711 CA 03 17           JZ      SEKP10                  ;
                    ;
                    ;
1714 3A 39 74           LDA     BNKPAT
1717 2E 00              MVI     L,00H
1719 FE 01              CPI     01
171B CA 1F 17           JZ      SEKP13
171E 2C                 INR     L
                    ;
                    ;
171F CD C5 18       SEKP13:     CALL    POHOME
1722 C0                 RNZ
                    ;
                    ;
                    ;
1723 1E 01              MVI     E,01                    ;
1725 0E FC              MVI     C,-4H                   ;
1727 21 03 00           LXI     H,903H                  ;BANK IS BEING POSITIONED TO EXTREME
172A CD 03 14           CALL    MOVCLS                  ;
172D CD B0 18           CALL    ERRHDR                  ;
1730 C0                 RNZ                             ;EXITS ON FATAL ERROR
                    ;
                    ;
1731 0E 05              MVI     C,5H                    ;
1733 C5             SEKP15:     PUSH    B                       ;INDEX STORAGE
1734 3A 3A 74       SEKP20:     LDA     DGTPAT
1737 F5                 PUSH    PSW
1738 0E 01              MVI     C,1                     ;CLOCKWISE 1 STEP
173A 1E 00              MVI     E,00                    ;DIGIT MOTOR
173C 21 03 08           LXI     H,803H                  ;RETRIES
173F CD 03 14           CALL    MOVCLS                  ;MOVE DIGIT TO EXTREME..9
1742 3A 38 74           LDA     ERROR                   ;
1745 B7                 ORA     A                       ;
1746 C2 4D 17           JNZ     SEKP21                  ;
1749 F1                 POP     PSW
174A C3 34 17           JMP     SEKP20
                    ;
                    ;
                    ;
174D F1             SEKP21:     POP     PSW
174E CD 40 18           CALL    SELDRN
1751 CD C5 18       SEKP23:     CALL    POHOME                  ;
                    ;
1754 C2 B3 17           JNZ     SEEK26
1757 0E F7              MVI     C,-9H                   ;CLOCKWISE 9STEPS
1759 1E 00              MVI     E,00                    ;
175B 21 03 09           LXI     H,803H                  ;RE TRIES
175E CD 03 14           CALL    MOVCLS                  ;POSITION TO 0
1761 CD B0 18           CALL    ERRHDR                  ;
1764 C1                 POP     B                       ;RESTORE STACK
1765 C0                 RNZ                             ;FATAL ERROR  EXIT
1766 00                 NOP
1767 00                 NOP
1768 00                 NOP
1769 00                 NOP
```

```
                    ;
                    ;
                    ;
                    ;
176A 0D             SEKP22:     DCR     C                       ;
176B CA 87 17           JZ      SEKP30                  ;
176E C5             SEKP25:     PUSH    B                       ;INDEX RESTORE
176F 0E 01              MVI     C,1                     ;CLOCWISE 1 STEP
1771 1E 01              MVI     E,01                    ;BANK MOTOR
1773 21 03 08           LXI     H,803H                  ;RETRIES
1776 CD 03 14           CALL    MOVCLS                  ;GO  TO NEXT BANK
1779 CD B0 18           CALL    ERRHDR                  ;
177C C1                 POP     B                       ;
177D C0                 RNZ                             ;FATAL ERROR EXIT
                    ;
177E 79                 MOV     A,C                     ;
177F FE 03              CPI     03                      ;HOME?
1781 C2 33 17           JNZ     SEKP15                  ;
1784 C3 6A 17           JMP     SEKP22                  ;
                    ;
                    ;
                    ;
1787 0E FE          SEKP30:     MVI     C,-2H                   ;COUNTER CLOCKWISE 2 STEPS
1789 1E 01              MVI     E,01                    ;BANK MOTOR
178B 21 03 08           LXI     H.803H                  ;
178E CD 03 14           CALL    MOVCLS                  ;MOVE BANK TO HOME
1791 CD B0 18           CALL    ERRHDR                  ;
1794 C0                 RNZ                             ;FATAL ERROR EXIT
                    ;
                    ;
1795 0E FE              MVI     C,-2H                   ;COUNTER CLOCKWISE 1 STEP
1797 1E 00              MVI     E,00                    ;DIGIT MOTOR
1799 21 03 08           LXI     H.803H                  ;
179C CD 03 14           CALL    MOVCLS                  ;SET DIGIT IN TO LOCK
179F CD B0 18           CALL    ERRHDR                  ;
17A2 C9                 RET
                    ;
                        ;
17A3 C5             DEL6M:      PUSH    B
17A4 06 14              MVI     B,20D
17A6 C3 AC 17           JMP     DELM1
                    ;
                    ;
                    ;
17A9 C5             DEL30M:     PUSH    B
17AA 06 64              MVI     B,100D
17AC CD 55 15       DELM1:      CALL    DEL300
17AF 05                 DCR     B
17B0 C2 AC 17           JNZ     DELM1
17B3 C1             SEEK36:     POP     B
17B4 C9                 RET
                    ;
                    ;
                    ;
                    ;
17B5 01 DC 17       DPTSP:      LXI     B,BASEAD
17B8 21 02 70           LXI     H,PORTB
17BB 7B                 MOV     A,E
17BC B7                 ORA     A
17BD 7E                 MOV     A,M
17BE CA D4 17           JZ      DPTS05
                    ;
                    ;
17C1 7E                 MOV     A,M
17C2 E6 E0              ANI     0E0H
17C4 07                 RLC
17C5 07                 RLC
17C6 07                 RLC
17C7 E5             DPTS10:     PUSH    H
```

```
17C8 26 00          MVI     H,00H
17CA 6F             MOV     L,A
17CB 09             DAD     B
17CC 7E             MOV     A,M
17CD E1             POP     H
17CE A6             ANA     M
17CF 77             MOV     M,A
                ;   STA     PORTB
17D0 CD A9 17       CALL    DELZOM
17D3 C9             RET
                ;
                ;
                ;
17D4 E6 0E      DPTS05:     ANI     0EH
17D6 0F             RRC
17D7 C6 04          ADI     04
17D9 C3 C7 17       JMP     DPTS10
                ;
                ;
                ;
                ;
                ;
17DC FF         BASEAD:     DB      0FFH
17DD DF             DB      0DFH
17DE FF             DB      0FFH
17DF BF             DB      0BFH
17E0 EF             DB      0EFH
17E1 FD             DB      0FDH
17E2 7F             DB      7FH
17E3 FB             DB      0FBH
17E4 FE             DB      0FEH
17E5 FF             DB      0FFH
17E6 F7             DB      0F7H
                ;
                ;
                ;
                ;Procedure DALIGN
                ;Objective:          this segment makes an attempt to align the digit motors to
                ;           a legitimate home position.
                ;
                ;Level.
                ;
                ;DALIGN:
                ;   MOTOR := DIGIT
                ;   PHASE := DPHASE1
                ;   DIRECTION := CW
                ;   Procedure DPHOME(:ERROR)
                ;   If ERROR = TRUE then
                ;                       MOTOR := DIGIT
                ;                       PHASE := DPHASE1
                ;                       DIRECTION := CCW
                ;                       Procedure DPHOME(:ERROR)
                ;                       If ERROR <>0 then ERROR := TYPE2ERROR
                ;                                         Procedure DPTSP(DIGIT)
                ;                                         end.
                ;                       else MOTOR := BANK
                ;                            Procedure PINCHK(:ERROR)
                ;                            Procedure DPTSP(DIGIT)
                ;                            If ERROR <> 0 then ERROR := TYPE3ERROR
                ;                            end
                ;End.
                ;
                ;
                ;
17E7 2E 00      DALIGN:     MVI     L,00
17E9 16 33          MVI     D,33H
17EB 1E 00          MVI     E,00H
17ED CD 86 19       CALL    DPHOME
17F0 CA FF 17       JZ      SEKP11
```

```
                    ;
                    ;
                    ;
                    ;
                    ;
17F3 2E 01          SEKP09:     MVI     L,01
17F5 16 33              MVI     D,33H
17F7 1E 00              MVI     E,00H
17F9 CD 86 19           CALL    DPHOME
17FC C2 0C 18           JNZ     ERSET
                    ;
                    ;
17FF 1E 01          SEKP11:     MVI     E,01H
1801 CD 2A 19           CALL    PINCHK
1804 F5                 PUSH    PSW
1805 1E 00              MVI     E,00
1807 CD B5 17           CALL    DPTSP
180A F1                 POP     PSW
180B C8                 RZ                          ;No Error condition
                    ;   MVI     A,01
                    ;   RET                         ;Type 1 Error set
180C CD B5 17       ERSET:      CALL    DPTSP
180F 3E 02              MVI     A,02                ;Type 2 error set
1811 C9                 RET
                    ;
                    ;
                    ;;
                    ;Procedure BALIGN
                    ;Objective:         this segment makes an attempt to align the bank motors to
                    ;           a legitimate home position.
                    ;
                    ;Level.
                    ;
                    ;BALIGN:
                    ;   MOTOR := BANK
                    ;   PHASE := DPHASE1
                    ;   DIRECTION := CW
                    ;   Procedure DPHOME(:ERROR)
                    ;   If ERROR = TRUE then
                    ;                       MOTOR := BANK
                    ;                       PHASE := DPHASE1
                    ;                       DIRECTION := CCW
                    ;                       Procedure DPHOME(:ERROR)
                    ;                       If ERROR <>0 then ERROR := TYPE2ERROR
                    ;                                         Procedure DPTSP(BANK)
                    ;                                         end.
                    ;                       else MOTOR := DIGIT
                    ;                            Procedure PINCHK(:ERROR)
                    ;                            Procedure DPTSP(BANK)
                    ;                            If ERROR <> 0 then ERROR := TYPE2ERROR
                    ;                            end
                    ;End.
                    ;
                    ;
                    ;
                    ;
1812                BALIGN:
1812 2E 00              MVI     L,00
1814 16 33          SEKP17:     MVI     D,33H
1816 1E 01              MVI     E,01H
1818 CD 86 19           CALL    DPHOME
181B C2 31 18           JNZ     SEKP14
181E 1E 00          SEKP13:     MVI     E,00
1820 CD 2A 19           CALL    PINCHK
1823 F5                 PUSH    PSW
1824 1E 01              MVI     E,01
1826 CD B5 17           CALL    DPTSP
1829 F1                 POP     PSW
182A C8                 RZ                          ;No error condition
```

```
                    ;   MVI     A,01
                    ;   RET                     ;Type 1 error set
                    ;
                    ;
1828 CD 95 17 PERSET:   CALL    DPTOP
1828 3E 02          MVI     A,02                type 2 error set
1830 C9             RET
                    ;
                    ;
                    ;
                    ;
1831 2E 01          SEKP14:     MVI     L,01
1833 16 33          MVI     D,33H
1835 1E 01          MVI     E,01H
1837 CD 86 19       CALL    PPHOME
183A C2 2F 18       JNZ     PERSET
                    ;
                    ;
183D C3 1E 18       JMP     SEKP13
                    ;
                    ;
                    ;
                    ;
                    ;
                    ;
                    ;
                    ; Accumulator contains the last sucessfully attained
                    ;digit sensor readings
                    ;this sensor reading is compared with the new sensor readings to
                    ;determine the direction of POHOME
                    ;drive
                    ;
                    ;
1840 47             SELDRN:     MOV     B,A
1841 3A 00 68       LDA     PORT2A
1844 E6 03          ANI     DCTMSK
1846 2E 00          MVI     L,00
1848 A8             XRA     B               ;CLEARS CARRY
1849 1F             RAR
184A D2 4E 18       JNC     SEKP08
184D 2C             INR     L
184E C9             SEKP08:     RET
                    ;
184F 16 88          MOPEN:      MVI     D,088H
1851 79             MOP05:      MOV     A,C
1852 B7             ORA     A
1853 7A             MOV     A,D
1854 FA 68 18       JM      MOP01
1857 07             RLC
1858 0D             DCR     C
1859 CA 6D 18       JZ      MOP10
185C 57             MOP02:      MOV     D,A
185D E6 0F          ANI     0FH
185F 32 02 70       STA     PORTB
1862 CD A3 17       CALL    DEL6M
1865 C3 51 18       JMP     MOP05
1868 0F             MOP01:      RRC
1869 0C             INR     C
186A C2 5C 18       JNZ     MOP02
186D CD A0 17 MOP10:    CALL    DEL30M
1870 C9             RET
                    ;
                    ;
                    ;
                    ;
1871 0E F4          SEKTRP:     MVI     C,-12D
1873 CD 4F 18       CALL    MOPEN
1876 0E 0C          MVI     C,12D
1878 CD 4F 18       CALL    MOPEN
187B C9             RET
```

```
8738                ;
8739 187C
8740                ;           THIS SEGMENT CONTAINS THE PROCEDURES USED IN STEPPER MOTOR
8741                ;           CONTROL OF THE SELECTION AND TRIP MECHANISMS.
8742                ;
8743                ;
8744                ;           PROCEDURE MVTRIP
8745                ;
8746                ;
8747                ;           THIS PROCEDURE MOVES THE DIGIT MOTOR FROM THE LOCKED POSITION
8748                ;           TO THE TRIP POSITION OF THE TRIP SHAFT.
8749                ;           ON DETECTION OF AN ERROR IN THE PROCEDURE, A FATAL ERROR
8750                ;           ROUTINE IS INVOKED . UPON EXIT  FROM THE FATAL ERROR ROUTINE
8751                ;           THE ZERO FLAG OF THE PROCESSOR STATUS WORD IS RESET TO ZERO
8752                ;           IF A FATAL ERROR HAS OCCURED.THE ACCUMULATOR WILL HAVE THE ERRO;
8753                ;
8754                ;
8755 187C CD 3F 15 MVTRIP:     CALL    LEDON
8756 187F 21 03 10 MVTR05:     LXI     H,1003H                 ;# OF RE TRIES
8757 1882 1E 00        MVI     E,00                    ;DIGIT MOTOR SELECTED
8758 1884 0E FE        MVI     C,-2                    ;COUNTER CLOCKWISE 2 STEPS
8759 1886 CD 03 14     CALL    MOVCLS
8760 1889 CD 4A 15     CALL    LEDOFF                  ;
8761 188C CD BC 18     CALL    MODLN                   ;
8762 188F CD B0 18     CALL    ERRHDR
8763 1892 C4 B5 18     CNZ     EXTERR
8764 1895 C9           RET                             ;
8765                ;
8766                ;
8767                ;
8768                ;
8769                ;*****************************************************************
8770                ;
8771                ;
8772                ;   PROCEDURE MVLOCK
8773                ;
8774                ;
8775                ;   THIS PROCEDURE MOVES THE DIGIT MOTOR FROM THE TRIP POSITION TO THE
8776                ;   LOCK POSITION OF THE TRIP SHAFT. ON DETECTION OF AN ERROR ,THE FATAL E
8777                ;
8778 1896 CD 3F 15 MVLOCK:     CALL    LEDON
8779 1899 21 03 08 MVL005:     LXI     H,803H                  ;RE TRIES
8780 189C 1E 00        MVI     E,00                    ;DIGIT MOTOR
8781 189E 0E 02        MVI     C,2H                    ;CLOCKWISE 2 STEP
8782 18A0 CD 03 14     CALL    MOVCLS                  ;
8783 18A3 CD 4A 15     CALL    LEDOFF
8784 18A6 CD BC 18     CALL    MODLN                   ;
8785 18A9 CD B0 18     CALL    ERRHDR
8786 18AC C4 B5 18     CNZ     EXTERR                  ;
8787 18AF C9           RET
8788                                ;
8789                ;
8790                ;
8791                ;
8792                ;*****************************************************************
8793                ;
8794                                                   ;THIS PROCEDURE ASSUMES THAT THE
8795                ;
8796                ;
8797                ;
8798                ;*****************************************************************
8799                ;
8800                ;
8801                ;           ERRHDR  ROUTINE
8802                ;           THIS ROUTINE IS CALLED ON DETECTION OF AN ERROR IN
8803                ;           THE MOTOR MOVE ROUTINES.THE ZERO FLAG AND THE
8804                ;           ACCUMULATOR RETURN THE FLAG INDICATION AND ERROR CODE
8805                ;
8806                ;
```

```
8807 18B0              ERRHDR:
8808 18B0 3A 30 74 ERRHC5:     LDA     ERROR                    ;
8809 18B3 B7               ORA     A                        ;SETTING FLAGS
8810 18B4 C9               RET                              ;
8811                   ;
8812                   ;
8813                   ;*****************************************************************
8814                   ;
8815                   ;
8816                   ;EXTERR ROUTINE
8817                   ;   This segment creates  a BCD coded error code from the
8818                   ;   error storage location .  Before converting to the BCD pattern
8819                   ;   30D is added to the error value from motor move routines.
8820                   ;   this routine is called upon only when an Error is detected by
8821                   ;   the errhdr routine.
8822 18B5              EXTERR:
8823 18B5 3A 38 74         LDA     ERROR   ;
8824 18B8 C6 1E            ADI     30D
8825 18BA 27               DAA             ;
8826 18BB C9               RET             ;
8827                   ;
8828                   ;
8829                   ;
8830                   ;*****************************************************************
8831                   ;MODLN routine
8832                   ;
8833                   ;
8834                   ;   This routine masks off the bank home position hold and provides
8835                   ;the digit motor hold pattern to the interface for modulation purpose.
8836                   ;
8837 18BC              MODLN:
8838 18BC 3A 02 70         LDA     PORTB
8839 18BF E6 0F            ANI     0FH
8840 18C1 32 02 70         STA     PORTB
8841 18C4 C9               RET
8842                   ;
8843                   ;
8844                   ;
8845                   ;
8846                   ;THIS ROUTINE PLACES THE MOTOR IN TO THE APPROPRIATE HOME
8847                   ;POSITION WHEN AN ERROR OCCURS ON SEEK
8848                   ;THIS ROUTINE MOVES THE MOTORS TWO STEPS AT A TIME
8849                   ;DEPENDING ON THE SENSOR READINGS THE MOTOR MOVEMENT DIRECTION IS DETERM
8850                   ;THIS ROUTINE TRANSFORMS THE THE LAST PATTERN OUTPUT FROM DMOVE ROUTINE
8851                   ;BREGISTER WILL BE LOADED BY THE EXPECTED ENCODER COUNT
8852                   ;C REGISTER WILL BE LOADED BY THE MOTOR STEP COUNT
8853                   ;MOTOR STEP COUNT WILL BE DETERMINED BY THE ENCODER READINGS
8854                   ;BEFORE REACHING THE ERROR CONDITION THE MOTOR WAS BEING DRIVEN IN
8855                   ;THE CW DIRECTION
8856                   ;
8857                   ;
8858 18C5              POHOME:
8859 18C5 CD 79 19 PLHOME:     CALL    SENSIN
8860 18C8 CA D4 18         JZ      PLH12           ;SENSOR (00)
8861 18CB FE 03            CPI     03H
8862 18CD CA D9 18         JZ      PLH14           ;SENSOR (00,11)
8863 18D0 CD FD 18         CALL    PH0110          ;SENSOR (01,10)
8864 18D3 C9               RET
8865                   ;
8866                   ;
8867 18D4 16 11        PLH12:      MVI     D,11H
8868 18D6 C3 DB 18         JMP     PLH10           ;check phases/
8869                   ;
8870 18D9 16 44        PLH14:      MVI     D,44H
8871 18DB CD DF 18 PLH10:      CALL    PH0011          ;
8872 18DE C9               RET                     ;
8873                   ;
8874                   ;
8875                   ;Procedure PH0011
```

```
8876                ;Objective: This segments positions the motors to a legitimate home posi
8877                ;           when the sensor patterns are , to start with , at 00 or 11, (the
8878                ;           sensors are either both pen or closed)
8879                ;PH0011:DIRECTION := CW
8880                ;   MSTEP:=-4
8881                ;   ECOUNT := -1
8882                ;   Procedure ENDMOV(NEXTPTN,MOTOR,DIRECTION,MSTEP,ECOUNT:ERROR)
8883                ;   If ERROR <> 0  then NEXTPTN := RRC(NEXTPTN)
8884                ;                       NEXTPTN := RRC(NEXTPTN)
8885                ;                       DIRECTION := CCW
8886                ;                       MSTEP       :=2
8887                ;                       ECOUNT:=    1
8888                ;                       Procedure ENDMOV(NEXTPTN,MOTOR,DIRECTION,MSTEP,ECOUNT:ERROR)
8889                ;   Procedure PTNCHK(MOTOR:ERROR)
8890                ;   end
8891                ;End.
8892                ;
8893                ;
8894                ;
8895 18DF           PH0011:
8896 18DF 0E FC         MVI     C,-4H           ;4STEPS CW
8897 18E1 06 FF         MVI     B,-1H
8898 18E3 CD C8 15      CALL    ENDMOV          ;POSITION TO 2STEPS BEFORE HOME
8899                                            ;1ENCODER STEP AWAY FROM HOME
8900 18E6 3A 38 74      LDA     ERROR
8901 18E9 FE 07         CPI     07H
8902 18EB CA F9 18      JZ      PH05            ;EXIT 1. ERROR FROM TRYING TO MOVE
8903                                            ;TO MOVE CW (TOWARDS LOCK FROM A
8904                                            ;SENSOR (00,11) AFTER IDENTIFYING
8905                                            ;A BLOCK
8906 18EE 7A            MOV     A,D
8907 18EF 0F            RRC
8908 18F0 0F            RRC                     ;MOTOR PATTERN FOR
8909 18F1 57            MOV     D,A
8910 18F2 0E 02         MVI     C,02H
8911 18F4 06 01         MVI     B,01
8912 18F6 CD C8 15      CALL    ENDMOV
8913                                            ;TWO MSTEPS TOWARDS SENSORS (00,11)
8914                                            ;IN CCW DIRECTION
8915 18F9 CD 2A 19 PH05:        CALL    PTNCHK
8916 18FC C9            RET
8917                ;
8918                ;
8919                ;
8920                ;Procedure PH0110
8921                ;Objective :        This segment positions the motors to a legitimate home
8922                ;           position wherein there is agreement between the phase applied
8923                ;           to the motor and the sensor readings observed.  Four single
8924                ;           step attempts will be made to position the motor to the
8925                ;           home position.  If a home position is reached before all
8926                ;           four attempts are completed, an exit will be done from this
8927                ;           segment.  The error will be flagged by the pattern check segment.
8928                ;
8929                ;PH0110:    If DIRECTION = CW then
8930                ;                               NEXTPTN := RLC (NEXTPTN)
8931                ;                               NEXTPTN := RLC (NEXTPTN)
8932                ;                               MSTEP:= -1
8933                ;                               ECOUNT := -1
8934                ;           else MSTEP:= 1
8935                ;                ECOUNT := 1
8936                ;           For TRIES = 4 to 0 by 1 do
8937                ;                   Procedure ENDMOV(NEXTPTN,MOTOR,DIRECTION,MSTEP,ECOUNT:ERROR)
8938                ;                   Procedure PTNCHK(MOTOR:ERROR)
8939                ;                   If ERROR = TRUE then TRIES:= TRIES-1
8940                ;                   else end
8941                ;           End
8942                ;End.
8943                ;
8944                ;
```

```
8945                ;
8946                ;
8947 18FD           PH0110:
8948                ;
8949                ;
8950 18FD 7D            MOV     A,L             ;SENSOR (01)
8951 18FE FE 01         CPI     01H
8952 1900 C2 0D 19      JNZ     PLH57           ;DIRECTION(CW,CCW)
8953                ;
8954                ;
8955 1903 7A        PLH52:      MOV     A,D             ;DIGIT SEEKING 00----------
8956 1904 07            RLC
8957 1905 07            RLC
8958 1906 0E FF         MVI     C,-1H
8959 1908 06 FF         MVI     B,-1H
8960 190A C3 12 19      JMP     PLH65
8961                ;
8962                ;
8963 190D 7A        PLH57:      MOV     A,D
8964 190E 0E 01         MVI     C,01H
8965 1910 06 01         MVI     B,01H
8966 1912 57        PLH65:      MOV     D,A             ;PATTERN IN D REGISTER
8967 1913 2E 04         MVI     L,04H
8968 1915 C5        PLH66:      PUSH    B
8969 1916 CD C8 15  PLH67:      CALL    ENDMOV
8970 1919 C1        PLH68:      POP     B
8971 191A CD 2A 19      CALL    PTNCHK
8972 191D C8            RZ                      ;EXIT 4 .NORMAL EXIT
8973                                            ;STILL ERRORS COULD EXIST
8974                                            ;DUE TO PTNCHK RESULTS
8975 191E 7A        PLH70:      MOV     A,D
8976 191F 2D            DCR     L
8977 1920 C2 15 19      JNZ     PLH66           ;2 + 2 MOTORS OVER?
8978                                            ;AGAINST A STOP
8979 1923 3E 09     PLH83:      MVI     A,09H
8980 1925 32 38 74      STA     ERROR
8981 1928 B7            ORA     A
8982 1929 C9            RET                     ;EXIT 6. THERE IS NO 00/11
8983                                            ;IN THIE DIRECTION OF MOVEMENT
8984                ;
8985                ;
8986                ;
8987                ;
8988                ;
8989                ;
8990                ;
8991                ;
8992                ;*****************************************************************
8993                ;
8994                ;
8995                ;
8996                ;PROCEDURE  PTNCHK( MOTOR:ERROR)
8997                ;
8998                ;Input (PORTB,MOTPTN)
8999                ;   IF MOTOR = BANK then MOTPTN:=MOTPTN.MSNMSK
9000                ;                        MOTPTN:= 4*RRC(MOTPTN)
9001                ;
9002                ;                           IF BNKPAT =( 01,02) THEN ERROR:=8; END.
9003                ;                       IF BNKPAT = 00 AND MOTPTN = (03,05) THEN ERROR :=0
9004                ;                                                                   END.
9005                ;                       IF MOTPTN (02,06) THEN ERROR := 0
9006                ;                                       ELSE ERROR:=8
9007                ;                                           END.
9008                ;
9009                ;
9010                ;                       ENDIF
9011                ;       ELSE        MOTPTN:= MOTPTN.LSNMSK
9012                ;               IF DGTPAT =(01,02)THEN ERROR:=8;    END.
9013                ;           IF DGTPAT = 0 AND MOTPTN = (08,09) THEN ERROR := 0
```

```
                    ;                                                   END.
                    ;          IF MOTPATN =(02,06) THEN ERROR:=0        ;END.
                    ;END                                                  ELSE ERROR := 8
                    ;                                                   END
                    ;;
                    ;
                    ;
                    ;   E REGISTER  ......      MOTOR(BANK,DIGIT)
                    ;   ERROR   CODE.....      8       FAILURE TO  ARRIVE AT HOME
                    ;
192A 7B             PTNCHK:     MOV     A,E                     ;MOTOR (BANK,DIGIT)
192B B7                 ORA     A                               ;MOTOR
192C 3A 02 70           LDA     PORTB
192F CA 68 19           JZ      PTNC10
                    ;
                    ;
1932 E6 F0              ANI     0F0H
1934 0F                 RRC
1935 0F                 RRC
1936 0F                 RRC
1937 0F                 RRC
1938 F5                 PUSH    PSW
1939 3A 39 74           LDA     BNKPAT
193C FE 01          PTNC15:     CPI     01
193E CA 71 19           JZ      PTNC20
                    ;
                    ;
                    ;
1941 FE 02              CPI     02H
1943 CA 71 19           JZ      PTNC20
1946 B7                 ORA     A
1947 CA 5A 19           JZ      PTNC30
                    ;
                    ;
                    ;
194A F1                 POP     PSW
194B FE 02              CPI     02H
194D CA 55 19           JZ      PTNC40
1950 FE 06              CPI     06H
1952 C2 72 19           JNZ     PTNC25
                    ;
                    ;
                    ;
1955 AF             PTNC40:     XRA     A
1956 32 38 74           STA     ERROR
1959 C9                 RET
                    ;
                    ;
                    ;
195A F1             PTNC50:     POP     PSW
195B FE 08              CPI     08H
195D CA 55 19           JZ      PTNC40
1960 FE 09              CPI     09H
1962 CA 55 19           JZ      PTNC40
1965 C3 72 19           JMP     PTNC25
                    ;
                    ;
                    ;
1968 E6 0F          PTNC10:     ANI     0FH
196A F5                 PUSH    PSW
196B 3A 3A 74           LDA     DGTPAT
196E C3 3C 19           JMP     PTNC15
                    ;
                    ;
1971 F1             PTNC20:     POP     PSW
1972 3E 08          PTNC25:     MVI     A,08H                   ;ERROR :=8
1974 32 38 74           STA     ERROR
1977 B7                 ORA     A                       ;NOT HOME ERROR
1978 C9                 RET                             ;EXIT
```

```
9084                ;;
9085                ;
9086                ;
9087 1979           SENSIN:
9088 1979 7B            MOV     A,E             ;CHECK MOTOR BANK/DIGIT
9089 197A B7            ORA     A
9090 197B 3A 00 68      LDA     PORT2A
9091 197E CA 83 19      JZ      PLH05           ;MOTOR (BANK,DIGIT)
9092 1981 0F            RRC
9093 1982 0F            RRC
9094 1983 E6 03     PLH05:      ANI     DGTMSK
9095 1985 C9            RET
9096                ;
9097                ;
9098                ;
9099 1986 CD 79 19 DPHOME:      CALL    SENSIN
9100 1989 CA 91 19      JZ      DPH1
9101 198C FE 03         CPI     03H
9102 198E C2 95 19      JNZ     DPH5
9103 1991 CD DF 18 DPH1:        CALL    PH0011
9104 1994 C9            RET
9105                ;
9106                ;
9107                ;
9108 1995 CD FD 18 DPH5:        CALL    PH0110
9109 1998 C9            RET
9110                ;
9112                ; (*************************************************************)
9113                ;
9114                ; PROCEDURE READ_ENCODERS;
9115                ;
9116                ;Objective: Read the encoder status and store the information in ram
9117                ;           storage and update the terminal count.  Flag errors of
9118                ;           1.  digit motor moved on a bank motor move
9119                ;           2.  digit motor moved too fast
9120                ;           3.  bank motor moved on a digit motor move
9121                ;           4.  bank motor moved too fast
9122                ;
9123                ;Initialisation requirements:
9124                ;           Initial patterns of bank and digit sensors be stored in the
9125                ;           respective locations before this module is invoked, during
9126                ;           power up activities.
9127                ;Level:
9128                ;           Calls ENCMOV, DEL300 and DEL75 modules.
9129                ;           Delay routines are used for adjusting the stepper motor rate.
9130                ;
9131                ;
9132                ;Procedure READENC(DGTPAT,BNKPAT,NUMREAD,MOTOR,ENCCOUNT: ENCCOUNT,ERROR)
9133                ;Do While (NUMREAD greater than 0 and ERROR  equal to 0
9134                ;   NUMREAD := NUMREAD - 1;
9135                ;   Input (PORT.SENSOR,SENSPTN)
9136                ;   SENSPTN1 := SENSPTN
9137                ;   SENSPTN := SENSPTN.DSNSRMASK
9138                ;   SENSPTN1 := (SENSPTN.BSNSRMASK)/4
9139                ;   Case MOTOR = BANK
9140                ;           If SENSPTN = (DGTPAT) then
9141                ;                           Procedure ENCMOV(BNKPAT,SENSPTN1:COUNTINC)
9142                ;                           If COUNTINC = 2 then
9143                ;                                       ERROR:= 3
9144                ;                                       End Case
9145                ;                           If ENCCOUNT greater than 0 then
9146                ;                                       ENCCOUNT:= ENCCOUNT-COUNTINC
9147                ;                           else        ENCCOUNT:= ENCCOUNT+COUNTINC
9148                ;           else            ERROR:= 1       ;DIGIT ON BANK
9149                ;           End If
9150                ;
9151                ;       MOTOR = DIGIT
9152                ;           If SENSPTN1 = BNKPAT then
9153                ;                           Procedure ENCMOV(DGTPAT,SENSPTN:COUNTINC)
```

```
9154                ;                                   If COUNTINC = 2 then
9155                ;                                              ERROR = 4
9156                ;                                              End Case
9157                ;                                   If ENCCOUNT greater than 0 then
9158                ;                                              ENCCOUNT=ENCCOUNT-COUNTINC
9159                ;                                   else       ENCCOUNT=ENCCOUNT+COUNTINC
9160                ;           else                    ERROR:= 2
9161                ;           End If
9162                ;       End Case
9163                ;End Do
9164                ;BNKPAT := SENSPTN1
9165                ;DGTPAT := SENSPTN
9166                ;End RENC.
9167                ;
9168                ;
9169                ;
9170                ; PARAM VAR (*C-REG*) COUNT : BYTE;
9171                ;   (*E-REG*) MOTOR : MOTORS;
9172                ;   (*L-REG*) NUM_READS : BYTE;
9173                ;
9174                ; VAR       (*A-REG*) COUNT_INC : BYTE;
9175                ;   (*B-REG*) NEW_BANK_PAT : ENCODER_PATTERNS;
9176                ;   (*D-REG*) NEW_DIGIT_PAT : ENCODER_PATTERNS;
9177                ;
9178 0001          ERRR1       EQU     01H
9179 0002          ERROR2      EQU     02H
9180 0003          ERROR3      EQU     03H
9181 0004          ERROR4      EQU     04H
9182               RENC:                           ; BEGIN
9183 1999
9184 1999 7D       RENC05:     MOV     A,L         ; WHILE (NUM_READS > 0) AND (ERROR = NO_ERRORS) DO
9185 199A B7           ORA     A
9186 199B C8           RZ
9187 199C 3A 38 74     LDA     ERROR
9188 199F B7           ORA     A
9189 19A0 C0           RNZ
9190                                       ;       BEGIN
9191 19A1 2D           DCR     L           ;       NUM_READS := NUM_READS - 1;
9192 19A2 3A 00 68     LDA     PORT2AD     ;       NEW_BANK_PAT := (PORTA AND 0CH) ROR 2;
9193 19A5 E6 0C        ANI     BNKMSK
9194 19A7 0F           RRC
9195 19A8 0F           RRC
9196 19A9 47           MOV     B,A
9197 19AA 3A 00 68     LDA     PORT2AD     ;       NEW_DIGIT_PAT := PORTA AND 03H;
9198 19AD E6 03        ANI     DGTMSK
9199 19AF 57           MOV     D,A
9200 19B0 7B           MOV     A,E         ;       CASE MOTOR OF
9201 19B1 B7           ORA     A
9202 19B2 CA E6 19     JZ      RENC20
9203 19B5 3A 3A 74     LDA     DGTPAT      ;           BANK:  IF NEW_DIGIT_PAT <> DIGIT_PAT THEN
9204 19B8 BA           CMP     D
9205 19B9 CA C4 19     JZ      RENC10
9206 19BC 3E 01        MVI     A,ERRR1     ;                      ERROR := DIG_ON_BANK
9207 19BE 32 38 74     STA     ERROR
9208 19C1 C3 14 1A     JMP     RENC35
9210               RENC10:                         ;                   ELSE
9211                                       ;                      BEGIN
9212 19C4 C5           PUSH    B           ;                      COUNT_INC := ENCODER_
9213 19C5 3A 39 74     LDA     BNKPAT      ;                          MOVE (NEW_BANK_PAT, BANK_PAT);
9214 19C8 4F           MOV     C,A
9215 19C9 D5           PUSH    D
9216 19CA 58           MOV     E,B
9217 19CB E5           PUSH    H
9218 19CC CD AB 15     CALL    ENCMOV
9219 19CF E1           POP     H
9220 19D0 D1           POP     D
9221 19D1 C1           POP     B
9222 19D2 FE 02        CPI     2.          ;                      IF COUNT_INC = 2 THEN
9223 19D4 C2 DF 19     JNZ     RENC15
```

```
9224 19D7 3E 03          MVI     A,ERROR3        ;                        ERROR := BANK_TOO_FAST
9225 19D9 32 38 74       STA     ERROR
9226 19DC C3 14 1A       JMP     RENC35
9227 19DF 2F        RENC15:      CMA             ;                    ELSE COUNT := COUNT - COUNT_INC
9228 19E0 3C             INR     A
9229 19E1 81             ADD     C
9230 19E2 4F             MOV     C,A
9231 19E3 C3 14 1A       JMP     RENC35
9232                                     ;                        END;
9233 19E6 3A 39 74 RENC20:       LDA     BNKPAT ;         DIGIT: IF NEW_BANK_PAT <> BANK_PAT THEN
9234 19E9 B8             CMP     B
9235 19EA CA F5 19       JZ      RENC25
9236 19ED 3E 02          MVI     A,ERROR2        ;                    ERROR := BANK_ON_DIG
9237                                             ;NOTE .ERROR CODE MASKED FOR DEMO.........
9238 19EF 32 38 74       STA     ERROR
9239 19F2 C3 14 1A       JMP     RENC35
9241                RENC25:                      ;                ELSE
9242                                     ;                    BEGIN
9243 19F5 C5             PUSH    B       ;                    COUNT_INC := ENCODER_
9244 19F6 3A 3A 74       LDA     DGTPAT  ;                        MOVE (NEW_DIGIT_PAT, DIGIT_PAT);
9245 19F9 4F             MOV     C,A
9246 19FA D5             PUSH    D
9247 19FB 5A             MOV     E,D
9248 19FC E5             PUSH    H
9249 19FD CD AB 15       CALL    ENCMOV
9250 1A00 E1             POP     H
9251 1A01 D1             POP     D
9252 1A02 C1             POP     B
9253 1A03 FE 02          CPI     2.      ;                    IF COUNT_INC = 2 THEN
9254 1A05 C2 10 1A       JNZ     RENC30
9255 1A08 3E 04          MVI     A,ERROR4;                        ERROR := DIG_TOO_FAST
9256 1A0A 32 38 74       STA     ERROR
9257 1A0D C3 14 1A       JMP     RENC35
9258 1A10 2F        RENC30:      CMA             ;                    ELSE COUNT := COUNT - COUNT_INC
9259 1A11 3C             INR     A
9260 1A12 81             ADD     C
9261 1A13 4F             MOV     C,A
9262                                     ;                    END;
9263                RENC35:                      ;;     END;
9264 1A14 78             MOV     A,B     ;     BANK_PAT := NEW_BANK_PAT;
9265 1A15 32 39 74       STA     BNKPAT
9266 1A18 7A             MOV     A,D     ;     DIGIT_PAT := NEW_DIGIT_PAT;
9267 1A19 32 3A 74       STA     DGTPAT
9268 1A1C CD 55 15       CALL    DEL300  ;     DELAY (375)
9269 1A1F CD 64 15       CALL    DEL75
9270 1A22 C3 99 19       JMP     RENC05  ;     END
9271                                     ; END;
9273                ;
9274                ; (*************************************************************)
9275                ;
9276                ; PROCEDURE SET_CLOSED;
9277                ;
9278                ;
9279                ; VAR       (*C-REGA) CUR_BANK_VAL : BYTE;
9280                ;   (*E-REGA) INDEX : PRINT_BANKS;
9281                ;
9282 1A25           MVPOST:
9283 1A25 CD 3F 15 SETCLS:       CALL    LEDON
9284 1A28 CD 38 1A       CALL    CHPOST
9285 1A2B CD 4A 15       CALL    LEDOFF
9286 1A2E CD BC 18       CALL    MODLN
9287 1A31 CD B0 18       CALL    ERRHDR
9288 1A34 C4 B5 18       CNZ     EXTERR
9289 1A37 C9             RET
9290                ;
9291                ;
9292                ;Procedure MOVPOST
9293                ;Objective
9294                ;    sets the print wheels to a new postage value upon execution.
```

```
9295          ;    updates the postage value upon a sucessfull completion of a
9296          ;    new setting.
9297          ;Level
9298          ;   Calls GNIB, MOVCLS, ERRHDR
9299          ;Note:      What action is to be taken up on detection of an error is
9300          ;   determined solely by the invoking routine.
9301          ;
9302          ;INDEX1 := 0
9303          ;Do while INDEX1 <> 4
9304          ;   VALUE1 := GNIB(POSVAL,INDEX1:VALUE)
9305          ;   VALUE2 := GNIB(POSREQ,INDEX1:VALUE)
9306          ;   If VALUE1 = VALUE2 then INDEX1 := INDEX1+1; Continue Do
9307          ;   MOTOR := DIGIT
9308          ;   DIRECTION := CCW
9309          ;   RETRIES := 3
9310          ;   MCOUNT := 2
9311          ;   SPEED := 8 ..................... CORRESPONDING TO 160 STEPS/SEC
9312          ;   Procedure MOVCLS( MOTOR,DIRECTION,MCOUNT,RETRIES,SPEED: ERROR)
9313          ;   Procedure ERRHDR( ERRORFLAG )
9314          ;   If ERRORFLAG = 0 then CURBNKVAL := 0
9315          ;                         BNKVAL(HOM) := 0
9316          ;                         INDEX := 0
9317          ;                         Do while INDEX <> 4
9318          ;                                  DELTA :=(GNIB (POSREQ,INDEX:VALUE)-
9319          ;                                           GNIB (POSVAL,INDEX:VALUE))
9320          ;                                  If DELTA <> 0 then
9321          ;                                       If INDEX >= 2 then
9322          ;                                           INDEX2:= INDEX - 1
9323          ;                                       else INDEX2:= INDEX-2
9324          ;                                       INDEX2 := COMPLMNT(INDEX2)
9325          ;                                       BNKVALINDEX := INDEX2 + 1
9326          ;                                       MOTOR := BANK
9327          ;                                       MCOUNT := BNKVALINDEX - CURBNKVAL
9328          ;                                       RETRIES := 3
9329          ;                                       SPEED := 08
9330          ;                                       Procedure MOVCLS(MOTOR,MCOUNT,-
9331          ;                                                  -RETRIES,SPEED:ERROR)
9332          ;                                       Procedure ERRHDR(ERRFLAG)
9333          ;                                       If ERRFLAG = 0 then
9334          ;                                                  MOTOR := DIGIT
9335          ;                                                  RETRIES := 3
9336          ;                                                  MCOUNT := DELTA
9337          ;                                                  SPEED := 08
9338          ;                                                  Procedure MOVCLS
9339          ;                                                          (MOTOR,RETRIES,
9340          ;                                                          MCOUNT,SPEED:ERROR)
9341          ;                                                  ProcedureERRHDR(ERRFLAG))
9342          ;                                                  If ERRFLAG<>0 then End
9343          ;                                                  end if
9344          ;                                       end if
9345          ;                                  else INDEX := INDEX + 1
9346          ;
9347          ;                              End do
9348          ;                              MOTOR := BANK
9349          ;                              RETRIES := 3
9350          ;                              SPEED := 08
9351          ;                              MCOUNT := BNKVALHOM - CURBNKVAL
9352          ;                              Procedure MOVCLS (MOTOR,SPEED,RETRIES,
9353          ;                                                  MCOUNT:ERROR)
9354          ;                              Procedure ERRHDR(ERRFLAG)
9355          ;                              If ERRFLAG = 0 then
9356          ;                                           RETRIES := 3
9357          ;                                           MOTOR := DIGIT
9358          ;                                           MCOUNT := 2
9359          ;                                           SPEED := 08
9360          ;                                           Procedure MOVCLS(
9361          ;                                              MOTOR,MCOUNT,
9362          ;                                              SPEED,RETRIES:ERROR)
9363          ;                                           Procedure ERRHDR(EFLAG)
```

```
9364                ;                                                   If ERRFLAG = 0 then
9365                ;                                                           For Z=1 to 4 by 1
9366                ;                                                               POSTVAL(Z)
9367                ;                                                                 := POSREQ(Z)
9368                ;                                                               Z:= Z + 1
9369                ;                                                           end for
9370                ;                                                   end if
9371                ;                                   end
9372                ;   end
9373                ;End movpost
9374 7421           PREQ        EQU     7421H           ;POSTAGE VALUE LOCATION
9375 7460           TWORK1      EQU     7460H           ;
9376 7466           POSREQ      EQU     7466H           ;WORK1+((16-NBANKS)/2))
9377 7421           POSVAL      EQU     PREQ
9378                ;
9379                ;
9380                ;
9381                ;
9382                            ;
9383 1A39 1E 00     CHPOST:     MVI     E,00.   ; IF POST_REQ = POST_VAL THEN RETURN;
9384 1A3A 21 21 74  SETC05:     LXI     H,POSVAL
9385 1A3D CD DB 1A      CALL    GNIB                    ;
9386 1A40 47            MOV     B,A                     ;
9387 1A41 21 66 74      LXI     H,POSREQ                ;
9388 1A44 CD DB 1A      CALL    GNIB                            ;
9389 1A47 90            SUB     B                       ;
9390 1A48 C2 54 1A      JNZ     SETC10                  ;
9391 1A4B 7B            MOV     A,E                     ;
9392 1A4C 3C            INR     A                       ;
9393 1A4D FE 04         CPI     04                      ;ALL BANKS CHECKED?
9394 1A4F C8            RZ                              ;EXIT
9395 1A50 5F            MOV     E,A                     ;
9396 1A51 C3 3A 1A      JMP     SETC05                  ;
9397                ;
9398                ;
9400 1A54 0E 02     SETC10:     MVI     C,+2    ; MOVE_CLOSED (DIGIT_TRIES, DIGIT,
9401 1A56 1E 00         MVI     E,00H   ;               DIGIT_VALUE (SET) - DIGIT_VALUE (LOCK));
9402 1A58 21 03 08      LXI     H,803H
9403 1A5B CD 03 14      CALL    MOVCLS
9404 1A5E CD B0 18      CALL    ERRHDR          ;ERROR PROCESSING
9405 1A61 C0            RNZ                     ;FATAL ERROR EXIT
9406 1A62 4F            MOV     C,A     ; CUR_BANK_VAL := BANK_VALUE (HOME);
9407 1A63 57            MOV     D,A     ; FOR INDEX := PENNIES TO TEN_DOLLARS DO
9408 1A64 5F        SETC15:     MOV     E,A
9409 1A65 21 21 74      LXI     H,POSVAL;       IF POST_REQ [INDEX] <> POST_VAL [INDEX] THEN
9410 1A68 CD DB 1A      CALL    GNIB
9411 1A6B 47            MOV     B,A
9412 1A6C 21 66 74      LXI     H,POSREQ                        ;
9413 1A6F CD DB 1A      CALL    GNIB                                    ;
9414 1A72 90            SUB     B
9415 1A73 CA A5 1A      JZ      SETC25
9416 1A76 F5            PUSH    PSW     ;           BEGIN
9417 1A77 7B            MOV     A,E     ;           MOVE_CLOSED (BANK_TRIES, BANK,
9418 1A78 FE 02         CPI     02H     ;                       BANK_VALUE (INDEX) - CUR_BANK_VAL;
9419 1A7A D2 7E 1A      JNC     SETC20
9420 1A7D 3D            DCR     A
9421 1A7E 3D        SETC20:     DCR     A
9422                ;   CMA
9423                ;   INR     A
9424 1A7F F5            PUSH    PSW
9425 1A80 91            SUB     C
9426 1A81 4F            MOV     C,A
9427 1A82 D5            PUSH    D
9428 1A83 1E 01         MVI     E,01H
9429 1A85 21 03 08      LXI     H,803H
9430 1A88 CD 03 14      CALL    MOVCLS
9431 1A8B D1            POP     D
9432 1A8C F1            POP     PSW     ;           CUR_BANK_VAL := BANK_VALUE (INDEX);
9433 1A8D 4F            MOV     C,A
```

```
1A8E F1          POP     PSW
1A8F 6F          MOV     L,A
1A90 CD B0 18    CALL    ERRHDR          ;
1A93 C0          RNZ                     ;FATAL ERROR EXIT
1A94 C5          PUSH    B       ;         MOVE_CLOSED (DIGIT_TRIES, DIGIT,
1A95 4D          MOV     C,L     ;                     POST_REQ [INDEX] - POST_VAL [INDEX];
1A96 D5          PUSH    D
1A97 1E 00       MVI     E,00H
1A99 21 03 08    LXI     H,803H
1A9C CD 03 14    CALL    MOVCLS
1A9F D1          POP     D
1AA0 C1          POP     B
1AA1 CD B0 18    CALL    ERRHDR          ;
1AA4 C0          RNZ                     ;FATAL ERROR EXIT
                                 ;         END;
1AA5 7B       SETC25:    MOV     A,E
1AA6 3C          INR     A
1AA7 FE 04       CPI     04H
1AA9 DA 64 1A    JC      SETC15
1AAC 79          MOV     A,C     ; MOVE_CLOSED (BANK_TRIES, BANK, BANK_VALUE (HOME)
1AAD 2F          CMA             ;             - CUR_BANK_VAL;
1AAE 3C          INR     A
1AAF 4F          MOV     C,A
1AB0 1E 01       MVI     E,01
1AB2 21 03 08    LXI     H,803H
1AB5 CD 03 14    CALL    MOVCLS
1AB8 CD B0 18    CALL    ERRHDR                          ;
1ABB C0          RNZ                                     ;FATAL ERROR EXIT
1ABC 0E FE       MVI     C,-2.   ; MOVE_CLOSED (DIGIT_TRIES, DIGIT, DIGIT_VALUE (LOCK)
1ABE 1E 00       MVI     E,00H   ;             - DIGIT_VALUE (SET));
1AC0 21 03 08    LXI     H,803H
1AC3 CD 03 14    CALL    MOVCLS
1AC6 CD B0 18    CALL    ERRHDR                  ;
1AC9 C0          RNZ                     ;FATAL ERROR
1ACA 0E 02       MVI     C,2.    ; FOR INDEX := PENNIES TO TEN_DOLLARS DO
1ACC 11 66 74    LXI     D,POSREQ;     POST_VAL [INDEX] := POST_REQ [INDEX]
1ACF 21 21 74    LXI     H,POSVAL
1AD2 1A       SETC30:    LDAX    D
1AD3 77          MOV     M,A
1AD4 13          INX     D
1AD5 23          INX     H
1AD6 0D          DCR     C
1AD7 C2 D2 1A    JNZ     SETC30
1ADA C9          RET             ; END;
                 ;
                 ;
                 ;
                 ;
                 ;
                 ;GETNIB ROUTINE
                 ;HLREGISTER HAS THE BASE ADDRESS:E REGISTER HAS THE BANK INDEX
                 ;RETURNS THE INDEXED NIBBLE IN ACCUMULATOR
                 ;
                 ;
1ADB D5       GNIB:      PUSH    D               ;SAVE REGISTER DE
1ADC AF          XRA     A               ;SET CY = 0
1ADD 57          MOV     D,A                     ;SETTING FOR DAD OPERATION
1ADE 7B          MOV     A,E                     ;
1ADF 1F          RAR                             ;DIVIDE BY 2
1AE0 5F          MOV     E,A                     ;
1AE1 19          DAD     D                       ;ADDRESS GENERATION
1AE2 D1          POP     D                       ;
1AE3 7B          MOV     A,E                     ;MSB/LSB SELECTION
1AE4 E6 01       ANI     01H                     ;00,01,04ETC  $01,03,05....
1AE6 3E 0F       MVI     A,0FH                   ;MASK FOR LSB
1AE8 C2 F3 1A    JNZ     GNI10                   ;
                 ;
                 ;
1AEB 3E F0       MVI     A,0F0H                  ;MASK FOR MSB SELECTION
```

```
9503 1AED A6          ANA     M                    ;
9504 1AEE 0F          RRC                          ;
9505 1AEF 0F          RRC                          ;
9506 1AF0 0F          RRC                          ;
9507 1AF1 0F          RRC                          ;
9508 1AF2 C9          RET                          ;
9509                ;
9510                ;
9511 1AF3 A6        GNI10:      ANA     M                    ;
9512 1AF4 C9          RET                          ;
9513                ;
9514                ;
9515                ;
9516 1AF5
9517                ;
9518 1AF5               END
85 assembly errors =    0
```

CROSS REFERENCE

| ABEL | VALUE | REFERENCE |
|---|---|---|
| CCFMT | 008F | -375 7167 |
| CCOD1 | 131B | -7105 7120 |
| CCOD2 | 132A | 7110 -7116 |
| CCOD3 | 1330 | 7115 -7121 |
| CCOD4 | 1340 | 7132 -7134 |
| CCOD5 | 135A | 7160 -7166 |
| CCODE | 12EE | 3274 -7042 |
| MTBUF | 00E0 | -254 3107 4568 4756 4773 7274 7327 7401 7415 7435 |
| SCCRC | 0040 | -101 2796 3845 4146 |
| SCFMT | 0080 | -376 2605 |
| SCREG | 0038 | -96 2451 2605 2778 2789 3839 4143 |
| SCSIZ | 0008 | -360 2451 2454 2473 2484 2494 2607 2775 2778 2789 3822 3839 4143 |
| ADCRC | 0000 | -410 2427 4238 6754 |
| ADCYC | 0004 | -414 2881 2927 4292 |
| ADRAM | 000A | -421 1111 |
| ADSW | 0011 | -397 |
| ALIGN | 1812 | 8312 8329 -8651 |
| ARF | 0017 | -399 3240 |
| ASES | 1673 | 8218 -8231 |
| ASEAD | 17DC | 8510 -8547 |
| BCDC | 000F | -7553 7578 |
| BCDO | 000C | -7552 7576 |
| BERSET | 182B | -8668 8679 |
| BINOC1 | 1364 | -7191 7206 |
| BINOC2 | 1366 | -7194 7202 |
| BINOCT | 135D | -7183 |
| BKL50 | 1530 | 7790 -7805 |
| BKLASH | 151B | 7721 -7786 |
| BLKTMR | 0050 | -136 699 |
| BNKMSK | 000C | -7556 9193 |
| BNKPAT | 7439 | -210 7729 7885 8401 9036 9213 9233 9265 |
| BODC | 0003 | -7551 7574 |
| BODO | 0000 | -7550 7572 |
| BUFOVR | 0012 | -398 3685 |
| CDBUF | 0316 | -1433 1781 1839 |
| CDBUF1 | 0320 | 1414 -1443 |
| CDBUFC | 0306 | -1409 1777 1799 1870 |
| CDBUFD | 030F | -1434 |
| CHPOST | 1A38 | 9284 -9303 |
| CHRBKT | 0058 | -156 573 1553 5484 |
| CLKD01 | 0046 | 531 -539 |
| CLKD02 | 0049 | 538 -543 |
| CLKDEC | 0040 | -530 654 |
| CLKDGT | 0043 | -537 634 |
| CLRBLK | 0E85 | 1234 3381 4081 4120 4660 4944 4973 -5252 7045 |

| | | | | | | | | | |
|---|---|---|---|---|---|---|---|---|---|
| CMDBUF | 00F0 | -259 | 3113 | 4539 | 7359 | | | | |
| CMDDSB | 05CD | -2272 | 3358 | | | | | | |
| CMDEN3 | 05F3 | -2317 | 3356 | | | | | | |
| CMPAR1 | 0E93 | -5283 | 5306 | | | | | | |
| CMPAR2 | 0EA9 | 5285 | 5298 | -5307 | | | | | |
| CMPARE | 0E8E | 3799 | 4189 | 4210 | 4678 | -5277 | | | |
| CONFIG | 062C | -2383 | 2583 | | | | | | |
| CONSU1 | 0647 | 2415 | -2425 | | | | | | |
| CONSU2 | 064C | 2424 | -2431 | | | | | | |
| CONSUM | 063A | -2410 | 2565 | 4164 | 7049 | | | | |
| CRC | 0EB1 | 1282 | 2487 | 2792 | 2815 | 3842 | 3850 | 4227 | -5334 |
| | | 7126 | 7236 | 7446 | | | | | |
| CRC1 | 0EB8 | -5341 | 5350 | | | | | | |
| CRCNI1 | 0ECD | -5379 | 5394 | | | | | | |
| CRCNI2 | 0ED6 | 5388 | -5390 | | | | | | |
| CRCNIB | 0EC6 | 5345 | -5367 | 6295 | 6737 | 6985 | | | |
| CSMFMT | 0080 | -377 | 2607 | | | | | | |
| CSTEP0 | 1660 | 8207 | -8213 | | | | | | |
| CTLBKT | 0056 | -151 | 574 | 1503 | 3543 | 5485 | | | |
| CTLCRC | 0010 | -31 | 2422 | 3837 | | | | | |
| CTLREG | 7000 | -324 | 899 | 961 | 1087 | | | | |
| CTLSU1 | 065B | 2462 | -2465 | | | | | | |
| CTLSUM | 064E | 2412 | -2449 | 3833 | | | | | |
| CURBKT | 005A | -161 | 1550 | 1967 | | | | | |
| DALIGN | 17E7 | 8296 | 8322 | 8345 | -8590 | | | | |
| DATA1 | 6800 | -325 | 320 | 4288 | | | | | |
| DBCTR | 005C | -166 | 565 | 1190 | | | | | |
| DBLAN1 | 0EEF | -5433 | 5462 | | | | | | |
| DBLAN2 | 0EEF | -5434 | 5438 | | | | | | |
| DBLANK | 0EDE | 1063 | 1494 | 1962 | 2922 | -5411 | 6147 | | |
| DBLH01 | 069D | -2531 | 3386 | | | | | | |
| DBLH02 | 06A6 | 2518 | -2551 | | | | | | |
| DBLH03 | 06D5 | 2564 | -2576 | | | | | | |
| DBLH04 | 06E2 | 2516 | -2598 | | | | | | |
| DBLH05 | 06E3 | 2521 | 2532 | 2537 | 2554 | 2559 | 2568 | 2578 | -2601 |
| DBLHDR | 0671 | -2512 | 3390 | | | | | | |
| DBOUN1 | 005B | 568 | -575 | | | | | | |
| DBOUNC | 004C | -562 | 733 | | | | | | |
| DBUF | 0080 | -219 | 1412 | 1439 | 1442 | 1653 | 1719 | 1803 | 1803 |
| | | 1879 | 1904 | 1910 | 1933 | 2050 | 2056 | 2168 | 2182 |
| | | 2186 | 2217 | 3642 | 5039 | 5050 | 5075 | 5087 | |
| DBVAL | 0002 | -342 | 580 | | | | | | |
| DECAD1 | 06FE | -2633 | 2654 | | | | | | |
| DECADD | 06FB | 2476 | -2624 | 2781 | 2829 | 7430 | | | |
| DECCOM | 070C | 2636 | -2675 | 2736 | | | | | |
| DECERR | 0720 | 2629 | -2704 | 2729 | | | | | |
| DECSU1 | 0731 | -2733 | 2757 | | | | | | |
| DECSUB | 072B | -2724 | 2804 | | | | | | |
| DEFDCM | 006C | -201 | 1164 | 3906 | | | | | |
| DEL1 | 1567 | -7855 | 7856 | | | | | | |
| DEL300 | 1555 | -7843 | 8500 | 9268 | | | | | |
| DEL30M | 17A9 | 7801 | 7804 | 7876 | 8201 | 8204 | 8310 | 8340 | -8498 |
| | | 8532 | 8726 | | | | | | |
| DEL6M | 17A3 | -8492 | 8721 | | | | | | |
| DEL75 | 1564 | 7845 | 7846 | 7847 | 7848 | -7853 | 7867 | 9269 | |
| DELM1 | 17AC | 8474 | -8500 | 8502 | | | | | |
| DFLUSH | 0EF6 | 737 | 5417 | -5454 | | | | | |
| DGTMSK | 0003 | -7555 | 7616 | 7870 | 7872 | 7879 | 7884 | 8700 | 9094 |
| | | 9198 | | | | | | | |
| DGTPAT | 743A | -211 | 7734 | 7880 | 8371 | 8423 | 9074 | 9203 | 9344 |
| | | 9267 | | | | | | | |
| DIAFMT | 005F | -378 | 2604 | | | | | | |
| DIEDCM | 006A | -196 | 1161 | 3910 | 4790 | 4867 | 4936 | 7326 | |
| DIMAGE | 0000 | -265 | 776 | 1462 | 1633 | 1649 | 1689 | 1847 | 1849 |
| | | 1850 | 2179 | 2243 | | | | | |
| DISAB1 | 05D5 | 2276 | -2282 | | | | | | |
| DISAB2 | 05EF | 2292 | -2300 | | | | | | |
| DISABL | 05D3 | -2278 | 4182 | | | | | | |
| DISP01 | 0072 | 607 | -609 | | | | | | |

| | | | | | | | | | |
|---|---|---|---|---|---|---|---|---|---|
| DISP02 | 0072 | 605 | -610 | | | | | | |
| DISP03 | 007D | -620 | 658 | | | | | | |
| DISP04 | 007F | -623 | 642 | | | | | | |
| DISPLY | 0062 | -596 | 738 | | | | | | |
| DOACCT | 0744 | 1018 | -2773 | 2964 | | | | | |
| DOSTAT | 0778 | -2850 | 3509 | | | | | | |
| DOTR01 | 07D9 | -2873 | 2983 | | | | | | |
| DOTR02 | 07ED | 2978 | -2994 | | | | | | |
| DOTR03 | 07F7 | -3009 | 3018 | | | | | | |
| DOTR04 | 080D | 3013 | -3030 | | | | | | |
| DOTR05 | 080F | 3024 | -3036 | | | | | | |
| DOTR06 | 0811 | -3040 | 3210 | | | | | | |
| DOTRIP | 0765 | -2921 | 3220 | 3584 | | | | | |
| DPH1 | 1991 | 9100 | -9103 | | | | | | |
| DPH5 | 1995 | 9102 | -9108 | | | | | | |
| DPHOME | 1983 | 8593 | 8603 | 8655 | 8678 | -9099 | | | |
| DPTS05 | 17D4 | 8515 | -8537 | | | | | | |
| DPTS10 | 17D7 | -8532 | 8540 | | | | | | |
| DPTSP | 17B5 | -8510 | 8611 | 8616 | 8661 | 8668 | | | |
| DSBMDP | 0F02 | 3370 | -5476 | | | | | | |
| DSCCRC | 0036 | -91 | 1286 | 2819 | 3854 | 4156 | 7240 | 7450 | |
| DSCPMT | 0070 | -379 | 2606 | | | | | | |
| DSCRDB | 001D | -86 | 1274 | 2466 | 2471 | 2606 | 2801 | 2812 | 3847 |
| | | 4153 | 4206 | 7071 | 7231 | 7416 | 7434 | | |
| DSCSIZ | 0007 | -321 | 1274 | 2471 | 2473 | 2798 | 2801 | 2812 | 3822 |
| | | 3847 | 4089 | 4123 | 4153 | 4209 | 4556 | 7230 | 7416 |
| | | 7417 | 7417 | 7435 | 7436 | | | | |
| DSPCHR | 0008 | -349 | 1884 | 1891 | 2239 | | | | |
| DSPTMR | 0052 | -141 | 704 | 1515 | 1544 | 1853 | 2254 | | |
| DSPVAL | 0007 | -343 | 1543 | 1852 | 2253 | | | | |
| EJEC | 0030 | -473 | | | | | | | |
| ENABL1 | 05F0 | 2321 | -2327 | | | | | | |
| ENABL2 | 0627 | 2355 | -2362 | | | | | | |
| ENABL3 | 0627 | 2342 | -2363 | | | | | | |
| ENABL4 | 0627 | 2337 | -2364 | | | | | | |
| ENABLE | 05F9 | -2323 | 4196 | | | | | | |
| ENAKPD | 0F14 | 3368 | -5500 | | | | | | |
| ENDMOV | 15AB | -7913 | 9218 | 9249 | | | | | |
| ENCT | 15B8 | 7921 | -7925 | | | | | | |
| ENDENT | 0819 | -3062 | 3378 | | | | | | |
| ENDM05 | 15CC | -7971 | 8024 | | | | | | |
| ENDM20 | 15E0 | 7974 | -7987 | | | | | | |
| ENDM25 | 15EB | 7984 | -7995 | | | | | | |
| ENDM30 | 15F9 | 7999 | -8006 | | | | | | |
| ENDM35 | 15FB | 8003 | -8010 | | | | | | |
| ENDM40 | 160F | -8027 | | | | | | | |
| ENDMOV | 15C8 | -7969 | 8898 | 8912 | 8969 | | | | |
| ENTAMT | 082E | -3106 | 3464 | | | | | | |
| ENTCM1 | 0839 | 3110 | -3116 | | | | | | |
| ENTCMB | 0835 | -3112 | 3468 | | | | | | |
| ENTSER | 0846 | -3146 | 3360 | | | | | | |
| EREXIT | 165A | 8195 | -8208 | | | | | | |
| ERRCNT | 0016 | -51 | 3254 | 3831 | | | | | |
| ERRCOD | 0014 | -46 | 3246 | 3829 | | | | | |
| ERRH05 | 18B0 | -8808 | | | | | | | |
| ERRHDR | 18B0 | 8073 | 8417 | 8446 | 8464 | 8479 | 8487 | 8762 | 8785 |
| | | -8807 | 9287 | 9404 | 9436 | 9446 | 9460 | 9466 | |
| ERROR | 7438 | -209 | 7567 | 7591 | 7679 | 7723 | 7741 | 7748 | 7895 |
| | | 7970 | 8043 | 8209 | 8377 | 8396 | 8429 | 8808 | 8823 |
| | | 8900 | 8980 | 9058 | 9080 | 9187 | 9207 | 9225 | 9238 |
| | | 9256 | | | | | | | |
| ERROR2 | 0002 | -9179 | 9236 | | | | | | |
| ERROR3 | 0003 | -9180 | 9224 | | | | | | |
| ERROR4 | 0004 | -9181 | 9255 | | | | | | |
| ERROR5 | 0005 | -7562 | 7740 | | | | | | |
| ERROR6 | 0006 | -7563 | 7747 | | | | | | |
| ERRR1 | 0001 | -9178 | 9206 | | | | | | |
| ERRCT | 0013 | -41 | 3604 | | | | | | |
| ERSET | 180C | 8604 | -8616 | | | | | | |

| | | | | | | | | | |
|---|---|---|---|---|---|---|---|---|---|
| EXTERR | 1895 | 8073 | 8763 | 8786 | -8822 | 9288 | | | |
| EXTSER | 0852 | -3166 | 3362 | | | | | | |
| EXTTRP | 0860 | -3190 | 3364 | | | | | | |
| FATE01 | 089E | 3245 | -3260 | | | | | | |
| FATERR | 0880 | 1041 | 1220 | 1242 | 2706 | 2953 | 2988 | 3002 | -3241 |
| | | 3330 | 3603 | 3688 | 4707 | 6205 | | | |
| FATINT | 087E | 502 | 506 | -3237 | | | | | |
| FATRST | 0008 | -413 | 1270 | 7252 | | | | | |
| FILDI1 | 0327 | -1464 | 1469 | | | | | | |
| FILDIM | 0722 | 1145 | -1459 | 1672 | 1842 | 2159 | | | |
| FILN01 | 0F26 | 5258 | -5527 | | | | | | |
| FILN02 | 0F27 | -5531 | 5541 | | | | | | |
| FILN03 | 0F32 | 5533 | -5542 | | | | | | |
| FILNIB | 0F24 | 1140 | 1212 | 1229 | 1278 | 1326 | 3825 | 4234 | -5524 |
| | | 7232 | | | | | | | |
| FINTR1 | 08AA | -3287 | 3291 | | | | | | |
| FINTR2 | 08BC | -3295 | 3306 | | | | | | |
| FINTR3 | 08DF | 3301 | -3309 | | | | | | |
| FINTR4 | 08E0 | 3022 | -3327 | | | | | | |
| FINTRP | 08A0 | 1026 | 2991 | -3276 | | | | | |
| FIXSED | 0000 | -21 | 351 | 1136 | 1136 | | | | |
| GETN01 | 0F3D | -5574 | | | | | | | |
| GETN02 | 0F45 | 5578 | -5584 | | | | | | |
| GETNIB | 0F35 | 1654 | 1806 | 1905 | 2169 | 2174 | 2223 | 2679 | 2689 |
| | | 3122 | 3661 | 3890 | 3899 | 4085 | 4651 | 4667 | 4757 |
| | | 4762 | 4806 | 4858 | 4717 | 4757 | 5288 | 5294 | 5342 |
| | | -5543 | 5816 | 6127 | 6931 | 7087 | 7106 | | |
| GNI10 | 1AF3 | 9499 | -9511 | | | | | | |
| GNIB | 1ADB | 9385 | 9388 | 9410 | 9413 | -9488 | | | |
| HACODE | 0090 | -486 | 7167 | | | | | | |
| HAREG | 0082 | -477 | 2605 | | | | | | |
| HCLRSV | 0047 | -436 | 3361 | | | | | | |
| HCONFG | 00AB | -487 | 2389 | | | | | | |
| HCSUM | 0084 | -479 | 2607 | | | | | | |
| HDIAGS | 003D | -484 | 2604 | | | | | | |
| HDISAB | 0042 | -433 | 1427 | 3357 | 3410 | | | | |
| HDISKB | 0063 | -439 | 3369 | | | | | | |
| HDLOCK | 008A | -481 | 2602 | | | | | | |
| HDREG | 0083 | -478 | 2606 | | | | | | |
| HDR001 | 091C | 3371 | -3393 | | | | | | |
| HDR002 | 091F | 3352 | -3398 | | | | | | |
| HDR003 | 092D | 3402 | -3407 | | | | | | |
| HDR004 | 093F | 3414 | -3420 | | | | | | |
| HDR005 | 093F | 3411 | -3421 | | | | | | |
| HDRONY | 08D5 | -3349 | 3375 | 5063 | | | | | |
| HDRP01 | 0954 | 3447 | -3452 | | | | | | |
| HDRP02 | 0954 | 3445 | -3453 | | | | | | |
| HDRP03 | 0977 | 3471 | -3485 | | | | | | |
| HDRP04 | 097C | 3410 | -3489 | | | | | | |
| HDRPLS | 0941 | -3439 | 3472 | 5051 | | | | | |
| HDSEEK | 163B | 8069 | -8191 | | | | | | |
| HEMABL | 0041 | -433 | 3075 | 3255 | | | | | |
| HEMARB | 0043 | -438 | 3367 | | | | | | |
| HENDEN | 0043 | -434 | 1496 | 3377 | | | | | |
| HENIAM | 0035 | -444 | 2018 | 3414 | 3463 | | | | |
| HENDEC | 0036 | -445 | 2017 | 3446 | 3467 | | | | |
| HEMTRP | 0040 | -437 | 3363 | | | | | | |
| HHCLIM | 008D | -485 | 2542 | | | | | | |
| HLOPCD | 0038 | -432 | 2521 | | | | | | |
| HMTRAC | 0031 | -403 | 2103 | | | | | | |
| HPCNT | 0035 | -480 | 2605 | | | | | | |
| HPHAM1 | 0044 | -8041 | 8199 | | | | | | |
| HPHASE | 0031 | -8047 | 8212 | | | | | | |
| HPSET | 0001 | -476 | 2077 | 2199 | 4511 | | | | |
| HREG40 | 0040 | -453 | 1723 | 3373 | | | | | |
| HREGAD | 0052 | -456 | 2032 | 2553 | 3546 | | | | |
| HREGCP | 005B | -460 | 2592 | | | | | | |
| HREGCS | 0054 | -458 | 2593 | | | | | | |
| HREGDL | 0052 | -457 | 2520 | | | | | | |

| | | | | | | | | | |
|---|---|---|---|---|---|---|---|---|---|
| HREGDR | 0052 | -457 | 2022 | 3550 | 3555 | | | | |
| HREGPS | 0055 | -470 | 2574 | | | | | | |
| HREGLP | 0052 | -466 | 2535 | | | | | | |
| HREGMT | 0051 | 426 | 2551 | | | | | | |
| HREGRC | 0055 | -469 | 2124 | 2570 | 3564 | | | | |
| HRDBPO | 0051 | -455 | 1532 | 3331 | 3525 | 3639 | | | |
| HRDBSL | 0052 | -471 | 2541 | | | | | | |
| HRDBTM | 0055 | -421 | 3395 | | | | | | |
| HRESET | 0050 | -454 | 3325 | | | | | | |
| HSETIM | 0004 | -443 | 2016 | 3526 | 5044 | | | | |
| HSETMN | 0000 | -441 | 3473 | | | | | | |
| HSTIPS | 0001 | -442 | 2014 | 3477 | | | | | |
| HSETSV | 0046 | -420 | 1757 | 3359 | | | | | |
| HSTAT | 0080 | -475 | 3991 | | | | | | |
| IDLE | 097E | 1191 | -3503 | 3506 | | | | | |
| IDLE01 | 09A4 | 3523 | -3529 | | | | | | |
| IDLE02 | 09B1 | 3538 | -3572 | | | | | | |
| IDLE03 | 09D1 | 3534 | -3573 | | | | | | |
| IDLE04 | 09E6 | 3580 | -3587 | | | | | | |
| INITSM | 156D | 1134 | -7865 | | | | | | |
| INT75 | 009D | 514 | -673 | | | | | | |
| KDCTRL | 004E | -131 | 598 | 723 | 1487 | 1510 | 1588 | 1621 | 1834 |
| | | 1838 | 2163 | 2210 | 3194 | 3581 | 4018 | 5479 | 5481 |
| | | 5506 | 5508 | | | | | | |
| KDIO | 00A7 | -697 | 1564 | | | | | | |
| KDIO01 | 00B7 | 706 | -708 | | | | | | |
| KDIO02 | 00B7 | 702 | -709 | | | | | | |
| KDIO03 | 00D0 | 721 | -721 | | | | | | |
| KDSKIP | 0002 | -344 | 1565 | | | | | | |
| KEYB01 | 034A | 1489 | 1493 | -1501 | | | | | |
| KEYB02 | 0370 | 1524 | -1530 | | | | | | |
| KEYB03 | 0375 | 1529 | -1536 | | | | | | |
| KEYB04 | 0375 | 1517 | -1537 | | | | | | |
| KEYB05 | 0375 | 1512 | -1538 | | | | | | |
| KEYB06 | 0378 | 1508 | -1540 | | | | | | |
| KEYB07 | 0380 | 1547 | -1555 | | | | | | |
| KEYB08 | 0380 | 1539 | -1556 | | | | | | |
| KEYB09 | 0380 | 1500 | -1557 | | | | | | |
| KEYBKT | 0054 | -146 | 563 | 736 | 851 | 5504 | | | |
| KEYBRD | 032D | -1486 | 3588 | | | | | | |
| KEYINT | 4C96 | -345 | 1566 | | | | | | |
| KILCOD | 02DE | -326 | 1126 | 1169 | 6179 | 6186 | 6912 | | |
| LEDOFF | 151A | -7827 | 7886 | 8070 | 8760 | 8783 | 9285 | | |
| LEDON | 153F | -7915 | 7866 | 8068 | 8755 | 8778 | 9283 | | |
| LOKFMT | 0040 | -380 | 2602 | | | | | | |
| LOWWRN | 001C | -61 | 2526 | 4084 | 4556 | | | | |
| LSNMAS | 000F | -7961 | 7981 | 7987 | | | | | |
| LSNMSK | 000F | -7557 | 7571 | 7639 | 7643 | 7796 | 8215 | 8238 | |
| LSTAT1 | 0F63 | 5622 | -5625 | | | | | | |
| LSTATE | 0F4E | 1030 | 1153 | 1180 | 1315 | 1521 | 1627 | 1679 | 2339 |
| | | 2513 | 2873 | 3072 | 3531 | 3728 | 4529 | 4627 | -5610 |
| | | 6134 | 6422 | 6777 | 7242 | 7316 | 7391 | | |
| MANRST | 09E9 | 3083 | -3600 | | | | | | |
| MAXINT | 7FA1 | -346 | | | | | | | |
| MEMORY | M 0000 | 0 | | | | | | | |
| MESAG1 | 0A17 | 3640 | -3655 | | | | | | |
| MESAG2 | 0A17 | 3638 | -3656 | | | | | | |
| MESAG3 | 0A1A | 3632 | -3658 | | | | | | |
| MESAG4 | 0A2E | 3669 | -3676 | | | | | | |
| MESAG5 | 0A31 | 3675 | -3681 | | | | | | |
| MESAG6 | 0A31 | 3657 | -3682 | | | | | | |
| MESAGE | 09EE | 3576 | -3620 | | | | | | |
| MODD01 | 03AD | 1593 | -1599 | | | | | | |
| MODD02 | 03D8 | 1637 | -1639 | | | | | | |
| MODD03 | 03E3 | 1645 | -1647 | | | | | | |
| MODD04 | 03F5 | 1630 | -1664 | | | | | | |
| MODD05 | 03FC | 1668 | -1671 | | | | | | |
| MODD06 | 03FF | 1663 | -1675 | | | | | | |
| MODD07 | 03FF | 1598 | -1676 | | | | | | |

| | | |
|---|---|---|
| MODD08 | 0408 | 1682 -1684 |
| MODD09 | 040E | -1690 1702 |
| MODD10 | 0419 | 1693 -1699 |
| MODDSP | 03A0 | 1562 -1586 |
| MODLN | 18BC | 8071 8761 8784 -8837 9286 |
| MOP01 | 1868 | 8714 -8723 |
| MOP02 | 185C | -8718 8725 |
| MOP05 | 1851 | -8711 8722 |
| MOP10 | 186D | 8717 -8726 |
| MOPEN | 184F | -8710 8734 8736 |
| MOVB01 | 0F8A | 5654 5672 -5705 |
| MOVB02 | 0F9A | 5716 -5719 |
| MOVB03 | 0FAB | 5726 -5732 |
| MOVBIT | 0F68 | -5647 5965 7196 |
| MOVC05 | 1426 | -7585 7717 |
| MOVC1 | 143D | -7599 |
| MOVC10 | 145E | -7629 |
| MOVC15 | 145F | 7625 -7630 7681 |
| MOVC20 | 1473 | 7634 -7643 |
| MOVC25 | 147E | 7642 -7651 |
| MOVC30 | 148C | 7655 -7660 |
| MOVC35 | 148E | 7659 -7664 |
| MOVC4 | 1407 | -7570 |
| MOVC40 | 14A8 | 7678 -7682 |
| MOVC42 | 14CF | 7706 -7711 |
| MOVC45 | 14BC | 7694 -7697 |
| MOVC50 | 14D5 | 7587 7590 7593 -7722 |
| MOVC55 | 14DC | 7731 -7734 |
| MOVC6 | 144D | 7610 -7616 |
| MOVC60 | 14F9 | 7580 7733 -7740 |
| MOVC65 | 14FF | 7736 7738 -7744 |
| MOVC7 | 1423 | 7573 7575 7577 7579 -7583 |
| MOVC70 | 1438 | -7721 |
| MOVC8 | 1456 | 7598 7618 -7620 |
| MOVCLS | 1403 | -7565 8376 8395 8416 8428 8445 8463 8478 |
| | | 8486 8759 8782 9403 9430 9443 9459 9465 |
| MRGTS1 | 0048 | -116 1009 1020 1204 1307 1330 1602 2039 |
| | | 2343 2588 2966 3147 3167 3200 3535 3998 |
| | | 4102 4169 4236 4491 4640 5617 6502 6794 |
| MRGTS2 | 004A | -121 354 2862 3242 5614 |
| MSERN1 | 0A6D | 3766 -3794 |
| MSERN0 | 0A38 | 3474 -3713 4571 |
| MSG2M1 | 0A04 | 3904 -3907 |
| MSG2M2 | 0AF2 | 3966 -3971 |
| MSG2M3 | 0AF2 | 3939 -3973 |
| MSG2M4 | 0AF2 | 3921 -3973 |
| MSG2M5 | 0AF2 | 3912 -3974 |
| MSG2MU | 0AAA | -3878 4577 4636 |
| MSNFMT | 007F | -381 2603 |
| MSNMA0 | 00F0 | -7940 7977 7991 |
| MSNMSK | 00F0 | -7558 7625 7647 7793 |
| MTRCHR | 0046 | -111 1136 1159 2394 |
| MTRSTS | 0AF4 | 3520 -3990 4261 |
| MULKEY | 0080 | -347 855 5503 |
| MVDD01 | 00F0 | -779 803 |
| MVDD02 | 00FA | 783 -791 |
| MVDDAT | 00DD | 626 646 -760 |
| MVLR01 | 0F54 | -5761 |
| MVLWIB | 0F8C | 1913 3129 3147 3770 3783 4093 4127 4591 |
| | | 4716 4779 4853 5001 5079 -5759 7063 7075 |
| | | 7437 |
| MVLO05 | 1899 | -8779 |
| MVLOCK | 1896 | 2997 -8778 |
| MVPOST | 1A25 | 1215 1237 4700 -9282 |
| MVRN01 | 0FC3 | 5773 -5801 5929 |
| MVRN02 | 0FC8 | -5812 5846 |
| MVRN03 | 0FDB | 5827 -5832 |
| MVRN04 | 0FDB | 5823 -5833 |
| MVRN05 | 0FE2 | 5836 -5841 |
| MVRN06 | 0FE7 | 5814 -5847 |

| | | | | | | | | | |
|---|---|---|---|---|---|---|---|---|---|
| MVRNIB | 0FC2 | 1938 | 2455 | 3930 | -5799 | | | | |
| MVTROS | 187F | -8756 | | | | | | | |
| MVTRIP | 1870 | 2948 | -8755 | | | | | | |
| NARG | 0000 | 0 | | | | | | | |
| NBANKS | 0004 | -362 | 383 | 1208 | 1208 | 1225 | 1322 | 2775 | 2778 |
| | | 2798 | 2801 | 4123 | 4126 | 4188 | 4562 | 4537 | 4588 |
| | | 4635 | 4674 | 4674 | 4677 | 4712 | 4715 | | |
| NDISP | 0002 | -348 | 349 | 773 | 1461 | 1462 | 1649 | 1687 | 1688 |
| | | 2179 | 2243 | | | | | | |
| NINCYC | 0018 | -400 | 2987 | | | | | | |
| NORFLG | 0040 | -126 | 1490 | 1558 | 1761 | 2009 | 2385 | 2331 | 3043 |
| | | 3117 | 3399 | 3442 | 3516 | 4320 | 4487 | 4691 | 5093 |
| | | 5127 | 6486 | | | | | | |
| NORSIZ | 0022 | -354 | 6689 | | | | | | |
| NORSTR | 0028 | -352 | 352 | 354 | 6690 | | | | |
| NPAUS1 | 0B1B | -4045 | 4047 | | | | | | |
| NPAUS2 | 0B19 | 1367 | 3980 | 3015 | 3288 | 3303 | -4042 | 6041 | 6345 |
| | | 6992 | | | | | | | |
| NUMED1 | 0014 | -7962 | 8015 | | | | | | |
| NVM30F | 1031 | 1391 | -6029 | 6201 | 6335 | 6671 | 7030 | | |
| NVM30S | 103D | -6040 | 6044 | | | | | | |
| NVM30T | 1047 | 1361 | -6063 | 6187 | 6330 | 6652 | 6821 | 6850 | 6963 |
| NVMBAD | 0001 | -411 | 1378 | 6378 | 6452 | 6917 | | | |
| NVMBYT | 1058 | -6088 | 6305 | 6461 | 6748 | | | | |
| NVMCH1 | 1077 | 6137 | -6140 | | | | | | |
| NVMCHS | 1068 | 2707 | 3511 | -6124 | | | | | |
| NVMCTL | 0066 | -186 | 2335 | 6126 | 6402 | 6493 | 6574 | 6691 | 6717 |
| | | 6960 | 7016 | | | | | | |
| NVMDE1 | 1099 | 1266 | -6191 | 6922 | | | | | |
| NVMDE2 | 10A0 | 6182 | -6200 | | | | | | |
| NVMDED | 1095 | 1117 | 1381 | 3428 | 3885 | 3931 | 4039 | 4093 | -6176 |
| | | 6312 | 6379 | 6409 | 6455 | 6755 | 6928 | 7253 | |
| NVMDXB | 10A9 | -6222 | 6667 | 6824 | 6952 | | | | |
| NVMER | 10B1 | -6240 | 6648 | 6785 | 6807 | | | | |
| NVMER1 | 10D1 | -6288 | 6302 | | | | | | |
| NVMER2 | 10DF | 6290 | -6303 | | | | | | |
| NVMER3 | 10EB | 6309 | -6315 | | | | | | |
| NVMER4 | 10EB | 6282 | -6316 | | | | | | |
| NVMER5 | 10FE | 6326 | -6329 | | | | | | |
| NVMER6 | 1101 | -6371 | 6375 | | | | | | |
| NVMER7 | 110B | -6344 | 6348 | | | | | | |
| NVMER8 | 111A | 6355 | -6358 | | | | | | |
| NVMERS | 4000 | -329 | 1363 | 6319 | | | | | |
| NVMFN1 | 114E | 6425 | -6434 | | | | | | |
| NVMFN2 | 114E | -6435 | 6465 | | | | | | |
| NVMFND | 112F | -6401 | 6496 | 6510 | 6568 | | | | |
| NVMLOD | 116B | 1151 | -6485 | | | | | | |
| NVMMAP | 1191 | 6226 | 6269 | 6442 | -6537 | 6718 | 6965 | | |
| NVMNB1 | 11B9 | 6579 | 6588 | -6599 | | | | | |
| NVMNBK | 119F | 6250 | -6565 | 6656 | 6815 | 6841 | | | |
| NVMNXT | 11BB | 6097 | 6299 | 6360 | 6369 | -6617 | 6742 | 6994 | 7008 |
| NVMOPN | 11C4 | 1300 | 6156 | -6639 | | | | | |
| NVMPRP | 11DF | 6263 | -6688 | 6713 | 6952 | | | | |
| NVMRD | 11EE | 6500 | 6514 | -6711 | | | | | |
| NVMRD1 | 11FD | -6726 | 6745 | | | | | | |
| NVMRD2 | 120F | 6728 | -6746 | | | | | | |
| NVMRED | 4400 | -328 | 1126 | 1168 | 1336 | 1372 | 1375 | 6179 | 6274 |
| | | 6447 | 6722 | 6884 | 6912 | | | | |
| NVMRET | 0002 | -412 | 6311 | | | | | | |
| NVMST1 | 1221 | 6780 | -6783 | | | | | | |
| NVMST2 | 1232 | 6796 | -6799 | | | | | | |
| NVMSTD | 1219 | 1356 | 3858 | -6776 | | | | | |
| NVMWN | 1261 | 1388 | 6183 | 6231 | -6875 | 6970 | 6989 | 7005 | 7012 |
| NVMWN1 | 1274 | -6891 | 6895 | | | | | | |
| NVMWN2 | 1287 | 6904 | -6908 | | | | | | |
| NVMWN3 | 129A | 6910 | -6931 | | | | | | |
| NVMWN4 | 129A | 6907 | -6932 | | | | | | |
| NVMWR | 129E | 1065 | 1351 | 3810 | 6150 | 6831 | -6950 | | |
| NVMWR1 | 1229 | -6975 | 6997 | | | | | | |

| | | | | | | | | | |
|---|---|---|---|---|---|---|---|---|---|
| NVMWR2 | 1CCD | 6977 | -6998 | | | | | | |
| NVMWR3 | 1CE6 | 6962 | -7021 | | | | | | |
| NVMWRT | 4000 | -327 | 6880 | | | | | | |
| OLDSWT | 0068 | -191 | | | | | | | |
| PAUTHK | 041F | -1717 | 2002 | | | | | | |
| PCEFMT | 007F | -382 | 2608 | | | | | | |
| PCEREG | 0028 | -81 | 352 | 2608 | 2826 | 3822 | | | |
| PCESIZ | 0007 | -363 | 2823 | 2826 | 3822 | | | | |
| PCLRK | 0447 | -1776 | 1993 | | | | | | |
| PDCMK | 0450 | -1796 | 1996 | | | | | | |
| PDCMK1 | 0461 | 1810 | -1816 | | | | | | |
| PERDSP | 0464 | -1831 | 3259 | 4269 | | | | | |
| PFLAG0 | 0000 | -7554 | 7583 | | | | | | |
| PH0011 | 18DF | 8871 | -8895 | 9103 | | | | | |
| PH0110 | 18FD | 8863 | -8947 | 9108 | | | | | |
| PH05 | 18F9 | 8902 | -8915 | | | | | | |
| PHASE1 | 0011 | -7559 | 7619 | | | | | | |
| PHASE2 | 0044 | -7560 | 7617 | | | | | | |
| PLH05 | 1982 | 9091 | -9094 | | | | | | |
| PLH10 | 18DB | 8868 | -8871 | | | | | | |
| PLH12 | 18D4 | 8860 | -8867 | | | | | | |
| PLH14 | 18D9 | 8862 | -8870 | | | | | | |
| PLH52 | 1903 | -8955 | | | | | | | |
| PLH57 | 190D | 8952 | -8963 | | | | | | |
| PLH65 | 1912 | 8960 | -8966 | | | | | | |
| PLH66 | 1915 | -8968 | 8977 | | | | | | |
| PLH67 | 1916 | -8969 | | | | | | | |
| PLH68 | 1919 | -8970 | | | | | | | |
| PLH70 | 191E | -8975 | | | | | | | |
| PLH83 | 1923 | -8979 | | | | | | | |
| PLHOME | 18C5 | -8859 | | | | | | | |
| PNUMK | 048A | -1863 | 1988 | | | | | | |
| PNUMK1 | 04A5 | 1895 | -1899 | | | | | | |
| POHOME | 18C5 | 8388 | 8408 | 8439 | -8858 | | | | |
| PORT2A | 6800 | -330 | 7570 | 7609 | 7868 | 7877 | 8214 | 8699 | 9090 |
| | | 9192 | 9197 | | | | | | |
| PORTA | 7001 | -331 | 612 | 840 | 1062 | 1092 | 1186 | 2959 | 3042 |
| | | 3278 | 4452 | 5455 | 6033 | 6035 | 6066 | 6068 | 7816 |
| | | 7818 | 7828 | 7830 | | | | | |
| PORTB | 7002 | -332 | 712 | 908 | 963 | 1060 | 7638 | 7646 | 7651 |
| | | 7791 | 7800 | 7803 | 7875 | 7980 | 7990 | 7995 | 8200 |
| | | 8203 | 8309 | 8337 | 8339 | 8511 | 8720 | 8838 | 8840 |
| | | 9026 | | | | | | | |
| PORTBI | 006E | -206 | 209 | 210 | 211 | 711 | 907 | 964 | |
| PORTC | 7003 | -333 | 847 | 4459 | | | | | |
| POSFMT | 0040 | -383 | 4511 | | | | | | |
| POSREG | 0042 | -106 | 1225 | 1322 | 2778 | 2801 | 4123 | 4185 | 4511 |
| | | 4712 | | | | | | | |
| POSREQ | 7466 | -9376 | 9387 | 9412 | 9469 | | | | |
| POSUP1 | 0B85 | 4111 | 4138 | -4205 | | | | | |
| POSUP2 | 0B92 | 4147 | 4157 | -4226 | | | | | |
| POSUPD | 0B22 | 3510 | -4074 | | | | | | |
| POSVAL | 7421 | -9377 | 9384 | 9409 | 9470 | | | | |
| PREG | 7421 | -9374 | 9377 | | | | | | |
| PROERR | 0BA1 | 494 | 496 | 498 | 500 | 504 | 508 | 512 | 1736 |
| | | 1745 | 2547 | 2587 | 3068 | 3192 | 3482 | 3678 | 3715 |
| | | -4260 | 4494 | 4533 | 4542 | 4551 | 4582 | 4625 | 4753 |
| | | 5008 | 7054 | 7287 | 7311 | 7321 | 7371 | 7396 | 7405 |
| | | 7429 | | | | | | | |
| PROKE1 | 04DF | -1974 | 1978 | | | | | | |
| PROKE2 | 04E3 | 1976 | -1979 | | | | | | |
| PROKE3 | 0502 | 1982 | -2012 | | | | | | |
| PROKEY | 04CE | 1554 | -1961 | | | | | | |
| PSETK | 0516 | 1999 | -2048 | | | | | | |
| PSETK1 | 052F | 2052 | -2075 | | | | | | |
| PSETK2 | 0536 | 2054 | -2087 | | | | | | |
| PTNC10 | 1968 | 9027 | -9072 | | | | | | |
| PTNC15 | 1970 | -9037 | 9075 | | | | | | |
| PTNC20 | 1971 | 9032 | 9043 | -9078 | | | | | |

| | | | | | | | | | |
|---|---|---|---|---|---|---|---|---|---|
| PTNC25 | 1972 | 9053 | 9060 | -9079 | | | | | |
| PTNC30 | 195A | 9045 | -9063 | | | | | | |
| PTNC40 | 1955 | 9051 | -9057 | 9065 | 9067 | | | | |
| PTNCHK | 192A | 8362 | 8365 | 8600 | 8658 | 8915 | 8971 | -9024 | |
| PTR | 0010 | -16 | 21 | -23 | 23 | 26 | -28 | 28 | 31 |
| | | -33 | 33 | 36 | -38 | 38 | 41 | -43 | 43 |
| | | 46 | -48 | 48 | 51 | -53 | 53 | 56 | -58 |
| | | 58 | 61 | -63 | 63 | 66 | -68 | 68 | 71 |
| | | -73 | 73 | 76 | -78 | 78 | 81 | -83 | 83 |
| | | 86 | -88 | 88 | 91 | -93 | 93 | 96 | -98 |
| | | 98 | 101 | -103 | 103 | 106 | -108 | 108 | 111 |
| | | -113 | 113 | 116 | -118 | 118 | 121 | -123 | 123 |
| | | 136 | -138 | 138 | 131 | -133 | 133 | 136 | -138 |
| | | 138 | 141 | -143 | 143 | 146 | -148 | 148 | 151 |
| | | -153 | 153 | 156 | -158 | 158 | 161 | -163 | 163 |
| | | 166 | -168 | 168 | 171 | -173 | 173 | 176 | -178 |
| | | 178 | 181 | -183 | 183 | 186 | -188 | -188 | 191 |
| | | -193 | 193 | 196 | -198 | 198 | 201 | -203 | 203 |
| | | 206 | -208 | 208 | 214 | -216 | 216 | 216 | 219 |
| | | -221 | 221 | 224 | -226 | 226 | 229 | -231 | 231 |
| | | 234 | -236 | 236 | 239 | -241 | 241 | 241 | 244 |
| | | -246 | 246 | 249 | -251 | 251 | 254 | -256 | 256 |
| | | 259 | -261 | 261 | -262 | 265 | -267 | 267 | |
| PUTN01 | 1007 | 5886 | -5896 | | | | | | |
| PUTNIB | 0FEE | 1813 | 1928 | 2650 | 2753 | 4670 | 4815 | 4821 | 4987 |
| | | 4992 | 5535 | 5819 | -5868 | 6733 | 7096 | 7112 | 7328 |
| PWRAB1 | 01A7 | 1014 | -1025 | | | | | | |

What is claimed is:

1. In a postage meter having means for printing postage, means for displaying numerical values, means for entering data, computer means electrically connected to each of the aforesaid means and programmed for processing data for controlling the operation thereof, wherein said computer means includes means for storing a first amount corresponding to all postage then available for printing, an improvement for changing the said first amount to a new first amount, said improvement comprising:

(a) said data entering means including a keyboard, said keyboard including a plurality of depressable numeric keys and at least two depressable special purpose keys;

(b) said computer means programmed for causing said displaying means to display a first numerical value in response to the depression of selected numeric keys, said first numerical value corresponding to a second amount desired to be added to said first amount;

(c) said computer means programmed for causing said display means to display a second numerical value in reponse to the depression of selected numeric keys, said second numerical value corresponding to a predetermined combination;

(d) said computer means programmed for entering said second amount in response to the depression of one of said special purpose keys and for entering said combination in response to the depression of another of said special purpose keys; and (e) said computer means programmed for automatically processing said second amount and said combination in response to entry of the later one of said second amount and said combination for adding said second amount to said first amount, whereby said first amount is changed to said new first amount.

2. The improvement according to claim 1, wherein said keyboard includes a first depressable display key, and said computer means programmed for causing said displaying means to display a third numerical value in response to depression of said third key, said third numerical value corresponding to said first amount.

3. The improvement according to claim 1, wherein said computer means is programmed for disabling said printing means in response to the depression of any one of said numeric keys after said second amount has been entered.

4. The improvement according to claim 1, wherein said keyboard includes a plurality of display keys, said computer means including means for storing a plurality of variable amounts, each of said variable amounts associated with a different one of said display keys, and said computer means programmed for causing said displaying means to display a given numerical value in response to the depression of each of said display keys, and said given numerical value corresponding to the variable amount associated with the depressed display key.

5. The improvement according to claim 4, wherein said computer means is programmed for disabling said printing means in response to the depression of any one of said numeric keys after said first numerical value has been entered.

6. The improvement according to claim 4, wherein said computer means is programmed for clearing the entry of the initially entered one of said second amount and combination in response to utilizaion of any of said keys for any purpose other than displaying numerical values and entering the unentered one of said second amount and combination.

7. The improvement according to claim 4, wherein one of said variable amounts in said first amount, and one of said display keys is a postage unused key, whereby the depression of said postage unused key results in the display of a third numerical value corresponding to all postage then available for printing.

8. The improvement according to claim 4, wherein one of said variable amounts corresponds to all postage that has been printed, and one of said display keys is a postage used key, whereby depression of said postage used key results in the display of a third numerical value corresponding to all postage that has been printed.

9. The improvement according to claim 4, wherein one of said variable amounts corresponds to the total count of all printing operations of the postage meter, and one of said display keys is a piece count key, whereby depression of said piece count key results in the display of a third numerical value corresponding to the total count of all printing operations of the postage meter.

10. The improvement according to claim 1, wherein said data entering means includes means for receiving data from an external device, and said computer means programmed for processing received data prior to responding to subsequent key depressions.

11. The improvement according to claim 10, wherein said computer means is programmed for processing received data for simulating the depression of the respective keys of said keyboard, whereby an external device may effectuate entry of said amount and combination.

12. The improvement according to claim 10, wherein said computer means is programmed for receiving and processing a disable keyboard command from an external device, for disabling said keyboard.

13. The improvement according to claim 10, wherein said computer means is programmed for overriding said automatic processing of said second amount and combination in response to receiving a disable keyboard command from an external device prior to entry of the later one of said second amount and combination, and said computer means programmed for thereafter entering said second amount and combination in response to an end of entry command received from an external device.

14. The improvement according to claim 1, wherein said postal meter has a serial number, said data entering means including a third special purpose key, said computer means programmed for generating a code in response to depression of said third key, said computer means programmed for causing said displaying means to display a third numerical value corresponding to said code, and said serial number and said first and third numerical values collectively comprising means for obtaining said second numerical value.

15. In a postage meter having means for printing postage, means for displaying numerical values, means for entering data, computer means electrically connected to said printing means and to said respective displaying means and data entering means, wherein said computer means is programmed for processing data for controlling the operation of the respective printing and displaying and data entering means, and wherein said data entering means includes a keyboard having a plurality of depressable keys, and wherein said computer means includes means for storing a first amount corresponding to all postage then available for printing; a method of changing the first amount to a new first amount, said method comprising the steps of:

(a) sequentially depressing a selected plurality of said keys of the keyboard for entering a second amount into said computer means;

(b) sequentially depressing a different selected plurality of said keys of the keyboard for entering a combination into said computer means; and (c) automatically processing said second amount and said combination for adding said second amount to said first amount.

16. The method according to claim 15 including the step of disabling said printing means.

17. The method according to claim 15, wherein said step for entering said second amount includes the step of displaying a numerical value corresponding to said second amount.

18. The method according to claim 15, wherein said step for entering said combination includes the step of displaying a numerical value corresponding to said combination.

19. The method according to claim 15 including the step of programming said computer means for clearing the initially entered one of said second amount and combination in response to utilization of said keyboard for any purpose other than displaying a numerical value and entering the unentered one of said second amount and combination.

20. The method according to claim 15 including the steps of:

(d) receiving data simulating the sequential depression of said keys from an external device for entering either one of said amount or combination, and (e) processing said received data.

21. The method according to claim 15 including the steps of:

(d) receiving data commanding disablement of said keyboard from an external device;

(e) receiving data simulating the depression of said keys from an external device for entering said amount and combination;

(f) receiving data commanding the entry of said amount and combination from an external device; and (g) sequentially processing the data of steps (d), (e) and (f) in the order setforth, whereby said processing step (a), (b) and (c) are not used.

* * * * *